US006537714B2

(12) United States Patent
Kaya et al.

(10) Patent No.: US 6,537,714 B2
(45) Date of Patent: Mar. 25, 2003

(54) IMAGE-FORMING METHOD AND IMAGE-FORMING APPARATUS

(75) Inventors: Takaaki Kaya, Shizuoka (JP); Takaaki Kotaki, Shizuoka (JP); Makoto Kanbayashi, Shizuoka (JP); Yushi Mikuriya, Shizuoka (JP); Katsumi Kondo, Ibaraki (JP); Wakashi Iida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,025

(22) Filed: Jul. 6, 2001

(65) Prior Publication Data

US 2002/0045114 A1 Apr. 18, 2002

(30) Foreign Application Priority Data

| | | |
|---|---|---|
| Jul. 7, 2000 | (JP) | 2000/206095 |
| Jun. 14, 2001 | (JP) | 2001/179605 |
| Jun. 14, 2001 | (JP) | 2001/179607 |
| Jun. 14, 2001 | (JP) | 2001/179608 |

(51) Int. Cl.[7] ..... G03G 13/01; G03G 15/01

(52) U.S. Cl. ..... 430/45; 430/46; 399/223; 399/299

(58) Field of Search ..... 430/45, 46; 399/223, 399/299

(56) References Cited

U.S. PATENT DOCUMENTS

| | | | | |
|---|---|---|---|---|
| 4,607,936 A | 8/1986 | Miyakawa et al. | ..... | 355/3 DR |
| 4,659,639 A | 4/1987 | Mizuno et al. | ..... | 430/65 |
| 4,788,120 A | 11/1988 | Shirai et al. | ..... | 430/66 |
| 5,529,865 A | 6/1996 | Kanbayashi et al. | ..... | 430/45 |
| 5,561,024 A | 10/1996 | Fukuda et al. | ..... | 430/128 |

FOREIGN PATENT DOCUMENTS

| | | |
|---|---|---|
| JP | 54-86341 | 7/1979 |
| JP | 56-83746 | 7/1981 |
| JP | 57-158650 | 9/1982 |
| JP | 60-67951 | 4/1985 |
| JP | 60-95551 | 5/1985 |
| JP | 60-168156 | 8/1985 |
| JP | 60-178457 | 9/1985 |
| JP | 60-225854 | 11/1985 |
| JP | 61-231561 | 10/1986 |
| JP | 62-168161 | 7/1987 |

*Primary Examiner*—Mark A. Chapman
(74) *Attorney, Agent, or Firm*—Fitzpatrick, Cella, Harper & Scinto

(57) ABSTRACT

In a two-component development system containing a toner and a carrier, an a-Si photosensitive member having a diameter of from 20 mm to 80 mm is used, the photosensitive member is electrostatically charged to have a surface potential of from 300 to 450 V (absolute value), and yellow, magenta, cyan and black toners are used each of which have a weight-average particle diameter of from 4.0 $\mu$m to 10.0 $\mu$m, and, under a condition that the carrier of the two-component developer has a 50% average particle diameter of from 10 $\mu$m to 80 $\mu$m and as image density (D0.5) measured usually after the toner is fixed once when the quantity of unfixed toner on a transfer medium, M/S, is 0.5 mg/cm$^2$, have a coloring power of from 1.0 to 1.9, and in which the difference between a maximum value and a minimum value of D0.5 of yellow, magenta, cyan and black colors is form 0 to 0.5. This makes it possible to obtain high-quality images in a high image density and a superior color reproduction.

106 Claims, 7 Drawing Sheets

IMAGE-FORMING METHOD AND IMAGE-FORMING APPARATUS

BACKGROUND OF THE INVENTION

1. Field of the Invention

This invention relates to an image-forming method and an image-forming apparatus which are applicable to laser beam color printers and color copying apparatus, and more particularly to a high-speed full-color image-forming method and image-forming apparatus therefor.

2. Related Background Art

As photosensitive members used conventionally in image-forming apparatus of this type are roughly grouped into organic members and inorganic members, as exemplified by OPC photosensitive members and a-Si photosensitive members. These techniques are described below.

Organic Photoconductor (OPC) Photosensitive Member

In recent years, as photoconductive materials for electrophotographic photosensitive members development on various organic photoconductive materials has advanced, and especially function-separated photosensitive members having a charge generation layer and a charge transport layer which are superposed have already been put into practical use and are set in copying machines and laser beam printers.

In these photosensitive members, however, it has been considered to be a problem that they commonly have a low durability. The durability is roughly grouped into durability on electrophotographic physical properties (i.e., running performance) concerning sensitivity, residual potential, charging performance and faint images (blurred image), and mechanical durability concerning wear and scratches of photosensitive member surfaces which are caused by rubbing.

Of these, with regard to the durability on electrophotographic physical properties (running performance), in particular, faint images, are known to be caused by deterioration of charge-transporting materials contained in photosensitive member surface layers which are due to active substances such as ozone and NOx generated from corona charging assemblies.

With regard to the mechanical durability, it is known to be caused by paper, cleaning members (such as a blade or a roller) and toners which come into contact with, and rub against, photosensitive layers.

In order to improve the the durability on electrophotographic physical properties (running performance), it is important to use charge-transporting materials that may be deteriorated with difficulty by the active substances such as ozone and NOx. It is known to select charge-transporting materials having a high oxidation potential.

In order to improve the mechanical durability, it is important to make the surface have a high lubricity and a low friction in order to withstand the rubbing with paper and cleaning members, and also to make the surface have good releasability in order to prevent toners from causing filming melt adhesion. It is known to incorporate surface layers with lubricating materials such as fluorine resin powder, fluorinated graphite and polyolefin resin powder.

If, however, the surface may extremely less wear, any moisture-absorptive substances produced by the active substances such as ozone and NOx may accumulate on the photosensitive member surface. As the result, the surface resistance lowers to make surface electric charges move in lateral directions to cause faint images (smeared images) in some cases.

Inorganic Photoconductor: Amorphous Silicon (a-Si) Photosensitive Member

In electrophotography, photoconductive materials that form photosensitive layers in photosensitive members are required to be highly sensitive, have a high SN ratio [light current (Ip)/dark current (Id)], have absorption spectra suited to spectral characteristics of irradiation light or electromagnetic waves, have a high response to light, have the desired dark resistance value and are harmless to human bodies when used. In particular, in the case of photosensitive members for image-forming apparatus, set in image-forming apparatus used in offices as business machines, the harmlessness in their use is an important point.

Photoconductive materials having good properties in these respects include amorphous silicon hydrides (hereinafter "a-Si:H"). For example, Japanese Patent Publication No. 60-35059 discloses its application in photosensitive members for image-forming apparatus.

Now, the layer construction of photosensitive members is described with reference to FIGS. 3A to 3D, which diagrammatically illustrate the layer construction of photosensitive members used in image-forming apparatus. The following description is a general description of photosensitive members. Hence, it is a description on the background art and at the same time it is applicable also to photoconductive members usable in the image-forming apparatus of the present invention. Also, the layer construction of photosensitive members shown in FIGS. 3A to 3D shows a first example to a fourth example of the layer construction of photosensitive members used in the present invention and in conventional-image-forming apparatus.

A photosensitive member 1100 for image-forming apparatus as shown in FIG. 3A has a photosensitive member support 1101 and a photosensitive layer 1102 provided thereon. The photosensitive layer 1102 is formed of a-Si:H,X and is constituted of a photoconductive layer 1103 having photoconductivity.

A photosensitive member 1100 for image-forming apparatus as shown in FIG. 3B has a photosensitive member support 1101 and a photosensitive layer 1102 provided thereon. The photosensitive layer 1102 is formed of a-Si:H,X and is constituted of a photoconductive layer 1103 having photoconductivity and an amorphous silicon surface layer 1104.

A photosensitive member 1100 for image-forming apparatus as shown in FIG. 3C has a photosensitive member support 1101 and a photosensitive layer 1102 provided thereon. The photosensitive layer 1102 is formed of a-Si:H,X and is constituted of a photoconductive layer 1103 having photoconductivity, an amorphous silicon surface layer 1104 and a charge injection block layer 1105 of an amorphous silicon type.

A photosensitive member 1100 for image-forming apparatus as shown in FIG. 3D has a photosensitive member support 1101 and a photosensitive layer 1102 provided thereon. The photosensitive layer 1102 is constituted of a photoconductive layer 1103 consisting of a charge transport layer 1106 and a charge generation layer 1107 which are formed of a-Si:H,X, and an amorphous silicon surface layer 1104.

In FIGS. 3A to 3D, reference numerals 1106 each denote a free surface.

The image-forming apparatus photosensitive members making use of a-Si:H are commonly produced by heating conductive supports to 50° C. to 400° C. and forming photosensitive layers comprised of a-Si, on the supports by a film-forming process such as vacuum deposition, sputtering, ion plating, thermal CVD (chemical vapor deposition), photo-assisted CVD, plasma-assisted CVD (hereinafter "PCVD"). In particular, PCVD (i.e., a process in which material gases are decomposed by direct-current, high-frequency or microwave glow discharge to form a-Si deposited films on supports) is put into practical use as a preferable process.

Japanese Patent Application Laid-Open No. 56-83746 discloses an image-forming apparatus photosensitive member comprising a conductive support and an a-Si photoconductive layer containing halogen atoms as a constituent (hereinafter "a-Si:X"). This publication reports that the incorporation of 1 to 40 atom % of halogen atoms into a-Si enables achievement of a high heat resistance and also electrical and optical properties preferable for a photoconductive layer of an image-forming apparatus photosensitive member.

Japanese Patent Application Laid-open No. 57-115556 also discloses a technique in which, in order to achieve improvements in electrical, optical and photoconductive properties such as dark resistivity, photoconductivity and response to light, service environmental properties such as moisture resistance, and stability with lapse of time, of a photoconductive member having a photoconductive layer constituted of an a-Si deposited film, a surface layer constituted of a non-photoconductive amorphous material containing silicon atoms and carbon atoms is provided on a photoconductive layer constituted of an amorphous material composed chiefly of silicon atoms.

Japanese Patent Application Laid-Open No. 60-67951 also discloses a technique concerning a photosensitive member provided with a light-transmitting insulating overcoat layer containing amorphous silicon, carbon, oxygen and fluorine. Japanese Patent Application Laid-open No. 62-168161 discloses a technique in which an amorphous material containing silicon atoms, carbon atoms and from 41 to 70 atom % of hydrogen atoms as constituents is used for a surface layer.

Japanese Patent Application Laid-Open No. 57-158650 still further discloses that an image-forming apparatus photosensitive member having a high sensitivity and a high resistance can be obtained by using in a photoconductive layer a-Si:H containing from 10 to 40 atom % of hydrogen and an absorption coefficient ratio of from 0.2 to 1.7 in respect of absorption peaks at 2,100 $cm^{-1}$ and 2,000 $cm^{-1}$ of an infrared absorption spectrum.

Japanese Patent Application Laid-Open No 60-95551 discloses a technique in which, aiming at an improvement in quality of images on an amorphous silicon photosensitive member, image-forming steps of charging, exposure, development and transfer are carried out maintaining the temperature at from 30 to 40° C. in the vicinity of the photosensitive member surface, so as to prevent surface resistance from decreasing with absorption of moisture at the photosensitive member surface and prevent smeared images (high-humidity smearing) from occurring concurrently therewith.

These techniques have achieved improvements in electrical, optical and photoconductive properties and service environmental properties of image-forming apparatus photosensitive members and also have concurrently brought about an improvement in image quality.

Support

As supports used in image-forming apparatus photosensitive members, they may be conductive or may be electrically insulative. Conductive supports may include supports made of metals such as Al and Fe and alloys of these (e.g., stainless steel). Also usable are supports obtained by subjecting the surfaces of electrically Insulative supports such as films or sheets of synthetic resins and glass or ceramic sheets to photoconductive treatment at least on the side where the photosensitive layer is formed.

In FIGS. 3A to 3D for example, the supports 1101 used may have the shape of cylinders or sheetlike endless belts with a smooth surface or uneven surface.

Especially when images are recorded using coherent light such as laser light, in order to more effectively cancel any faulty images due to interference fringes appearing in visible images, the surface of the support 1101 may be made uneven to such an extent that charging carriers do not substantially decrease. Such unevenness provided on the surface of the support 1101 can be formed by any known methods disclosed in Japanese Patent Application Laid-Open No. 60-168156, No. 60-178457, No. 60-225854 and so forth.

As another method for more effectively canceling the faulty images due to interference fringes occurring when the coherent light such as laser light is used, the surface of the support 1101 may be made uneven by making a plurality of sphere-traced concavities on the surface of the support 1101 to such an extent that charging carriers do not substantially decrease. The surface of the support 1101 is made more finely uneven than the resolving power required for the image-forming apparatus photosensitive member 1100 and moreover such unevenness is formed by a plurality of sphere-traced concavities.

The unevenness formed by such a plurality of sphere-traced concavities provided on the surface of the support 1101 can be produced by a known method disclosed in Japanese Patent Application Laid-Open No. 61-231561.

As still another method for more effectively canceling the faulty images due to interference fringes occurring when the coherent light such as laser light is used, an interference preventive layer or region such as a light absorption layer may be provided in the photosensitive layer 1102 or beneath the photosensitive layer 1102.

Photoconductive Layer

In the image-forming apparatus photosensitive member, in order to effectively achieve its object, the photoconductive layer 1103 formed on the support 1101, or optionally on a subbing layer (not shown), and constituting part of the photosensitive layer 1102 is formed by a vacuum-deposition deposited-film formation process under conditions appropriately numerically set in accordance with film-forming parameters so that the desired characteristics can be obtained.

Stated specifically, it may be formed by, e.g., a thin-film deposition process such as glow discharging (including AC discharge CVD such as low-frequency CVD, high-frequency CVD or microwave CVD, or DC discharge CVD), sputtering, vacuum metallizing (vacuum deposition), ion plating, photo-assisted CVD or thermal CVD.

Any of these thin-film deposition processes may appropriately be selected according to factors such as the conditions for manufacture, the extent of a load on capital investment in equipment, the scale of manufacture and the properties and performances desired on image-forming apparatus photosensitive members produced. Glow discharging is preferred in view of its relative easiness to control conditions in the manufacture of image-forming apparatus photosensitive members having the desired performances.

When the photoconductive layer 1103 is formed by glow discharging, basically an Si-feeding material gas capable of feeding silicon atoms (Si), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-Si:H,X is formed on a prescribed support previously set at a prescribed position.

In the image-forming apparatus photosensitive member, the photoconductive layer 1103 is required to contain hydrogen atoms and/or halogen atoms. This is important in order to compensate unbonded arms of silicon atoms in the layer and to improve layer quality, in particular, to improve photoconductivity and charge retentivity. Accordingly, the content of hydrogen atoms or halogen atoms or the total content of hydrogen atoms and halogen atoms may preferably be in a content of from 10 to 30 atom %, and more preferably form 15 to 25 atom % based on the total of silicon atoms and hydrogen atoms and/or halogen atoms.

The material that can serve as the Si-feeding gas used in the image-forming apparatus photosensitive member may include gaseous or gasifiable silicon hydrides (silanes) as those effectively usable. In view of readiness in handling for layer formation and Si-feeding efficiency, the material may preferably include $SiH_4$ and $Si_2H_6$.

To structurally incorporate the hydrogen atoms into the photoconductive layer 1103 to be formed, and in order to make it more easy to control the percentage of the hydrogen atoms to be incorporated, and further to obtain preferable film properties, the films may preferably be formed using the above gases with which $H_2$ and/or He or a gas of a silicon compound containing hydrogen atoms is further mixed in a desired quantity.

These gases may be used not only alone, but also in the form of a mixture of some kinds in a prescribed mixing proportion.

A material effective as a material gas for feeding halogen atoms used in the image-forming apparatus photosensitive member may preferably include gaseous or gasifiable halogen compounds as exemplified by halogen gases, halides, halogen-containing interhalogen compounds and silane derivatives substituted with a halogen.

The material may also include gaseous or gasifiable. halogen-containing silicon hydride compounds constituted of silicon atoms and halogen atoms, as those effectively usable.

In order to control the quantity of the hydrogen atoms and/or halogen atoms incorporated in the photoconductive layer 1103, for example, the temperature of the support 1101, the quantity of materials used to incorporate the hydrogen atoms and/or halogen atoms, the discharge power and so forth may be controlled.

In the image-forming apparatus photosensitive member, the photoconductive layer 1103 may preferably be incorporated with atoms capable of controlling its conductivity as occasion calls. The atoms capable of controlling the conductivity may be contained in the state they are evenly distributed in the photoconductive layer 1103, or partly non-uniformly distributed in the layer thickness direction.

The atoms capable of controlling the conductivity may include what are called impurities, used in the field of semiconductors. As well known, usable are atoms belonging to Group IIIb of the periodic table (Group IIIb atoms) capable of imparting p-type conductivity, or atoms belonging to Group Vb of the periodic table (Group Vb atoms) capable of imparting n-type conductivity.

These starting materials for incorporating the atoms capable of controlling the conductivity may be optionally diluted with $H_2$ and/or He when used.

It is also effective to incorporate carbon atoms and/or oxygen atoms and/or nitrogen atoms in the photoconductive layer 1103. The carbon atoms and/or oxygen atoms and/or nitrogen atoms may evenly be distributed in the photoconductive layer, or may partly non-uniformly be distributed so as to change in its content in the layer thickness direction of the photoconductive layer.

In the image-forming apparatus photosensitive member, the thickness of the photoconductive layer 1103 may appropriately be determined as desired from the viewpoints of the desired electrophotographic performances to be obtained and economical advantages. The layer may preferably be formed in a thickness of from 20 to 50 $\mu$m. more preferably from 23 to 45 $\mu$m, and most preferably from 25 to 40 $\mu$m.

In order to form the desired photoconductive layer 1103 that can achieve what is aimed in the image-forming apparatus photosensitive member and has the desired film properties, the mixing proportion of Si-feeding gas and dilute gas, the gas pressure inside the reactor, the discharge power and the support temperature may be appropriately set.

The above conditions can not independently separately be determined. Optimum values may preferably be determined on the basis of mutual and systematic relationship so that the photosensitive member having the desired properties can be formed.

Surface Layer

In the image-forming apparatus photosensitive member, the surface layer 1104 may preferably be further formed on the photoconductive layer 1103 formed on the support 1101 in the manner as described above. This surface layer 1104 has a free surface 1106, and is provided so that what is aimed in the image-forming apparatus photosensitive member can be achieved chiefly with regard to moisture resistance, performance on continuous repeated use, electrical breakdown strength, service environmental properties and running performance.

The surface layer 1104 may preferably be formed using an amorphous silicon (a-Si) type material, or any of materials such as an amorphous silicon containing a hydrogen atom (H) and/or a halogen atom (X) and further containing a carbon atom (hereinafter "a-SiC:H,X"), an amorphous silicon containing a hydrogen atom (H) and/or a halogen atom (X) and further containing an oxygen atom (hereinafter "a-SiO:H,X"), an amorphous silicon containing a hydrogen atom (H) and/or a halogen atom (X) and further containing a nitrogen atom (hereinafter "a-SiN:H,X"), and an amorphous silicon containing a hydrogen atom (H) and/or a halogen atom (X) and further containing at least one of a carbon atom, an oxygen atom and a nitrogen atom (hereinafter "a-SiCON:H,X").

In the image-forming apparatus photosensitive member, in order to effectively achieve the object thereof, the surface layer 1104 is formed by a vacuum-deposition deposited film forming process under conditions appropriately numerically set in accordance with film forming parameters so as to achieve the desired performances. Stated specifically, it may be formed by any thin-film deposition process such as glow discharging (including AC discharge CVD such as low-frequency CVD, high-frequency CVD or microwave CVD, and DC discharge CVD), sputtering, vacuum metallizing, ion plating. photo-assisted CVD and thermal CVD.

These thin-film deposition processes are employed under appropriate selection according to the conditions for manufacture, the extent of a load on capital investment in equipment, the scale of manufacture and the properties and performances desired on image-forming apparatus photosensitive members produced. In view of productivity of photosensitive members, it is preferable to use the same deposition process as that for the photoconductive layer.

When, for example, the surface layer 1104 comprised of a-SiC;H,X is formed by glow discharging, basically an Si-feeding material gas capable of feeding silicon atoms (Si), a C-feeding material gas capable of feeding carbon atoms (C), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-SiC:H,X is formed on the support 1101 previously set at a given position and on which the photoconductive layer 1103 has been formed.

When the surface layer is formed of a-SiC as a main constituent, its carbon content may preferably be in the range of from 30% to 90% based on the total of silicon atoms and carbon atoms.

In the image-forming apparatus photosensitive member, the surface layer 1104 is required to contain hydrogen atoms and/or halogen atoms. This is important in order to compensate unbonded arms of the silicon atoms and to improve layer quality, in particular, to improve photoconductivity and charge retentivity. The hydrogen atoms may usually be in a content of from 30 to 70 atom %, preferably from 35 to 65 atom %, and more preferably from 40 to 60 atom %, based on the total amount of constituent atoms. The fluorine atoms may usually be in a content of from 0.01 to 15 atom %, preferably from 0.1 to 10 atom %, and most preferably from 0.6 to 4 atom %.

Any defects or imperfections (comprised chiefly of dangling bonds of silicon atoms or carbon atoms) present inside the surface layer are known to have ill influences on the properties required for image-forming apparatus photosensitive members. For example, charging performance may deteriorate because of the injection of charges from the free surface into the photoconductive layer; charging performance may vary because of changes in surface structure in a service environment, e.g., in an environment of high humidity; and the injection of charges into the surface layer from the photoconductive layer at the time of corona charging or irradiation by light may cause a phenomenon of afterimages during repeated use because of entrapment of charges in the defects inside the surface layer.

The controlling of the hydrogen content in the surface layer so as to be 30 atom % or more brings about a great decrease in the defects inside the surface layer, so that improvements can be achieved in respect of electrical properties and high-speed continuous-service performance. On the other hand, if the hydrogen content in the surface layer is more than 70 atom %, the hardness of the surface layer tends to lower, resulting in a lowering of running performance.

The controlling of fluorine atom content in the surface layer so as to be within the range of 0.01 atom % or more also enables more effective achievement of the generation of the bonds between silicon atoms and carbon atoms in the surface layer.

As a function of the fluorine atoms in the surface layer, it is also possible to effectively prevent the bonds between silicon atoms and carbon atoms from breaking because of damage caused by coronas or the like. On the other hand, if the fluorine atom content in the surface layer is more than 15 atom %, it becomes almost ineffective to generate the bonds between silicon atoms and carbon atoms in the surface layer and to prevent the bonds between silicon atoms and carbon atoms from breaking.

Moreover, residual potential and image memory may become remarkably seen because the excessive fluorine atoms inhibit the mobility of carriers in the surface layer.

The fluorine content and hydrogen content in the surface layer may be controlled according to the flow rate of $H_2$ gas, the support temperature, the discharge power and the gas pressure.

The surface layer 1104 in the image-forming apparatus photosensitive member may usually be formed in a thickness of from 0.01 to 3 $\mu$m, preferably from 0.05 to 2 $\mu$m, and more preferably from 0.1 to 1 $\mu$m. If the layer thickness is smaller than 0.01 $\mu$m, the surface layer may become lost because of friction or the like during the use of the photosensitive member. If it is larger than 3 $\mu$m, a lowering of electrophotographic performance such as an increase in residual potential may occur.

The surface layer 1104 in the image-forming apparatus photosensitive member is carefully formed so that the required performances can be obtained as desired. From the structural viewpoint, the material constitute of any element of Si, C and/or N and/or O and R and/or X takes the form of from crystalline to amorphous depending on the conditions for its formation. From the viewpoint of electric properties, it exhibits the property of from conductive to semiconductive and up to insulating, and also the property of from photoconductive to nonphotoconductive. Accordingly, in the image-forming apparatus photosensitive member, the conditions for its formation are severally selected as desired so that a compound having the desired properties as intended can be formed.

For example, in order to provide the surface layer 1104 mainly for the purpose of improving its breakdown strength, the compound is prepared as a non-single-crystal material having a remarkable electrical insulating behavior in the service environment. When the surface layer is provided mainly for the purpose of improving the performance on continuous repeated use and service environmental properties, the compound is formed as a non-single-crystal material having become milder in its degree of the above electrical insulating properties to a certain extent and having a certain sensitivity to the light with which the layer is irradiated.

When the surface layer 1104 is formed, it is also preferable to control its resistance value appropriately on the one hand in order to prevent smeared images from being caused by a low resistance of the surface layer or prevent the layer from being affected by residual potential, and on the other hand in order to improve charging efficiency.

In the image-forming apparatus photosensitive member, a blocking layer (a lower surface layer) having a smaller content of carbon atoms, oxygen atoms and nitrogen atoms than the surface layer may further be provided between the photoconductive layer and the surface layer. This is effective for improving performances such as charging performance.

Between the surface layer 1104 and the photoconductive layer 1103, there may also be provided with a region in which the content of carbon atoms and/or oxygen atoms and/or nitrogen atoms changes in the manner that it decreases toward the photoconductive layer 1103. This makes it possible to improve the adherence between the surface layer and the photoconductive layer and to lessen an influence of interference due to reflected light at the interface between the layers.

Charge Injection Block Layer

In the image-forming apparatus photosensitive member, it is more effective to provide between the conductive support and the photoconductive layer a charge injection block layer having the function to block the injection of charges from the conductive support side.

The charge injection block layer has polarity dependence that it has the function to prevent charges from being injected from the support side to the photoconductive layer side when the photosensitive layer is subjected to charging in a certain polarity on its free surface, and exhibits no such function when subjected to charging in a reverse polarity. In order to impart such function, atoms capable of controlling its conductivity are incorporated in a relatively large content compared with those in the photoconductive layer.

The atoms capable of controlling the conductivity, contained in that layer, may evenly uniformly be distributed in the layer, or may evenly be contained in the layer thickness but contained partly in such a state that they are distributed non-uniformly. In the case when they are distributed in non-uniform concentration, they may preferably be contained so as to be distributed in a larger quantity on the support side.

In any case, however, in the in-plane direction parallel to the surface of the support, it is preferable for such atoms to be evenly contained in a uniform distribution so that the properties in the in-plane direction can also be made uniform.

The atoms capable of controlling the conductivity, incorporated in the charge injection block layer, may include what is called impurities used in the field of semiconductors, and it is possible to use the periodic table Group III atoms capable of imparting p-type conductivity, or the periodic table Group V atoms capable of imparting n-type conductivity.

The atoms capable of controlling the conductivity, incorporated in the charge injection block layer in the image-forming apparatus photosensitive member, may be in an amount determined appropriately as desired so that its object can effectively be achieved.

The charge injection block layer may further be incorporated with at least one kind of carbon atoms, nitrogen atoms and oxygen atoms. This enables achievement of more improvement of the adherence between the charge injection block layer and other layers provided in direct contact with the charge injection block layer.

The carbon atoms, nitrogen atoms or oxygen atoms contained in that layer may evenly uniformly be distributed in the layer, or may evenly be contained in the layer thickness direction but contained partly in such a state that they are distributed non-uniformly.

In any case, however, in the in-plane direction parallel to the surface of the support, it is necessary for such atoms to be evenly contained in a uniform distribution so that the properties in the in-plane direction can also be made uniform.

The carbon atoms and/or nitrogen atoms and/or oxygen atoms incorporated in the whole layer region of the charge injection block layer in the image-forming apparatus photosensitive member may be in an amount determined appropriately as desired so that its object can effectively be achieved.

Hydrogen atoms and/or halogen atoms may also be contained in the charge injection block layer in the image-forming apparatus photosensitive member, which are effective for compensating unbonded arms of constituent atoms to improve film quality, In the image-forming apparatus photosensitive member, the charge injection block layer may preferably be formed in a thickness of from 0.1 to 5 $\mu$m, more preferably from 0.3 to 4 $\mu$m, and most preferably from 0.5 to 3 $\mu$m, in view of the achievement of the desired electrophotographic performance and also in view of economical effects.

To form the charge injection block layer in the image-forming apparatus photosensitive member, the same vacuum deposition process as in the formation of the photoconductive layer described previously may be employed.

In addition to the foregoing, in the image-forming apparatus photosensitive member, the photosensitive layer 1102 may preferably have, on its side of the support 1101, a layer region in which at least aluminum atoms, silicon atoms and hydrogen atoms and/or halogen atoms are contained in such a state that they are distributed non-uniformly in the layer thickness direction.

In the image-forming apparatus photosensitive member, for the purpose of more improving the adherence between the support 1101 and the photoconductive layer 1103 or charge injection block layer 1105, an adherent layer may be provided which is formed of, e.g., $Si_3N_4$, $SO_2$, SiO, or an amorphous material mainly composed of silicon atoms and containing hydrogen atoms and/or halogen atoms and carbon atoms and/or oxygen atoms and/or nitrogen atoms. A light absorption layer may also be provided for preventing occurrence of interference fringes due to the light reflecting from the support.

Production Apparatus

The photosensitive member as described above, used both in the present invention and in conventional methods and apparatus may be produced by using a known CVD apparatus as described below. FIG. 4 illustrates the construction of an example of an apparatus used to produce the photosensitive member of the present invention and the conventional photosensitive member by high-frequency plasma-assisted CVD making use of RF bands (hereinafter "RF-PCVD").

This apparatus is constituted chiefly of a deposition system 2100, a material gas feed system 2220 and an exhaust system (not shown) for evacuating the inside of a reactor 2111.

In the reactor 2111 in the deposition system 2100, a cylindrical support 2112, a support heater 2113 and a material gas feed pipe 2114 are provided. A high-frequency matching box 2115 is also connected to the reactor.

The material gas feed system 2220 is constituted of gas cylinders 2221 to 2226 for material gases such as $SiH_4$, $H_2$, $CH_4$, $B_2H_6$ and $PH_3$, valves 2231 to 2236, 2241 to 2246 and 2251 to 2256, and mass flow controllers 2211 to 2216. The gas cylinders for the respective material gases are connected to the gas feed pipe 2114 in the reactor 2111 through a valve 2260.

FIG. 5 also illustrates the construction of an example of an apparatus used to produce the photosensitive member of the present invention and the conventional photosensitive member by high-frequency plasma-assisted CVD making use of VHF bands (hereinafter "VHF-PCVD").

The deposition system 2100 in the apparatus shown in FIG. 4 is replaced with a deposition system 3100 as shown in FIG. 5, to connect it to the material gas feed system 2200. Thus, a production apparatus used in VHF-PCVD is set up.

This production apparatus is constituted chiefly of an inside-evacuatable reactor 3111 having a vacuum-sealed structure, a material gas feed system 2200 and an exhaust system (not shown) for evacuating the inside of the reactor.

In the reactor 3111, cylindrical supports 3112, support heaters 3113, a material gas feed pipe 3114 and an electrode are provided. A high-frequency matching box 3120 is also connected to the electrode.

The inside of the reactor 3111 is connected to a diffusion pump (not shown) through an exhaust tube 3121. In the reactor, space 3130 surrounded by the cylindrical supports 3112 forms a discharge space.

In recent years, with expansion of networks in offices and with spread of information made rich in variety, color image formation is becoming popular in printers and copying machines, too. In particular, with the expansion of the amount of information, color printers and color copying machines are sought to be made having high-speed.

Conventionally, in photosensitive members which are latent-image-bearing members of such color copying machines, OPC photosensitive members have widely been used as stated previously. The OPC photosensitive members, however, have a low hardness and may be abraded, so that the photosensitive members have had to be more often replaced as machines have higher speed. Accordingly, in respect of studies on high-speed copying machines making use of OPC photosensitive members, it has been studied to make them have higher hardness to prevent their abrasion so as to cope with high-speed copying.

On the other hand, in image-forming apparatus making use of the a-Si photosensitive members, they have a high hardness and hence can solve the problem of replacement of photosensitive members because of drum abrasion occurring in the OPC photosensitive members. Also, there is an advantage that they have a good dot reproducibility and can provide copies having a high image quality. There are, however, some problems in the employment of the a-Si in digital color copying machines.

The a-Si photosensitive members may cause the formation of smeared images in conditions of high temperature and high humidity and further may cause another problem of a change in surface potential because of variations of temperature. To solve these problems, a drum heater is put inside the photosensitive member to control temperature to a constant level.

Meanwhile, toners for color copying machines are so made up that a plurality of color toners are multiply fixed, and hence the softening point of the toners has been set low.

Where toners having a high softening point are used, their color mixing performance in fixing assemblies may lower to cause a problem in color reproducibility. Where such toners having a high softening point are used in high-speed full-color copying machines, a great mechanical shear may act at the part where rollers at cleaner and transfer zones come into contact with the photosensitive member and also the photosensitive member may generate heat so greatly as to make the toners tend to melt on the photosensitive member.

This may occur more remarkably especially when the photosensitive member is temperature-controlled by the drum heater, and may cause a problem of melt adhesion that the toners adhere to the photosensitive member and a problem of filming that toner resin accumulates uniformly on the photosensitive member surface.

Thus, also in the case when a-Si photosensitive members are used, it has been necessary for the photosensitive members to be put to maintenance, making it impossible to well bring out the advantage of long lifetime the a-Si photosensitive members have originally.

Accordingly, in the case when the a-Si photosensitive member are set in color copying machines, it has been considered necessary to newly provide toners that can achieve both the prevention of melt adhesion and filming to the photosensitive member and the color reproducibility in fixing.

In addition, where photosensitive members axe set in tandem-type full-color copying machines, the photosensitive members are restricted to a certain size because of the internal space of the apparatus. As the result, respective assemblies having the functions of charging, exposure, development, transfer, cleaning and charge elimination are restricted to certain sizes.

Especially when the width of a charging assembly is restricted, no sufficient surface potential may be obtained on the photosensitive member, so that no high-density images may be obtained. Accordingly, it is required to provide a toner and a developing method which can obtain a sufficient image density even in low-potential development. Also, even in a system having achieved such low-potential development, it is required to establish a toner and a developing method which can provide images having good color reproducibility and high image quality.

Stated additionally, another advantage in using the a-Si photosensitive members in full-color copying machines is that images can be formed in a high image quality. The a-Si photosensitive members can well restrict the level of dots produced by imagewise exposure, and can form images in a high image quality.

In an attempt to merely make color toners have a small particle diameter, the toners may have a large charge quantity and such toners commonly tend to participate in development in a small quantity. This may act disadvantageously on the low-potential development on a-Si photosensitive members. Hence, it is urgently sought to newly provide an image-forming method and an image-forming apparatus which can form images in a high minuteness and a high image quality, using toners showing a high developing performance.

SUMMARY OF THE INVENTION

The present invention was made taking account of the above circumstances. Accordingly, an object of the present invention is to provide an image-forming method and an image-forming apparatus which can materialize high-minuteness, high-image-quality and high-speed image formation while preventing deterioration of photosensitive members and improving their running performance.

To achieve the above object, the present invention provides an image-forming method used in an image-forming apparatus having;

four image-forming units making use of a first toner, a second toner, a third toner and a fourth toner which have colors different from one another, for forming toner images on a transfer medium; and a heat-and-pressure fixing means for performing heat-and-pressure treatment on the transfer medium having the toner images thereon;

the four image-forming units each having:

a photosensitive member having an amorphous silicon or non-single-crystal silicon layer;

a charging means for charging the photosensitive member electrostatically;

an exposure means for exposing the photosensitive member to form an electrostatic latent image thereon; and a developing means having a developing sleeve for developing the electrostatic latent image formed on the photosensitive member;

the photosensitive member having a diameter of from 20 mm to 80 mm;

after charging the photosensitive member with the charging means, the electrostatic latent image being formed by exposure with the exposure means, and, at a development position in unexposed areas, the photosensitive member being made to have a surface potential of from 300 V to 450 V as an absolute value;

the developing means having a two-component developer containing the toner and a carrier:

the photosensitive member and the developing sleeve being so disposed as to have a minimum gap between them of from 350 $\mu$m to 800 $\mu$m;

while the developing sleeve rotates at a peripheral speed from 1.1 times to 4.0 times the peripheral speed of the photosensitive member, the electrostatic latent image being developed with a magnetic brush of the two-component developer to form a toner image on the photosensitive member:

the first toner, second toner, third toner and fourth toner being selected from the group consisting of a non-magnetic yellow toner, a non-magnetic magenta toner, a non-magnetic cyan toner and a non-magnetic black toner;

the non-magnetic yellow toner, non-magnetic magenta toner, non-magnetic cyan toner and non-magnetic black toner having negative chargeability and each having a weight-average particle diameter of from 4.0 $\mu$m to 10.0 $\mu$m;

the carrier of the two-component developer having a 50% average particle diameter of from 10 $\mu$m to 80 $\mu$m; and where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being each from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min. a difference between D0.5max and D0.5min being 0.5 or less.

The present invention also provides an image-forming method for forming a full-color image or a multi-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit;

transferring to the transfer medium having the first, second and third toner images a fourth toner image formed in a fourth image-forming unit; and transporting to a heat-and-pressure fixing means the transfer medium having the first, second, third and fourth toner images to effect heat-and-pressure fixing;

(A) the formation of the first toner image in the first image-forming unit:

(i) comprising at least a first charging step of electrostatically charging a first photosensitive member having an amorphous silicon or non-single-crystal silicon layer, a first exposure step, and a first developing step having a first developing sleeve;

(ii) the first photosensitive member having a diameter of from 20 mm to 80 mm; the first photosensitive member being charged in the first charging step from 300 V to 450 V as an absolute value at its developing zone opposite to the first developing sleeve; and thereafter a first electrostatic latent image being formed on the first photosensitive member by exposure made in the first exposure step;

(iii) in the first developing step, a magnetic brush of a two-component developer containing a first toner and a first magnetic carrier being formed on the first developing sleeve;

(iv) the first photosensitive member and the first developing sleeve being so disposed as to have a minimum gap between them of from 350 $\mu$m to 800 $\mu$m;

(v) the first electrostatic latent image being developed with the magnetic brush of the two-component developer while the first developing sleeve is rotated at a peripheral speed from 1.1 times to 4.0 times the peripheral speed of the first photosensitive member, to form the first toner image on the first photosensitive member (B) the formation of the second toner image in the second image-forming unit:

(i) comprising at least a second charging step of electrostatically charging a second photosensitive member having an amorphous silicon or non-single-crystal silicon layer, a second exposure step, and a second developing step having a second developing sleeve;

(ii) the second photosensitive member having a diameter of from 20 mm to 80 mm; the second photosensitive member being charged in the second charging step from 300 V to 450 V as an absolute value at its developing zone opposite to the second developing sleeve; and thereafter a second electrostatic latent image being formed on the second photosensitive member by exposure made in the second exposure step;

(iii) in the second developing step, a magnetic brush of a two-component developer containing a second toner and a second magnetic carrier being formed on the second developing sleeve;

(iv) the second photosensitive member and the second developing sleeve being so disposed as to have a minimum gap between them of from 350 $\mu$m to 800 $\mu$m;

(v) the second electrostatic latent image being developed with the magnetic brush of the two-component developer while the second developing sleeve is rotated at a peripheral speed from 1.1 times to 4.0 times the peripheral speed of the second photosensitive member, to form the second toner image on the second photosensitive member;

(C) the formation of the third toner image in the third image-forming unit:

(i) comprising at least a third charging step of electrostatically charging a third photosensitive member having an amorphous silicon or non-single-crystal silicon layer, a third exposure step, and a third developing step having a third developing sleeve;

(ii) the third photosensitive member having a diameter of from 20 mm to 80 mm; the third photosensitive member being charged in the third charging step from 300 V to 450 V as an absolute value at its developing zone opposite to the third developing sleeve; and thereafter a third electrostatic latent image being formed on the third photosensitive member by exposure made in the third exposure step;

(iii) in the third developing step, a magnetic brush of a two-component developer containing a third toner and a third magnetic carrier being formed on the third developing sleeve;

(iv) the third photosensitive member and the third developing sleeve being so disposed as to have a minimum gap between them of from 350 $\mu$m to 800 $\mu$m;

(v) the third electrostatic latent image being developed with the magnetic brush of the two-component developer while the third developing sleeve is rotated at a peripheral speed from 1.1 times to 4.0 times the peripheral speed of the third photosensitive member, to form the third toner image on the third photosensitive member;

(D) the formation of the fourth toner image in the fourth image-forming unit:

(i) comprising at least a fourth charging step of electrostatically charging a fourth photosensitive member having an amorphous silicon or non-single-crystal silicon layer, a fourth exposure step, and a fourth developing step having a fourth developing sleeve;

(ii) the fourth photosensitive member having a diameter of from 20 mm to 80 mm; the fourth photosensitive member being charged in the fourth charging step from 300 V to 450 V as an absolute value at its developing zone opposite to the fourth developing sleeve; and thereafter a fourth electrostatic latent image being formed on the fourth photosensitive member by exposure made in the fourth exposure step;

(iii) in the fourth developing step, a magnetic brush of a two-component developer containing a fourth toner and a fourth magnetic carrier being formed on the fourth developing sleeve;

(iv) the fourth photosensitive member and the fourth developing sleeve being so disposed as to have a minimum gap between them of from 350 $\mu$m to 800 $\mu$m;

(v) the fourth electrostatic latent image being developed with the magnetic brush of the two-component developer while the fourth developing sleeve is rotated at a peripheral speed from 1.1 times to 4.0 times the peripheral speed of the fourth photosensitive member, to form the fourth toner image on the fourth photosensitive member, and (E) the first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) the non-magnetic yellow toner, non-magnetic magenta toner, non-magnetic cyan toner and non-magnetic black toner having positive chargeability and each having a weight-average particle diameter of from 4.0 $\mu$M to 10.0 $\mu$m;

(b) the magnetic carrier of the two-component developer having a 50% volume-average particle diameter of from 10 $\mu$m to 80 $\mu$m; and (c) where a coloring power of the toner of each color is defined as image density DO.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being from 0 to 0.5.

The present invention still also provides an image-forming method for forming a full-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit:

transferring to the transfer medium having the first, second and third toner images a fourth toner image formed in a fourth image-forming unit; and fixing the first, second, third and fourth toner images to the transfer medium by heat-and-pressure fixing;

(A) the first image-forming unit:

(i) comprising at least a first photosensitive drum, a first charging means for charging the first photosensitive drum electrostatically, a first exposure means for forming on the photosensitive drum thus charged a first electrostatic latent image by exposure, and a first developing means for developing the electrostatic latent image at a developing zone;

(ii) the first photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the first developing means having a one-component developer containing a first toner and a first developing sleeve for transporting the developer to the developing zone;

the first photosensitive drum and the first developing sleeve being so disposed as to either contact each other or maintain a minimum gap between them;

the first electrostatic latent image being developed with the one-component developer while in a case of contact development the first developing sleeve is rotated at a peripheral speed from 1.05 times to 2.0 times the peripheral speed of the first photosensitive drum and in a case of non-contact development the first developing sleeve is rotated at a peripheral speed from 1.1 times to 4.0 times the peripheral speed of the first photosensitive drum, to form the first toner image on the first photosensitive drum;

(B) the second image-forming unit:

(i) comprising at least a second photosensitive drum, a second charging means for charging the second photosensitive drum electrostatically, a second exposure means for forming on the photosensitive drum thus charged a second electrostatic latent image by exposure, and a second developing means for developing the electrostatic latent image at a developing zone;

(ii) the second photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the second developing means having a one-component developer containing a second toner and a second developing sleeve for transporting the developer to the developing zone;

the second photosensitive drum and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) the third image-forming unit:

(i) comprising at least a third photosensitive drum, a third charging means for charging the third photosensitive drum electrostatically, a third exposure means for forming on the photosensitive drum thus charged a third electrostatic latent image by exposure, and a third developing means for developing the electrostatic latent image at a developing zone;

(ii) the third photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the third developing means having a one-component developer containing a third toner and a third developing sleeve for transporting the developer to the developing zone;

the third photosensitive drum and the third developing sleeve being so disposed as to either contact each other or maintain a minimum gap between them;

the third electrostatic latent image being developed with the one-component developer while in a case of contact development the third developing sleeve is rotated at a peripheral speed from 1.05 times to 2.0 times the peripheral speed of the third photosensitive drum and in a case of non-contact development the third developing sleeve is rotated at a peripheral speed from 1.1 times to 4.0 times the peripheral speed of the third photosensitive drum, to form the third toner image on the third photosensitive drum;

(D) the fourth image-forming unit:

(i) comprising at least a fourth photosensitive drum, a fourth charging means for charging the fourth photosensitive drum electrostatically, a fourth exposure means for forming on the photosensitive drum thus charged a fourth electrostatic latent image by exposure, and a fourth developing means for developing the electrostatic latent image at a developing zone;

(ii) the fourth photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the fourth developing means having a one-component developer containing a fourth toner and a fourth developing sleeve for transporting the developer to the developing zone;

the fourth photosensitive drum and the fourth developing sleeve being so disposed as to either contact each other or maintain a minimum gap between them;

the fourth electrostatic latent image being developed with the one-component developer while in a case of contact development the fourth developing sleeve is rotated at a peripheral speed from 1.05 times to 2.0 times the peripheral speed of the fourth photosensitive drum and in a case of non-contact development the fourth developing sleeve is rotated at a peripheral speed from 1.1 times to 4.0 times the peripheral speed of the fourth photosensitive drums to form the fourth toner image on the fourth photosensitive drum; and (E) the first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) the non-magnetic yellow toner, non-magnetic magenta toner, non-magnetic cyan toner and non-magnetic black toner being each a negatively chargeable toner containing a binder resin and a colorant: each having a weight-average particle diameter of from 4.0 $\mu$m to 10.0 $\mu$m; and (b) each toner having a coloring power of from 1.0 to 1.8, and a difference between the coloring power of the toner showing the maximum coloring power among the three colors of yellow, magenta and cyan and the coloring power of the toner showing the minimum coloring power among them being from 0 to 0.5.

The present invention further provides an image-forming method for forming a full-color image or a multi-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit;

transferring to the transfer medium having the first, second and third toner images a fourth toner image formed in a fourth image-forming unit; and transporting to a heat-and-pressure fixing means the transfer medium having the first, second, third and fourth toner images to effect heat-and-pressure fixing;

(A) the formation of the first toner image in the first image-forming unit:

(i) comprising at least a first charging step of electrostatically charging a first photosensitive member having an amorphous silicon or non-single-crystal silicon layer, a first exposure step, and a first developing step having a first developing sleeve;

(ii) the first photosensitive member having a diameter of from 20 mm to 80 mm; the first photosensitive member being charged in the first charging step from 300 V to 450 V as an absolute value at its developing zone opposite to the first developing sleeve, and thereafter a first electrostatic latent image being formed on the first photosensitive member by exposure made in the first exposure step; and (iii) in the first developing step, a one-component developer being used which contains a first toner;

the first photosensitive member and the first developing sleeve being so disposed as to either contact each other or maintain a minimum gap between them;

the first electrostatic latent image being developed with the one-component developer while in the case of contact development the first developing sleeve is rotated at a peripheral speed from 1.05 times to 2.0 times the peripheral speed of the first photosensitive drum and in the case of non-contact development the first developing sleeve is rotated at a peripheral speed from 1.1 times to 4.0 times the peripheral speed of the first photosensitive drum, to form the first toner image on the first photosensitive drum;

(B) the formation of the second toner image in the second image-forming unit:

(i) comprising the method having at least a second charging step of electrostatically charging a second photosensitive member having an amorphous silicon or non-single-crystal silicon layer, a second exposure step, and a second developing step having a second developing sleeve;

(ii) the second photosensitive member having a diameter of from 20 mm to 80 mm; the second photosensitive member being charged in the second charging step from 300 V to 450 V as an absolute value at its developing zone opposing the second developing sleeve; and thereafter a second electrostatic latent image being formed on the second photosensitive member by exposure made in the second exposure step; and (iii) in the second developing step, a one-component developer being used which contains a second toner;

the second photosensitive member and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) the formation of the third toner image in the third image-forming unit;

(i) comprising the method having at least a third charging step of electrostatically charging a third photosensitive member having an amorphous silicon or non-single-crystal silicon layer, a third exposure step, and a third developing step having a third developing sleeve;

(ii) the third photosensitive member having a diameter of from 20 mm to 80 mm; the third photosensitive member being charged in the third charging step from 300 V to 450 V as an absolute value at its developing zone opposite to the third developing sleeve; and thereafter a third electrostatic latent image being formed on the third photosensitive member by exposure made in the third exposure step; and (iii) in the third developing step, a one-component developer being used which contains a third toner;

the third photosensitive member and the third developing sleeve being so disposed as to either contact each other or maintain a minimum gap between them;

the third electrostatic latent image being developed with the one-component developer while in the case of contact development the third developing sleeve is rotated at a peripheral speed from 1.05 times to 2.0 times the peripheral speed of the third photosensitive drum and in the case of non-contact development the third developing sleeve is rotated at a peripheral speed from 1.1 times to 4.0 times the peripheral speed of the third photosensitive drum. to form the third toner image on the third photosensitive drum;

(D) the formation of the fourth toner image in the fourth image-forming unit:

(i) comprising the method having at least a fourth charging step of electrostatically charging a fourth photosensitive member having an amorphous silicon or non-single-crystal silicon layer, a fourth exposure step, and a fourth developing step having a fourth developing sleeve;

(ii) the fourth photosensitive member having a diameter of from 20 mm to 80 mm; the fourth photosensitive member being charged in the fourth charging step from 300 V to 450 V as an absolute value at its developing zone opposing the fourth developing sleeve; and thereafter a fourth electrostatic latent image being formed on the fourth photosensitive member by exposure made in the fourth exposure step; and (iii) in the fourth developing step, a one-component developer being used which contains a fourth toner;

the fourth photosensitive member and the fourth developing sleeve being so disposed as to either contact each other or maintain a minimum gap between them;

the fourth electrostatic latent image being developed with the one-component developer while in the case of contact development the fourth developing sleeve is rotated at a peripheral speed from 1.05 times to 2.0 times the peripheral speed of the fourth photosensitive drum and in the case of non-contact development the fourth developing sleeve is rotated at a peripheral speed from 1.1 times to 4.0 times the peripheral speed of the fourth photosensitive drum, to form the fourth toner image on the fourth photosensitive drum; and (E) the first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) the non-magnetic yellow toner, non-magnetic magenta toner, non-magnetic cyan toner and non-magnetic black toner being positively chargeable and each having a weight-average particle diameter of from 4.0 μm to 10.0 μm; and (b) where the coloring power of the toner of each color is defined as image density D0.5 measured after being fixed once when a quantity of unfixed toner on a transfer medium, M/S, is 0.5 mg/cm$^2$ and the coloring power of the nonmagnetic yellow toner is represented by D0.5Y. the coloring power of the non-magnetic magenta toner by D0.5M, the coloring power of the nonmagnetic cyan toner by D0.5C and the coloring power of the non-magnetic black toner by D0.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being from 0 to 0.5.

The present invention still further provides image-forming apparatus used in the above image-forming methods.

DESCRIPTION OF THE PREFERRED EMBODIMENTS

Figure 1:
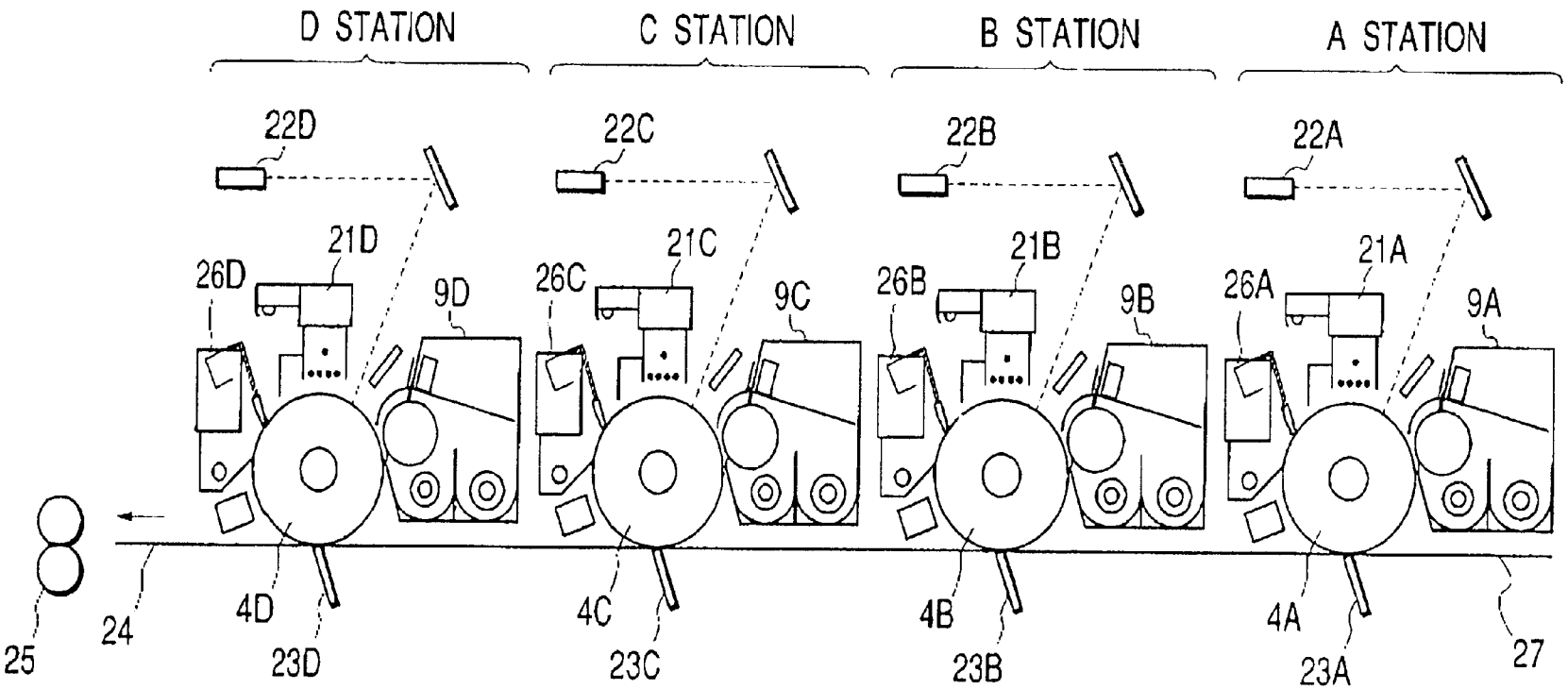
FIG. 1 schematically illustrates the construction of a full-color copying machine of an electrophotographic system, which is an embodiment of an image-forming apparatus carrying out the present invention.

The present invention will be described below in detail.

(A) As a first invention, the present invention concerns an image-forming process which can stably obtain high-density images.

According to the present invention, in a two-component development system containing a toner and a carrier, an a-Si photosensitive member having a diameter of from 20 mm to 80 mm is used, the photosensitive member is electrostatically charged to have a surface potential of from 300 to 450 V (absolute value), and yellow, magenta, cyan and black toners are used each of which have a weight-average particle diameter of from 4.0 μm to 10.0 μm. and, under a condition that the carrier of the two-component developer has a 50% average particle diameter of from 10 μm to 80 μm and as image density (D0.5) measured usually after the toner is fixed once when the quantity of unfixed toner on a transfer medium, M/S, is M/S=0.5 mg/cm$^2$, have a coloring power of from 1.0 to 1.9, and in which the difference between a maximum value and a minimum value is from 0 to 0.5 . This has made it possible to obtain high-quality images in a high image density and a superior color reproduction.

If the photosensitive member has a diameter smaller than 20 mm, the surface potential (charge potential) on the photosensitive member by which potential the charge width is restricted can not be given as a sufficient charge potential taking account of the capacity of the charging assembly and high-pressure leak, and, in the evolution to high-speed full-color copying machines, images having high image quality can not be obtained. Also, the nip between it and the developing sleeve is so small as to narrow the developing zone to cause a decrease in image density.

If on the other hand the photosensitive member has a diameter larger than 80 mm, a sufficient charge potential can be attained and also a sufficient density can be achieved, but, at the time of transfer, toner images formed in a previous image-forming unit and held on the transfer medium or a part of the toner tend(s) to be re-transferred to the photosensitive member. This tends to cause an increase in toner consumption and an image density unevenness at the time of transfer.

Especially when images are formed through four stations, images at the first station may be re-transferred at the second, third and fourth stations, and hence are put to a severe condition for keeping the image density and avoiding the image density unevenness at the time of transfer. In addition, the use of large-diameter photosensitive members makes the apparatus large-size.

As to the charging of the photosensitive member, if the surface potential at the part of the developing assembly is lower than 300 V, no sufficient image density is obtainable. Surface potential higher than 450 V is not preferable because uneven density due to uneven potential of the photosensitive member may occur and any defects of the photosensitive member, such as drum ghosts, tend to be picked up, tending to cause faulty images.

The image density (D0.5) measured usually after the toner is fixed once when the quantity of unfixed toner on a transfer medium, M/S, is M/S=0.5 mg/cm$^2$ can be changed by the amount of colorants added to toners or by the state of dispersion of colorants.

If the D0.5 is lower than 1.0, a decrease in image density may be caused when images are formed using the a-Si photosensitive member under conditions where a sufficient charge potential has been given. Where the D0.5 is made higher only by enlarging the amount of a pigment, the pigment may become excess in the toner to inhibit the toner from being charged or change its viscoelasticity to vary fixing performance, and also the pigment tends to come off from toner particles during running tending to cause fogging, filming, spent carrier, and so forth.

Hence, the D0.5 must be controlled not only by the amount for its addition but also by taking account of what pigment is to be selected and how the pigment is to be dispersed. However, even where the charge inhibition and viscoelasticity of the toner has been controlled and the D0.5 has been made higher, a D0.5 which is higher than 1.8 is not preferable because the toner may have a low halftone reproducibility and in addition may cause an abrupt rise in density gradation, requiring severe control against environmental variations.

Thus, the toners used In the present invention may preferably have a coloring power D0.5 of from 1.0 to 1.8, and more preferably from 1.1 to 1.7.

Then, studies have been made on the coloring power of the three yellow, magenta and cyan color toners. As the result, it has been found that the difference in gloss at the same image density areas of the respective colors becomes great and no high-quality images are obtainable when the difference between the maximum value and the minimum value of D0.5 of yellow, magenta and cyan colors is greater than 0.5. Moreover, the environmental properties the respective toners have are liable to be picked up to tend to make the colors off-balance depending on temperature and humidity when full-color images are formed Thus, it has been found preferable to set the difference between the maximum value and the minimum value of D0.5 of yellow, magenta and cyan colors within the range of from 0 to 0.5.

In the present invention, the photosensitive member (for example, photosensitive drum) and the developing sleeve are so disposed as to have a minimum gap between them of from 350 $\mu$m to 800 $\mu$m, and also electrostatic latent images are developed with a magnetic brush of a two-component developer while the developing sleeve is rotated at a peripheral speed from 1.1 to 4.0 times the peripheral speed of the photosensitive drum. This has been found to cause no melt adhesion of toner to the photosensitive drum surface, to provide a sufficient image density, to be effective also against toner deterioration and also to enable stable formation of images having good dot reproduction.

If the minimum gap between the photosensitive drum and the developing sleeve (SD gap) is smaller than 350 $\mu$m, a great shear may act at the gap, so that the toner tends to melt-adhere to the photosensitive drum surface. If on the other hand it is larger than 800 $\mu$m, the toner must fly over too long a distance to reach the drum with ease and attain any sufficient image density.

If the development with a magnetic brush of a two-component developer is made while the developing sleeve is rotated at a peripheral speed less than 1.1 times the peripheral speed of the photosensitive drum, the toner necessary for development can not be fed and hence no sufficient image density can be attained. If on the other hand the developing sleeve is rotated at a peripheral speed more than 4.0 times the peripheral speed of the photosensitive drum, a great shear may act in the developing assembly, and both the toner and the carrier may greatly deteriorate to cause a remarkable decrease in density upon continuous service.

The present invention provides a tandem-type full-color copying machine having an amorphous silicon photosensitive drum.

The use of a tandem-type system enables achievement of a high-speed full-color system without making the photosensitive drum move at a higher speed (process speed), which can also be made compact. Also, compared with a one-drum stationary development system (with a plurality of developing assemblies), it can be free from any potential difference at the position of each developing assembly which is due to dark attenuation, and in consequence, the image density can easily be controlled. Still also, it can remove problems such as density decrease and image density unevenness which are attributable to the re-transfer of image at the time of using an a-Si photosensitive member having a large diameter and any uneven performance which is a problem inherent in the production of large-diameter drums.

The developers and toners in the present invention are described below. Pigments used in the present invention are described first.

In the present invention, there are no particular limitations on the types of pigments, which may appropriately be selected taking account of their dispersibility in resins, improvement of color reproducibility, high coloring power and high fastness to light and also that they may not be inhibitory factors to charging.

As preferred yellow pigments, they may include C.I. Pigment Yellow 74, 93, 97, 109, 128, 151, 154, 155, 166, 168, 180 and 185.

As preferred magenta pigments, they may include quinacridone pigments, C.I. Pigment Red 48:2, 57:1 and 58:2. C.I. Pigment Red 5, 31, 146, 147, 150, 184, 187, 238 and 245, or C.I. Pigment Red 185 and 265.

As cyan pigments, they may include copper phthalocyanine pigments or aluminum phthalocyanine pigments. The copper phthalocyanine pigments may be phthalocyanine pigments having a structure represented by the following Formula (I), the phthalocyanine skeleton of which has been substituted with 1 to 5 phthalimide methyl groups.

(I)

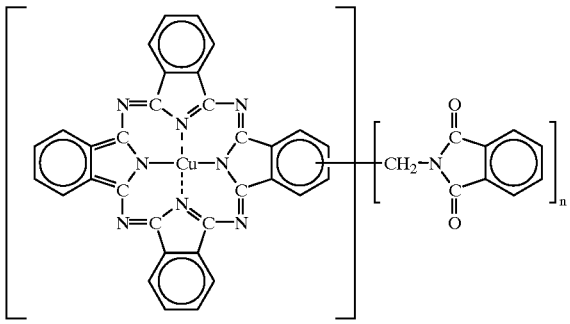

wherein n represents a positive number of 1 to 5.

As black pigments, carbon black and any organic pigments may be used without any problem as long as they assume black color.

Use of these pigments brings about improved dispersibility of toner pigments in binder resins, so that the coloring power can be improved, low-potential development can be made and good full-color images can be formed.

In regard to yellow toners, which reflect sensitively on transmission of OHP films, the yellow-color pigment may be contained in an amount not more than 12 parts by weight, and preferably from 0.5 to 8 parts by weight, based on 100 parts by weight of the binder resin.

If it is in an amount more than 12 parts by weight, the toner may have a poor color reproducibility in respect of green and red, which are mixing colors for yellow, and, as images, in respect of human flesh color. In regard to the remaining magenta toners and cyan toners, the magenta-color pigment and cyan-color pigment may each be contained in an amount not more than 15 parts by weight, and preferably from 0.1 to 9 parts by weight, based on 100 parts by weight of the binder resin.

To produce the toners according to the present invention, a thermoplastic resin and the pigment or a dye as a colorant, optionally together with a charge control agent and other additives, are thoroughly mixed by means of a mixing machine such as a ball mill, and then the mixture is melt-kneaded by means of a heat kneading machine such as a heat roll, a kneader or an extruder to make the resin and so forth melt one another, in which the pigment or dye is dispersed or dissolved, followed by cooling for solidification and thereafter pulverization and strict classification. Thus colorant-containing resin particles (toner particles) according to the present invention are obtained.

In order to obtain the toners each having the coloring power of from 1.0 to 1.8 as image density (D0.5) measured usually after the toner is fixed once when the quantity of unfixed toner on a transfer medium, M/S, is M/S=0.5 $mg/cm^2$, like the toners according to the present invention, It is preferable to use a pigment dispersion method as described below.

In the present invention, in order to achieve a specific state of dispersion of pigment particles in the toner particles as described above, it is preferable to put into a kneader or a mixer a first binder resin and a paste pigment containing 5 to 50% by weight of pigment particles insoluble in the dispersion medium, heat them while mixing them under application of no pressure to cause the first binder resin to melt to move the paste resin (i.e., pigment in liquid phase) to the first binder resin kept heated, i e., the molten resin phase, thereafter melt-knead the first binder resin and the pigment particles, followed by removal of the liquid component by evaporation and then drying to obtain a first kneaded product containing the first binder resin and the pigment particles, and then add to the first kneaded product a second binder resin and also optionally additives such as a charge control agent to prepare a mixture, melt-knead the mixture with heating to obtain a second kneaded product, and cool the second kneaded product, followed by pulverization and classification to produce a toner. Here, the first binder resin and the second binder resin may be resins of the same type or may be different resins.

In the present invention, the above paste refers to a condition in which in the step of producing pigment particles the pigment particles are present without having passed through any drying step at all. In other words, it is a condition in which the pigment particles are present in substantially the state of primary particles in an amount of from 5 to 50% by weight based on the total weight of the paste. The remaining 50 to 95% by weight in the paste is held by the greater part of a volatile liquid together with some quantities of a dispersant and an auxiliary agent.

There are no particular limitations on the volatile liquid as long as it is a liquid which evaporates upon usual heating. A liquid that may particularly preferably be used in the present invention and may preferably be used also in view of ecology is water.

In the present invention, the insoluble pigment particles refer to pigment particles insoluble in the dispersion medium which is the volatile liquid in the paste, and are those capable of dispersing in the paste. For example, when water is selected as the volatile liquid, pigment particles insoluble in water are entirely the insoluble pigment particles.

The paste pigment used in the present invention may preferably contain such water-insoluble pigment particles in an amount of from 5 to 50% by weight, and more preferably from 5 to 45% by weight. If the insoluble pigment particles are in a content more than 50% by weight, the particles may be dispersed in the resin in so low an efficiency that the kneading temperature must be set higher or the kneading time must be set longer. In addition, it may be essential for the kneading machine to be provided with a strong screw or paddle. If so, it tends to cause the breaking of polymer chains.

If on the other hand the paste pigment contains the insoluble pigment particles in a amount less than 5% by weight as solid content, it is inevitable to introduce the paste pigment into apparatus in a large quantity in order to attain the intended pigment content. Thus, the apparatus must be made large-sized. Also, if it is less than 5% by weight, tab stop of removing water in the steps subsequent to the first kneading must be enforced so that the water can completely be removed. thus a great load may be applied to the resin consequently.

When the paste pigment and the resin are kneaded or mixed, the pigment and the resin may preferably be in a proportion of from 10:90 to 50:50, and preferably from 15:85 to 45:55, in terms of solid content.

If the proportion of the pigment to the resin is smaller than 10% by weight, the resin must be charged in the kneading machine in a large quantity with respect to the paste pigment, tending to cause segregation of the pigment in the kneaded product. In order to bring such a product into a uniform system, the kneading time must inevitably be set longer. If so, an excess load may be applied to the resin, making it impossible to attain any intended resin properties.

If the proportion of the pigment to the resin is larger than 50% by weight, the pigment particles can not smoothly move to the resin in the liquid phase. In addition, even at the time of melt kneading after the pigment particles have moved to the resin, the kneaded product cannot be brought into any uniform state, thus any high dispersion cannot be achieved consequently The reason why in the present invention the melt kneading is carried out under application of no pressure is that, if it is done under application of a pressure, the liquid, e.g., water in the paste pigment may vigorously attack the binder resin to cause hydrolysis reaction in part especially when the resin is a polyester resin, or may cause a change of properties of the resin. If so, the binder resin may greatly change in properties to come to have no anti-offset properties in some cases. Accordingly, in the present invention, it is preferable for the first binder resin and the paste pigment to be melt-kneaded under application of no pressure.

The kneading machine used in the present invention may include heat kneaders, single-screw extruders, twin-screw extruders, and kneaders, and may particularly preferably include heat kneaders.

As the binder resin used in the present invention, various resins known conventionally as binder resins for electrophotography may be used.

For example, usable are polystyrene, styrene copolymers such as a styrene-butadiene copolymer and a styrene-acrylic copolymer, a polyethylene-vinyl acetate copolymer, phenolic resins, epoxy resins, acrylic phthalate resins, polyamide resins, polyester resins and maleic acid resins. In the present invention, good pigment dispersion and charge stability can be achieved when polyester resins are used as the binder resin.

The polyester resins are described below in greater detail.

As a dibasic acid component constituting the polyester resin preferably used, it may include, e.g., aromatic dicarboxylic acids such as terephthalic acid, isophthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid and 1,2-diphenoxyethane-p,p'-dicarboxylic acid. As acids other than these, usable are maleic acid, fumaric acid, glutaric acld, cyclohexanedicarboxylic acid, succinic acid, malonic acid, adipic acid, mesaconic acid, itaconic acid, citraconic acid, sebacic acid, and anhydrides or lower alkyl esters of these acids.

As a dihydric alcohol, it may be a diol represented by the following Formula (II):

(II)

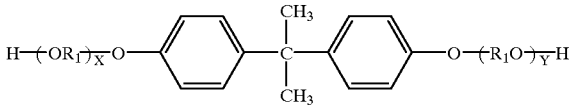

wherein $R_1$ is an alkylene group having 2 to 5 carbon atoms, X and Y are positive numbers satisfying $2 \leqq X+Y$ and may include polyoxypropylene(2,2)-2,2-bis(4-hydroxyphenyl)propane, polyoxyethylene(2)-2,2-bis(4-hydroxyphenyl)propane, polyoxypropylene(6)-2,2-bis(4-hydroxyphenyl)propane and polyoxypropylene(13)-2,2-bis(4-hydroxyphenyl)propane.

As other dihydric alcohol, it may include diols such as ethylene glycol, diethylene glycol, triethylene glycol, 1,2-propylene glycol, 1,3-propylene glycol, 1,4-butanediol, neopentyl glycol and 1,4-butenediol, 1,4-bis(hydroxymethyl) cyclohexane, and bisphenol A or hydrogenated bisphenol A.

The polyester resin used in the present invention may contain an acid having an alkyl or alkenyl substituent, such as maleic acid, fumaric acid, glutaric acid, succinic acid, malonic acid or adipic acid having a n-dodecenyl group, an isododecenyl group, a n-dodecyl group, an isododecyl group or an isooctyl group, and/or an alcohol such as ethylene glycol, 1,3-propylene diol, tetramethylene glycol, 1,4-butylene diol and 1,5-pentylene diol.

As a production process for the polyester resin used in the present invention, the polyester resin may be obtained by, e.g., the following process.

A linear condensation product is formed, in the course of which its molecular weight is so controlled as to come to be 1.5 times to 3 times the intended acid value and hydroxyl value, and also the reaction is so controlled that the condensation reaction may proceed more slowly and gradually than conventional reaction so as to make the molecular weight distribution uniform, which may be so controlled by, e.g., (i) carrying out the reaction at a lower temperature and for a longer time than conventional reaction, (ii) decreasing its esterifying agent, (iii) using an esterifying agent having a low reactivity, or (iv) using any of these methods in combination.

Thereafter, under such conditions, a cross-linking acid component and optionally an esterifying agent are further added to carry out reaction to form a three-dimensional condensation product. Further, the temperature is raised and the reaction is carried out slowly and for a long time so as to make the molecular weight distribution uniform, to proceed cross-linking reaction. At the time the hydroxyl value, acid value or M1 value have lowered to the intended value, the reaction is terminated to obtain the polyester resin.

In the present invention, the polyester resin may have an acid value of from 2.0 to 50.0 mg·KOH/g, preferably from 3,0 to 40.0 mg·KOH/g, and more preferably from 5.0 to 30.0 mg·KOH/g. This is preferable because superior charging stability can be attained in every environment.

If the polyester resin has an acid value lower than 2.0 mg·KOH/g, the toner may have a tendency of charging-up to tend to cause a decrease in image density In a low-temperature low-humidity environment. Moreover, the colorant may decline in dispersibility In the resin to tend to cause a difference in charge quantity between toner particles, tending to cause fog a little during long-term running.

If the polyester resin has an acid value higher than 50.0 mg·KOH/g, the toner may have a low stability with time when charged electrostatically, tending to cause a decrease in charge quantity with progress of running. Especially in a high-temperature high-humidity environment, faulty images such as toner scatter and fog tend to occur.

In the present invention, taking account of the storage stability and fixing performance of toners and also the mutual color mixing performance between toners of different colors, the resin may have a glass transition temperature of from 50 to 70° C., and preferably from 52 to 68° C.

If the resin has a glass transition temperature lower than 50° C., the toner can have a good fixing performance, but may have low anti-offset properties to cause contamination of fixing rollers and winding-around on fixing rollers undesirably. Also, images having been fixed may have too high a surface gloss, resulting in an undesirable low image quality level.

If the resin has a glass transition temperature higher than 70° C., the toner may have so low a fixing performance as to make it inevitable to make higher the preset fixing temperature of the copying machine main body, and the images obtained may commonly have a low gloss, resulting in a low color mixing performance for full-color toners.

The resin used in the present invention may preferably have a number-average molecular weight (Mn) of from 1,500 to 20,000, and more preferably from 2,000 to 15,000, a weight-average molecular weight (Mw) of from 6,000 to 100,000, and more preferably from 8,000 to 80,000, and Mw/Mn of preferably from 2 to 10. The resin that fulfills the above condition contributes to good heat fixing performance, improves the dispersion of colorants therein, makes toners less vary in charge quantity and brings about an improvement in reliability of image quality.

It the resin has a number-average molecular weight (Mn) lower than 1,500 or has a weight-average molecular weight (Mw) lower than 6,000, in either case the fixed-image surfaces can be highly smooth and look vivid, but the offset tends to occur during running. Also, the toner may have a low storage stability to cause the melt adhesion of toner in developing assembly and the toner-spent where toner components adhere to carrier particle surfaces. Such an additional problem is also worrisome. Moreover, when toner materials are melt-kneaded in the production of toner particles, any shear may be applied with difficulty to tend to lower the dispersion of colorants for chromatic colors, therefore tending to cause a lowering of the coloring power of toners and variations in charge quantity of toners.

If the resin has a number-average molecular weight (Mn) higher than 20,000 or has a weight-average molecular weight (Mw) higher than 100,000, in either case the toners can have good anti-offset properties, but it is inevitable to make the preset fixing temperature higher. Even if the extent of dispersion of the colorants can be controlled, a low surface smoothness at image areas may result to tend to lower color reproducibility.

If the resin has Mw/Mn less than 2, the molecular weight itself is so low as to tend to cause, like the above case of low molecular weight, the phenomenon of offset as a result of running, the lowering of storage stability, the melt adhesion of toner in developing assembly and the toner-spent on carrier particles, and also tend to cause uneven charge quantity of toners.

If the resin has Mw/Mn more than 10, the toners can have good anti-offset properties, but it is inevitable to make the preset fixing temperature higher. Even is the extent of dispersion of the colorants can be controlled, a low surface smoothness at image areas may result to tend to lower color reproducibility.

The toners of the present invention may also preferably each have a softening-point temperature Tm of 85° C.; Tm≦120° C. as calculated from a flow tester curve.

If the toner has a softening-point temperature higher than 120° C., the toners can have good anti-offset properties, but it is inevitable to make the preset fixing temperature higher. Even if the extent of dispersion of the colorants can be controlled, a low surface smoothness at image areas may result to tend to lower color reproducibility.

If the toner has a Tm lower than 85° C., the fixed-image surfaces can certainly be highly smooth and look vivid, but the offset tends to occur during running. Also, the toners may have a low storage stability to cause the melt adhesion of toner. Such an additional problem is also worrisome. Thus, the softening-point temperature Tm of toners may preferably be 85° C.≦Tm≦120° C., and preferably 90° C.≦Tm≦115° C.

The toners according to the present invention may preferably be negatively chargeable toners in view of the readiness to stabilize charge. Especially in toners making use of highly negatively chargeable polyester resins as binder resins and in which the colorants described previously have uniformly been dispersed, the charge can readily be made stable and superior running performance and high image quality can be achieved.

In the toners according to the present invention, negative charge control agents may optionally be added, and organometallic compounds may preferably be contained. Such compounds may preferably include metallic compounds of aromatic carboxylic acid derivatives as exemplified by metallic compounds of salicylic acid and metallic compounds of alkylsalicylic acid.

In the present invention, chromium compounds or aluminum compounds of di-tert-butylsalicylic acid are preferred, which also enable control of the softening point of toners at the time of kneading by the mutual action with the resin. This effect is not so much seen in metallic compounds such as zinc compounds.

In the case when the metallic compounds of aromatic carboxylic acids are incorporated in the toner resins, the compound may preferably be in a content of from 0.5 to 10 parts by weight, and more preferably from 1 to 8 parts by weight, based on 100 parts by weight of the binder resin. The incorporation of the metallic compound of aromatic carboxylic acid in a content of from 0.5 to 10 parts by weight is preferred because its cross-linking reaction with the resin may well proceed at the time of melt kneading, so that the colorant can finely uniformly be dispersed in the resin and also the negative triboelectric chargeability of toners can be regulated within a preferred range.

If the metallic compound of aromatic carboxylic acid is less than 0.5 part by weight, the resin may have so few metal-crosslinked portions that its melt viscosity does not build up or, even if it has built up, it is at a low rate of build-up and may be less effective for the negative charge control of toners.

If the metallic compound of aromatic carboxylic acid is more than 10 parts by weight, the resin may have too many metal-crosslinked portions to make the toners have good low-temperature fixing performance and have good mutual color mixing performance between toners of different colors. Also, in a low-temperature low-humidity environment, the toners tend to cause charge-up.

In the toners according to the present invention, the colorant is finely and uniformly dispersed by making the resin and the metallic compound of aromatic carboxylic acid act mutually to cause the cross-linking reaction to take place and enlarging the shear applied to secondary particles of the colorant at the time of kneading, Thus, they are toners so designed that they have superior rapid-melt properties even on the low-temperature side at the time of heat-and-pressure fixing and can exhibit their elastic quality strongly on the high-temperature side to make the offset hardly occur.

The toners according to the present invention may each optionally be incorporated with a fatty metal salt (e.g., zinc stearate or aluminum stearate) or a fine fluorine-containing polymer powder (e.g., fine powder of polytetrafluoroethylene, polyvinylidene fluoride or a tetrafluoroethylene-vinylidene fluoride copolymer), serving as a lubricant, or a conductivity-providing agent such as tin oxide or zinc oxide.

In the present invention, the toners may each further contain a release agent, which may include, e.g., aliphatic hydrocarbon waxes, oxides of aliphatic hydrocarbon waxes, ester waxes, waxes composed chiefly of fatty esters, saturated straight-chain fatty acids, unsaturated fatty acids, saturated alcohols, polyhydric alcohols, fatty amides, saturated fatty bisamides, unsaturated fatty amides and aromatic bisamides.

In the toners, the release agent may preferably be in a content of from 0.1 to 20 parts by weight, and more preferably from 0.5 to 10 parts by weight, based on 100 parts by weight of the binder resin. If the releasing agent is in a content more than 20 parts by weight, anti-blocking properties and high-temperature anti-offset properties tend to lower. If it is in a content less than 0.1 part by weight, it has less release effect.

Usually, any of these release agents may preferably be incorporated in the binder resin by a method in which the binder resin is dissolved in a solvent, the resultant resin solution is heated and then the release agent is added and mixed with stirring, or a method in which the release agent is added at the time of the kneading of toner component materials containing at least the binder resin and the colorant.

For the production of the toners, usable are a method in which toner component materials are well kneaded by means of a heat kneading machine such as a heat roll, a kneader or an extruder, followed by mechanical pulverization, and the resultant pulverized powder is classified to obtain toners, or a method in which in a binder resin solution other toner component materials such as colorants are dispersed, followed by spray drying to obtain toners.

In the present invention, the toners may each have a weight-average particle diameter (D4) of from 4.0 to 10.0 μm, and preferably from 5.0 to 9.0 μm.

If the toner has a weight-average particle diameter (D4) smaller than 4.0 μm, the charge can be made stable with difficulty to tend to cause fog and toner scatter during running.

If the toner has a weight-average particle diameter (D4) larger than 10.0 μm, the toner may have a greatly low image reproducibility at halftone areas, and, as the resultant images, coarse images may be formed.

In the toners according to the present invention, a fluidity improver may preferably be added. As the fluidity improver, any materials are usable as long as a fluidity can be seen to have been improved, when compared with that before and after its addition.

The fluidity improver may include, e.g., fine metal oxide powders such as fine silica powder, fine alumina powder, fine titanium oxide powder, fine zirconium oxide powder, fine magnesium oxide powder and fine zinc oxide powder; fine nitride powders such as fine boron nitride powder, fine aluminum nitride powder and fine carbon nitride powder; and also fine powders of calcium titanate, strontium titanate, barium titanate and magnesium titanate.

In the present invention, it is especially preferable to use an inorganic fine powder having an average primary particle diameter of from 0.001 to 0.2 μm and having been hydrophobic-treated.

In the above additive, it is important factors not only to improve the fluidity of toners but also not to inhibit the charging performance of toners. Accordingly, in the toners according to the present invention, it is preferable for particle surfaces of the additive to have been hydrophobic-treated. This enables simultaneous satisfaction for the providing of fluidity and the stabilization of charging.

Having been hydrophobic-treated makes it possible to remove any influence of water content which is a factor that influences the charge quantity, and to lessen any gap in charge quantity between a high-humidity environment and a low-humidity environment, bringing about an improvement in environmental properties. Also, the addition of hydrophobic treatment in the course of production steps makes it possible to prevent the primary particles from agglomerating. Thus, these make it possible for the toners to be uniformly charged.

In the present invention, fine titanium oxide powder or fine alumina powder having an average primary particle diameter of from 0.001 to 0.2 μm is particularly preferred because a good fluidity can be provided, the negatively chargeable toners can be charged uniformly and consequently the toner scatter and fog may hardly occur. Moreover, such fine powder can be made to hardly become buried in toner particle surfaces, so that the toners may deteriorate with difficulty and can be improved in many-sheet running performance. This tendency is more remarkable in color toners having sharp-melt properties.

Fine silica particles are strongly negatively chargeable in themselves, whereas the fine titanium oxide powder or fine alumina powder is substantially neutrally chargeable and hence can be controlled to have any intended charge level depending on the degree of hydrophobic treatment.

As hydrophobic-treating agents used in the present invention, they may appropriately be selected in accordance with the purposes of surface modification, e.g., the controlling of charging performance and also the stabilization of charge in a high-humidity environment and the reactivity. For example, such agents may be silane-type organic compounds such as alkylalkoxysilanes, siloxanes, silanes and silicone oils, and those which do not undergo any decomposition by themselves at the reaction or treatment temperature As a particularly preferred agent, an alkylalkoxysilane represented by the following general formula may be used as a coupling agent, which has a volatility and has both a hydrophobic group and a linking group rich in reactivity.

$$R_mSiY_n$$

wherein R represents an alkoxyl group; m represents an integer of 1 to 3; Y represents a hydrocarbon group such as an alkyl group, a vinyl group, a glycidoxyl group or a methacrylic group; and n represents an integer of 1 to 3.

Such compounds may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

Of these, an alkylalkoxysilane compound may more preferably be used which is represented by the formula: $C_aH_{2a+1}$—Si—$(OC_bH_{2b+1})_3$ (wherein a represents an integer of 4 to 12, and b represents an integer of 1 to 3).

In the above formula, if a is smaller than 4, though hydrophobic treatment may be made with ease, it is difficult to provide a sufficient hydrophobicity. If on the other hand a is larger than 13, though hydrophobicity can be sufficient, fine powder particles may greatly coalesce one another to tend to have a low fluidity-providing ability. Also, if b is larger than 3, the compound may have a low reactivity to make it hard for the fine powder to be made well hydrophobic. Accordingly, in the present invention, a may preferably be from 4 to 12, and more preferably from 4 to 8, and b may preferably be from 1 to 3, and more preferably 1 or 2.

In this treatment, the hydrophobic-treating agent may be used in an amount of from 1 to 50 parts by weight, and preferably from 3 to 45 parts by weight, based on 100 parts by weight of the fine titanium oxide powder or fine aluminum powder, so as to provide a hydrophobicity of from 30 to 90%, and preferably from 40 to 80%.

If the hydrophobicity is lower than 30%, the charge quantity may greatly lower as a result of long-term leaving in a high-humidity environment, making it necessary to provide a mechanism for charge acceleration on the side of hardware.

If on the other hand the hydrophobicity is higher than 90%, the fine titanium oxide powder or fine alumina powder itself may be charge-controllable with difficulty, so that the toners may cause charge-up in a low-humidity environment undesirably.

The fine titanium oxide powder or fine alumina powder used in the present invention may further preferably have an average particle diameter of from 0.001 to 0.2 μm, and more preferably from 0.005 to 0.1 μm, in view of fluidity-providing performance.

If it has an average particle diameter larger than 0.2 μm, the toners may have a low fluidity to tend to be non-uniformly charged, so that the toner scatter and fog tend to occur, making it difficult to form images having high image quality. If on the other hand it has an average particle diameter smaller than 0.001 μm, the treated fine titanium oxide powder or treated fine alumina powder tend to be buried in colorant-containing resin particles (toner particles), so that the toners tend to deteriorate early and tend to have a low running performance. This tendency is more remarkable when used in color toners having sharp-melt properties.

In addition, if it has an average particle diameter smaller than 0.001 μm, the inorganic fine powder itself may have so high a reactivity that particles tend to coalesce with one another, making it difficult to attain the intended high fluidity.

The average particle diameter of the fine titanium oxide powder or fine alumina powder used in the present invention is measured with a transmission electron microscope.

In the present invention, as a method for treating the fine titanium oxide powder or fine alumina powder, it is effective to use a method in which the fine powder is mechanically dispersed in a solution so as to have primary particle diameter, during which the coupling agent is hydrolyzed to make treatment, but the method is by no means limited to this. The powder may also be treated by a gaseous-phase process.

Such treated fine titanium oxide powder or treated fine alumina powder, which is preferable for the present invention, may be in a content of from 0.2 to 5 parts by weight, preferably from 0.3 to 3 parts by weight, and more preferably from 0.5 to 2.5 parts by weight, based on 100 parts by weight of the toner particles.

If it is less than 0.2 part by weight, the toners may have a low fluidity. If on the other hand it is more than 5 parts by weight, it tends to come off from the toner particles. Any treated fine powder thus having come off tends to contaminate carrier particle surfaces to cause a lowering of charge-providing ability of the carrier itself undesirably. Also, the treated fine powder having come off tends to fly onto the photosensitive member surface at the time of development to also tend to cause faulty cleaning. Still also, when used as color toners, inclusion of such treated fine powder in a large quantity may cause a darkness in projected Images of OHP, making it impossible to obtain sharp images.

In the present invention, the treated fine titanium oxide powder or treated fine alumina powder may further preferably have a BET specific surface area of 100 $m^2/g$ or larger, and preferably 130 $m^2/g$ or larger.

If it has a BET specific surface area smaller than 100 $m^2/g$, the intended high fluidity may be attained with difficulty. Also, though the untreated fine powder had showed the BET specific surface area at a very high value before the treatment, it may have a BET specific surface area greatly lowered in the step of hydrophobic treatment. Such fine powder having consequently come to have a BET specific surface area smaller than 100 $m^2/g$ may cause a problem. What corresponds thereto is a case in which the inorganic fine powder has unwantedly reacted with the treating agent as it stands agglomerated without being uniformly dispersed in the solution, or a case in which the treating agent itself has undergone self-condensation to adhere to the particle surfaces of inorganic fine powder or particle surfaces of agglomerated inorganic fine powder partly in an oily state. This makes it difficult to obtain the intended uniformly surface-treated fine powder.

As the carrier used in each two-development developer according to the present invention, it may include magnetic particles selected from the group consisting of, e.g., particles of magnetic metals such as iron, nickel, copper, zinc, cobalt, manganese, chromium and rare earth elements, which may be surface-oxidized or unoxidized, magnetic alloys of any of these, magnetic oxides of these and magnetic ferrites of these.

A binder-type carrier may also be used in which a magnetic powder has been dispersed in a resin.

As the carrier, it is preferable to use a coated carrier comprising as carrier cores the above magnetic particles whose surfaces have been coated with a coating material. In such a coated carrier, as methods for coating the carrier core surfaces with a coating material, usable are a method in which the coating material is dissolved or suspended in a solvent, followed by coating to make it adhere to the carrier cores, and a method in which the both are merely blended in the state of powder.

The coating material for carrier cores may include polytetrafluoroethylene, monochlorotrifluoroethylene polymer, polyvinylidene fluoride, silicone resins, polyester resins, styrene resins, acrylic resins, polyamides, polyvinyl butyral and aminoacrylate resins. Any of these may suitably be used alone or in combination.

The treatment with the above material may be made in an amount determined appropriately, and of preferably from 0.1 to 30% by weight, and more preferably from 0.5 to 20% by weight, based on the weight of the resin-coated carrier.

The carrier used in the present invention may preferably have a 50% average particle diameter of from 10 to 80 $\mu$m, and more preferably from 20 to 70 $\mu$m.

If the carrier has a 50% average particle diameter smaller than 10 $\mu$m, the two-component developer may strongly be packed to have a low blendability of toner with carrier, so that the blendability of toner with carrier may be lower, the charging performance of the toner may be made stable with difficulty and also the carrier tends to adhere to the photosensitive drum surface.

If the carrier has a 50% average particle diameter larger than 80 $\mu$m, the carrier may have fewer opportunities of contact with the toner, and hence a toner having a low charge quantity may become present together to tend to cause fog. Also, since the toner tends to scatter, it is necessary to set toner concentration a little lower in the two-component developer, making it impossible to form images in a high image density in some cases.

A particularly preferred carrier is a magnetic coated carrier comprising magnetic core particles such as magnetic ferrite core particles whose surfaces have been coated with a resin such as a silicone resin, a fluorine resin, a styrene resin, an acrylic resin or a methacrylic resin preferably in an amount of from 0.01 to 5% by weight, and more preferably from 0.1 to 1% by weight, and whose particle size distribution has been so regulated as to contain at least 70% by weight of carrier particles of 250 mesh-pass and 400 mesh-on and also have the above 50% average particle diameter.

Where the above magnetic coated carrier has a sharp particle size distribution, it has a triboelectric chargeability preferable for the toners and also has the effect of improving electrophotographic performance.

When each toner and the carrier are blended to prepare the two-component developer, good results are obtainable where they are blended in such a proportion that the toner in the developer is in a concentration of from 2% by weight to 15% by weight, preferably from 3% by weight to 13% by weight, and more preferably from 4% by weight to 10% by weight.

If the toner is in a concentration lower than 2% by weight, a low image density tends to result. If it is in a concentration higher than 15% by weight, fog and in-machine toner scatter tend to occur, tending to make the developer have a short lifetime (B) In second invention, the toners (the yellow toner, the magenta toner, the cyan toner and the black toner) are positively chargeable non-magnetic toners, and are used as two-component developers together with magnetic carriers.

In the positively chargeable non-magnetic toners used in the second invention, the colorants for respective colors as described above, having the same coloring powers as the negatively chargeable nonmagnetic toners in the first invention, are used.

The toners in the present invention (second invention) may each optionally be incorporated with a positive charge control agent, and, as the positive charge control agent, may each preferably contain at least one selected from the group consisting of a quaternary ammonium salt, an imidazole compound, an ammonio-group-containing styrene-acrylic copolymer and a phosphonium compound.

In particular, as those for color toners, a quaternary ammonium salt and an imidazole compound, which are white-color charge control agents, may preferably be used.

The quaternary ammonium salt incorporated in the non-magnetic toners according to the present invention is represented by the following Formula (III).

(III)

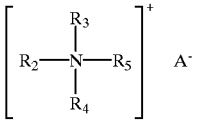

wherein $R_2$ to $R_5$ each independently represent a hydrogen atom, an alkyl group, an alkenyl group, an unsubstituted aromatic group or a substituted aromatic group; and $A^-$ represents a counter anion.

Of the groups represented by $R_2$ to $R_5$, at least one group may preferably be an alkyl group or alkenyl group having 6 or more, preferably 10 or more and particularly 12 or more carbon atoms, an unsubstituted aromatic group or a substituted aromatic group.

The counter anion represented by $A^-$ may include halogen ions such as $Cl^-$, $Br^-$ and $I^-$; halogen oxide ions such as $ClO^{-3}$, $ClO^{-4}$, $IO^{-3}$ and $IO^{-4}$: an ion represented by the following Formula (IV):

(IV)

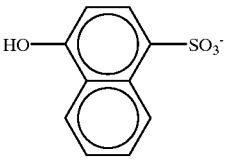

sulfonate ions such as $CH_3SO_3$-; sulfate ions: ions such as $BF_4^-$ and $PF_6^-$; molybdate ions or tungstate ions such as $Mo_7O_{24}^{6-}$, $H_2W_{12}O_{42}^{10-}$ and $PO4W_{12}O_{40}^{-3}$; and heteropolyacid ions containing a molybdenum atom or a tungsten atom.

The quaternary ammonium salt used in the present invention may be exemplified by the following.

VP2036 (melting point: 200° C.) and VP2038 (melting point; 215° C.), available from Hoechst Japan Ltd.; TP302 (melting point: 215° C.), TP415 (melting point: 204° C.) and TP4040 (melting point: 209° C.), available from Hodogaya Chemical Co., Ltd., and A-902 (melting point: 210° C.), available from Nippon Kaaritto K.K.

Meanwhile, in charge control resins, functional groups capable of imparting positive chargeability to the toners may include various groups, and may preferably include tri-substituted ammonio groups. In particular, a trialkylammonio group represented by the following Formula (V) is more preferred because of its superior function to impart the positive chargeability.

(V)

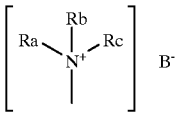

wherein Ra, Rb and Rc may be the same or different and each represent an alkyl group such as a methyl group, an ethyl group, a normal-propyl group, an isopropyl group, a normal-butyl group, an iobutyl group, a tertiary-butyl group, a pentyl group or a hexyl group; $B^-$ represents a molybdate ion, a phosphorusmolybdate ion, a chromemolybdate ion, a phosphorustungstate ion, a silicotungstate ion, an antimonate ion, a bismuthate ion, a chlorine ion, a bromine ion, an iodine ion, an nitrate ion, a sulfate ion, a perchlorate ion, a periodate ion, a benzoate ion, a naphtholsulfonate ion, a benzenesulfonate ion, a toluenesulfonate ion, a xylenesulfonate ion, a tetraphenylboron ion, a tetrafluoroboron ion, a tetrafluorophosphorus ion or a hexafluorophosphorus ion.

As backbone chains of the charge control resin, various polymeric backbone chains may be used. Since, however, the compatibility with the polyester resin which is a resin for fixing is especially important in view of the transparency and positive chargeability of toners, it is preferable to use polymeric backbone chains having a good compatibility with the polyester resin. Such polymeric backbone chains may include, e.g., styrene-acrylic copolymer resins such as a styrene-acrylate copolymer and a styrene-methacrylate copolymer. In the case when the styrene-acrylic copolymer resins are used as the backbone chains, the above functional groups may preferably be substituted at acrylic ester moieties.

Besides, as the positive charge control agent used in the present invention, an imidazole derivative represented by the following Formula (VI) may preferably be used.

(VI)

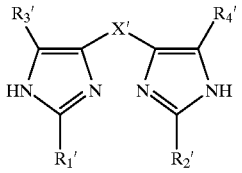

wherein $R_1'$ to $R_4'$ each represent a substituent selected from the group consisting of a hydrogen atom, an alkyl group, an aralkyl group and an aryl group, and these may be the same or different from one another and also may be substituted: X' represents a linkage group selected from the group consisting of a phenylene group, a propenylene group, a vinylene group, an alkylene group and —$C(R_5')R_6'$—, where $R_5'$ and $R_6'$ each represent a substituent selected from the group consisting of a hydrogen atom, an alkyl group, an aralkyl group and an aryl group.

The substituents in the case when the substituents of the groups represented by $R_1'$ to $R_4'$ are further substituted may each include, e.g., an amino group, a hydroxyl group, an alkyl group, an alkoxyl group and a halogen atom.

The groups represented by $R_1'$ to $R_4'$ may specifically include a hydrogen atom, a methyl group, an ethyl group, an propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icocyl group, a henicocyl group, a dococyl group, a tricocyl group, a tetracocyl group, a pentacocyl group, an i-propyl group, an i-butyl group, a t-butyl group, a cyclopentyl group, a cyclohexyl group, a benzyl group, a phenethyl group, a diphenylmethyl group, a trityl group, a cumyl group, a phenyl group, a tolyl group, a xylyl group, a mesityl group, a naphthyl group and an anthryl group.

In the groups represented by $R_1'$ to $R_4'$, the alkyl group may also be one having 1 to 25 carbon atoms; the aralkyl group, 7 to 20 carbon atoms; and the aryl groups, 6 to 20 carbon atoms.

In the groups represented by $R_5'$ and $R_6$, the alkyl group may be one having 1 to 20 carbon atoms; the aralkyl group, 7 to 15 carbon atoms; and the aryl groups, 6 to 15 carbon atoms.

The imidazole derivative represented by the above Formula (VI) may particularly preferably be an imidazole derivative represented by the following Formula (VII) or (VIII).

(VII)

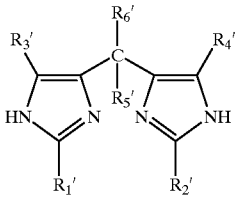

wherein $R_1'$ and $R_2'$ each represent a substituent selected from the group consisting of an alkyl group having 5 to 20 carbon atoms, an aralkyl group having 7 to 20 carbon atoms and an aryl group having 6 to 20 carbon atoms, and these may be the same or different from each other and also may be substituted. The substituents in the case when these are substituted may each include, e.g., an amino group, a hydroxyl group, an alkyl group, an alkoxyl group and a halogen atom.

$R_3'$ to $R_6'$ each represent a substituent selected from the group consisting of a hydrogen atom, an alkyl group, an aralkyl group and an aryl group, and these may be the same or different from one another and also may be substituted. The substituents in the case when these are substituted may each include, e.g., an amino group, a hydroxyl group, an alkyl group, an alkoxyl group and a halogen atom.

In the groups represented by $R_3'$ to $R_6'$ the alkyl group may be one having 1 to 6 carbon atoms; the aralkyl group, 7 to 15 carbon atoms; and the aryl groups, 6 to 15 carbon atoms.

(VIII)

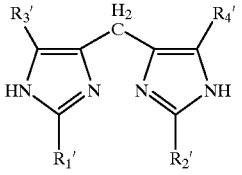

wherein $R_1'$ and $R_2'$ each represent a substituent selected from the group consisting of an alkyl group having 5 to 20 carbon atoms, an aralkyl group having 7 to 20 carbon atoms and an aryl group having 6 to 20 carbon atoms, and these may be the same or different from each other and also may be substituted. The substituents in the case when these are substituted may each include, e.g., an amino group, a hydroxyl group, an alkyl group, an alkoxyl group and a halogen atom.

$R_3'$ and $R_4'$ each represent a substituent selected from the group consisting of a hydrogen atom, an alkyl group, an aralkyl group and an aryl group, and these may be the same or different from one another and also may be substituted. The substituents in the case when these are substituted may each include, e.g., an amino group, a hydroxyl group, an alkyl group, an alkoxyl group and a halogen atom.

In the groups represented by $R_3'$ and $R_4'$, the alkyl group may be one having 1 to 6 carbon atoms; the aralkyl group, 7 to 15 carbon atoms; and the aryl groups, 6 to 15 carbon atoms.

The imidazole derivative represented by the above Formula (VII) has a superior dispersibility in the binder resin. Also, the imidazole derivative represented by the above Formula (VIII) has a good dispersibility and also has a superior adherence to the binder resin, and hence any sleeve contamination due to separation of the imidazole derivative from toner particles can be kept from occurring.

In the above Formulas (VII) and (VIII), if the alkyl group represented by $R_1'$ and $R_2'$ has carbon atoms less than 5, the compound may have a low positive chargeability, and may require its addition in a larger quantity in order to bring out the effect as a positive charge control agent. If on the other hand the alkyl group, aralkyl group and aryl group have carbon atoms more than 20, the imidazole derivative itself may have a low melting point, and hence the imidazole derivative may have a low melt viscosity in the step of melt kneading when toners are produced, and may be difficult to disperse uniformly in the binder resin. This tends to cause deterioration of image characteristics because of such poor dispersion, and hence the binder resin may be restricted in some cases.

In the present invention, the imidazole derivative may be added in an amount of from 0.01 to 20.0 parts by weight, preferably from 0.1 to 10.0 parts by weight, and more preferably from 0.5 to 5.0 parts by weight, based on 100 parts by weight of the binder resin. If it is added in an amount less than 0.01 part by weight, the toners may have no sufficient charge quantity, and any effect of adding the imidazole derivative may come out. On the other hand its addition in an amount more than 20.0 parts by weight is not preferable because its addition is in excess to cause poor dispersion in toners to become present as agglomerates or the imidazole derivative may be present in a non-uniform quantity per each toner particle.

When the imidazole derivative is used in the present invention, it may be used in combination with a conventional positive charge control agent.

The imidazole derivative used in the present invention is synthesized in the following way.

Using ethanol as a solvent, a solution prepared by adding aldehyde and a solvent potassium hydroxide to an imidazole derivative represented by the following Formula (D) is refluxed for few hours. What has been precipitated by refluxing is filtered and washed with water, followed by re-crystallization using methanol again.

(D)

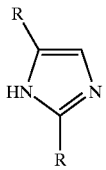

wherein R represents a substituent selected from the group consisting of a hydrogen atom, an alkyl group, an aralkyl group and an aryl group, and these may be the same or different from one another.

This synthesis method by no means limits the imidazole derivative used in the present invention.

Exemplary compounds [structural formulas (1) to (32)] are shown below. These are typical examples given taking account of readiness to handle, too, and likewise by no means limit the toners according to the present invention.

(1)
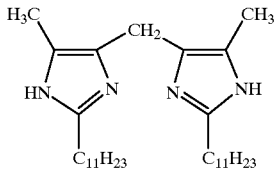
(2)
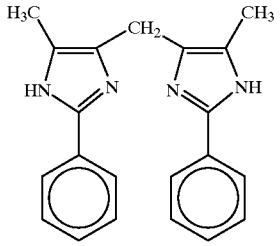
(3)
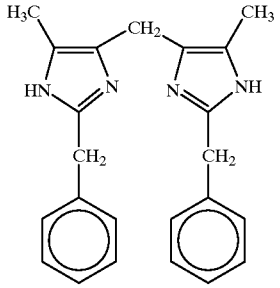
(4)
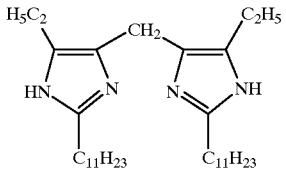
(5)
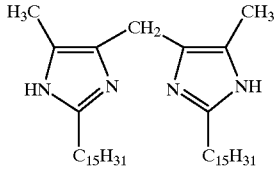
(6)
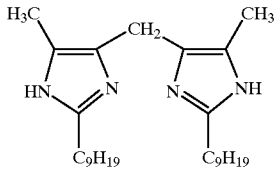
(7)
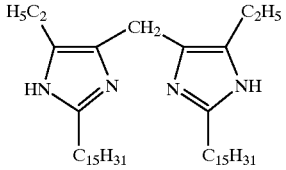
-continued
(8)
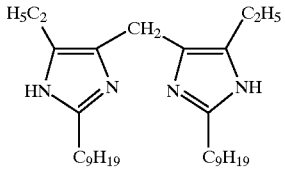
(9)
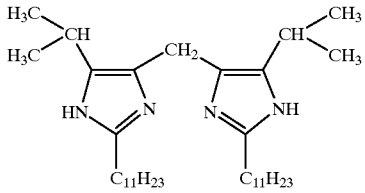
(10)
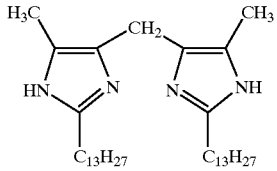
(11)
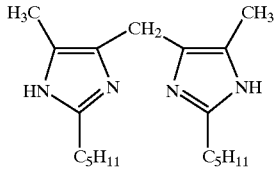
(12)
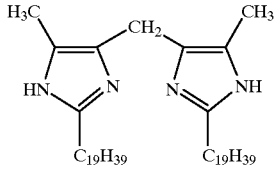
(13)
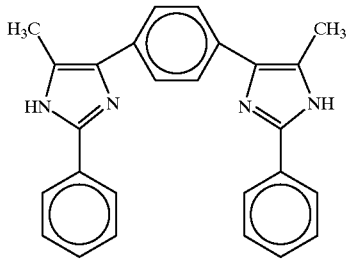
(14)
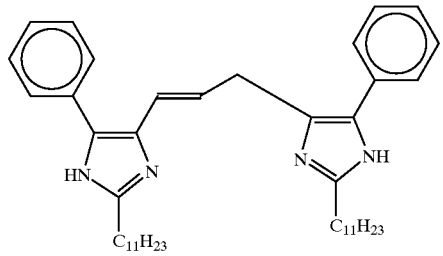

(15)
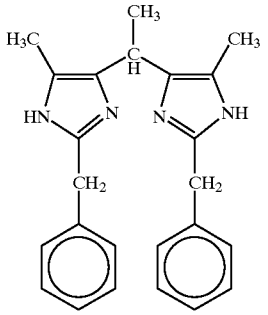
(16)
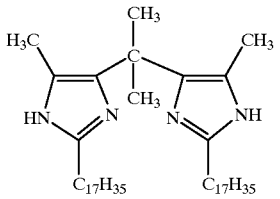
(17)
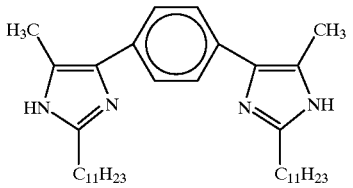
(18)
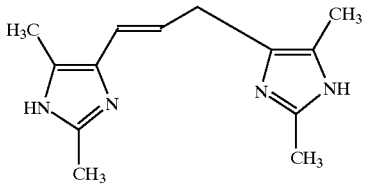
(19)
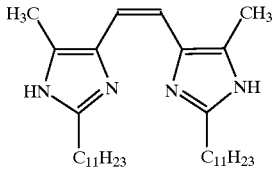
(20)
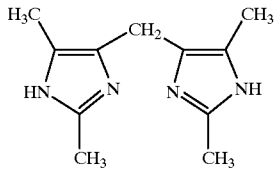
(21)
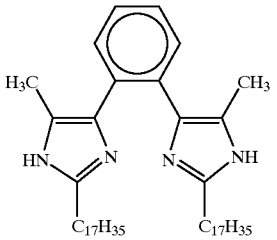
(22)
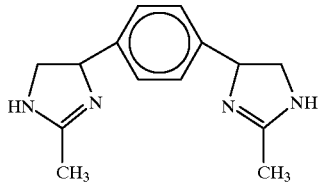
(23)
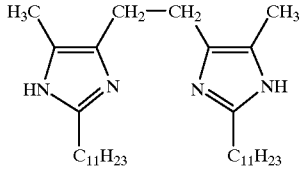
(24)
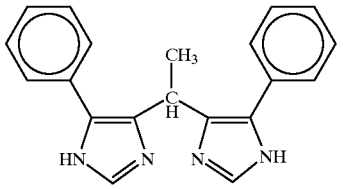
(25)
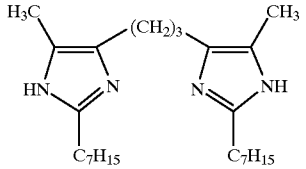
(26)
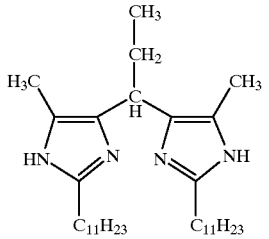

-continued (27)

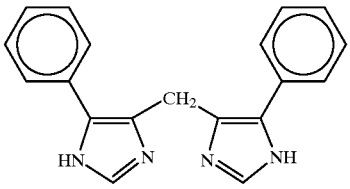

Some of compounds shown below have different or identical substituents on the right and left sides of the imidazole, and may be mixtures of any of these.

(28)

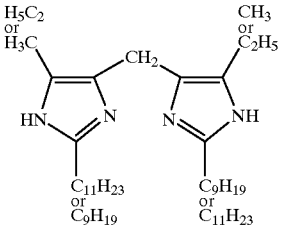

(29)

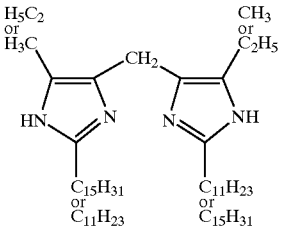

(30)

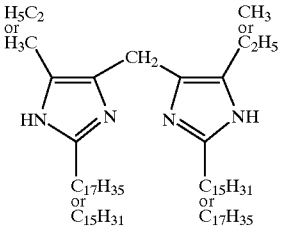

(31)

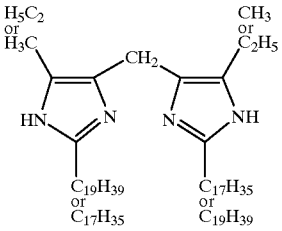

-continued (32)

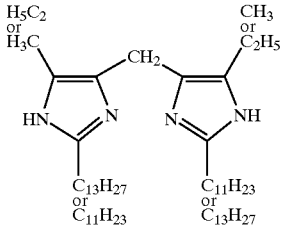

As the positive charge control agent used in the present invention, a phosphonium compound represented by the following Formula (IX) may also preferably be used.

(IX)

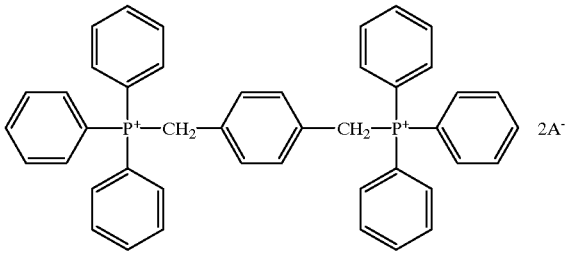

This positive charge control agent may be contained in each toner in an amount of from 0.5 to 10 parts by weight, and preferably from 1 to 8 parts by weight, based on 100 parts by weight of the binder resin. The addition of this positive charge control agent in the amount of from 0.5 to 10 parts by weight is preferable because the colorant can finely and uniformly be dispersed in the binder resin and also the triboelectric charge quantity of the toner can be regulated within a preferable range. If the positive charge control agent is added in an amount less than 0.5 part by weight, it may be less effective for its positive charge control of the positively chargeable toners. If it is added in an amount more than 10 parts by weight, the toners tend to cause charge-up.

The positively chargeable toners in the present invention may each optionally be incorporated with a fatty metal salt (e.g., zinc stearate or aluminum stearate) or a fine fluorine-containing polymer powder (e.g., fine powder of polytetrafluoroethylene, polyvinylidene fluoride or a tetrafluoroethylene-vinylidene fluoride copolymer), serving as a lubricant, or a conductivity-providing agent such as tin oxide or zinc oxide.

In the present invention, the toners may each further contain a release agent. The release agent may include, e.g., aliphatic hydrocarbon waxes, oxides of aliphatic hydrocarbon waxes, ester waxes, waxes composed chiefly of fatty esters, saturated straight-chain fatty acids, unsaturated fatty acids, saturated alcohols, polyhydric alcohols, fatty amides, saturated fatty bisamides, unsaturated fatty amides and aromatic bisamides.

In the toners, the release agent may preferably be in a content of from 0.1 to 20 parts by weight, and more preferably from 0.5 to 10 parts by weight, based on 100 parts by weight of the binder resin. If the releasing agent is in a content more than 20 parts by weight, anti-blocking properties and high-temperature anti-offset properties tend to lower. If it is in a content less than 0.1 part by weight, it has less release effect.

Usually, any of these release agents may preferably be incorporated in the binder resin by a method in which the binder resin is dissolved in a solvent, the resultant resin solution is heated and then the release agent is added and mixed with stirring, or a method in which the release agent is added at the time of the kneading of toner component materials containing at least the binder resin and the colorant.

For the production of the toners, usable are a method in which toner component materials are well kneaded by means of a heat kneading machine such as a heat roll, a kneader or an extruder, followed by mechanical pulverization, and the resultant pulverized powder is classified to obtain toners, or a method in which in a binder resin solution other toner component materials such as colorants are dispersed, followed by spray drying to obtain toners.

In the present invention, the positively chargeable toners may each have a weight-average particle diameter (D4) of from 4.0 to 10.0 μm, and preferably from 5.0 to 9.0 μm. If the toner has a weight-average particle diameter (D4) smaller than 4.0 μm, the charge can be made stable with difficulty tending to cause fog and toner scatter during running. If the toner has a weight-average particle diameter (D4) larger than 10.0 μm, the toner may have a very low image reproducibility at halftone areas, and, as the resultant images, coarse images may be formed.

In the positively chargeable toners in the present invention, an inorganic fine powder such as fluidity improver may preferably be added as an external additive in order to improve the fluidity of toners. As the fluidity improver, any materials are usable as long as a fluidity can be seen to have been improved, when compared with that before and after its addition. Such a fluidity improver may include, e.g., fine metal oxide powders such as fine silica powder, fine alumina powder, fine titanium oxide powder, fine zirconium oxide powder, fine magnesium oxide powder and fine zinc oxide powder: fine nitride powders such as fine boron nitride powder, fine aluminum nitride powder and fine carbon nitride powder; and also fine powders of calcium titanate, strontium titanate, barium titanate and magnesium titanate.

The external additive may usually be used in an amount of from 0.1 to 5 parts by weight based on 100 parts by weight of the toner particles.

In the present invention, it is especially preferable to use an inorganic fine powder having a number-average primary particle diameter of from 0.001 to 0.2 μm and having been hydrophobic-treated.

In the above additive, it is important factors not only to improve the fluidity of toners but also not to inhibit the charging performance of toners. Accordingly, in the toners according to the present invention, it is preferable for particle surfaces of the additive to have been hydrophobic-treated. This enables simultaneous satisfaction for the providing of fluidity and the stabilization of charging. More specifically, having been hydrophobic-treated makes it possible to remove any influence of water content which is a factor that influences the charge quantity, and to lessen any gap in charge quantity between a high-humidity environment and a low-humidity environment, bringing about an improvement in environmental properties. Also, the addition of hydrophobic treatment in the course of production steps makes it possible to prevent the primary particles from agglomerating. Thus, these make it possible for the toners to be uniformly charged.

In the present invention, fine titanium oxide powder or fine alumina powder having a number-average primary particle diameter of from 0.001 to 0.2 μm is particularly preferred because a good fluidity can be provided, the positively chargeable toners can be charged uniformly and consequently the toner scatter and fog may hardly occur. Moreover, such fine powder can be made to hardly become buried in toner particle surfaces, so that the toners may deteriorate with difficulty and can be improved in many-sheet running performance. This tendency is more remarkable in toners having sharp-melt properties.

The fine titanium oxide powder or fine alumina powder used in the present invention may further preferably have a number-average particle diameter of from 0.001 to 0.2 μm, and more preferably from 0.005 to 0.1 μm, in view of fluidity-providing performance.

If it has a number-average particle diameter larger than 0.2 μm, the toners may have a low fluidity. If it is smaller than 0.001 μm, the treated fine titanium oxide powder or treated fine alumina powder tend to be buried in toner particle surfaces, so that the toners tends to have a low running performance. This tendency is more remarkable when used in color toners having sharp-melt properties.

In addition, if it has a number-average particle diameter smaller than 0.001 μm, the inorganic fine powder itself may inevitably have so high a reactivity that particles tend to coalesce one another, making it difficult to attain the intended high fluidity.

The average particle diameter of the inorganic fine powder may be measured with a transmission electron microscope.

As hydrophobic-treating agents used in the present invention, they may appropriately be selected in accordance with the purposes of surface modification, e.g., the controlling of charging performance and also the stabilization of charge in a high-humidity environment and the reactivity. In particular, an inorganic fine powder having been surface-treated with a silane coupling agent, titanium coupling agent or silicone oil having a substituent containing a nitrogen atom in the side chain is preferred in view of positive chargeability.

As the coupling agent having a substituent containing a nitrogen atom in the side chain, any of conventionally known agents may be used. In particular, the silane coupling agent and titanium coupling agent are preferred.

The silane coupling agent and titanium coupling agent commonly have a structure represented by R'mSi—Zn or R'mTi—Zn. respectively (wherein R' is an alkoxyl group or a halogen atom, Z is a group having an amino group, and m and n are each an integer of 1 to 3, provided that m+n=4).

The substituent containing a nitrogen atom may preferably be an amino group. The amino group may be any of amino groups of primary amines, secondary amines, tertiary amines and quaternary amines. For example, it may include the following.

$—NH_2$ $—NH—CH_3$, $—NH—C_2H_5$, $—NH—C_3H_7$ $—N(CH_3)_2$ $—N(C_2H_5)_2$, $—NH—C_2H—NH_2$ $—N(C_3H_6)_2$, $—NH—C_2H_4—NH(CH_3)_2$ $—N(C_4H_9)_2$ $—N(CH_3)_3{+}Cl^-$, $—N(CH_3)_3{+}.HCO_3^-$ $—N(C_2H_5)_3{+}Cl^-$, $—N(C_2H_5)_3{+}.HCO_{3-}$ $—N(C_3H_7)_3{+}Cl^-$ $—N(C_4H_9)_3{+}Cl^-$

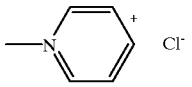

Also preferably usable is an inorganic fine powder on and to the particle surfaces of which a coupling agent, silicone oil or hexamethyldisilazane not having any substituent containing a nitrogen atom in the side chain has reacted, adsorbed and adhered together with any of the above coupling agents having the substituent containing a nitrogen atom in the side chain.

These particles may preferably be those having a specific surface area of from 0.1 to 500 $m^2/g$, more preferably from 0.5 to 450 $m^2/g$, and still more preferably from 1 to 400 $m^2/g$.

In the present invention, as a method for hydrophobic-treating the fine silica powder, fine titanium oxide powder or fine alumina powder, it is effective to use a method in which the fine powder is mechanically dispersed in a solution so as to have primary particle diameter, during which the coupling agent is hydrolyzed to make treatment, but the method is by no means limited to this. The powder may also be treated by a gaseous-phase process.

In the present invention, in the case when such treated fine silica powder, treated fine titanium oxide powder or treated fine alumina powder is used as the inorganic fine powder the present invention, it may be in a content of from 0.2 to 5 parts by weight, preferably from 0.3 to 3 parts by weight, and more preferably from 0.5 to 2.5 parts by weight, based on 100 parts by weight of the toner particles.

If it is less than 0.2 part by weight, the toners may have a low fluidity. If on the other hand it is more than 5 parts by weight, it tends to come off from the toner particles. Any treated fine powder thus having come off tends to contaminate particle surfaces of the carrier of the two-component developer and the machine interior to cause a lowering of charge-providing ability of the carrier itself undesirably. Also, the treated fine powder having come off tends to fly onto the photosensitive member surface at the time of development to also tend to cause faulty cleaning. Still also, when used as the color toners, inclusion of such treated fine powder in a large quantity may cause a darkness in projected images of OHP making it impossible to obtain sharp images.

In the present invention, the hydrophobic-treated fine silica powder, hydrophobic-treated fine titanium oxide powder or hydrophobic-treated fine alumina powder may further preferably have a BET specific surface area of 100 $m^2/g$ or larger, and preferably 130 $m^2/g$ or larger.

If it has a BET specific surface area smaller than 100 $m^2/g$, the intended high fluidity may be attained with difficulty. Also, though the untreated fine powder had showed the BET specific surface area at a very high value before the treatment, it may have a BET specific surface area greatly lowered in the step of hydrophobic treatment. Such fine powder having consequently come to have a BET specific surface area smaller than 100 $m^2/g$ may cause a problem. What corresponds thereto is a case in which the inorganic fine powder has unwantedly reacted with the treating agent as it stands agglomerated without being uniformly dispersed in the solution, or a case in which the treating agent itself has undergone self-condensation to adhere to the particle surfaces of inorganic fine powder or particle surfaces of agglomerated inorganic fine powder partly in an oily state. This makes it difficult to obtain the intended uniformly surface-treated fine powder.

As the magnetic carrier used in each two-development developer according to the present invention, it may include, e.g., particles of iron, nickel, copper, zinc, cobalt, manganese, chromium and rare earth elements, which may be surface-oxidized or unoxidized, and magnetic alloys, magnetic oxides and magnetic ferrites of any of these. Further, a binder-type carrier having magentic power dispersed in a resin may also be used.

In the present invention, it is preferable to use a coated carrier comprising as carrier cores the above magnetic particles whose surfaces have been coated with a coating material.

In such a coated carrier, as methods for coating the carrier core surfaces with a coating material, usable are a method in which the coating material is dissolved or suspended in a solvent, followed by coating to make it adhere to the carrier cores, and a method in which both are merely blended in the state of powder.

The coating material for carrier cores may include polytetrafluoroethylene, monochlorotrifluoroethylene polymer, polyvinylidene fluoride, silicone resins, polyester resins, styrene resins, acrylic resins, polyamides, polyvinyl butyral and aminoacrylate resins. Any of these may suitably be used alone or in combination.

The treatment with the above material may be made in an amount determined appropriately, and of preferably from 0.1 to 30% by weight, and more preferably from 0.5 to 20% by weight, based on the weight of the resin-coated carrier.

In order to stabilize the positive chargeability of the toners, it is more preferable to also disperse a negatively chargeable additive in the carrier's coating material. It is also effective to use as the coating material a resin containing a negatively chargeable substituent such as fluorine or to disperse it in the coating material.

Such a negatively chargeable substituent may include negative charge control agents, e.g. aluminum di-tert-butylsalicylic acid compounds, chromium di-tert-butylsalicylic acid compounds and azo iron metal complexes, any of which may be used. The resin containing a fluorine-containing substituent may include fluorine-modified acrylics, polytetrafluoroethylene, polyvinylidene fluoride or copolymers of any of these.

The carrier used in the present invention may preferably have a 50% volume-average particle diameter of from 10 to 80 $\mu$m, and more preferably from 20 to 70 $\mu$m.

If the carrier has a 50% volume-average particle diameter smaller than 10 $\mu$m, the two-component developer may strongly be packed to have a low blendability of toner with carrier, so that the blendability of toner with carrier may lower, the charging performance of the toner may be made stable with difficulty and also the carrier tends to adhere to the photosensitive drum surface. It the carrier has a 50% volume-average particle diameter larger than 80 $\mu$m, the carrier may have less opportunities of contact with the toner, and hence a toner having a low charge quantity may become present together to tend to cause fog. Also, since the toner tends to scatter, it is necessary to set toner concentration a little lower in the two-component developer, making it impossible to form images in a high image density in some cases.

A particularly preferred carrier is a magnetic coated carrier comprising magnetic core particles such as magnetic ferrite core particles whose surfaces have been coated with a coating material resin such as a silicone resin, a fluorine resin, a styrene resin, an acrylic resin or a methacrylic resin preferably in an amount of from 0.01 to 5% by weight, and more preferably from 0.1 to 1% by weight, based on the weight of the carrier cores, and whose particle size distribution has been so regulated as to contain at least 70% by weight of carrier particles of 250 mesh-pass and 400 mesh-on and also have the above 50% volume-average particle diameter.

As a method for regulating the magnetic carrier so as to have the above 50% volume-average particle diameter and specific particle size distribution, for example a sieve may be used to make classification. In order to make the classification especially precise, carrier particles may preferably be sieved several times repeatedly, using a sieve having a suitable mesh size. It is also an effective means to use a sieve whose mesh opening shape has been controlled by plating or the like.

When each toner and the carrier are blended to prepare the two-component developer, good results are obtainable where they are blended in such a proportion that the toner in the developer is in a concentration of from 2% by weight to 15% by weight, preferably from 3% by weight to 13% by weight, and more preferably from 4% by weight to 10% by weight.

If the toner is in a concentration lower than 2% by weight, a low image density tends to result. If it is in a concentration higher than 15% by weight, fog and in-machine toner scatter tend to occur, tending to make the developer have a short lifetime.

(C) Usable as a negatively chargeable non-magnetic toner (or non-magnetic toner having negative chargeability) to be used for a monocomponent developer in the third invention is the negatively chargeable non-magnetic toner described in the first invention.

(D) Usable as a positively chargeable non-magnetic toner (or non-magnetic toner having positive chargeability) to be used for a monocomponent developer in the fourth invention is the positively chargeable non-magnetic toner described in the second invention.

Hereinafter preferred embodiments of the first and the second inventions are exemplified and described in detail with reference to the drawings. However, the description is not at all meant for any restriction of the sizes, the materials, the shapes, and the relative arrangement of constituent parts described in the preferred embodiments on the ranges of the present invention unless there are any specified description of them.

Further, in the following figures, the same reference numerals are assigned to the same members as those described in the figures employed for the description of the foregoing conventional technique and those described in the figures described before.

Embodiment of image formation apparatus

An image formation apparatus of the present invention will be described using figures. The description of one embodiment of an image formation apparatus according to the present invention to be described below is meant for one embodiment of an image formation method according to the present invention. FIG. 1 is a schematic diagram of an electrophotographic full-color apparatus of one embodiment of an image formation apparatus with which the present invention is actualized.

In FIG. 1, the A, B, C, and D stations form Yellow, Magenta, Cyan, and Black images, respectively, of a full-color image, however, the order of the color stations is not significant. In the following description, for example, the term, primary chargers 21, denotes the primary chargers 21A, 21B, 21C, and 21D in the respective A, B, C, and D stations.

In the respective stations, image formation is carried out as follows. A photosensitive drum 4 is installed in a rotatable manner and the photosensitive drum 4 is evenly charged by the primary chargers 21 as charging means, which are constituent elements of the present invention and then the information signals are exposed by, for example, light emitting devices 22 such as a laser as exposure means, which are constituent elements of the present invention, to form an electrostatic latent image and the electrostatic latent image is developed by a development apparatus 9 to form a toner image and visualize the image.

Next, the toner image is transferred to a transfer paper sheet 24 fed by a transfer sheet feeding seat 27 using a transfer charger 23 with or without using an intermediate transfer material.

At each station, a Yellow toner image, a Magenta toner image, a Cyan toner image, and a Black toner image are successively superposed and transferred onto the transfer paper sheet 24.

The resulting transfer paper sheet 24 on which these four color toner images are superposed is subjected to the color fixing and fixing process by heat and pressure with a fixation apparatus 25 as heating and pressurizing fixation means and then discharged as a full-color image-bearing sheet.

The un-transferred remaining toner on the photosensitive drum 4 is removed by a cleaning apparatus 26.

Further, as the photosensitive drum 4, for example, the foregoing drum described in FIG. 3 can be used.

Figure 2:
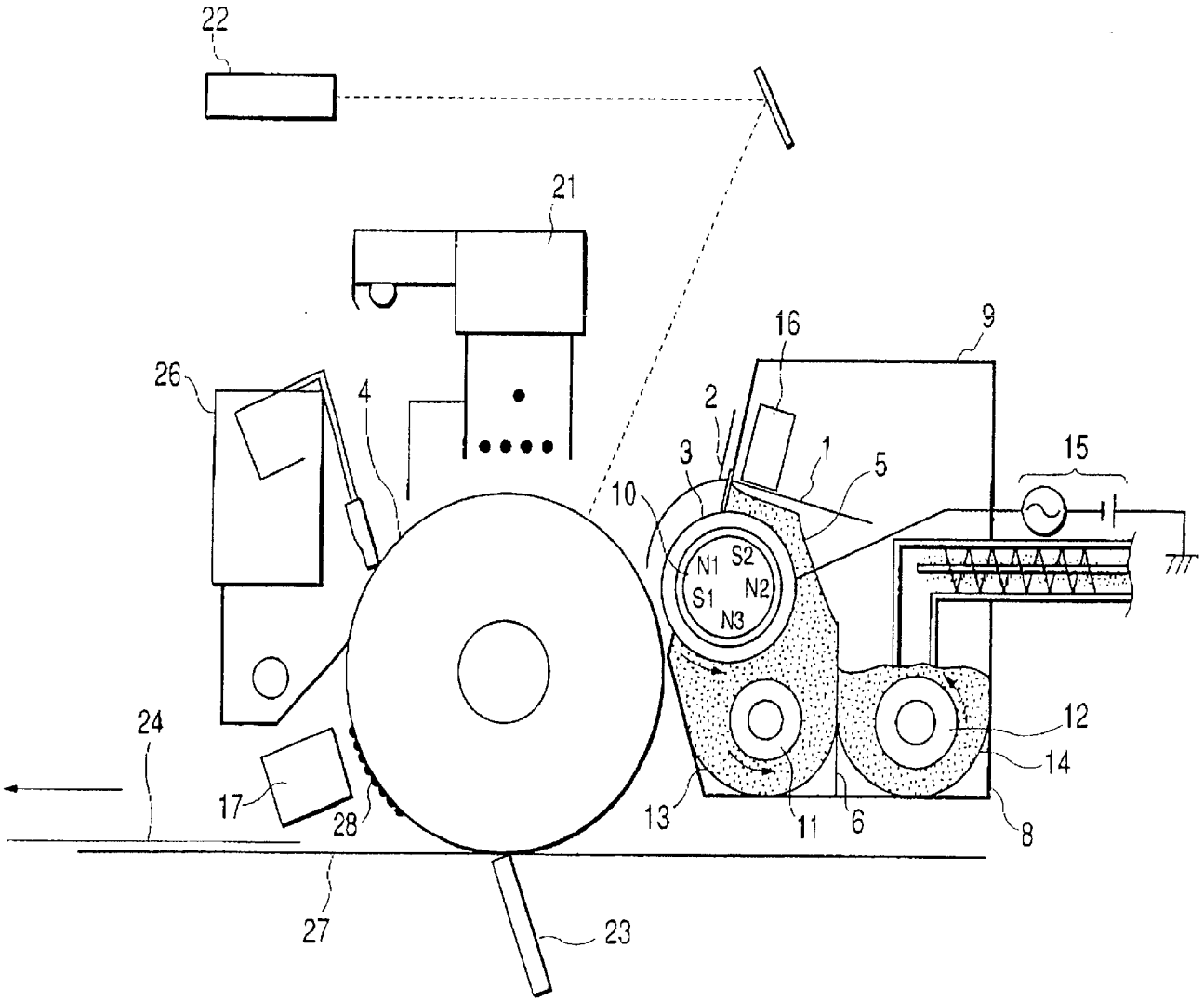
FIG. 2 schematically illustrates the construction of a developing assembly 9 making use of a two-component developer, which is used in the image-forming apparatus shown in FIG. 1.
Figure 3A:
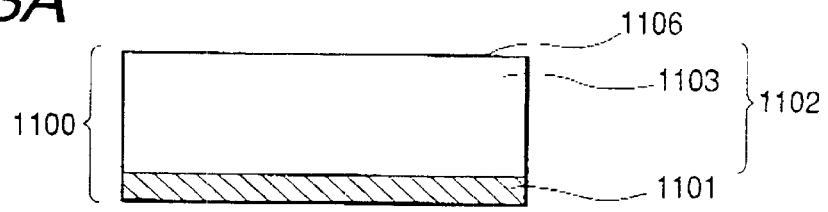
FIGS. 3A, 3E, 3C and 3D diagrammatically illustrate the layer construction of photosensitive members used in image-forming apparatus of the present invention and in conventional image-forming apparatus.
Figure 3B:
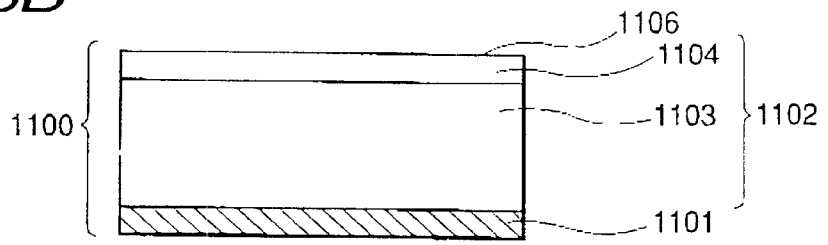
Figure 3C:
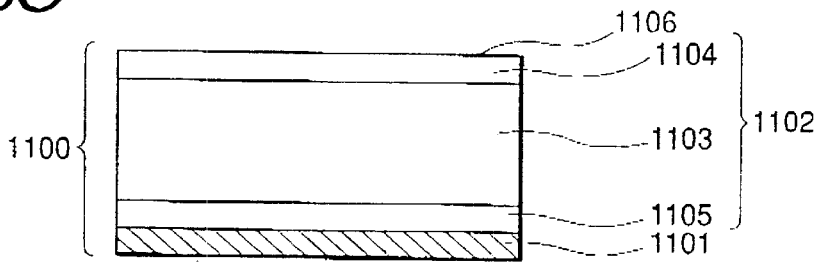
Figure 3D:
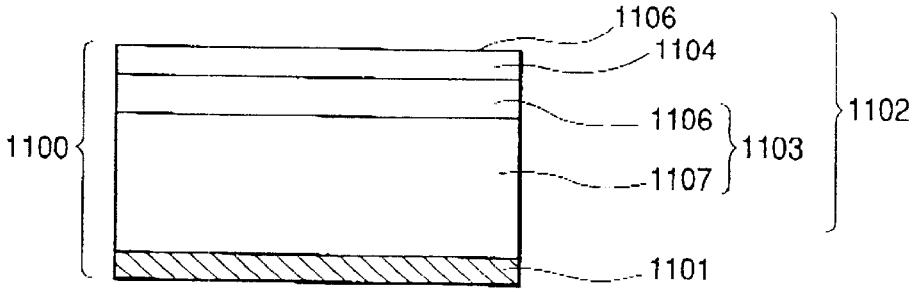
Figure 4:
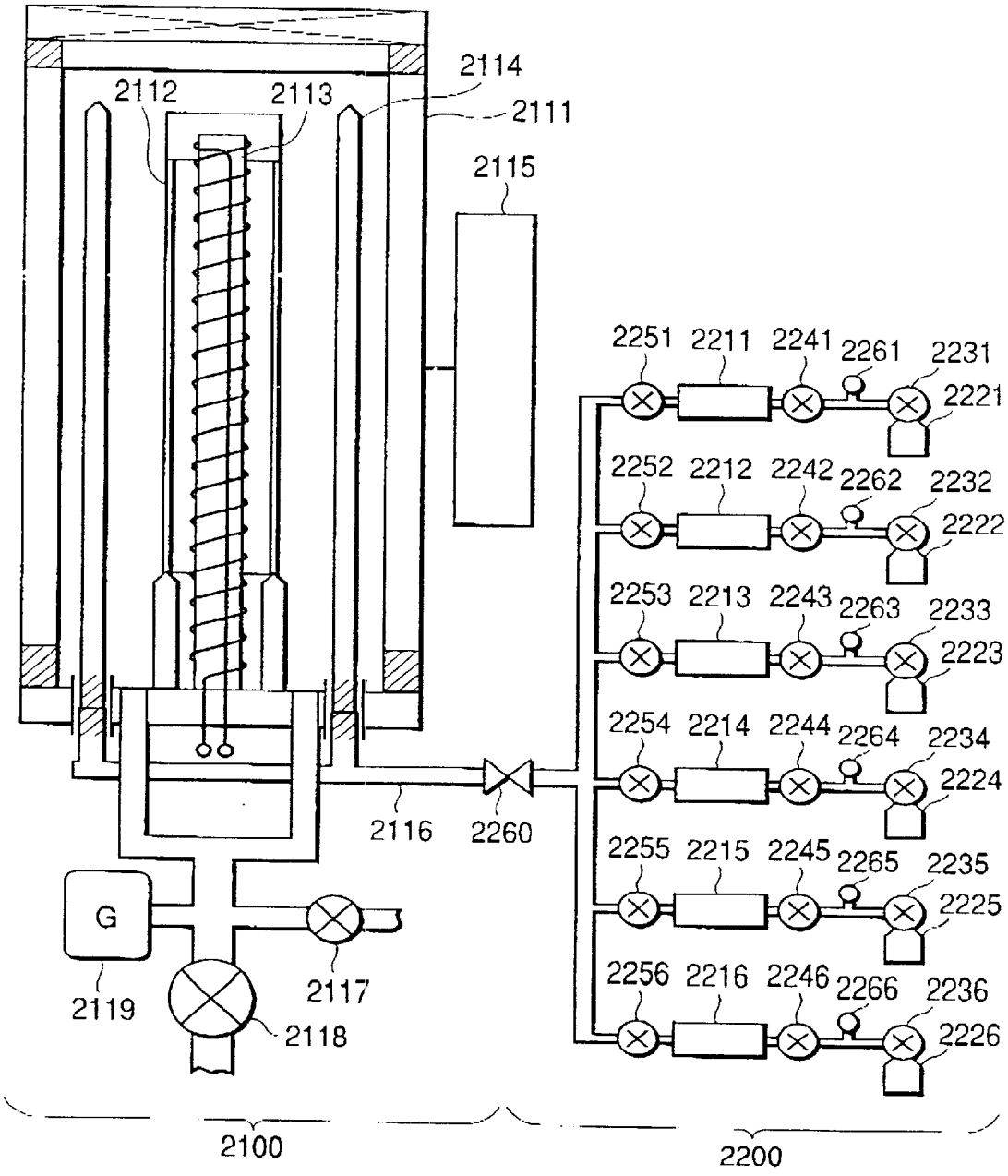
FIG. 4 illustrates the construction of an example of an apparatus used to produce the photosensitive member of the present invention and the conventional photosensitive member by high-frequency plasma-assisted CVD making use of RF bands (RF-PCVD).
Figure 5:
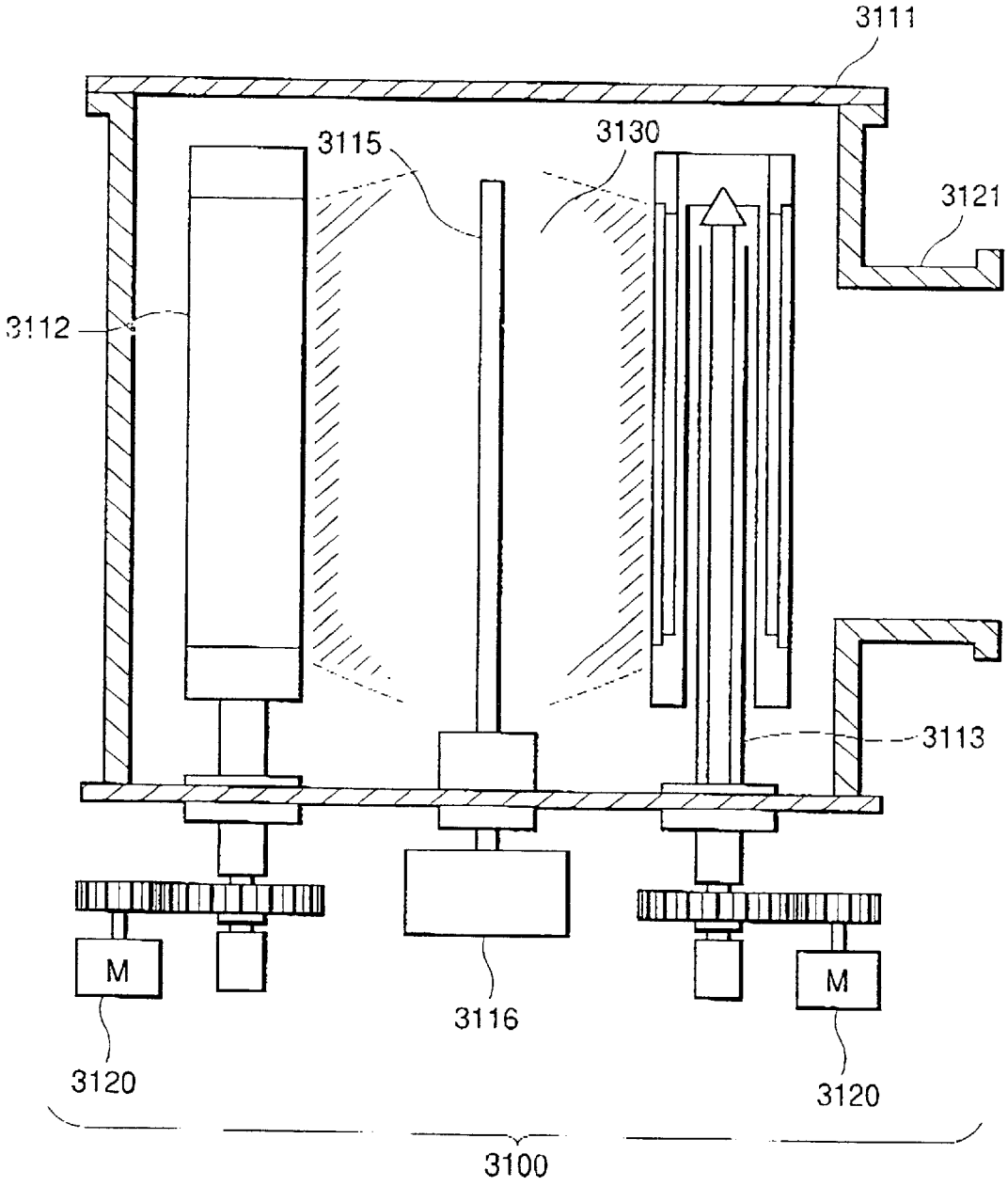
FIG. 5 illustrates the construction of an example of an apparatus used to produce the photosensitive member of the present invention and the conventional photosensitive member by high-frequency plasma-assisted CVD making use of VHF bands (VHF-PCVD).

Next, a description is given regarding the development apparatus 9 to be used for the image formation apparatus illustrated in FIG. 1 with the reference to FIG. 2, which shows the development apparatus 9 to be used for the image formation apparatus illustrated in FIG. 1.

In the forgoing figures, the development apparatus 9 disposed on the opposite to the photosensitive drum 4 comprises a development container 8, a development sleeve 3, which is a constituent element of the present invention, a developer return member 1 for regulating a storage part 5 of the developer, and a blade 2 as a head restriction member for the developer. The inside of the development apparatus 9 is partitioned with a partition wall 6 extended in the perpendicular direction into a development chamber (a first chamber) 13 and a stirring chamber (a second chamber) 14 and the upper part of the partitioning wall 6 is opened. The development chamber 13 and the stirring chamber 14 store a two-component developer containing a non-magnetic toner and a magnetic carrier and an excess of the developer in the development chamber 13 is recovered in the stirring chamber 14 side.

A first and a second stirring screws 11, 12 are installed in the development chamber 13 and the stirring chamber 14.

The development chamber 13 of the development apparatus 9 is opened at the position corresponding to the development region facing the photosensitive drum 4 and the development sleeve 3 is so installed as to be partially exposed to the opened part in a rotatable manner.

The development sleeve 3 is made of a non-magnetic material and rotated at the time of development operation in the direction shown as an arrow in the figures and a magnet (a magnet roller) 10, which is a magnetic field generating means, is fixed in the inside. The development sleeve 3 carries and transports the layer of the two-component developer whose thickness is restricted by the blade 2 and supplies the developer to the photosensitive drum 4 in the development region facing the photosensitive drum 4 to develop the latent image.

In order to improve the development efficiency, development bias voltage generated by overlaying alternating voltage on, for example, direct voltage from a power source 15 is applied to the development sleeve 3.

With the above described structure, the development apparatus 9 holds the developer supplied to the surface of the development sleeve 3 by the stirring screws 11, 12 in a magnetic brush state owing to the magnetic force of the magnetic roller 10 and transports the developer in such a state to the opposed part (the development region) facing the photosensitive drum 4 by rotation of the development sleeve 3 and the head of the magnetic brush is cut by the developer return member 1 and the blade 2 to properly keep the developer amount to be transported to the development region.

To explain more particularly, a magnetic roller 10 of such a conventional development apparatus comprises a pentode constitution and the developer stirred by the stirring screw 11 of the development chamber is constrained by the magnetic force of the transportation magnetic pole for lifting up (the lifting up pole) N2 and transported to the developer storage part 5 by rotation of the development sleeve 3.

The developer amount is regulated by the development return member 1, and while sufficiently constraining the developer with a magnetic pole (a cutting pole) S2 for transportation having a prescribed magnetic flux density or higher and forming the magnetic brush, the developer is transported. Next, the head of the magnetic brush is cut by the blade 2, that is, the head restriction member to properly adjust the developer amount and the developer is transported to an electrode N1 for transportation.

Further, bias voltage, on which a direct and/or alternating electric field is superposed, is applied to the development sleeve 3 in a development pole S1 through the bias power source 15 installed in the main body side of the image formation apparatus and the toner on the development sleeve 3 is transferred to the electrostatic latent image side of the photosensitive drum 4 and the electrostatic latent image is visualized as a toner image.

In FIG. 1, the A, B, C, and D stations form respectively Yellow, Magenta, Cyan, and Black images of a full-color image, however the order of the colort stations is not significant. In the following description, for example, the term, primary chargers 21, denotes the primary chargers 21A, 21B, 21C, and 21D in the respective A, B, C, and D stations.

In the respective stations, image formation is carried out as follows.

A photosensitive drum 4, which is an a-Si-based photosensitive member, is installed in a rotatable manner and the photosensitive drum 4 is evenly charged by the primary chargers 21 and then the information signals are exposed by, for example, light emitting devices 22 such as laser to form an electrostatic latent image and the electrostatic latent image is developed and visualized by a development apparatus 9. Next, the visualized image is transferred to a transfer paper sheet (a transfer material) 24 fed by a transfer sheet feeding seat 27 using a transfer charger 23.

On the transfer paper sheet 24, a Yellow toner image, a Magenta toner image, a Cyan toner image, and a Black toner image are successively superposed in the respective stations and transferred. The resulting transfer paper sheet 24, on which these four color toner images are superposed, is subjected to the color mixing and fixing process by heat and pressure by a fixation apparatus 25 and then discharged as a full-color image-bearing sheet. Further, the un-transferred remaining toner on the photosensitive drum 4 is removed by a cleaning apparatus 26. The reference numeral 17 is a toner concentration detection means on the drum.

If employing a two-component type development mode in which a magnetic brush is composed and having the minimum gap between a development sleeve and the photosensitive member in a range of 350 to 800 $\mu$m, common development apparatuses may be used as the development apparatus for the image development unit in the present invention without any specific restrictions.

FIG. 2 shows an example of the development apparatus to be employed for the image forming unit.

The development apparatus 9 disposed on the opposite to a photosensitive drum 4 in FIG. 2 comprises a development container 8, a development sleeve 3 as a developer transportation means, a developer return member 1 for regulating a storage part 5 of the developer, and a blade 2 as a head restriction member for the developer. The inside of the development apparatus 9 is partitioned with a partition wall 6 extended in the perpendicular direction into a development chamber (a first chamber) 13 and a stirring chamber (a second chamber) 14 and the upper part of the partitioning wall 6 is opened. The development chamber 13 and the stirring chamber 14 store a two-component developer containing a non-magnetic color toner and a magnetic carrier and an excess of the developer in the development chamber 13 is recovered in the stirring chamber 14 side.

A first stirring screw 11 and a second stirring screw 12 are installed in the development chamber 13 and the stirring chamber 14.

The development chamber 13 of the development apparatus 9 is opened at the position corresponding to the development region facing to the photosensitive drum 4 and the development sleeve 3 is so installed as to be partially exposed to the opened part in a rotatable manner. The development sleeve 3 is made of a non-magnetic material and rotated at the time of development operation in the direction shown as an arrow in the FIG. and a magnet (a magnet roller) 10, which is a magnetic field generating means, is fixed in the inside. The development sleeve 3 carries and transports the layer of the two-component developer whose thickness is restricted by the blade 2 and supplies the developer to the photosensitive drum 4 in the development region facing to the photosensitive drum 4 to develop the latent image. In order to improve the development efficiency, development bias voltage generated by overlaying alternating voltage on, for example, direct voltage from a power source 15 is applied to the development sleeve 3.

With the above described structure, the development apparatus 9 holds the two-component type developer supplied to the surface of the development sleeve 3 by the stirring screws 11, 12 in a magnetic brush state owing to the magnetic force of the magnetic roller 10 and transports the developer in such a state to the opposed part (the development region) facing to the photosensitive drum 4 by rotation of the development sleeve 3 and the head of the magnetic brush is cut by the developer return member 1 and the blade 2 to properly keep the developer amount to be transported to the development region.

The magnetic roller 10 of such a development apparatus comprises a pentode constitution and the developer stirred by the stirring screw 11 of the development chamber is constrained by the magnetic force of the transportation magnetic pole for lifting up (the lifting up pole) N2 and transported to the developer storage part 5 by rotation of the development sleeve 3. The developer amount is regulated by the development return member 1 and in order to stably constrain the developer, being sufficiently constrained by a magnetic pole (a cutting pole) S2 for transportation having a prescribed magnetic flux density or higher and forming the magnetic brush, the developer is transported. Next, the head of the magnetic brush is cut by the blade, that is, the head restriction member 2 to properly adjust the developer amount and the developer is transported to an electrode N1 for transportation. Further, bias voltage on which a direct and/or alternating electric field is superposed is applied to the development sleeve 3 in a development pole S1 through the bias power source 15 installed in the main body side of the image formation apparatus and the toner on the development sleeve 3 is transferred to the electrostatic latent image side of the photosensitive drum 4 and the electrostatic latent image is visualized as a toner image.

Common exposure apparatuses may be used as the exposure apparatus to be employed for an image formation unit. The image formation unit is preferably provided with transfer means, a cleaning apparatus and the like used in a transferring charging apparatus, as shown in FIG. 1, which may also be those commonly used for a general image formation apparatus.

Figure 6:
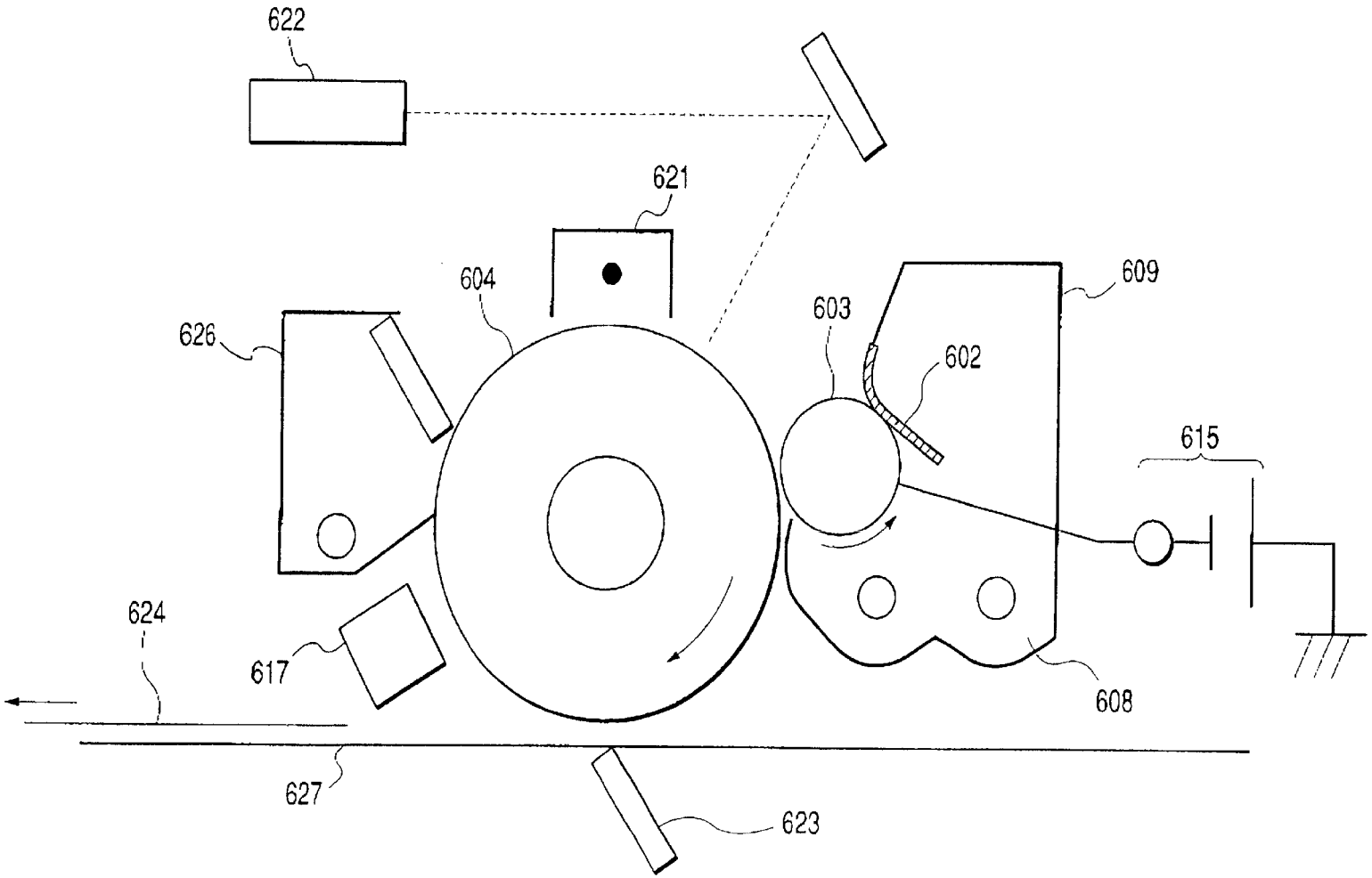
FIG. 6 schematically illustrates the construction of a developing assembly making use of a one-component developer, which is used in place of each developing assembly 9 used in the image-forming apparatus shown in FIG. 1.

In the third and the fourth invention, a development apparatus 609 for which a monocomponent developer containing a non-magnetic toner as illustrated in FIG. 6 is used in place of the development apparatus 9A, the development apparatus 9B, the development apparatus 9C, and the development apparatus 9D as illustrated in FIG. 1 and the development apparatus 9 illustrated in FIG. 2.

In the third and the fourth invention, when an image is formed using an a-Si-type photosensitive member with a drum-like shape 20 to 80 mm in diameter in the tandem type full-color image formation and using the foregoing monocomponent non-magnetic developer, the absolute value of the surface potential in the unexposed part of the photosensitive member in the development region is controlled to be 300 to 450 V and the development sleeve to supply the developer to the photosensitive member in the development region is rotated at a circumferential velocity (or peripheral speed) 1.1 to 4.0 times as high as that of the photosensitive member to develop the electrostatic image on the photosensitive member.

It is sufficient for the present invention to satisfy the above described characteristics and the respective processes other than the above described characteristics and means to be employed for them are not specifically restricted and conventionally known techniques can be employed. Further, the present invention may employ a tandem manner in the image formation process using an a-Si type photosensitive member and is capable of forming full-color images with high image quality for a long period of time even in a low potential system.

For the present invention, a photosensitive member to be used comprises a conductive supporting body (or support) and an amorphous silicon layer formed on the supporting body and moves a prescribed track. In the present invention, the amorphous silicon layer is a photosensitive member layer and mainly contains. amorphous silicon as a main constituent material. The amorphous silicon layer has an amorphous structure containing mainly silicon atom, but may partially contain a crystalline structure.

The amorphous silicon layer may be composed as a layered body comprising layers having a plurality of different functions. A photoconductive layer, a surface layer, a charge injection inhibiting layer and the like can be exemplified as such layers. Further, a constitution composed of a photoconductive layer, a charge generation layer, and a charge transportation layer may also be exemplified. Hereinafter, a photosensitive member to be employed for the present invention will be described.

FIG. 3 is a schematic constitution diagram for illustrating the layered constitution of the photosensitive member to be employed for the present invention.

For the third and the fourth invention, those except the development apparatuses 9A, 9B, 9C and 9D in FIG. 1 can be used as they are.

In the present invention, the above described charging means for charging the photosensitive member can be employed. As the charging means to be employed for the present invention, any means capable of charging the photosensitive member may be used without any specific restrictions and they may be a contact type charging apparatus such as a roller type charging apparatus, a fur brush type charging apparatus, a magnetic brush charging apparatus, and the like and a non-contact type charging apparatus such as a corona discharge type charging apparatus.

In the present invention, exposure means forming an electrostatic image on the charged photosensitive member by exposure may be used. Those which can form an electrostatic image on the photosensitive member by exposure of the charged photosensitive member may be employed as the exposure means for the present invention without any particular restrictions, and an electrostatic image can be formed by desirable exposure depending on the charged state of the photosensitive member. As such an exposure methods available are a back scanning exposure for forming light parts of an image on a photosensitive member bearing positive charge by exposure and an image exposure (or imagewise exposure) for forming dark parts of an image on a photosensitive member bearing negative charge. These methods may properly be selected based on the charged state of the photosensitive member and the chargeability of a developer.

Hereinafter, the methods for measuring respective physical properties will be described.

Measurement Method of Toner Particle Size Distribution

Coulter Counter TA-II or Coulter Multisizer (manufactured by Coulter Co.) is used as a measurement apparatus. The electrolytic solution is an about 1% NaCl solution prepared using first grade NaCl. For example, ISOTON R-II (Coulter Scientific Japan Co.) may be used.

The measurement method is carried out as follows: 0.1 to 5 ml of a surfactant (preferably an alkylbenzenesulfonic acid salt) is added to 100 to 150 ml of the foregoing aqueous electrolytic solution and then 2 to 20 mg of a measurement sample is added.

The resulting electrolytic solution in which the sample is suspended is subjected to dispersing treatment for about 1 to 3 minutes by an ultrasonic dispersing apparatus and using the foregoing measurement apparatus and an 100 $\mu$m aperture as an aperture, the volume and the number of a toner particle are measured for respective channels to calculate the volume distribution and the number distribution.

After that, the weight average particle diameter (D4) (the median values of the respective channels are used as the representative values for the respective channels) of toner on the basis of the weight obtained from the volume distribution of the toner particles is found.

The following 13 channels are employed as channels: 2.00 to 2.52 $\mu$m; 2.52 to 3.17 $\mu$m; 3.17 to 4.00 $\mu$m: 4.00 to 5.04 $\mu$m; 5.04 to 6.35 $\mu$m; 6.35 to 8.00 $\mu$m; 8.00 to 10.08 $\mu$m; 10.08 to 12.70 $\mu$m: 12.70 to 16.00 $\mu$m: 16.00 to 20.20 $\mu$m; 20.20 to 25.40 $\mu$m; 25.40 to 32.00 $\mu$m; and 32.00 to 40.30 $\mu$m.

Measurement Method of 50% Particle Diameter of Carrier

The average particle size and the particle distribution of a magnetic carrier are measured as follows: a laser diffraction type particle distribution measurement apparatus HELOS (manufactured by JEOL Ltd.) is used in combination with a dry type dispersion unit RODOS (manufactured by JEOL Ltd.) and under the conditions of the lens focal distance of 20 mm, the dispersion pressure of 3.0 bar, and the measurement duration of 1 to 2 seconds; the particle diameter range from 0.5 μm to 350.0 μm is divided into 31 channels as shown in Table 1 and the 50% particle diameter (median diameter) in the volume distribution is calculated as the average particle diameter and at the same time the volume % of the particles in each particle size range is calculated based on the frequency distribution of volume standards.

The laser diffraction type particle distribution measurement apparatus HELOS employed for the particle distribution measurement is an apparatus capable of carrying out measurement based on Fraunhofer diffraction theory. Simple explanation of the measurement theory is as follows: when a laser beam source, a diffraction image is formed in the focal face of the lens on the opposite to the laser beam source and the diffraction image is detected by a detector and the results is computation-processed to calculate the particle size distribution of the measurement particle.

The method applicable for adjusting a magnetic particle as to have the above described average particle diameter and the specified particle size distribution can be carried out by, for example, classifying the particle using sieves. Especially, in order to carry out precise classification, it is preferable to carry out classification using a sieve with a proper mesh repeatedly a plurality of times. Further, it is also effective to use sieves with the openings of the meshes controlled by plating.

Measurement Method of Glass Transition Temperature of resin

A differential scanning calorimeter (DSC measurement apparatus), DSC-7 (manufactured by Perkin-Elmer Corporation) is employed for the present invention.

A measurement sample is precisely measured in 5 to 20 mg, preferably 10 mg. The measured sample is put in an aluminum pan and measurement is carried out at 10° C./min temperature increase ratio in a measurement temperature range of 30° C. to 200° C. while using an empty aluminum pan as a reference.

During the heating process, an endothermic peak, a main peak, can be obtained in the temperature range of 40 to 100° C.

In this case, the crossing point of the line of the middle points of base lines before and after the appearance of the endothermic peak and the differential thermal analysis curve is defined as the glass transition temperature Tg in the present invention.

Measurement Method of Molecular Weight of Resin

The Mn, Mw, and Mw/Mn of resin are measured by gel permeation chromatography (GPC).

A column is stabilized in a heat chamber at 40° C. and at the temperature, tetrahydrofuran (THF) as a solvent is passed through the column at 1 ml/min flow rate and about 100 μl of a THF solution containing a sample is injected to carry out measurement. At the time of molecular weight measurement of the a sample, the molecular weight distribution which a sample has is calculated based on the relation between the logarithmic value of a calibration curve produced using several monodisperse polystyrene standardized samples and the counted number.

As the standardized polystyrene samples for calibration curve production, for example, those with about $10^2$ to $10^7$ molecular weight produced by Tosoh Corporation or Showa Deako K.K. are used and it is preferable to use at least 10 standardized polystyrene samples. As a detector, an R1 (refractive index) detector is employed. As a column, a plurality of commercialized polystyrene gel columns are preferably used in combination.

Combination examples are a combination of Shodex GPC KF-801, 802, 803, 804, 805, 806, 807, and 800P produced by Showa Denko K.K.; and a combination of TSK gel G1000H (HXL), G2000H (HXL) G3000H (HXL), G4000H (HXL), G5000H (HXL), G6000H (HXL), G7000H (HXL), and TSK guard column.

Each sample is produced as follows. Each sample is put in HHF and kept still for several hours and then sufficiently shaken to be well mixed with THF (until an agglomerate of the sample disappears) and again kept still further for 12 hours or longer. In this process, it is necessary to leave the sample in THF for 24 hours or more. After that, the resulting solution is passed through a sample treatment filter (with pore size of 0.45 to 0.5 μm, e.g. Maishori Disk H-25-5 manufactured by Tosoh Corporation; Ekikuro Disk 25CR manufactured by German Science Japan Co.) to obtain each sample for GPC. The sample concentration is so adjusted as to be 0.5 to 5 mg/ml in the resin content.

Measurement Method of Acid Value

Each sample is measured in the amount of 2 to 10 g and put in Erlenmeyer flask and mixed with about 50 ml of a solvent mixture of methanol and toluene in a 30:70 ratio to dissolve the resin component. If the solubility is low, a small amount of acetone may be added. Using a 0.1% mixed indicator of Bromothymol Blue and Phenol Red, the sample is titrated with a previously standardized N/10 potassium hydroxide-alcohol solution and the acid value is calculated according to the following equation from the consumed amount of the potassium hydroxide-alcohol solution.

$$\text{Acid value} = KOH(ml) \times N \times 56.1/\text{sample weight}$$

(wherein N is the factor of N/10 KOH)

Measurement Method of Triboelectricity Quantity of Toner

The measurement methods of triboelectricity quantities of toners will be described for the case of a two-component type developer and for the case of a monocomponent type developer, respectively.

Figure 7:
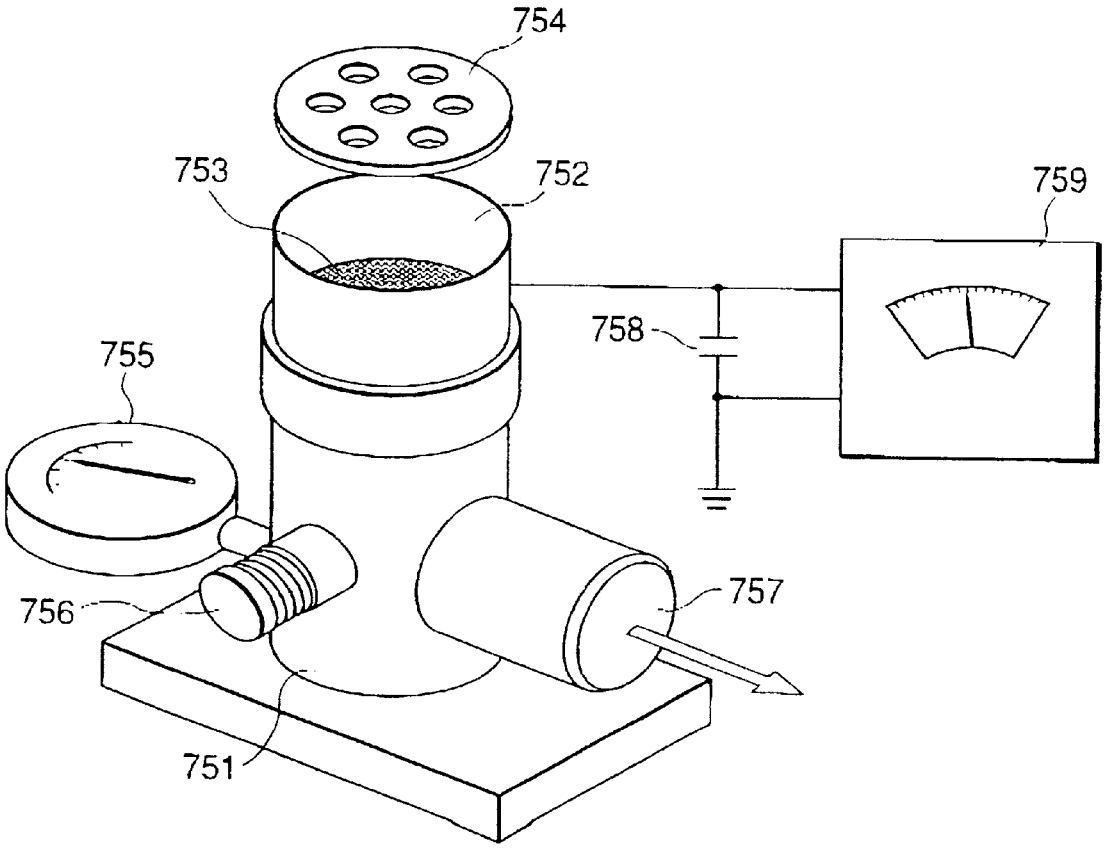
FIG. 7 schematically illustrates a measuring device used to measure the quantity of triboelectricity of toners.

FIG. 7 is an illustration of the apparatus for measuring the triboelectricity quantity of a two-component developer. To a measurement container 752 made of a metal and having a 500 mesh screen 753 at the bottom, about 0.5 to 1.5 g of a tow-component developer collected from a development sleeve of a copying machine or a printer is put and a cover 754 made of a metal is put on the container. In this case, the measurement container 752 is so adjusted as to be W1 (g) as the entire weight. Next, using an aspirator 751 (comprising an insulator at least in the part contacting with the measurement container 752), an air ventilation adjustment valve 756 is adjusted by suction through a suction port 757 to adjust the pressure of the vacuum meter 755 to be 250 mmAq. In such a condition, sufficient suction preferably for 2 minutes is carried out to suck and remove the toner. The potential shown, by a potentiometer 759 at that moment is defined as V (V). The reference numeral 758 in FIG. is a capacitor having the capacity C (mF). The weight of the entire measurement container after suction is measured and defined as W2 (g). The triboelectricity quantity (mC/kg) can be calculated according to the following equation.

$$\text{The triboelectricity quantity } (mC/kg) \text{ of a sample} = C \times V/(W1 - W2)$$

(wherein the measurement condition is 23.60% RH)

One-component Type Developer

The triboelectricity quantity of a one-component type developer is calculated based on the suction type Faraday cage method.

The suction type Faraday cage method is a method for calculating the electric charge quantity per unit weight of a developer, that is, triboelectricity quantity (mC/kg), by recovering the entire amount of a one-component developer in a prescribed surface area of a development sleeve or a copying machine or a printer by suction using a developer recovery apparatus, measuring the weight and the electric charge quantity of the recovered developer and calculating the quantity from the measured weight and electric charge quantity of the developer.

The developer recovery apparatus to be employed for the suction type Faraday cage method comprises a suction apparatus part for sucking air and a recovery apparatus part joined to the suction apparatus for recovering the developer. The recovery apparatus comprises an outer cylinder having a suction port with a tip end part with a curvature corresponding to the outer circumferential curvature of the development sleeve for sucking the developer on the development sleeve and an inner cylinder having a cylindrical filter paper for recovering the sucked developer.

In order to practically suck and recover the developer on the development sleeve using the developer recovery apparatus, the development sleeve is stopped rotating and using the foregoing development recovery apparatus, the developer on the development sleeve is sucked by pushing the suction port of the developer recovery apparatus against the surface of the development sleeve along the longitudinal direction from one end side of the development sleeve to the other end side and the sucked developer is recovered with the cylindrical filter paper.

The cylindrical filter paper with which the developer is recovered is weighed and the weight of the developer is calculated by subtracting the weight of the cylindrical filter paper before the recovery from the weight of the cylindrical filter paper after the recovery. At that time, the electric charge quantity of the developer recovered in the cylindrical paper in the inner cylinder electrostatically shielded from the outside is measured.

Next, FIG. 6 shows a development apparatus 609 of a one-component type development system.

In the same figure, the development apparatus 609 installed opposite to a photosensitive drum 604 comprises a development container 608, a development sleeve 603 as developer transportation means, and a blade as a member for imparting the electric charge to the developer and restricting the toner amount.

The development container 608 is opened at the position corresponding to the development region facing to the photosensitive drum 604 and the development sleeve 603 is so installed as to be partially exposed to the opened part in a rotatable manner. The development sleeve 603 is made of a nonmagnetic material and rotated at the time of development operation in the direction shown as an arrow in the Figure. The development sleeve 603 carries and transports the layer of the one-component developer whose thickness is restricted by an elastic blade 602 and supplies the developer to the photosensitive drum 604 in the development region facing to the photosensitive drum 604 to develop the latent image. In order to improve the development efficiency, development bias voltage generated by superposing alternating voltage on, for example, direct voltage from a power source 615 is applied to the development sleeve.

With the above described structure, the development apparatus 609 transports the developer supplied to the surface of the developer sleeve 603 to the opposed part (the development region) facing to the photosensitive drum 604 by rotation of the development sleeve 603 and the charge supply and the toner amount are restricted by the elastic blade 602 to properly keep the developer amount to be transported to the development region.

In the development region existing in the opposed part to the photosensitive drum 604, bias voltage on which a direct and/or alternating electric field is superposed is applied to the development sleeve 603 through the bias power source 615 installed in the main body side of the image formation apparatus and the toner on the development sleeve is transferred to the electrostatic latent image side of the photosensitive drum 604 and the electrostatic latent image is visualized as a toner image.

The image formation unit in FIG. 6 further comprises a primary charger 621, a light emitting element 622, a transfer charger 623, a transfer sheet 624, a cleaning apparatus 626 and toner concentration detection means 617 for measuring the concentration of the toner on the photosensitive drum. FIG. 6 further shows a transfer sheet transporting seat 627 for transporting the transfer sheet 624.

Hereinafter, examples of the present invention will be described according to drawings, however the present invention is not at all restricted by these examples.

(A) Practical Example of the First Invention

Manufacture Example of Photosensitive Member

Using a manufacturing apparatus of a photosensitive member for an image formation apparatus by a RF-PCVD method, a positive charge type photosensitive member and a negative charge type photosensitive member were made on mirror-polished aluminum cylinders with the diameter of 60 mm under the conditions shown in Table 2 and Table 3, respectively. The photosensitive member made according to the conditions shown in Table 2 or Table 3 is called photosensitive member 1 or photoconductor 2, respectively.

Toner Production Example

Binder resin shown in the following table was used.

Yellow Toner Production Example

The Yellow toner was produced as follows.

A first kneading process

| | |
|---|---|
| polyester resin (1) | 70 parts by weight |
| a paste pigment containing 30% by weight of solid content (the remaining 70% by weight was water) and obtained by removing water to a certain extent from a pigment slurry in the production of C.I. pigment 180 by a known method before filtration process without carrying out drying process even once | 100% by weight |

At first, a kneader type mixer was loaded with the foregoing raw materials in the above described formulation and while being kneaded, the mixture was heated under non-pressurizing condition.

At the time when the temperature reached the highest temperature (which is inevitably determined based on the boiling point of the solvent in the paste; in this case, about 90 to 100° C.), the pigment in the aqueous phase was distributed or transferred to the melted resin phase and after that was confirmed, the mixture was further heated, melted, and kneaded for 30 minutes to sufficiently transfer the pigment in the paste.

After that, the mixer was stopped for a time and hot water was discharged, and then the temperature was increased to 130° C. and the resulting mixture was heated, melted, and kneaded for about 30 minutes to disperse the pigment and remove water. On completion of the process, followed by cooling, the resulting kneaded product was taken out. The water content of the kneaded product finally obtained was about 0.8% by weight.

A second kneading process

| | |
|---|---|
| The foregoing kneaded product (the content of the pigment particle 30% by weight) | 20.0 parts by weight |
| polyester resin (1) | 86.0 parts by weight |
| di-tert-butyl salicylate aluminum compound | 4.0 parts by weight |

The foregoing materials were preliminarily sufficiently mixed by a Henshel mixer and while the temperature was set at 120° C., the mixture was melted and kneaded by a biaxial extrusion kneader and after being cooled, the kneaded mixture was coarsely ground by a hammer mill to about 1 to 2 mm size and then finely ground by a pulverizer of an air jet type to 40 μm or smaller particle diameter.

Further, the finely ground product thus obtained was so classified and selected as to obtain Yellow toner particles (classified product) with a weight average diameter of 8.0 μm in the particle size distribution, and for the purpose of improving the fluidity and imparting chargeability, 1.0 part by weight of titanium oxide fine powder treated with a Si-type compound to be hydrophobic was externally added to 100 parts by weight of the Yellow toner particle to produce a Yellow toner (Y1).

Next, Yellow toners Y 2 to Y 12, Y 17, and Y 18 were produced in the same way as in the Yellow toner Y 1 except that the type and amount of pigment were changed.

Next, Yellow toners Y 13 to Y 16 were produced in the same way as in the case of the Yellow toner Y1 except that the grinding and classifying conditions and the amounts of the external additives were changed.

Production Examples of Yellow Toners Y19, Y20

| | |
|---|---|
| polyester resin (1) | 70 parts by weight |
| C.I. pigment Yellow 180 | 30 parts by weight |

At first, a kneader type mixer was loaded with the foregoing raw materials and while being kneaded, the mixture was heated in non-pressurizing condition and preliminarily and sufficiently mixed. After that, the resulting mixture was kneaded two times with a three-roll to produce a first kneaded product.

| | |
|---|---|
| the foregoing first kneaded product | 26.7 parts by weight |
| polyester resin (1) | 81.3 parts by weight |
| di-tert-butyl salicylate aluminum compound | 4 parts by weight |

The foregoing materials were preliminarily and sufficiently mixed by a Henshel mixer and the mixture was melted and kneaded by a biaxial extruder, and thereafter, the Yellow toner Y19 was obtained in the same way as in the case of the Yellow toner Y1. In approximately same way, the Yellow toner Y20 with the pigment content of 4 parts by weight was obtained.

Production Example of Yellow Toner Y21

| | |
|---|---|
| polyester resin (1) | 100 parts by weight |
| C.I. pigment Yellow 180 | 4 parts by weight |
| di-tert-butyl salicylate aluminum compound | 4 parts by weight |

The foregoing materials were preliminarily and sufficiently mixed by a Henshel mixer and the mixture was melted and kneaded by a biaxial extruder, and thereafter, the Yellow toner Y21 was obtained in the same way as in the case of the Yellow toner Y1.

Production Example of Yellow Toner Y22

The first kneaded product (the content of the pigment particles 30% by weight) produced in the case of the Yellow toner Y1 was further kneaded five times by a three-roll to further sufficiently disperse the pigment and thereafter in the same manner, the Yellow toner Y22 was obtained. The respective Yellow toner production methods were shown in Table 5A.

Production Examples of Magenta Toners

In approximately the same manner as in the case of the Yellow toner Y1 and using the respective pigment pastes of Magenta pigments described in the following Table 6A, first kneaded products were obtained and after that, the products each were so diluted and kneaded as to have the desired pigment contents and thereafter, approximately the same process was carried out to produce Magenta toners M1 to M16 with the weight average particle diameter of 7 to 7.5 μm.

Production Examples of Cyan Toners

Production Examples of Cyan Toners C1, C2 and C4 to C6

In approximately the same manner as in the case of the Yellow toner Y1 and using the respective pigment pastes of Cyan materials described in the following Table 7A, first kneaded products were obtained and after that, the products each were so diluted and kneaded as to have the desired pigment contents and thereafter, approximately the same process was carried out to produce Cyan toners C1, C2 with the weight average particle diameter of 6.0 to 8.0 μm and Cyan toners C4 to C6 were obtained by using alumina A in place of the titanium oxide as the external additive as described in Table 8A.

Production Example of Cyan Toner C3

The Cyan toner C3 was produced in approximately the same manner as in the case of the Yellow toner Y21

| | |
|---|---|
| polyester resin (1) | 100 parts by weight |
| C.I. pigment Blue 15:3 | 2 parts by weight |
| di-tert-butyl salicylate aluminum compound | 4 parts by weight |

The foregoing materials were preliminarily and sufficiently mixed by a Henshel mixer and the mixture was melted and kneaded by a biaxial extruder, and thereafter, the Cyan toner C3 was obtained in the same way.

Production Examples of Cyan Toners C7 to C9

The Cyan toners C7 to C9 shown in Table 7A were produced in the same manner as in the case of the Cyan toner C1 except that the following materials were used respectively in place of the charge control agent used for the Cyan toner C1;

di-tert-butyl salicylate chromium compound
di-tert-butyl salicylate aluminum compound
n-octyl salicylate aluminum compound Production Examples of Cyan Toners C10 to C15

The Cyan toners C10 to C15 shown in Table 7A were produced in the same manner as that in the case of the Cyan toner C3 except that the resin (2) to resin (7) were used respectively in place of the resin (1) used for the Cyan toner C1.

Production Examples of Black Toners

Production Example of Black Toner Bk1

| | |
|---|---|
| polyester resin (1) | 70 parts by weight |
| CB-A | 30 parts by weight |

At first, a kneader type mixer was loaded with the foregoing raw materials and while being kneaded, the mixture was heated under non-pressurizing condition and preliminarily and sufficiently mixed. After that, the resulting mixture was kneaded two times with a three-roll to produce a first kneaded product.

The Foregoing First Kneaded Product

| | |
|---|---|
| the foregoing first kneaded product | 10.0 parts by weight |
| polyester resin (1) | 93.0 parts by weight |
| di-tert-butyl salicylate aluminum compound | 4 parts by weight |

The foregoing materials were preliminarily and sufficiently mixed by a Henshel mixer and the mixture was melted and kneaded by a biaxial extruder, and thereafter, the Black toner Bk1 shown in Table 9A was obtained in the same way.

Production Examples of Black Toners Bk2, Bk3

The first kneaded product was obtained in approximately the same manner as in the case of the Black toner Bk1, then the addition amounts were so adjusted as to be desired carbon black amounts, and thereafter, the Black toners Bk2 and Bk3 shown in Table 9A were obtained in approximately the same way.

Production Example of Black Toner Bk4

| | |
|---|---|
| polyester resin (1) | 100 parts by weight |
| CB-A | 2.0 parts by weight |
| di-tert-butyl salicylate aluminum compound | 4 parts by weight |

The foregoing materials were preliminarily and sufficiently mixed by a Henshel mixer and the mixture was melted and kneaded by a biaxial extruder, and thereafter, the Black toner Bk4 shown in Table 9A was obtained in the same way as that in the case of the Black toner Bk1.

Production Examples of Black Toners Bk5, Bk6

The Black toners Bk5, Bk6 as shown in Table 9A were obtained in the same manner as in the case of the Black toner Bk1 except that carbon black CB-B and carbon black CB-C shown in Table 10A were used as carbon black in place of CB-A used for the Black toner Bk1 while the addition amounts were slightly changed.

Production Example of Black Toner Bk7

| | |
|---|---|
| polyester resin (1) | 70 parts by weight |
| C.I. pigment Yellow 17 | 7.5 parts by weight |
| C.I. pigment Red 5 | 15 parts by weight |
| C.I. pigment Blue 15:3 | 7.5 parts by weight |

At first, a kneader type mixer was loaded with the foregoing raw materials and while being kneaded, the mixture was heated in non-pressurizing condition and preliminarily and sufficiently mixed. After that, the resulting mixture was kneaded four times with a three-roll to produce a first kneaded product.

| | |
|---|---|
| the foregoing first kneaded product | 20.0 parts by weight |
| polyester resin (1) | 83.67 parts by weight |
| the first kneaded product of CB-A used at the time of the Black toner Bk1 production | 3.33 parts by weight |
| di-ter-butyl salicylate aluminum compound | 4 parts by weight |

The foregoing materials were preliminarily and sufficiently mixed by a Henshel mixer and the mixture was melted and kneaded by a biaxial extruder, and thereafter, the Black toner Bk7 shown in Table 9A was obtained in the approximately same manner as in the case of the Black toner Bk1.

Production examples of carriers and developers

A carrier (carrier 1) for a two-component developer was produced by using a Mn—Mg—Fe type ferrite as a core material and coating the core material with about 0.2% by weight of modified silicone resin produced from a nitrogen-containing silane coupling agent and silicone resin. The carrier 1 had the 50% average particle size of 40 $\mu$m. Then, the core materials, the coating materials, and the particle sizes were changed to produce carriers 2 to 7. The production methods and the carriers were shown as the following Table 11A.

Each of the two-component type developers was produced by mixing 5 parts by weight of each of the toners with each of the forgoing carriers to be 100 parts by weight in total.

EXPERIMENTAL EXAMPLE 1A

A negatively chargeable photosensitive member was produced on mirror-polished aluminum cylinders with diameters in a range from 15 mm to 100 mm under the conditions shown in the foregoing Table 3 using a manufacturing apparatus for a photosensitive member for an image formation apparatus by a RF-PCVD method.

Image evaluation for the produced photosensitive members was carried out using experimental apparatuses comprising charging, exposing, developing, transferring, cleaning, and decharging means and capable of forming full-color images using four colors.

A Yellow toner, a Magenta toner, a Cyan toner, and a Black toner were arranged in the first image formation unit, the second image-formation unit, the third image formation unit, and the fourth image formation unit, respectively. The circumferential velocity (process speed) of the photosensitive members was 200 mm/s, the surface potential of the photosensitive members was set to be −350 V at the developer position, the distance between the photosensitive drums and the development sleeve was set 400 $\mu$m, and the development sleeve was rotated at a circumferential velocity two times as fast as that of the photosensitive members. Imagewise exposure was employed for image formation.

As toners, Y1, M1, C1, and Bk1 were employed respectively for the Yellow toner, the Magenta toner, the Cyan toner, and the Black toner. The carrier 1 was used as the carrier.

To evaluate the images, investigation was carried out to measure the image density in the case of development with only the Black toner, the image density in the case of development with only the Yellow toner, and the image density of only yellow parts in the case of development with four colors. The results are shown in Table 12A.

In the case where a photosensitive member with the diameter of 15 mm was employed, the surface potential −350 V could not be obtained and thus images with high density could not obtained. For that, although the image formation was carried out at the same potential while decreasing the circumferential velocity of the photosensitive member to 100 mm/s, no satisfactory image could obtained even in such a case.

In the case where a photosensitive member with the diameter of 100 mm was employed, sufficient densities were obtained in the case of using single colors, however in the case where four-color image formation was carried out, the image density decrease was observed in the images formed in the first image formation unit. This is supposed to be attributable to that the toner on a transfer material was re-transferred to the photosensitive member owing to the larger diameter of the photosensitive member.

EXPERIMENTAL EXAMPLE 2A

Using the experimental apparatus employed in the experimental example 1A and a-Si photosensitive members with the diameter of 60 mm, image formation was carried out. The charging potential was changed in a range from −200 V to −500 V and the image densities, the dispersion of the densities at the reflection density of 0.6, and the density difference, after one turn between the exposed parts and the un-exposed parts at the reflection density of 0.6, which is called the ghost, were investigated for respective black images. The results were shown in Table 13A.

In the case where the absolute value of the surface potential was lower than 300 V, the image density was lowered. In the case where the absolute value of the surface potential was higher than 450 V, the density dispersion of images with the reflection density of 0.3 was deteriorated and the drum ghost was intensified.

EXPERIMENTAL EXAMPLE 3A

Using the experimental apparatus employed in the experimental example 1A and an a-Si photosensitive member with the diameter of 60 mm, the dependency on the SD gap was evaluated. The SD gap was changed from 300 μm to 900 μm and the fusion (or melt-adhesion) of the photosensitive member and the image densities were investigated after printing 10,000-sheet copies of 7%-black original (or after extensive operation on 10,000 sheets). The results were shown in Table 14A.

In the case where the SD gap was narrower than 350 μm, the drum fusion took place. On the other hand, in the case where the gap was wider than 800 μm, sufficiently high image densities were not obtained.

EXPERIMENTAL EXAMPLE 4A

Using the experimental apparatus employed in the experimental example 1A and an a-Si photosensitive member with the diameter of 60 mm, the dependency on the circumferential velocity ratio of the sleeve was evaluated. The circumferential velocity of the sleeve was adjusted to 1.05 times that of the photosensitive member and the image density of black color at the beginning and the image density after printing 50,000-sheet copies of a 7%-black original were investigated. The results are shown in Table 15A.

In the case where the circumferential velocity ratio of the sleeve was lower than 1.1, the density was found decreased from the initial image. In the case where the circumferential velocity ratio of the sleeve was higher than 4.0, the density was found decreased after extensive operation on 50,000 sheets. Fogging also took place to make it impossible to obtain images with good quality.

EXPERIMENTAL EXAMPLE 5A

Using the experimental apparatus employed in the experimental example 1A and an a-Si photosensitive member with the diameter of 60 mm, the dependency of the image quality on the particle sizes of toners was evaluated. The Yellow toners Y1, Y13 to Y16 were used. The results were shown in Table 16A.

EXPERIMENTAL EXAMPLE 6A

Using the experimental apparatus employed in the experimental example 1A and an a-Si photosensitive member with the diameter of 60 mm, the dependency of the image quality on the particle sizes of carriers was evaluated. The results were shown in Table 17A.

In the case where the carrier particle size was smaller than 10 μm, the carrier adhesion to the image parts were observed from the beginning in the durability test and further in the case where the carrier was smaller than 10 μm, the coating amount on the sleeve was not uniform and density unevenness was liable to occur. On the other hand, in the case where the carrier diameter was larger than 80 μm, the density of heads formed on the sleeve became sparse and traces of ears remained in halftone parts to result in lack of image evenness.

EXPERIMENTAL EXAMPLE 7A

Using the experimental apparatus employed in the experimental example 1A and an a-Si photosensitive member with the diameter of 60 mm, the dependency of the toners on the coloring power was evaluated. The coloring power of the toner was evaluated on the basis of the image density (D0.5) after being fixed once when the un-fixed toner amount (M/s) on a transfer material is 0.5 mg/cm$^2$. Yellow toners with different coloring power were produced and the images with 16 gradations were formed using the respective toners and the density and the gradation were evaluated. The results were shown in Table 18A.

According to the results shown in Table, if D0.5 was low, sufficient image density could not be obtained and if D0.5 was higher than 1.8, a problem took place on the density reproducibility of intermediate colors in environmental changes.

EXPERIMENTAL EXAMPLE 8A

Using the experimental apparatus employed in the experimental example 1A and an a-Si photosensitive member with the diameter of 60 mm, the dependency of the images on the binder resin of a toner was evaluated. In relation to the Cyan toner C1, toners C10 to C15 with different types of resin were produced and evaluation was carried out on a density change from the beginning and at the time of printing 50,000-sheet copies (the density at the beginning→the density at the time of printing 50,000-sheet copies) in low temperature and low humidity environments using the respective types of resin, the image qualities in high temperature and high humidity environments, and the transparency of OHP. The results were shown in Table 19A.

EXAMPLE 1A

Under the above described conditions show in Table 3 and by using a manufacturing apparatus for a photosensitive member for the image forming apparatus by a RF-PCVD method, a negatively chargeable photosensitive member was prepared on an aluminum cylinder subjected to mirror finish of 60 mm in a diameter.

The estimation of the prepared photosensitive member was made by using an image forming apparatus as shown in FIG. 1 which was a remodeled copying machine of a copying machine CLC1000 manufactured by CANON KABUSHIKI KAISHA. A cyan toner was disposed for a first image forming unit; a magenta toner, for a second image forming unit; a yellow toner, for a third image forming unit; and a black toner, for a fourth image forming unit. The photosensitive member was rotated at a circumferential speed (process speed) of 133 mm/S. A surface potential of the photosensitive member was set at 400 V at a developer position.

The distance between the photosensitive member and a developing sleeve was 450 $\mu$m and the developing sleeve rotated at a speed 1.75 times the circumferential speed of the photosensitive member. For the image formation, imagewise exposure was employed, and the image forming apparatus capable of performing the image formation at 30 sheets a minute was prepared.

Regarding the toner, Y1 was used as the yellow toner; M1, the magenta toner; C1, the cyan toner; and Bk1, the black toner. As a carrier, a carrier 1 was used.

The image density of each color after being fixed once when the un-fixed toner amount (M/S) on a transfer material was 0.5 mg/cm$^2$ was D0.5Y: 1.43; D0.5M: 1.23; D0.5C: 1.30; and D0.5BK. 1.30. Further, the difference between the maximum value (D0.5 max) and the absolute minimum value (D0.5 m/n) of D0.5Y, D0.5M and D0.5C was 0.20.

A difference in gloss of each color, the chroma of the color image and the color reproducibility in environmental changes are shown In Table 20A.

Measuring Method of D0.5

A contrast potential of the main body and other developing conditions were adjusted so that the unfixed toner amount on a transfer material becomes 0.5 mg/cm$^2$. After that, under the same conditions, an image was normally fixed through a fixing apparatus and the optical density of an image (or image density) was measured. For the measurement of the optical density of an image, a X-Rite reflection density meter Model 404 manufactured by X-Rite was used.

Gloss Measuring Method

For the measurement of a gloss (glossiness), a gloss meter Model VG-10 manufactured by NIPPON DENNSHOKU was used. In the measurement, at first, a voltage was set at 6V by a constant-voltage apparatus and then a light projecting angle and a light receiving angle were respectively adjusted to 60° and, after a standard was set up by using zero point adjustment and standard plate, a sample image was placed on a sample stand and, furthermore, three sheets of white paper were superposed on it so as to perform the measurement, and a numerical value shown in a display unit was read by % unit.

For the sample image, an image in which the value read by the X-Rite reflection density meter Model 404 (manufactured by X-Rite) for each of yellow, magenta and cyan becomes 1.50 was prepared and the gloss of each color was read and, after that, the difference between the maximum value and the minimum value were calculated. The image having a gloss difference of less than 3 was estimated as "AA", the image having the gloss difference of no less than 3 and less than 6 as "A", the image having the gloss difference of no less than 6 and less than 10 as "B" and the image having the gloss difference of no less than 10 as "C".

Measuring Method of Chroma of Color Image

The chroma of the image is the value calculated by the following equation:

$$C^*=\sqrt{(a^*)^2+(b^*)^2}$$

the greater the C* becomes, the clearer the image becomes. When a full color image forming is performed, as the C* and the expanse become greater, clearer images can be reproduced regarding each color and an intermediate color.

The color tone of the toner was quantitatively measured based on the definition of the calorimetric system standardized in 1976 by International Commission of Illumination (CIE). That is, a*, b* (a*, b* are chromaticity showing a hue and a chroma) and L* (luminosity) were measured. As a measuring device, a X-rite spectrocolorimeter type 938 (manufactured by X-Rite) was used, and as a light source for measurement, a C light source was employed, where an angle of visibility was adjusted to 2°.

For the sample image, an image where the value read by the reflection density meter Model 404 for each color of yellow, magenta and cyan becomes 1.50 was prepared and the gloss at each color was read and, after a*, b* at each color were read, a formable color space was calculated, thereby estimating the chroma of the color.

Next, regarding the color reproducibility when a full color image using a trichromatic color was formed, a fresh color image and a green image were prepared and estimated.

Regarding yellow, magenta, cyan, flesh color and green, the case where the color reproducibility was good and an excellent image was obtained, was estimated as "AA": the case where the image having a slightly poor chroma in only one color, but excellent reproducibility in each of other colors was obtained, was estimated as "A"; the case where the image having a slight problem in the color reproducibility, but practically no problem was obtained, was estimated as "B"; and the case where the image having a problem in the color reproducibility was obtained, was estimated as "C".

Measuring Method of Color Reproducibility in Environmental Changes

In a low temperature and low humidity environment (23° C./5%), a gray image was formed, by using yellow, magenta and cyan, so that L* (luminosity) became 55 to 56 and a* and b* became a*: −2 to 2 and b*: −2 to 2. Without changing the conditions set for the image forming apparatus, the environment was changed to a high temperature and high humidity environment (30° C./80%) and the image formation of the gray image was carried out.

Regarding color appearance variation of gray, the image having no color appearance variation and being excellent was estimated as "A"; the image having a slight color appearance variation, but practically no problem, "B"; and the image having apparently the color appearance variation, as "C".

EXAMPLE 2A

Except that Y5 was used as the yellow toner, M5 was used as the magenta toner and C2 was used as the cyan toner C2, by using the image forming apparatus used in the example 1, the image formation was carried out.

The image density of each color after being fixed once when the un-fixed toner amount on a transfer member (M/S) was 0.5 mg/cm$^2$ was D0.5Y: 1.12; D0.5M: 1.15; D0.5C: 1.25; and D0.5Bk: 1.30. Further, the difference between the maximum value (D0.5 max) and the absolute minimum value (D0.5 min) of D0.5Y, D0.5M and D0.5C was 0.13.

The difference in gloss of each color, the chroma of the color image and the color reproducibility in environmental changes are shown in Table 20A.

EXAMPLE 3A

Except that Y5 was used as yellow toner, M10 was used as the magenta toner and C2 was used as the cyan toner, by using the image forming apparatus used in Example 1A, the same image formation was carried out.

The difference between the maximum value (D0.5 max) and the minimum value (D0.5 min) of D0.5Y, D0.5M, and D0.5C, a difference in gloss of each color, the chroma of the color image and the color reproducibility in environmental changes are shown in Table 20A.

COMPARATIVE EXAMPLE 1A

Except that Y5 was used as the yellow toner, M13 was used as the magenta toner and C2 was used as the cyan toner, by using the image forming apparatus used in Example 1A, the same image formation was carried out.

The difference between the maximum value (D0.5 max) and the minimum value (D0.5 min) of D0.5Y, D0.5M and D0.5C the difference in gloss of each color, the chroma of the color image and the color reproducibility in environmental changes are shown in Table 20A.

In this case, when the image estimation was made, the difference in gloss of each color was large and no clear image was obtained. Further, severe control on density change with environmental difference was needed, and density irregularity with environmental difference was intensified.

EXAMPLE 4A

Except that Y5 was used as yellow toner, M5 was used as the magenta toner and C4 was used as the cyan toner, by using the image forming apparatus used in Example 1A, the same image formation was carried out.

The deference between the maximum value (D0.5 max) and the minimum value (D0.5 mm) of D0.5Y, D0.5M and D0.5C the difference in gloss of each color, the chroma of the color image and the color reproducibility in environmental changes are shown in Table 20A.

COMPARATIVE EXAMPLE 2A

Except that Y5 was used as yellow toner, M5 was used as the magenta toner and C5 was used as the cyan toner, by using the image forming apparatus used in Example 1A, the same image formation was carried out.

The difference between the maximum value (D0.5 max) and the minimum value (D0.5 min) of D0.5Y, D0.5M and D0.5C the difference in gloss of each color, the chroma of the color image and the color reproducibility in environmental changes are shown in Table 20A.

In this case, when the image estimation was made, the difference in gloss of each color was large and no clear image could be obtained. Further, severe control on density change with environmental difference was needed, and density irregularity with environmental difference was intensified.

EXAMPLE 5A

Except that Y18 was used as the yellow toner, M13 was used as the magenta toner and C5 was used as the cyan toner, by using the image forming apparatus used in Example 1A, the same image formation was carried out.

The image density of each color after being fixed one when the un-fixed toner amount on a transfer material (M/S) was 0.5 mg/cm$^2$ was D0.5Y. 1.58; D0.5M: 1.66; D0.5C: 1.69; and D0.5SBk: 1.30. Further, the difference between the maximum value (D0.5 max) of D0.5Y, D0.5M and D0.5C and the minimum value (D0.5 min) was 0.11.

The difference in gloss of each color, the chroma of the color image and the color reproducibility in environmental changes are shown in Table 20.

EXAMPLE 6A

Except that Y18 was used as yellow toner, M1 was used as the magenta toner and C5 was used as the cyan toner, by using the image forming apparatus used in Example 1A, the same image formation was carried out.

The difference between the maximum value (D0.5 max) and the minimum value (D0.5 min) of D0.5Y, D0.5M and D0.5C, the difference in gloss of each color, the chroma of the color image and the color reproducibility in environmental changes are shown in Table 20.

COMPARATIVE EXAMPLE 3A

Except that Y18 was used as yellow toner, M5 was used as the magenta toner and C5 was used as the cyan toner, by using the image forming apparatus used in Example 1A, the same image formation was carried out.

The difference between the maximum value (D0.5 max) and the minimum value (D0.5 min) of D0.5Y, D0.5M and D0.5C, the difference in gloss or each color, the chroma of the color image and the color reproducibility in environmental changes are shown in Table 20A.

In this case, when the image estimation was made, the gloss difference at each color was large and no clear image could be obtained. Further, severe control on density variation with environmental difference was needed, and density irregularity with environmental difference was intensified.

EXAMPLE 7A

Except that Y8 was used as the yellow toner, M13 was used as the magenta toner and C15 was used as the cyan toner, by using the image forming apparatus used in Example 1A, the same image formation was carried out.

The difference between the maximum value (D0.5 max) and the minimum value (D0.5 min) of D0.5Y, D0.5M and D0.5C the difference in gloss of each color, the chroma of the color image and the color reproducibility in environmental changes are shown in Table 20A.

COMPARATIVE EXAMPLE 4A

Except that Y5 was used as the yellow toner, M13 was used as the magenta toner and C5 was used as the cyan toner, by using the image forming apparatus used in Example 1A, the same image formation was carried out.

The difference of the maximum value (D0.5 max) and the minimum value (D0.5 min) of D0.5Y, D0.5M and D0.5C the difference in gloss of each color, the chroma of the color image and the color reproducibility in environmental changes are shown in Table 20A.

In this case, when the image estimation was made, the difference in gloss of each color was large and no clear image could be obtained. Further, severe control on density variation with environmental difference was needed, and density irregularity with environmental difference was intensified.

EXAMPLE 8A

Under the above described conditions shown in Table 3A, by using a manufacturing apparatus for the photosensitive member for the image forming apparatus by a RF-PCVD method, a negatively chargeable photosensitive member was prepared on an aluminum cylinder subjected to mirror finish having a diameter of 40 mm.

The estimation on the prepared photosensitive member was made by using an image forming apparatus which has a remodeled copying machine of CLC1000, manufactured by CANON KABUSHIKI KAISHA. A cyan toner was disposed for a first image forming unit: a magenta toner, for a second image forming unit; a yellow toner, for a third image forming unit; and a black toner, for a fourth image forming unit. The circumferential speed (process speed) of the photosensitive member was 100 mm/s. A surface potential of the photosensitive member was set at 320V at a developer position The distance between the photosensitive drum and a developing sleeve was 600 $\mu$m and the developing sleeve rotated at a speed 1.5 times the circumferential speed of the photosensitive member. For the image formation, imagewise exposure was employed, and the image forming apparatus capable of performing the image formation at 21 sheets a minute was prepared.

Regarding the toner, the yellow toner used was Y2, the magenta toner M2, the cyan toner C2 and the black toner Bk2. As a carrier, a carrier 6 was used.

The image density of each color after being fixed once when the un-fixed toner amount (M/S) on a transfer material was 0.5 mg/cm$^2$ was D0.5Y:1.42; D0.5M:1.40; D0.5C:1.25; and D0.5BK:1.53.

The difference in gloss of each color, the chroma of the color image and the color reproducibility in environmental changes are shown in Table 20A.

EXAMPLE 9A

Under the above described conditions shown in Table 3, by using a manufacturing apparatus for the photosensitive member for the image forming apparatus by a RF-PCVD method, a negatively chargeable photosensitive member was prepared on an aluminum cylinder subjected to mirror finish having a diameter of 60 m.

The estimation on the prepared photosensitive member was made by using an image forming apparatus as shown in FIG. 1 which was a remodeled recopying machine of CLC1000 (manufactured by CANON KABUSHIKI KAISHA). A cyan toner was disposed for a first image forming unit; a magenta toner, for a second image forming unit; a yellow toner, for a third image forming unit; a black toner, for a fourth image forming unit. The circumferential speed (the process speed) of the photosensitive member was 300 mm/8. A surface potential of the photosensitive member was set at 380V at a developer position. The distance between the photosensitive drum and a developing sleeve was 450 $\mu$m and the developing sleeve rotated at a speed 3 times the circumferential speed of the photosensitive member. For the image forming, imagewise exposure was employed, and the image forming apparatus capable of performing the image formation at 70 sheets a minute was prepared.

Regarding the toner, the yellow toner used was Y3, the magenta toner M3, the cyan toner C1 and the black toner Bk7, respectively. As a carrier, a carrier 7 was used.

The image density of each color after being fixed once when the un-fixed toner amount (M/S) on a transfer material was 0.5 mg/cm$^2$ was D0.5Y:1.40; D0.5M:1.30; D0.5C:1.30; and D0.5BK:1.28.

The difference in gloss of each color, the chroma of the color image and the color reproducibility in environmental changes are shown in Table 20A.

EXAMPLES 10A TO 20A

Except that Y2 to Y12 were used as the yellow toner, the image formation was carried out under the same conditions as in Example 1A. The difference in gloss of each color, the chroma of the color image and the color reproducibility in environmental changes are shown in Table 21A.

EXAMPLES 21A TO 35A

Except that M2 to M16 were used as the magenta toner, the image formation was carried out under the same conditions as in Example 1A. The difference in gloss of each color, the chroma of the color image and the color reproducibility in environmental changes are shown in Table 22A.

EXAMPLES 36A TO 39A

Except that C2 and C7 to C9 were used as the cyan toner, the image formation was carried out under the same condition as in Example 1A. The difference in gloss of each color, the chroma of the color image and the color reproducibility in environmental changes are shown in Table 23A

EXAMPLES 40A TO 44A

Except that Bk2 and Bk5 to Bk8 were used as the black toner, the image formation was carried out under the same conditions as in Example 1A. The difference in gloss of each color, the chroma of the color image and the color reproducibility in environmental changes are shown in Table 23A.

EXAMPLE 45A

In the above described conditions shown in Table 2A, by using a manufacturing apparatus for the photosensitive member for the image forming apparatus by a RF-PCVD method, a positively chargeable photosensitive member was prepared on an aluminum cylinder subjected to mirror finish having a diameter of 60 mm.

The estimation on the prepared photosensitive member was made by using an image forming apparatus which was a remodeled recopying machine of CLC1000 manufactured by CANON KABUSHIKI KAISHA. A cyan toner was disposed for a first image forming unit; a magenta toner, for a second image forming unit; a yellow toner, for a third image forming unit; a black toner, for a fourth image foiling unit. The circumferential speed (the process speed) of the photosensitive member was 200 mm/s. A surface potential of the photosensitive member was set at 380V at a developing area. The distance between the photosensitive drum and a developing sleeve was 500 $\mu$m and the developing sleeve rotated at a speed 1.9 times the circumferential speed of the photosensitive member. For the image formation, imagewise exposure was employed, and the image forming apparatus capable of performing the image formation at 50 sheets a minute was prepared.

Regarding the toner, Y1 was used as the yellow toner, M1 was used as the magenta toner, C1 was used as the cyan toner and Bk1 was used as the black toner. As a carrier, a carrier 1 was used.

The image density of each color after being fixed once when the un-fixed toner amount (M/S) on a transfer material was 0.5 mg/cm$^2$ was D0.5Y:1.43; D0.5M:1.23; D0.5C:1.30; and D0.5BK:1.30.

The difference in gloss of each color, the chroma of the color image and the color reproducibility in environmental changes are shown in Table 24A.

EXAMPLES 46A TO 56A

Except that Y2 to Y12 were used as the yellow toner, the image formation was carried out under the same conditions as in Example 45A. The difference in gloss of each color, the chroma of the color image and the color reproducibility in environmental changes are shown in Table 24A.

EXAMPLES 57A TO 71A

Except that M2 to M16 were used as the magenta toner, the image formation was carried out under the same conditions as in Example 45A. The difference in gloss of each color, the chroma of the color image and the color reproducibility in environmental changes are shown in Table 25A.

EXAMPLES 72A TO 76A

Except that C2 and C7 to C9 were used as the cyan toner, the image formation was carried out under the same conditions as in Example 45A. The difference in gloss of each color, the chroma of the color image and the color reproducibility in environmental changes are shown in Table 26A.

EXAMPLES 77A TO 80A

Except that Bk2 and Bk5 to Bk8 were used as the black toner, the image formation was carried out under the same conditions as in Example 45A. The difference in gloss of each color, the chroma of the color image and the color reproducibility in environmental changes are shown in Table 26A.

B) Practical Examples of Second Invention

<Preparation of Photosensitive Member>

(1) Preparation of a-Si Photosensitive Member

By using a manufacturing apparatus by a RF-PCVD method, a positively chargeable photosensitive member was prepared under the conditions as shown in Table 2B and a negatively chargeable photosensitive member under the conditions as shown in Table 3 on an aluminum cylinder subjected to mirror finish having a diameter of 60 mm.

The photosensitive member prepared by the method shown in Table 2B is referred to as a-Si photosensitive member 1 and the photosensitive member prepared by the method shown in Table 3A is referred to as a-Si photosensitive member 2.

Further, the photosensitive members prepared by the method shown in Table 2A by using aluminum cylinders having diameters of 15, 20, 40, 80 and 100 mm are referred to as a-Si photosensitive members 3, 4, 5, 6 and 7, respectively.

<Preparation of binder resin>

(1) Preparation of binder resin 1

| | |
|---|---|
| Polyoxypropylene(2,2)-2,2 bis (4-hydroxyphenyl)propane | 15 mol % |
| Polyoxyethylene (2,2)-2,2 bis (4-hydroxyphenyl) propane | 34 mol % |
| Terephthalic acid | 15 mol % |
| Fumaric acid | 36 mol % |
| Trimellitic acid | 2 mol % |

These were placed in a four-necked flask which was provided with a reflux condenser, a water separator, a nitrogen introduction pipe, a thermometer and a stirrer, and, while introducing nitrogen into the flask, condensation polymerization was performed.

In addition, in a reaction vessel which was provided with the stirring apparatus, a thermometer, a nitrogen introduction pipe, a reflux pipe and a dropping apparatus for isocyanate compound, 500 parts by weight of xylene and 100 parts by weight of polyester resin were placed. By stirring and heating, the polyester resin was dissolved into xylene. A xylene solution containing 5 parts by weight of diphenylmethane-4,4-di-isocyanate was dropped in a certain amount over two hours under xylene reflux. After the dropping was completed, stirring was continued for another one hour and the reaction was finished. Xylene was removed, and an urethane-modified polyester resin (1) as a binder resin was obtained.

Changing components and their amounts and performing the same condensation polymerization as in the polyester resin (1), polyester resins (2) to (6) were obtained. Physical properties of the obtained resins and the monomers used are shown in Table 4B.

(2) Preparation of Binder Resin 2

| | |
|---|---|
| Styrene | 75 parts by weight |
| n-butyl acrylate | 25 parts by weight |
| Mono-n-butyl malate | 10 parts by weight |
| Divinylbenzene | 0.3 parts by weight |
| Benzoyl peroxide | 1.2 parts by weight |

To the above described mixed solution, 170 parts by weight of water in which 0.12 part by weight of polyvinyl alcohol saponification product was dissolved was added and strongly stirred to prepare a suspension polymerization solution. To the reaction vessel in which 300 parts by weight of water was placed and the internal atmosphere was replaced with nitrogen, the above described suspension-polymerization solution was added, and suspension polymerization was performed. After the reaction was completed, the reaction product was washed with water, dehydrated and dried at 40° C. for 24 hours, a vinyl-type resin (7) was obtained.

This resin (7) had, as shown in Table 4B, an acid value of 13.2, Tg: 63° C., Mn: 6000 and Mw: 1880.

<Preparation of Toner>

(1) Preparation of Yellow Toner

Using the materials as shown in Table 5B, a yellow toner was prepared as follows. Physical properties of the obtained yellow toner are also shown in Table 5B.

(1—1) Preparation of Yellow Toners Y1 to Y18

| | |
|---|---|
| Polyester resin (1) | 70 parts by weight |
| Paste pigment | 100 parts by weight |

C.I. Pigment yellow 180 was manufactured by a known method. It was a paste pigment containing 30% by weight of solid content (the remaining 70% by weight was water) and obtained by removing water to a certain degree from a pigment slurry and without carrying out drying process even once First, a Kneader type mixer was loaded with the above described raw materials in the above described formulation and, while being mixed, the temperature was raised under non-pressurization condition. When reaching the highest temperature (which is inevitably decided by the boiling point of the solvent in the paste, in this case, about 90 to 100° C.), the pigment in the aqueous phase is distributed or transferred into a melted resin phase and, after confirming this, heated, melted, and kneaded further for 30 minutes, so that the pigment in the paste was sufficiently transferred. After that, the mixer was stopped for a time and a hot water is discharged, then the temperature was raised up to 130° C., and the resulting mixture was heated and melt-kneaded for about 30 minutes, and the pigment was dispersed and water was removed. On completion of the step, followed by cooling and a first kneaded product was taken out. The water content of this final kneaded product was about 0.8% by weight.

| | |
|---|---|
| The above described first kneaded product (the content of pigment particles is 30% by weight) | 20.0 parts by weight. |
| Polyester resin (1) | 86.0 parts by weight |
| Quaternary 4 ammonium salt | 4.0 parts by weight |

The above described formulation was sufficiently preliminarily mixed by a Henschel mixer and, while the temperature was set at 120° C., the mixture was melt-kneaded by a biaxial extrusion mixer to produce a second kneaded product which, after being cooled, was roughly ground to a degree of about 1 to 2 mm and then finely ground to a size below 40 μm by a pulverizer in an air-jet system. Further, the obtained finely ground product was classified and selected so that a weight average particle diameter in the particle size distribution becomes 8.0 μm, thereby obtaining yellow toner particles (classified product). In order to improve a flowability and impart chargeability, 0.1 part by weight of a titanium oxide fine powder treated with a Si-type compound to be hydrophobic was externally added to 100 parts by weight of the yellow toner particles to produce a yellow toner (Y1). The used external additives are shown in Table 8B.

Next, in the same way as in the yellow toner Y1 except that the type and amount of pigment as a colorant were changed, the yellow toners Y2 to Y12, Y17 and Y18 were prepared.

Next, except that the grinding and classifying conditions and the amount of external additive were changed, yellow toners Y13 to Y16 different in particle size were obtained in approximately the same way as in the yellow toner Y1.

| | |
|---|---|
| The above described first kneaded product | 26.7 parts by weight |
| Polyester resin (1) | 81.3 parts by weight |
| Quaternary ammonium salt | 4 parts by weight |

The above formulation was sufficiently preliminary mixed by the Henschel mixer, and melt-kneaded by a biaxial extruder to produce a second kneaded product and, after that, in the same way as in the yellow toner Y1, a yellow toner Y19 was obtained. The pigment content was adjusted to 4 parts by weight, and a yellow toner Y20 was obtained in the same way.

(1–3) Preparation of a Yellow Toner Y21

| | |
|---|---|
| Polyester resin (1) | 100 parts by weight |
| C.I. pigment yellow 180 | 4 parts by weight |
| Quarternary ammonium salt | 4 parts by weight |

The above formulation was sufficiently preliminary mixed by the Henschel mixer, and melt-kneaded by the biaxial extruder and, after that, a yellow toner Y21 was obtained in the same way as in the yellow toner Y1.

(1–4) Preparation of a Yellow Toner Y22.

The first kneaded product (the content of the pigment particles 30% by weight) prepared in the case of the yellow toner Y1 was further kneaded five times by a three-roll, and the pigment was dispersed sufficiently and, after that, a yellow toner Y22 was obtained in the same way.

(2) Preparation of Magenta Toner (2-1) Preparation of Magenta Toners M1 to M16

After first kneaded product were obtained in approximately the same way as in the yellow toner Y1 except that paste pigments of the magenta pigments as shown in Table 6B were used, the products each were so diluted and kneaded as to have the desired pigment contents to produce second kneaded products and, after that, magenta toners M1 to M16 having a weight average particle size of 7.5 μm were obtained in the same way as in the case of the yellow toner Y1.

(3)Preparation of Cyan Toner (3-1) Preparation of Cyan Toners C1, C2 and C4 to C6.

After first kneaded products were obtained approximately in the same way as in the yellow toner Y1 except that the paste pigments of the cyan pigments as shown in Table 7B were used, and then, the products each were diluted and kneaded to have the desired pigment contents to produce second kneaded products and, after that, cyan toners C1 and C2 having a weight average mean diameter of 6.0 to 8.0 μm were obtained in the same way as in the case of the yellow toner Y1. Further, changing an external additive from titanium A to aluminas A and C4 to C6 were obtained in the same way as in the yellow toner Y1.

(3-2) Preparation of Cyan Toner C3

C3 was produced approximately in the same way as in the yellow toner Y21 except that the pigment used as a colorant was changed.

The following raw materials were sufficiently preliminarily mixed, and melt-kneaded by the biaxial extruder and, approximately in the same way as in the case of the yellow toner Y21, the cyan toner C3 as shown in Table 7B was obtained.

| | |
|---|---|
| Polyester resin (1) | 100 parts by weight |
| C.I. pigment blue 15.3 | 2 parts by weight |
| Quaternary ammonium salt | 4 parts by weight |

(3-3) Preparation of Cyan Toners C7 to C9

Except that, instead of a charge control agent used in the cyan toner C1, imidazole compound, ammonio group-containing styrene acryl copolymer resin or a mixture of quaternary ammonium salt and imidazole compound were used, cyan toners C7 to C9 as shown in Table 7B were obtained in the same way as in the case of the cyan toner C1.

(3–4)Preparation of Cyan Toners C10 to C15

Except that, in stead of the resin (1) used in the cyan toner C1, the resin (2) to the resin (7) were used, cyan toners C10 to C15 as shown in Table 7 were obtained in the same way as in the case of the cyan toner C1.

(4) Preparation of Black Toner (4-1) Preparation of Black Toner Bk1

| | |
|---|---|
| Polyester resin (1) | 70 parts by weight |
| CB-A | 30 parts by weight |

The above describe raw materials were fed into a kneader-type mixer and, while being mixed, raised in temperature under non-pressurization condition and sufficiently preliminarily mixed. After that, they were kneaded four times by the three-roll and a first kneaded product was obtained.

| | |
|---|---|
| The above described first kneaded product | 10.0 parts by weight |
| Polyester resin (1) | 93.0 parts by weight |
| Quaternary ammonium salt | 4 parts by weight |

The above described raw materials were sufficiently preliminarily mixed by the Henschel mixer, and melt-kneaded by the biaxial extruder to produce a second kneaded product and, after that, a black toner Bk1 as shown in Table 9 was obtained in approximately the same way as in the case of the yellow toner Y1.

The black pigment used as a colorant is shown in Table 10.

(4-2) Preparation of Black Toners Bk2 and Bk3

After a first kneaded product was obtained in the same way as in the black toner Bk1, the mixing amount was so adjusted to a desired carbon black content and, after that, black toners Bk2, Bk3 were obtained in the same way as in the case of the black toner Bk1.

(4-3) Preparation of Black Toner Bk4

| | |
|---|---|
| Polyester resin (1) | 100 parts by weight |
| CB-A | 2.0 parts by weight |
| Quaternary ammonium salt | 4 parts by weight |

The above described materials were sufficiently preliminarily mixed by the Henschel mixer, and melt-kneaded by the biaxial extruder and, after that, a black toner Bk4 as shown in Table 9B was obtained in the same way as in the case of the Bk1 toner.

(4-4) Preparation of Black Toners Bk5 and Bk6

Instead of the CB-A used in the black toner Bk1, CB-B or CB-C was used and further, except that an amount of the carbon black was slightly changed, black toners Bk5 and Bk6 as shown in Table 9B were obtained in the same way as in the case of the black toner Bk1.

(4–5) Preparation of Black Toner Bk7

| | |
|---|---|
| Polyester resin (1) | 70 parts by weight |
| C.I. pigment yellow 17 | 7.5 parts by weight |
| C.I. pigment red 5 | 15 parts by weight |
| C.I. pigment blue 15:3 | 7.5 parts by weight |

The above materials were fed into the kneader-type mixer and, while being mixed, raised in temperature under non-pressurization condition and sufficiently pre-mixed. After that, they were kneaded four times by the three-roll and a first kneaded product was obtained.

| | |
|---|---|
| The above described first kneaded product | 20.0 parts by weight |
| Polyester resin (1) | 83.67 parts by weight |
| The first kneaded product of the CB-A used at the preparation time of the black toner Bk1 | 3.33 parts by weight |
| Quaternary ammonium salt | 4 parts by weight |

The above described materials were sufficiently preliminarily mixed by the Henschel mixer, and melt-kneaded by the biaxial extruder and, after that, a black toner Bk7 as shown in Table 9B was obtained in the same way as in the case of the black toner Bk1.

(5) Preparation of Carrier and Developer

By using a Mn—Mg—Fe type ferrite as a core material and by coating the core material with 0.2% by weight of modified silicone resin produced from a nitrogen-containing silane coupling agent and a silicone resin, a carrier (carrier 1) for a two component type developer was prepared. The 50% volume average particle size of the carrier 1 was 40 $\mu$m.

Next, by changing the core material, coating material and particle size, carriers 2 to 7 were prepared. The preparation methods, sizes of carriers, etc. are shown in Table 11B.

Each of two-component developers was produced by mixing 5 parts by weight of each of the above obtained toners with each of the foregoing carriers to be 100 parts by weight in total.

<Experimental Example 1B>

The estimation on images was made by using an experimental apparatus which had the same constitution as the image forming apparatus shown in FIG. 1 in the above described embodiment and was capable of forming a full color image of four colors, and was provided with charging, exposing, developing, transferring, cleaning and decharging means.

For a first image forming unit, the yellow toner was arranged; for a second image forming unit, the magenta toner; for a third image forming unit, the cyan toner; and for a fourth image forming unit, the black toner, and for the photosensitive member, positively chargeable photosensitive members 1, 3, 4, 6, and 7 were used.

The circumferential speed (process speed: PS) of the photosensitive member was 200 mm/s and the surface potential of the photosensitive member was set at 350V in a developing area. The distance between the photosensitive member and the developing sleeve was 400 $\mu$m and the developing sleeve was allowed to rotate at a speed two times the circumferential speed of the photosensitive member. For the image forming, an imagewise exposure was applied.

Regarding the toners, Y1, M1, C1 and Bk1 were used as the yellow toner, the magenta toner, the cyan toner, and the black toner, respectively.

In the image estimation, investigation was carried out to measure the image density in the case of development with only the black toner alone, the image density in the case of development with only the yellow toner and the image density of only the yellow portion in the case of development with the four colors. The results are shown in Table 12B.

When the photosensitive member 3 having a diameter of 15 mm was used, the surface potential of 350V was unable to obtain and a high image density of image was unable to obtain. For this reason, the circumferential speed of the photosensitive member was reduced to 100 mm/s and the image formation was made at the same potential. However, even in such a case, a satisfactory image was unable to be obtained.

Further, when the photosensitive member 7 having a diameter of 100 mm was used, the density of a single color was sufficiently obtained, but when the image formation was made by using four colors, the lowering of the image density of the image formed by the first image forming unit was observed. The reason is thought to be that, because the diameter of the photosensitive member became larger. the toner on the transfer material was transferred again on the photosensitive member.

<Experimental Example 2B>

By using the experimental apparatus used in the Experimental Example 1B and by using the a-Si photosensitive member having a diameter of 60 mm as a photosensitive member, the image formation was made. The charge potential was changed in a range from 250 to 500V, and the image density of a black image, the dispersion of the densities at the reflection density of 0.6 and a difference in the density after one cycle between an exposed portion and a non-exposed portion at the reflection density of 0.6, which is called the ghost, were examined. The result is shown in Table 13B.

When the surface potential was smaller than 300V, the image density was lowered. When the potential was larger than 450V, the density dispersion of density dispersion of images having the reflection density of 0.3 became worse and the drum ghost became larger.

<Experimental Example 3B>

By using the a-Si photosensitive member having a diameter of 60 mm for the photosensitive member of the experimental apparatus used in the Experimental Example 1, estimation was made regarding the dependency on the minimum gap (SD gap) between the photosensitive member and the developing sleeve. The SD gap was changed in a range from 300 to 900 $\mu$m and the density and melt-adhesion of the photosensitive member at the time 10,000-sheet copies of a 7%-black original were printed were examined. The results are shown in Table 14B.

When the SD gap was smaller than 350 $\mu$m, the drum melt-adhesion occurred. When the gap was larger than 800 $\mu$m, the image density was unable to satisfactorily obtained.

<Experimental Example 4B>

By using the experimental apparatus used in the Experimental Example 1 and by using the a-Si photosensitive member having a diameter of 60 mm as a photosensitive member, estimation was made for the dependency on a peripheral speed ratio of the sleeve. The peripheral speed of the sleeve was changed in a range from 1.05 to 5 times the circumferential speed of the photosensitive member, and the black image density at the initial stage and the image density at the time 50,000-sheet copies of a 7%-black original were printed were examined. The results are shown in Table 15B.

When a sleeve circumferential speed ratio was smaller than 1.1, the lowering of the image density was observed from the initial stage. When the sleeve peripheral speed ratio was larger than 4.0, the lowering of the density occurred after extensive operation on 50,000 sheets. Further, fogging occurred and no excellent image was obtained.

<Experimental Example 5B>

By using the experimental apparatus used in the Experimental Example 1B and by using the a-Si photosensitive member having a diameter of 60 mm as a photosensitive member, estimation on the dependency of the image quality on the particle size of the toner was made. The yellow toners Y1 and Y13 to Y16 were used. The results are shown in Table 16B.

<Experimental Example 6B>

By using the a-Si photosensitive member having a diameter of 60 mm for the photosensitive member of the experimental apparatus used in the Experimental Example 1B, estimation regarding the dependency of the image quality for the particle size of the carrier was made. The results are shown in Table 17B.

When the carrier particle size was smaller than 10 $\mu$m. the carrier adhesion at image portions was observed from the initial stage of the extensive operation, and further, when the carrier was smaller than 10 $\mu$m, the coating amount on the sleeve was not even and the irregularity of the density was liable to occur. On the other hand, when the carrier particle size was larger than 80 $\mu$m, the density of ears formed on the sleeve was sparse and ear traces of ears were produced in a halftone portion, thereby causing lack of image uniformity.

<Experimental Example 7B>

By using the experimental apparatus used in the Experimental Example 1B and by using the a-Si photosensitive member as a photosensitive member, estimation regarding the dependency on a tinting strength (or coloring power) of the toner was made. The tinting strength of the toner was estimated by the image density (D0.5) after being fixed once when the un-fixed toner amount (M/S) on a transfer material was 0.5 mg/cm$^2$. Regarding the yellow toners, by using Y3 and Y17 to Y22 which were different from each other in tinting strength, images of 16 gradations were formed for each toner, and the density and the gradation reproducibility were estimated. The results are shown in Table 18B.

According to the results as shown in Table 18B, when D0.5 was smaller, a sufficient image density was not obtained, and when D0.5 was larger than 1.8, a problem arose in the density reproducibility of intermediate color in environmental changes.

<Experimental Example 8B>

By using the experimental apparatus used in the Experimental Example 1B and by using the a-Si photosensitive member having a diameter of 60 mm as a photosensitive member, estimation was made for the dependency of images on the binder resin of the toner. By using toners C10 to C15 different in resin from the cyan toner C1, estimation was made on a change from an image density at the initial stage to an image density at the time 50,000-sheet copies were printed under a low temperature and low humidity environment (the image density at the beginning→the image density at the time 50.000-sheet copies were printed), image quality under a high temperature and high humidity environment and transparency of OHP, for each resin. The results are shown In Table 19B.

EXAMPLE 1B

By remodeling a recopying machine CLC1000 (manufactured by CANON KABUSHIKI KAISHA) and using an experimental apparatus comprising the same constitution as the image forming apparatus as shown in FIG. 1, estimation on images was made.

For a first image forming unit, a cyan toner was arranged; for a second image forming unit, a magenta toner; for a third image forming unit, a yellow toner; and for a fourth image forming unit, a black toner, and for the photosensitive member, the positively chargeable a-Si photosensitive member 1 as manufactured above were used. The circumferential speed (process speed; PS) of the photosensitive member was 133 mm/s.

The surface potential of the photosensitive member was set at 400V in a developing area, and the distance between the photosensitive member and the developing sleeve was 450 $\mu$m, and the developing sleeve was allowed to rotate at a speed 1.75 times the speed of the photosensitive member. For the image forming, the imagewise exposure was adopted and the image forming apparatus capable of performing the image formation at 30 sheets a minute was prepared.

Regarding toners, Y1, M1, C1 and Bk1 were used as the yellow toner, the magenta toner, the cyan toner and the black toner, respectively. and as a magnetic carrier, the carrier 1 was used.

The image density of each color after being fixed once when the un-fixed toner amount(M/S) on the transfer material was 0.5 g/cm$^2$ was 1.42 for D0.5Y, 1.23 for D0.5M, 1.30 for D0.5C and 1.28 for D0.55k. Further, the difference between the maximum value (D0.5 max) and the minimum value (D0.5 min) of D0.5Y, D0.5M and D0.5C was 0.19.

The difference in gloss of each color, the chroma of the color image and the color reproducibility in environmental changes are shown in Table 20B.

EXAMPLE 2B

Except that Y5, M5 and C2 were used as the yellow toner, the magenta toner and the cyan toner, respectively, the image forming estimation was made in the same way as in Example 1B.

As a result, D0.5Y was 1.11, D0.5M was 1.15, D0.5C was 1.23, and D0.5Bk was 1.28. The difference between the maximum value (D0.5 max) and the minimum value (D0.5 min) of D0.5Y, D0.5M and D0.5C was 0.12.

The difference in gloss of each color, the chroma of the color image and the color reproducibility in environmental changes are shown in Table 20B.

EXAMPLE 3B

Except that Y5, M10 and C2 were used as the yellow toner, the magenta toner and the cyan toner, respectively, the image forming estimation was made in the same way as in Example 1B.

The difference between the maximum value (D0.5 max) and the minimum value (D0.5 min) of D0.5Y, D0.5m and D0.5C, and the difference in gloss of each color, the chroma of the color image and the color reproducibility in environmental changes are shown in Table 20B.

COMPARATIVE EXAMPLE 1B

Except that Y5, M13 and C2 were used as the yellow toner, the magenta toner and the cyan toner, respectively, the image forming estimation was made in the same way as in Example 1B.

The difference between the maximum value (D0.5 max) and the absolute minimum value (D0.5 min) of D0.5Y, D0.5M and D0.5C. and the difference in gloss of each color, the chroma of the color image and the color. reproducibility in environmental changes are shown in Table 20B.

As a result of the image estimation, the difference in gloss of each color was large and no clear image could be obtained. Further, severe control on density variation with environmental difference was needed, and density irregularity with environmental difference was intensified.

EXAMPLE 4B

Except that Y5, M5 and C4 were used as the yellow toner, the magenta toner and the cyan toner, respectively, the image forming estimation was made in the same way as in Example 1B.

The difference between the maximum value (D0.5 max) and the minimum value (D0.5 min) of D0.5Y, D0.5M and D0.5C, and the difference in gloss of each color, the chroma of the color image and the color reproducibility in environmental changes are shown in Table 20B.

COMPARATIVE EXAMPLE 2B

Except that Y5, M5 and C5 were used as the yellow toner, the magenta toner and the cyan toner, respectively, the image forming estimation was made in the same way as in Example 1B.

The difference between the maximum value (D0.5 max) and the minimum value (D0.5 min) of D0.5Y, D0.5M and D0.5C, and the difference in gloss of each color, the chroma of the color image and the color reproducibility in environmental changes are shown in Table 20B.

As a result of the image estimation, the difference in gloss of each color was large and no clear image could be obtained. Further, severe control on density variation with environmental difference was needed, and density irregularity with environmental difference was intensified.

EXAMPLE 5B

Except that Y18, M13 and C5 were used as the yellow toner, the magenta toner and the cyan toner, the image forming estimation was made in the same way as in Example 1B.

D0.5Y was 1.57, D0.5M was 1.64, D0.5C was 1.69 and D0.5Bk was 1.28. The difference between the maximum value (D0.5 max) and the minimum value (D0.5 mm) of D0.5Y, D0.5M and D0.5C was 0.12.

The difference in gloss of each color, the chroma of the color image and the color reproducibility in environmental changes are shown in Table 20B.

EXAMPLE 6B

Except that Y18, M1 and C5 were used as the yellow toner, the magenta toner and the cyan toner, respectively, the image forming estimation was made in the same way as in Example 1B.

The difference between the maximum value (D0.5 max) and the minimum value (D0.5 min) of D0.5Y, D0.5M and D0.5C, and the difference in gloss of each color. the chroma of the color image and the color reproducibility in environmental changes are shown in Table 20B.

COMPARATIVE EXAMPLE 3B

Except that Y18, M15 and C5 were used as the yellow toner, the magenta toner and the cyan toner, the image forming estimation was made in the same way as in Example 1B.

The difference between the maximum value (D0.5 max) and the minimum value (D0.5 min) of D0.5Y, D0.5M and D0.5C, and the difference in gloss of each color. the chroma of the color image and the color reproducibility in environmental changes are shown in Table 20B.

As a result of the image estimation, the difference in gloss of each color was large and no clear image could be obtained. Further, severe control on density variation with environmental difference was needed, and density irregularity with environmental difference was intensified.

EXAMPLE 7B

Except that Y8, M13 and C5 were used as the yellow toner, the magenta toner and the cyan toner, respectively, the image forming estimation was made in the same way as in Example 1B.

The difference between the maximum value (D0.5 max) and the minimum value (D0.5 min) of D0.5Y, D0.5M and D0.5C, and the difference in gloss of each color, the chroma of the color image and the color reproducibility in environmental changes are shown in Table 20B.

COMPARATIVE EXAMPLE 4B

Except that Y5, M13 and C5 were used as the yellow toner, the magenta toner and the cyan toner, respectively, the image forming estimation was made in the same way as in Example 1B.

Thc difference between the maximum value (D0.5 max) and the minimum value (D0.5 min) of D0.5Y, D0.5M and D0.5C, and the difference in gloss of each color, the chroma of the color image and the color reproducibility in environmental changes are shown in Table 20B.

As a result of the image estimation, the difference in gloss of each color was large and no clear image could be obtained. Further, severe control on density variation with environmental difference was needed, and a density irregularity with the environmental difference was intensified.

EXAMPLE 8B

By remodeling a copying machine CLC1000 (manufactured by CANON KABUSHIKI KAISHA) and using an experimental apparatus comprising the same constitution as the image forming apparatus as shown in FIG. 1 estimation on the image was made.

For a first image forming unit, the cyan toner was arranged; for a second image forming unit, the magenta toner; for a third image forming unit, the yellow toner; and for a fourth image forming unit, the black toner, and for the photosensitive member, the positively chargeable a-Si photosensitive member 5 as manufactured above was arranged respectively as the photosensitive member, and the circumferential speed (process speed: PS) was 100 mm/s.

The surface potential of the photosensitive member was set at 320V in a developing area, and the distance between the photosensitive member and the developing sleeve was taken as 600 $\mu$m, and the developing sleeve was allowed to rotate at a speed 1.5 times the speed of the photosensitive member. For the image forming, the imagewise exposure was employed and the image forming apparatus capable of performing the image formation at 21 sheets a minute was prepared.

Regarding the toners, the yellow toner used was Y2, the magenta toner M2, the cyan toner C2 and the black toner Bk2, and as a magnetic carrier, a carrier 6 was used.

D0.5Y was 1.41, D0.5M was 1.41, D0.5C was 1.23 and D0.5Bk was 1.50.

The difference in gloss of each color, the chroma of the color image and the color reproducibility in environmental changes are shown in Table 20B.

EXAMPLE 9B

By remodeling a copying machine CLC1000 (manufactured by CANON KABUSHIKI KAISHA) and using an experimental apparatus comprising the same constitution as the image forming apparatus as shown in FIG. 1, estimation on the image was made.

For a first image forming unit, the cyan toner was arranged; for a second image forming unit, the magenta toner; for a third image forming unit, the yellow toner: and for a fourth image forming unit, the black toner, and for the photosensitive member, the positively chargeable a-Si photosensitive member as manufactured above was used as a photosensitive member. The circumferential speed (process speed: PS) 300 mm/s.

The surface potential of the photosensitive member was set at 380V in a developing area, and the distance between the photosensitive member and the developing sleeve was 450 $\mu$m, and the developing sleeve was allowed to rotate at a speed 3 times the speed of the photosensitive member. For the image forming, the imagewise exposure was applied and the image forming apparatus capable of performing the image formation at 70 sheets a minute was prepared.

Regarding the toners, the yellow toner used was Y3, the magenta toner M3, the cyan toner C1 and the black toner Bk7, and as a magnetic toner, a carrier 7 was used.

D0.5Y was 1.38, D0.5M was 1.30, D0.5C was 130 and D0.5Bk was 1.25.

The difference in gloss of each color, the chroma of the color image and the color reproducibility in environmental changes are shown In Table 20B.

EXAMPLES 10B TO 20B

Except that Y2 to Y12 were used as the yellow toner, the image forming estimation was made in the same conditions as in Example 1B. The difference in gloss of each color, the chroma of the color image and the color reproducibility in environmental changes are shown in Table 20B.

EXAMPLES 21B TO 35B

Except that M2 to M16 were used as the magenta toner, the image forming estimation was made in the same conditions as in Example 1B. The difference in gloss of each color, the chroma of the color image and the color reproducibility in environmental changes are shown in Table 20B.

EXAMPLES 36B TO 39B

Except that C2 and C7 to C9 were used as the cyan toner, the image forming estimation was made in the same conditions as Example 1B. The difference in gloss of each color, the chroma of the color image and the color reproducibility in environmental changes are shown in Table 20B.

EXAMPLES 40B TO 44B

Except that Bk2 and Bk5 to Bk8 were used as the black toner, the image forming estimation was made in the same conditions as in Example 1B. The difference in gloss of each color, the chroma of the color image and the color reproducibility in environmental changes are shown in Table 20B.

EXAMPLE 45B

By remodeling a copying machine CLC1000 (manufactured by CANON KABUSHIKI KAISHA) and using an experimental apparatus comprising the same constitution as the image forming apparatus as shown in FIG. 1, estimation on the image was made.

For a first image forming unit, the cyan toner was arranged; for a second image forming unit, the magenta toner; for a third image forming unit, the yellow toner; and for a fourth image forming unit, the black toner, and for the photosensitive member, the positively chargeable a-Si photosensitive member as manufactured above was arranged. The circumferential speed (process speed: PS) was 200 mm/s.

The surface potential of the photosensitive member was set at 380V in a developing area, and the distance between the photosensitive member and the developing sleeve was 500 $\mu$m, and the developing sleeve was allowed to rotate at a speed 1.9 times the speed of the photosensitive member. For the image forming, a back scan exposure was applied and the image forming apparatus capable of performing the image formation at 50 sheets a minute was prepared.

Regarding the toners, Y1, M1, C1 and Bk 1 were used as the yellow toner, the magenta toner, the cyan toner and the black toner, respectively.

D0.5Y was 1.42, D0.5M was 1.23, D0.5C was 1.30 and D0.5Bk was 1.28.

The difference in gloss of each color, the chroma of the color image and the color reproducibility in environmental changes are shown in Table 20B.

C) Practical Examples of the Third Invention

<Preparation of a Photosensitive Member>

A positively chargeable photosensitive member and a negatively chargeable photosensitive member were prepared on a mirror finish aluminium cylinder 60 mm in diameter under the conditions shown in Table 1C and the conditions shown in Table 2C, respectively, by the use of a preparation device of a photosensitive member for an image forming apparatus by a RP-PCVD method. In the following, a photosensitive member prepared by the method shown in Table 1C will be referred to as photosensitive member 1 and a photosensitive member prepared by the method shown in Table 2C will be referred to as photosensitive member 2.

<Examples of Toner Preparation>

As binder resins, those shown in Table 3C were used.

<Examples of Preparing Yellow Toner>

A yellow toner was prepared as described below.

Polyester resin (1) 70 parts by weight

A paste pigment having 30% by weight of solid content (70% by weight was water) and obtained by removing some parts of water from a pigment slurry before a filtration process in which slurry C.I. Pigment yellow 180 was produced by a known method, and by never letting through a drying process 100 parts by weight The First Kneading Process The above-mentioned raw materials were fed into a kneader-type mixer according to the above-mentioned formulation and were increased in temperature with mixing at normal pressure. At the time when the highest temperature (the temperature is inevitably determined by the boiling point of a solvent in the paste, and in this case, about 90 to 100° C.) was reached, the pigment in the liquid phase divided or moved to the melted resin phase. After the state was confirmed, the mixture was further melted and kneaded with heating for 30 minutes to move the pigment in the paste thoroughly. After that, once the mixer was stopped, and after hot water was exhausted, the mixture was further heated to 130° C. and was melted and kneaded with heating for about 30 minutes to evaporate water as well as disperse the pigment. After the process was ended, the mixer was cooled and the kneaded product was taken out. The water content in this final kneaded product was about 0.8 wt. %.

The Second Kneading Process

| | |
|---|---|
| The above-mentioned kneaded product (the content of pigment particles is 30 wt. %) | 20.0 parts by weight |
| Polyester resin (1) | 86.0 parts by weight |
| Aluminium compound of di-tert-butyl salicylate | 4.0 parts by weight |

The materials of the above-mentioned formulation were sufficiently premixed in a Henschel mixer and then were melted and kneaded with a double screw extrusion kneading machine in which temperature was set to be 120° C. After being cooled, the kneaded product was roughly grinded to about 1 to 2 mm size with a hammer mill and then further pulverized to 40 $\mu$m or less in particle diameter with a air-jet type pulverizer. Further, the obtained pulverized product was classified, and yellow toner particles (classified product) were obtained by selecting particles so that their weight-average diameter will be 8.0 $\mu$m in size distribution. To 100 parts by weight of the yellow toner particles, 1.0 part by weight of titanium oxide fine powder (titanium oxide A which is listed in Table 7C), which was subjected to hydrophobicity treatment with a silicon compound, was externally added for the purpose of improving fluidity and imparting chargeability to the yellow toner (Y1).

Next, yellow toner Y2 to Y12, Y17 and Y18 were prepared in the same way except for changing kinds of pigments and-their amounts to be added.

Next, yellow toner Y13 to Y16 different in particle size were prepared in almost the same way as in the preparation of yellow toner Y1, except for changing the conditions of grinding and classification and the amounts of external additives.

An Example of Preparing Yellow Toner Y19 and Y20

| | |
|---|---|
| Polyester resin (1) | 70 parts by weight |
| C.I. Pigment yellow 93 | 30 parts by weight |

The above-mentioned materials were fed into a kneader-type mixer and were increased in temperature with mixing at normal pressures to be sufficiently premixed. After that, the mixture was kneaded with a three-roll two times to make the first kneaded product.

| | |
|---|---|
| The first kneaded product | 26.7 parts by weight |
| Polyester resin (1) | 81.3 parts by weight |
| Aluminium compound of di-tert-butyl salicylate | 4 parts by weight |

The above-mentioned materials were sufficiently premixed in a Henschel mixer and then were melted and kneaded with a double screw extruder, and after that, in the same way as in yellow toner Y1, yellow toner Y19 was obtained.

Yellow toner Y20 in which the pigment content is 4 parts by weight was obtained almost in the same way.

An Example of Preparing Yellow Toner Y21

| | |
|---|---|
| Polyester resin (1) | 100 parts by weight |
| C.I. Pigment yellow 93 | 4 parts by weight |
| Aluminium compound of di-tert-butyl salicylate | 4 parts by weight |

The above-mentioned materials were sufficiently premixed in a Henschel mixer and then were melted and kneaded with a double screw extruder, and after that, yellow toner Y21 was obtained in the same way as in yellow toner Y1.

An Example of Preparing Yellow Toner Y22

The first kneaded product (the content of pigment particles is 30 wt. %), which was prepared in the process of preparing yellow toner Y3, was further kneaded with a three-roll five times to make pigments sufficiently dispersed. After that yellow toner Y22 was obtained in the same way.

The preparation methods of respective yellow toners are shown in Table 4C.

<Examples of Preparing Magenta Toner>

Almost in the same way as in yellow toner Y1, that is, after the first kneaded products were obtained using each paste pigment for magenta pigments described in Table 5C, the products were diluted and kneaded so that the desired contents of pigments could be obtained. After that, almost in the same way, magenta toners M1 to M16 of 7 to 7.5 $\mu$m in weight-average particle size were obtained.

<Examples of Preparing Cyan Toner>

An Example of Preparing Cyan Toners C1, C2 and C4 to C6

Almost in the same way as yellow toner Y1, that is, after the first kneaded product was obtained using each paste pigment for cyan materials described in Table 6, the product was diluted and kneaded so that the desired content of pigment could be obtained. After that, almost in the same way, cyan toners C1 and C2 of 6.0 to 8.0 μm in weight-average diameter were obtained, and C4 to C6 was obtained by changing the external additive from titanium oxide A to alumina A described in Table 7C.

The BET specific surface area of inorganic fine powder described in Table 7C can be obtained by the BET multipoint method with Autosorp 1, a full automatic gas adsorption amount measurement device made by Yuasa Ionics Inc., using nitrogen gas as a adsorption gas. Furthermore, as a pretreatment of a sample, deaeration will be carried out at 50° C. for 6 hours An Example of Preparing Cyan Toner C3

Cyan toner C3 was prepared almost in the same way as in yellow toner Y21.

| | |
|---|---|
| Polyester resin (1) | 100 parts by weight |
| C.I. Pigment blue 15:3 | 2 parts by weight |

Aluminium compound of di-tert-butyl salicylate 4 parts by weight

The above-mentioned materials were sufficiently premixed in a Henschel mixer and then were melted and kneaded with a double screw extruder, and almost in the same way except for using alumina A described in Table 7 as an external additive from the outside, cyan toner C3 described in Table 6C was obtained An Example of Preparing Cyan Toners C7 to C9

Almost in the same way except for using chromium compound of di-tert-butyl salicylate, zirconium compound of di-tert-butyl salicylate and aluminium compound of n-octyl salicylate instead of a charge control agent used in the case of preparing cyan toner C1, cyan toner C7 to C9 described in Table 6C were obtained.

An Example of Preparing Cyan Toners C10 to C15

Almost in the same way except for using resin (2) to resin (7) Instead of resin (1) used in the case of preparing cyan toner C1. cyan toners C10 to C15 shown in Table 6C were obtained <Examples of Preparing Black Toner>

An Example of Preparing Black Toner Bk1

| | |
|---|---|
| Polyester resin (1) | 70 parts by weight |
| CB-A (described in Table 9C) | 30 parts by weight |

The above-mentioned materials were fed into a kneader-type mixer and were raised in temperature with mixing at normal pressures to be sufficiently premixed. After that, the mixture was kneaded with a three-roll four times to make the first kneaded product.

| | |
|---|---|
| The above-mentioned first kneaded product | 10.0 parts by weight |
| Polyester resin (1) | 93.0 parts by weight |
| Aluminium compound of di-tert-butyl salicylate | 4 parts by weight |

The above-mentioned materials were sufficiently premixed in a Henschel mixer and then were melted and kneaded with a double screw extruder, and after that, almost in the same way as in Y1, black toner Bk1 described in Table 8C was obtained.

An Example of Preparing Black Toners Bk2 and Bk3

After the first kneaded product was obtained almost in the same way as in black toner Bk1, the compounding amount was controlled so that the desired amount of carbon black could be obtained, after that, almost in the same way, black toners Bk2 and Bk3 described in Table 8C were obtained.

An Example of Preparing Black Toner Bk4

| | |
|---|---|
| Polyester resin (1) | 100 parts by weight |
| CB-A | 2.0 parts by weight |
| Aluminium compound of di-tert-butyl salicylate | 4 parts by weight |

The above-mentioned materials were sufficiently premixed in a Henschel mixer and then were melted and kneaded with a double screw extruder to prepare toner without making the first kneaded product, and black toner Bk4 described in Table 8C was obtained.

An Example of Preparing Black Toner Bk5 and Bk6

Instead of CB-A used in the case of preparing Bk1, using carbon black described in Table 9, i.e. CB-B and CB-C, the amount added of carbon black was changed slightly. Referring to the others, in the same way as in the case of Bk 1 part, black toner Bk5 and Bk6 described in Table 8C were obtained.

An Example of Preparing Black Toner Bk7

| | |
|---|---|
| Polyester resin (1) | 70 parts by weight |
| C.I. Pigment yellow 17 | 7.5 parts by weight |
| C.I. Pigment red 5 | 15 parts by weight |
| C.I. Pigment blue 15:3 | 7.5 parts by weight |

The above-mentioned materials were fed into a kneader-type mixer and were raised in temperature with mixing at normal pressures to be sufficiently premixed. After that, the mixture was kneaded with a three-roll four times to make the first kneaded product.

| | |
|---|---|
| The above-mentioned first kneaded product | 20.0 parts by weight |
| Polyester resin (1) | 83.67 parts by weight |
| The first kneaded product of CB-A used in case of preparing black toner Bk1 | 3.33 parts by weight |
| Aluminum compound of di-tert-butyl salicylate | 4 parts by weight |

The above-mentioned materials were sufficiently premixed in a Henschel mixer and then were melted and kneaded with a double screw extruder, and after that, almost in the same way as Bk1, black toner Bk7 described in Table 8C was obtained.

An Example of Preparing Black Toner Bk8

Black toner Bk8 described in Table 8C was obtained in almost the same way in as in Bk1 toner except for using silica A described in Table 7C instead of titanium oxide A used in the case of preparing Bk1 toner.

Furthermore, the primary particle diameter and BET specific surface area of carbon black described in Table 9C were measured in the same way as in the above described inorganic fine powder. The oil absorption of CB is the ratio of linseed oil to carbon black when fluidity was observed for the first time in a paste prepared by mixing carbon black and linseed oil. The pH of CB was measured with a glass electrode after preparing an aqueous suspension of carbon black.

<Experimental Example 1C>

Negatively chargeable photosensitive members (photosensitive member 2) were prepared on mirror finish aluminium cylinders of 15 mm to 100 mm in diameter under the conditions shown in Table 2C mentioned above by the use of a preparation device of a photosensitive member by RP-PCVD method.

Images were evaluated using an experimental apparatus in which each developing device in an image forming apparatus shown in FIG. 1, which comprises charging, exposuring, developing, transferring, cleaning and decharging means and can form a full-color image with four colors, was changed to a one component developing device shown in FIG. 6.

Yellow toner, magenta toner, cyan toner and black toner were arranged in the first image forming unit, the second image forming unit, the third image forming unit and the fourth image forming unit, respectively. The circumferential speed of the photosensitive member (process speed) was set to be 200 mm/s, and the surface potential of the photosensitive member was set to be 350 V in the developing area. The developing sleeve was rotated at the speed of 2 times the circumference speed of the photosensitive member. Image-wise exposure was adopted for forming an image. Further, the developing sleeve was rotated in the forward direction to the photosensitive member.

Regarding the toners, Y1, M1, C1 and Bk1 were used as the yellow toner, magenta toner, cyan toner, and black toner, respectively. Furthermore, concerning the evaluation of images, the image densities in the case of development with only the black toner was developed, the image densities in the case of development with only the yellow toner, and the image densities in the case of development with four colors were examined. The results are shown in Table 10C.

In the case where a photosensitive member of 15 mm in diameter was used, the surface potential of 350 V could not be obtained, thus an image with high density could not be obtained. Accordingly, the circumferential speed of the photosensitive member was lowered to 100 mm/s and an image was formed at the same electric potential, but even in this case, no satisfactory image could be obtained.

In the case where a photosensitive member of 100 mm in diameter was used, the density of a single color was sufficient, but in the case where an image was formed in four-color, the image density of the image formed by the first image forming unit was found to be lowered. The reason is considered to be that the toner on the transfer material was transferr again on the photosensitive member since the diameter of the photosensitive member became larger.

<Experimental Example 2C>

An image formation was carried out using the above-mentioned a-Si type photosensitive member of 60 mm in diameter with the use of the experimental apparatus used in Experimental Example 1C. The charge potential was changed in a range from 200 V to 500 V, and the density dispersion at a reflection density (i.e., image density) of 0.6 in each black image and the density difference between an exposed part and a non-exposed part after one round. which is referred to as the ghost, at a reflection density of 0.6 were examined. The results are shown in Table 11C.

When the surface potential was lower than 300 V, the image density became low. And when the surface potential was higher than 450 V, the scatter of the image density at 0.3 reflection density became worse and the drum ghost became large.

<Experimental Example 3C>

The evaluation of the dependence of the image density and the like on the circumferential speed ratio of the sleeve was carried out using the above-mentioned a-Si type photosensitive member of 60 mm in diameter with the use of the experimental apparatus used in Experimental Example 1C. The circumference speed of the sleeve was changed in a range of from 1.05 to 5 times that of the photosensitive member, and the image density of black color at the initial stage and the image density at the time 50.000-sheet copies of a 7%-black original were printed were examined. The results are shown In Table 12C.

When the circumference speed ratio of the sleeve was lower than 1.1, the image density was found to be lowered from the initial stage. When the circumference speed ratio of the sleeve was higher than 4.0, the density was decreased after extensive operation on 50,000 sheets. Further, no good image was obtained because of the occurrence of fogging.

<Experimental Example 4C>

The dependence of the image quality on the particle diameter of toner was evaluated using the above-mentioned a-Si type photosensitive member of 60 mm in diameter with the use of the experimental apparatus used in Experimental Example 1C. Yellow toners Y1 and Y13 to Y16 were used. The results are shown in Table 13C.

<Experimental Example 5C>

The dependence of the image density and density reproducibility on the tinctorial power of toner was evaluated using the above-mentioned a-Si type photosensitive member of 60 mm in diameter with the use of the experimental apparatus used in Experimental Example 1C. The tinctorial power of toner was evaluated by the image density (D0.5) after being fixed once when the amount of unfixed toner on a transfer material (M/S) was 0.5 mg/cm$^2$. Concerning the yellow toner, images of 16 gradations were formed by using each of yellow toners so prepared as to be different in tinctorial power, and the image density, the density reproducibility of half tone and the gradation reproducibility were evaluated for each toner. The results are shown in Table 14C.

From the results shown in the table, when D0.5 was low, sufficient image density could not be obtained, and when D0.5 was higher than 1.8, some trouble occurred in the density reproducibility of intermediate color in environmental changes.

<Experimental Example 6C>

The dependence of the image on the binder resin in toner was evaluated using the above-mentioned a-Si type photosensitive member of 60 mm in diameter with the use of the experimental apparatus used in Experimental Example 1C. Using toners C10 to C15 prepared changing the resin of cyan toner C1 to other resins. a density change from the initial stage to the time when 50,000-sheet copies were printed in a low temperature and low humidity environment (the image density at the beginning→the image density at the time 50,000-sheet copies were printed), image quality in a high temperature and high humidity environment, and transparency of OHP were evaluated. The results are shown in Table 15C.

<Example 1C>

A negatively chargeable photosensitive member (photosensitive member 2) was prepared on a mirror finish aluminum cylinder of 60 mm in diameter under the conditions shown in Table 2C by the use of a preparation device of a photosensitive member by RF-PCVD method.

Images were evaluated on the prepared photosensitive member using an experimental apparatus in which CLC1000, a copying machine made by CANON KABUSHIKI KAISHA, was remodeled into a one component developing system (shown in FIG. 1 and FIG. 6). Cyan toner, magenta toner, yellow toner and black toner were arranged in the first image forming unit, the second image forming unit, the third image forming unit and the fourth image forming unit, respectively. The photosensitive member was rotated at the circumferential speed (process speed) of 133 mm/s. The surface potential of the photosensitive member was set to be 400 V in the developing area. The developing sleeve was rotated at the speed of 1.75 times the circumference speed of the photosensitive member. Image-wise exposure was adopted for image formation and an image forming apparatus that can form 30 sheets of images per one minute was manufactured.

Regarding toners, Y1, C1 and Bk1 were used as the yellow toner, magenta toner, cyanide toner, and black toner, respectively.

The image density of each color (tinctorial power) after being fixed once when the amount of unfixed toner on a transfer material (M/S) was 0.5 mg/cm$^2$, was 1.43 for D0.5Y, 1.23 for D0.5M, 1.30 for D0.5C, and 1.30 for D0.5Bk. Further, the difference between the maximum value (D0.5 max) and minimum value (D0.5 min) of D0.5Y, D0.5M and D0.5C was 0.20. The gloss difference, the chroma of the color image, and the color reproducibility in environmental changes are shown in Table 16C.

<Example 2C>

Image formation was evaluated by the use of the image forming apparatus used in Example 1C, except f or using Y5 as the yellow toner, M5 as the magenta toner and C2 as the cyan toner.

The image density of each color after being fixed once when the amount of unfixed toner on a transfer material (M/S) was 0.5 mg/cm$^2$, was 1.12 for D0.5Y, 1.15 for D0.5M, 1.25 for D0.5C, and 1.30 for D0.5Bk. Further, the difference between the maximum value (D0.5 max) and minimum value (D0.5 min) of D0.5Y, D0.5M and D0.5C was 0.13. The gloss difference, the chroma of the color image, and the color reproducibility in environmental changes with each color are shown in Table 16C.

<Example 3C>

Image formation was evaluated by the use of the image forming apparatus used in Example 1C, except for using Y5 as the yellow toner, M10 as the magenta toner and C2 as the cyan toner.

The image density after being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes are shown in Table 16C.

<Comparative Example 1C>

Image formation was evaluated by the use of the image forming apparatus used in Example 1C, except for using Y5 as the yellow toner, M13 as the magenta toner and C2 as the cyan toner.

The image density after being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

In this case, when images were evaluated, the gloss difference with each color were large and no clear image could be obtained. Further, density change due to environmental difference became larger because severe control on the density change was needed under environmental difference.

<Example 4C>

Image formation was carried out by the use of the image forming apparatus used in example 1C, except for using Y5 as the yellow toner, M5 as the magenta toner and C4 as the cyan toner.

On each color, the image density after being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

<Comparative Example 2C>

Image formation was evaluated with the use of the image forming apparatus used in Example 1C, except for using Y5 as the yellow toner, M5 as the magenta toner and C5 as the cyan toner.

The image density after being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

In this case, when images were evaluated, the gloss difference with each color were large and no clear image could be obtained. Further, the density change due to environmental difference became larger because severe control on the density change was needed under environmental differences <Example 5C>

Image formation was evaluated with the use of the image forming apparatus used in Example 1C, except for using Y18 as the yellow toner, M13 as the magenta toner and C5 as the cyan toner.

The image density after being fixed once when the amount of unfixed toner on a transfer material (M/S) was 0.5 mg/cm$^2$, were 1.58 for D0.5Y, 1.66 for D0.5M, 1.69 for D0.5C, and 1.30 for D0.5Bk. The difference between the maximum value (D0.5 max) and minimum value (D0.5 max) of D0.5Y, D0.5M and D0.5C was 0.11. The gloss difference, the chroma of the color image, and the color reproducibility in environmental changes are shown in Table 16C.

<Example 6C>

Image formation was evaluated by the use of the image forming apparatus used in Example 1C, except for using Y18 as the yellow toner, M1 as the magenta toner and C5 as the cyan toner.

The image density after being fixed once when the amount of unfixed toner on a transfer material (M/S) was 0.5 mg/cm$^2$ the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

<Comparative Example 3C>

Image formation was evaluated by the use of the image forming apparatus used in Example 1C, except for using Y18 as the yellow toner, M5 as the magenta toner and C5 as the cyan toner.

The image density aster being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

In this case, when images were evaluated, the gloss difference with each color were large and no clear image could be obtained. Further, the density change due to environmental difference became larger because severe control on the density change was needed under environmental difference.

<Example 7C>

Image formation was evaluated by the use of the image forming apparatus used in Example 1C, except for using Y8 as the yellow toner, M13 as the magenta toner and C5 as the cyan toner.

The image density after being fixed once when the amount of unfixed toner on a transfer material (M/S) was 0.5 mg/cm$^2$. the difference between the maximum value (D0.5 max) and minimum value (D0.5 min) of D0.5Y, D0.5M and D0.5C, and the gloss difference, the chroma of the color image and the color reproducibility in environmental changes are shown in Table 16C.

<Comparative Example 4C>

Image formation was evaluated by the use of the image forming apparatus used in Example 1C, except for using Y5 as the yellow toner, M13 as the magenta toner and C5 as the cyan toner.

The image density after being fixed once when the amount of unfixed toner on a transfer material (M/S) was 0.5 mg/cm$^2$, the difference between the maximum value (D0.5 max) and minimum value (D0.5 min) of D0.5Y, D0.5M and D0.5C, and the gloss difference, the chroma of the color image and the color reproducibility in environmental changes with each color are shown in Table 16C.

In this case, when images were evaluated, the gloss difference with each color were large and no clear image could be obtained. Further, the density change due to environmental difference became large because severe control the density change was needed under environmental difference.

<Example 8C>

A negatively chargeable photosensitive member was prepared on a mirror finish aluminum cylinder of 40 mm in diameter under the conditions shown in Table 2C by the use of a preparation device of a photosensitive member for an image forming apparatus by RF-PCVD method.

Images were evaluated on the prepared photosensitive member using an experimental apparatus in which CLC1000, a copying machine made by CANON KABUSHIKI KAISHA, was remodeled. Cyan toner, magenta toner, yellow toner and black toner were arranged in the first image forming unit, the second image forming unit, the third image forming unit and the fourth image forming unit, respectively. The circumferential speed of the photosensitive member (process speed) was set to be 100 mm/s, and the surface potential of the photosensitive member was set to be 320 V in the developing area. The developing sleeve was rotated at the speed of 1.5 times the circumference speed of the photosensitive member. Imagewise exposure was adopted for image formation and an image forming apparatus that can form 21 sheets of images per one minute was manufactured.

As toner, Y2, M2, C2 and Bk2 were used as the yellow toner, magenta toner, cyan toner, and black toner, respectively.

The image density of each color after being fixed once when the amount of unfixed toner on a transfer material (M/S) was 0.5 mg/cm$^2$, were 1.42 for D0.5Y, 1.40 for D0.5M, 1.25 for D0.5C, and 1.53 for D0.5Bk. The gloss difference, the chroma of the color image, and the color reproducibility in environmental changes with each color are shown in Table 16C.

<Example 9C>

A negatively chargeable photosensitive member was prepared on a mirror finish aluminium cylinder of 60 mm in diameter under the conditions shown in Table 2C by the use of a preparation device of a photosensitive member for an image forming apparatus by RF-PCVD method.

Images were evaluated on the prepared photosensitive member using an experimental apparatus in which CLC1000, a copying machine made by CANON KABUSHIKI KAISHA, was remodeled into a one component developing system. Cyan toner, magenta toner, yellow toner and black toner were arranged in the first image forming unit, the second image forming unit, the third image forming unit and the fourth image forming unit, respectively. The circumferential speed of the photosensitive member (process speed) was set to be 300 mm/s, and the surface potential of the photosensitive member was set to be 380 V in the developing area. The developing sleeve was rotated at the speed of 3 times the circumference speed of the photosensitive member. Imagewise exposure was adopted for image formation and an image forming apparatus that can produce 70 sheets of images per one minute was manufactured.

As toner, Y3, M3, C1 and Bk7 were used as the yellow toner, magenta toner, cyan toner, and black toner, respectively.

The image density of each color after being fixed once when the amount of unfixed toner on a transfer material (M/S) was 0.5 mg/cm$^2$, was 1.40 for D0.5Y, 1.30 for D0.5M, 1.30 for D0.5C, and 1.28 for D0.5Bk. The gloss difference, the chroma of the color image, and the color reproducibility in environmental changes with each color are shown in Table 16C.

<Examples 10C to 20C>

Image formation was evaluated under the same conditions as in Example 1C, except for changing the yellow toner into Y2 to Y12. The gloss difference, the chroma of the color image, and the color reproducibility in environmental changes with each color are shown In Table 16C and Table 17C.

<Examples 21C to 35C>

Image formation was evaluated under the same conditions as in Example 1C, except for changing the magenta toner into M2 to M16. The gloss difference, the chroma of the color image, and the color reproducibility in environmental changes with each color are shown in Table 17C.

<Examples 36C to 39C>

Image formation was evaluated under the same conditions as in Example 1C, except for changing the cyan toner into C2 and C7 to C9. The gloss difference, the chroma of the color image, and the color reproducibility in environmental changes with each color are shown In Table 17C.

<Examples 40C to 44C>

Image formation was evaluated under the same conditions as in Example 1C, except for changing the black toner into Bk2 and Bk5 to Bk8. The gloss difference, the chroma of the color image, and the color reproducibility in environmental changes with each color are shown in Table 18C.

<Examples 45C>

A negatively chargeable photosensitive member (photosensitive member 1) was prepared on a mirror finish aluminium cylinder of 60 mm in diameter under the conditions shown in Table 1C by the use of a preparation device of a photosensitive member by RF-PCVD method.

Images were evaluated on the prepared photosensitive member using an experimental apparatus in which CLC1000, a copying machine made by CANON KABUSHIKI KAISHA, was remodeled into a one component developing system. Cyan toner, magenta toner, yellow toner and black toner were arranged in the first image forming unit, the second image forming unit, the third image forming unit and the fourth image forming unit, respectively. The circumferential speed of the photosensitive member (process speed) was set to be 200 mm/s, and the surface potential of the photosensitive member was set to be 380 V in the developing area. The developing sleeve was rotated at the speed of 1.9 times the circumference speed of the photosensitive member. Imagewise exposure was adopted for image formation and an image forming apparatus that can form 50 sheets of images per one minute was manufactured.

As toner, Y1, M1, C1 and Bk1 were used as the yellow toner, magenta toner, cyan toner, and black toner were used.

The image concentration of each color after being fixed once when the amount of unfixed toner on a transfer material (M/S) was 0.5 mg/cm$^2$, were 1.43 for D0.5Y, 1.23 for D0.5M, 1.30 for D0.5C, and 1.30 for D0.5Bk. The gloss difference, the chroma of the color image, and the color reproducibility in environmental changes are shown in Table 18C.

<Examples 46C to 56C>

Image formation was evaluated under the same conditions as in Example 45C, except for changing the yellow toner into Y2 to Y12. The gloss difference, the chroma of the color image, and the color reproducibility in environmental changes with each color are shown in Table 18C.

<Examples 57C to 71C>

Image formation was evaluated under the same conditions as in Example 45C, except for changing the magenta toner into M2 to M16. The gloss difference, the chroma of the color image, and the color reproducibility in environmental changes with each color are shown in Table 1C and Table 19C.

<Examples 72C to 75C>

Image formation was evaluated under the same conditions as in Example 45C, except for changing the cyan toner into C2 and C7 to C9. The gloss difference, the chroma of the color image, and the color reproducibility in environmental changes with each color are shown in Table 19C.

<Examples 76C to 80C>

Image formation was evaluated under the same conditions as in Example 45C, except for changing the black toner into Bk2 and Bk5 to Bk8. The gloss difference, the chroma of the color image, and the color reproducibility in environmental changes with each color are shown in Table 19C.

D) Practical Example of the Fourth Invention

<Preparation of Photosensitive Member>

(1) Preparation of a-Si Photosensitive Members

A positively chargeable photosensitive member and a negatively chargeable photosensitive member were prepared on mirror finish aluminium cylinders of 60 mm in diameter under the conditions shown in Table 1D and the conditions shown in Table 2C, respectively, by the use of a preparation device by RF-PCVD method In the following, a photosensitive member prepared by the method shown in Table 1D will be referred to as a-Si photosensitive member 1 and a photosensitive member prepared by the method shown in Table 2C will be referred to as a-Si photosensitive member 2.

Further, photosensitive members prepared using aluminium cylinders of 15, 20, 40, 80 and 100 mm in diameter by the method shown in Table 1 will be referred as a-Si photosensitive member 3 to 7.

<Production of Binder Resins>

(1) Production of Binder Resin—1

| | |
|---|---|
| Polyoxypropylene (2,2)-2,2-bis-(4-hydroxyphenyl) propane | 15 mol % |
| Polyoxyethylene (2,2)-2,2-bis-(4-hydroxyphenyl)propane | 34 mol % |
| Terephthalic acid | 15 mol % |
| Fumaric acid | 36 mol % |
| Trimellitic acid | 2 mol % |

These compounds were fed into a four-neck flask, which was equipped with a reflux condenser, a water separator, a nitrogen gas introduction pipe, a thermometer and a stirrer, and their condensation polymerization was evaluated with introducing nitrogen gas into the flask.

Further, 500 parts by weight of xylene and 100 parts by weight of polyester resin were put in a reaction vessel equipped with a stirrer, a thermometer, a nitrogen gas introduction pipe, a reflux condenser and a dropping unit for isocyanate compounds. The mixture was heated with stirring to dissolve polyester resin into xylene. A xylene solution containing 5 parts by weight of diphenylmethane-4,4'-diisocyanate was dropped into the polyester resin solution at a constant amount over 2 hours with refluxing xylene. After the completion of dropping, stirring was further continued for one hour and then the reaction was stopped. An urethne-modified polyester resin (1) as a binder resin was obtained by distilling and removing xylene from the product solution.

Condensation polymerizations similar to polyester resin (1) were evaluated by properly changing the constituting components and the compounding amount, thus polyester resins (2) to (6) were obtained Physical properties of obtained resins and monomers used are shown in Table 3D.

(2) Production of Binder Resin—2

| | |
|---|---|
| Styrene | 75 parts by weight |
| n-butyl acrylate | 25 parts by weight |
| Mono-n-butyl maleate | 10 parts by weight |
| Divinylbenzene | 0.3 parts by weight |
| Benzoyl peroxide | 1.2 parts by weight |

Into the above-mentioned mixed solution, 170 parts by weight of water dissolving 0.12 parts by weight of saponified polyvinyl alcohol was added and vigorously stirred to make a suspension polymerization liquid. Into a reaction vessel in which 300 parts by weight of water was put and replaced with nitrogen gas, the above-mentioned suspension was added and the suspension polymerization reaction was evaluated. After the reaction was completed, the reaction mixture was washed with water and dehydrated. And then, the reaction product was dried at 40° C. for 24 hours. Thus, vinyl series resin (7) was obtained.

As shown in Table 3D, this resin (7) had physical properties as follows: acid value is 13.2, Tg is 63° C., Mn is 6,000, and Mw is 18,800.

<Preparation of Toner>

(1) Preparation of Yellow Toner

Using materials shown in Table 4D, a yellow toner was prepared as described below. Physical properties of obtained yellow toners are also shown in Table 4D.

(1-1) Preparation of Yellow Toner Y1 to Y18

| | |
|---|---|
| Polyester resin (1) | 70 parts by weight |
| Paste pigment | 100 parts by weight |

(It is C.I. Pigment yellow 180 produced by a known method. It is a paste pigment containing 30 wt. % of solid (remaining 70 wt. % is water) that was obtained only by removing some part of water from the pigment slurry before the filtration process and never let through the drying process.)

The above-mentioned raw materials were first fed into a kneader-type mixer according to the above-mentioned formation and were increased in temperature with mixing at normal pressures. At the time when the highest temperature (the temperature is inevitably determined by the boiling point of a solvent in the paste, and in this case, about 90 to 100° C.) was reached, the pigment in the liquid phase divided or moved to the melted resin phase. After the state was confirmed, the mixture was further melted and kneaded with heating for 30 minutes to move the pigment in the paste thoroughly. After that, once the mixer was stopped, and after hot water was exhausted, the mixture was further heated to 130° C. and was melted and kneaded with heating for about 30 minutes to distill and remove water as well as disperse the pigment. After the process was ended, the mixture was cooled and the first kneaded product was taken out. The water content in this final kneaded product was about 0.8 wt. %.

| | |
|---|---|
| The above-mentioned first kneaded product (the content of pigment particles 30 wt. %) | 20.0 parts by weight |
| Polyester resin (1) | 86.0 parts by weight |
| Quaternary ammonium salt | 4.0 parts by weight |

The mixture of the above-mentioned formulation was sufficiently prefixed in a Henschel mixer and then were melted and kneaded with a double screw extrusion kneading machine in which temperature was set to be 120° C. to produce the second kneaded product. After being cooled, the kneaded product was roughly grinded to about 1 to 2 mm size with a hammer mill and then further pulverized to 40 μm or less in particle diameter with an air-jet type pulverizer. Further, the obtained pulverized product was classified, and yellow toner particles (classified product) were obtained by selecting particles so that weight-average particle diameter will be 8.0 μm in size distribution. To 100 parts by weight of the yellow toner particles, 1.0 part by weight of titanium oxide fine powder, which was subjected to hydrophobicity treatment with a silicon compound, was externally added for the purpose of improving fluidity and imparting chargeability to the yellow toner (Y1). The external additives used are shown in Table 7D.

Next, yellow toners Y2 to Y12, Y17 and Y18 were prepared in the same way, except for changing sorts of pigments as coloring agents and their amounts to be added.

Next, yellow toners Y13 to Y16 different in particle size were prepared in almost the same way as in the preparation of yellow toner Y1, except for changing the conditions of grinding and classification and the amounts of external additives.

(1–2) Preparation of Yellow Toners Y19 and Y20

| | |
|---|---|
| Polyester resin (1) | 70 parts by weight |
| C.I. Pigment yellow 180 | 30 parts by weight |

The above-mentioned raw materials were fed into a kneader-type mixer and were increased in temperature with mixing at normal pressures to be sufficiently premixed. After that, the mixture was kneaded with a three-roll two times to make the first kneaded product.

The above-mentioned first kneaded product

| | |
|---|---|
| The above-mentioned first kneaded product | 26.7 parts by weight |
| Polyester resin (1) | 81.3 parts by weight |
| Quaternary ammonium salt | 4 parts by weight |

The mixture of the above-mentioned recipe was sufficiently premixed in a Henschel mixer and then was melted and kneaded with a double screw extruder to produce the second kneaded product, and after that, in the same way as in yellow toner Y1, yellow toner Y19 was obtained. Yellow toner Y20 was similarly obtained by changing the content of pigment into 4 parts by weight.

(1–3) Preparation of Yellow Toner Y21

| | |
|---|---|
| Polyester resin (1) | 100 parts by weight |
| C.I. Pigment yellow 180 | 4 parts by weight |
| Quaternary ammonium salt | 4 parts by weight |

The mixture of the above-mentioned formulation was sufficiently premixed in a Henschel mixer and then was melted and kneaded with a double screw extruder, and after that, in the same way as in yellow toner Y1, yellow toner Y21 was obtained.

(1–4) Preparation of Yellow Toner Y22

The first kneaded product (the content of pigment 30 wt. %), which was prepared in the process of preparing yellow toner Y1, was further kneaded with a three-roll five times to make pigments sufficiently dispersed. After that, in the same way, yellow toner Y22 was obtained.

(2) Preparation of Magenta Toner (2-1) Preparation of Magenta Toners M1 to M16

After the first kneaded products were obtained almost in the same way as in the process of preparing yellow toner Y1 except for using the paste pigments of magenta pigment that are coloring agents described in Table 5D, the products were diluted and kneaded respectively so that the desired contents of pigments could be obtained to produce the second kneaded products. After that, in the same way as in the production of yellow toner Y1, magenta toners M1 to M16 of 7 to 7.5 μm in weight-average particle size were obtained.

(3) Preparation of Cyan Toner (3-1) Preparation of Cyan Toners C1, C2 and C4 to C6

After the first kneaded products were obtained almost in the same way as in the process of preparing yellow toner Y1 except for using the paste pigments of cyan pigment that are coloring agents described in Table 6D, the products were diluted and kneaded respectively so that the desired contents of pigments could be obtained to produce the second kneaded products. After that, in the same way as in the production of yellow toner Y1, cyan toners C1 and C2 of 6.0 to 8.0 μm in weight-average particle size were obtained. Further, cyan toners C4 to C6 were obtained by changing an external additive from titanium oxide A to alumina A described in Table 7D and producing in the same way as in the production of yellow toner Y1.

(3-2) Preparation of Cyan Toner C3

Cyan toner C3 was produced almost in the same way as yellow toner Y21 except for changing the pigment used as a coloring agent.

The following raw materials were sufficiently premixed in a Henschel mixer and then were melted and kneaded with a double screw extruder, and almost in the same way as the in production of yellow toner Y21, cyan toner C3 described in Table 6D was obtained.

| | |
|---|---|
| Polyester resin (1) | 100 parts by weight |
| C.I. Pigment blue 15:3 | 2 parts by weight |
| Quaternary ammonium salt | 4 parts by weight |

(3-3) Preparation of Cyan Toners C7 to C9

Cyan toners C7 to C9 described in Table 6D were obtained in the same way as in the production of cyan toner C1, except for using an imidazole compound, a styrene-acryl copolymer resin containing an ammonio group, or a mixture of quaternary ammonium salt and imidazole compound instead of a charge control agent used for preparing cyan toner C1.

(3–4) Preparation of Cyan Toners C10 to C15

Cyan toners C10 to C15 described in Table 6D were obtained in the same way as in the production of cyan toner C1, except for using resin (2) to resin (7) instead of resin (1) used for preparing cyan toner C1.

(4) Preparation of Black Toner (4-1) Preparation of Black Toner Bk1

| | |
|---|---|
| Polyester resin (1) | 70 parts by weight |
| CB-A | 30 parts by weight |

The above-mentioned raw materials were fed into a kneader-type mixer and were raised in temperature with mixing at normal pressures to be sufficiently premixed. After that, the mixture was kneaded with a three-roll four times to make the first kneaded product.

| | |
|---|---|
| The above-mentioned first kneaded product | 10.0 parts by weight |
| Polyester resin (1) | 93.0 parts by weight |
| Quaternary ammonium salt | 4 parts by weight |

The above-mentioned raw materials were sufficiently premixed in a Henschel mixer and then were melted and kneaded with a double screw extruder to make the second kneaded product, and after that, almost in the same way as in the production of yellow toner Y1, black toner Bk1 described in Table 8D was obtained.

Black pigments used as coloring agents are shown in Table 9D.

(4-2) Preparation of Black Toners Bk2 and Bk3

After the first kneaded product was obtained almost in the same way as in black toner Bk1, the compounding amount was controlled so that the desired amount of carbon black could be obtained, after that, in the same way as in the production of black toner Bk1, black toners Bk2 and Bk3 described in Table 8D were obtained.

(4-3) Preparation of Black Toner Bk4

| | |
|---|---|
| Polyester resin (1) | 100 parts by weight |
| CB-A | 2.0 parts by weight |
| Quaternary ammonium salt | 4 parts by weight |

The above-mentioned raw materials were sufficiently premixed in a Henschel mixer and then were melted and kneaded with a double screw extruder, after that, in the same way as in the production of Bk1 toner, black toner Bk4 described in Table 8D was obtained.

(4-4) Preparation of Black Toners Bk5 and Bk6

Black toners Bk5 and Bk6 described in Table 8D were obtained in the same way as in the production of black toner Bk1, except for using CB-B or CB-C Instead of CB-A that was used for preparing black toner Bk1, and further changing slightly the amount of carbon black.

(4– 5) Preparation of Black Toner Bk7

| | |
|---|---|
| Polyester resin (1) | 70 parts by weight |
| C.I. Pigment yellow 17 | 7.5 parts by weight |
| C.I. Pigment red 5 | 15 parts by weight |
| C.I. Pigment blue 15:3 | 7.5 parts by weight |

The above-mentioned raw materials were fed into a kneader-type mixer and raised in temperature with mixing at normal pressures to be sufficiently premixed. After that, the mixture was kneaded with a three-roll four times to make the first kneaded product.

The above-mentioned first kneaded product

| | |
|---|---|
| | 20.0 parts by weight |
| Polyester resin (1) | 83.67 parts by weight |
| The first kneaded product of CB-A that was used for preparing black toner Bk1 | 3.33 parts by weight |
| Quaternary ammonium salt | 4 parts by weight |

The above-mentioned raw materials were sufficiently premixed in a Henschel mixer and then were melted and kneaded with a double screw extruder, and after that, almost in the same way as in the production of black toner Bk1, black toner Bk7 described in Table 8D was obtained.

<Experimental Example 1D>

Images were evaluated using an experimental apparatus in which each developing device in an image forming apparatus shown in FIG. 1, which comprises functions of charging, exposure, developing, transferring, cleaning and charge eliminating and can form a full-color image with four colors, was changed to a one component developing device shown in FIG. 6.

Yellow toner, magenta toner, cyan toner and black toner were arranged in the first image forming unit, the second image forming unit, the third image forming unit and the fourth image forming unit, respectively, and positively chargeable photosensitive members 1, 3, 4, 6, and 7, which were prepared as mentioned above, were used as photosensitive members, The circumferential speed of the photosensitive member (process speed: PS) was set to be 200 mm/s, and the surface potential of the photosensitive member was set to be 350 V in the developing area. The developing sleeve was rotated at the speed of 2 times the circumferential speed of the photosensitive member. Imagewise exposure was adopted for forming an image.

As toners, Y1 for yellow toner, M1 for magenta toner, C1 for cyan toner, and Bk1 for black toner were used, respectively.

Concerning the evaluation of images, the image densities in the case where the development was made only with black toner, the image densities in the case where the development was made only with yellow toner, and the image densities of yellow area in the case where the development was made with toners of four colors were examined. The results are shown in Table 10.

In the case where photosensitive member 3 of 15 mm in diameter was used, the surface potential of 350 V could not be obtained, thus an image with high image density could not be obtained. Accordingly, the circumferential speed of the photosensitive member was lowered to 100 mm/s and an image was produced at the same electric potential, but even in the case, no sufficient image could be obtained.

In the case where photosensitive member 7 of 100 mm in diameter was used, the image density in monochrome was sufficient, but in the case where an image was produced with toners of four colors, the image density in the image formed with the first image forming unit was found to be lowered. As the cause of this, it is considered that the toner on the transfer material was transferred again to the photosensitive member since the diameter of the photosensitive member became larger.

<Experimental Example 2D>

An image formation was evaluated using a-Si type photosensitive member 1 of 60 mm in diameter as a photosensitive member with the use of the experimental apparatus used in Experimental Example 1D. The charge potential was changed in a range from 200 V to 500 V. and the image density in an black image, the density scatter (or dispersion) at a reflection density of 0.6, and the density difference between an exposed part and a non-exposed part after one round, which is referred to as the ghost image, at a reflection density of 0.6 were examined. The results are shown in Table 11D.

When the surface potential was lower than 300 V, the image density became low. And when the surface potential was higher than 450 V, the scatter of the image density at a reflection density of 0.3 became worse and the drum ghost became larger.

<Experimental Example 3D>

The evaluation of the dependence on the circumferential speed ratio of the sleeve was evaluated using a-Si type photosensitive member 1 of 60 mm in diameter as a photosensitive member with the use of the experimental apparatus used in Experimental Example 1D. The circumference speed of the sleeve was changed in a range from 1.05 to 5 times that of the photosensitive member, and the image density in black color at the initial stage and the image density when 50,000 sheets of copies were made from an original with a 7%-black color were examined. The results are shown in Table 12D.

When the circumferential speed ratio of the sleeve was lower than 1.1, the image density was found to be lowered from the initial stage. And when the circumferential speed ratio of the sleeve was higher than 4.0, the image density was decreased after the operation of forming images on 50,000 sheets. Further, no good image was obtained because of the occurrence of fog.

<Experimental Example 4D>

The evaluation of the dependence of the image quality on the particle diameter of toner was evaluated using a-Si type photosensitive member 1 of 60 mm in diameter as a photosensitive member with the use of the experimental apparatus used in Experimental Example 1D. Yellow toners Y1 and Y13 to Y16 were used. The results are shown in Table 13D.

<Experimental Example 5D>

The dependence of the image density and density reproducibility on the tinctorial power of toner was evaluated using a-Si type photosensitive member 1 of 60 mm in diameter as a photosensitive member with the use of the experimental apparatus used in Experimental Example 1D. The tinctorial power of toner was evaluated by the image density (D0.5) after an image was fixed once when the amount of unfixed toner on a transfer material (M/S) was 0.5 $mg/cm^2$. Using toners Y17 to Y22 having different tinctorial power as yellow toner, images of 16 gradations were produced by each toner and the image densities and gradation reproducibility were evaluated for each toner. The results are shown in Table 14D.

From the results shown in Table 14D, when D0.5 was low, sufficient image density could not be obtained, and when D0.5 was higher than 1.8, some troubles occurred in the density reproducibility of intermediate color in environmental changes.

<Experimental Example 6D>

The dependence of the image on the binder resin in toner was evaluated using a-Si type photosensitive member 1 of 60 mm in diameter as a photosensitive member with the use of the experimental apparatus used in Experimental Example 1D. Using toners C10 to C15 prepared changing the resin of cyan toner C1 to other resins a density change for each resin from the initial stage to the time when 50,000-sheet copies were made in an environment of low temperature and low humidity (image density at the beginning→the image density at the time 50,000-sheet copies were made), the image quality in an environment of high temperature and high humidity, and the transparency of OHP were evaluated.

The results are shown in Table 15D.

<Example 1D>

Images were evaluated using an image forming apparatus shown in FIG. 1 and FIG. 6 in which CLC1000, a copying machine made by CANON KABUSHIKI KAISHA, was remodeled into a one component developing system.

Cyan toner, magenta toner, yellow toner and black toner were arranged in the first image forming unit, the second image forming unit, the third image forming unit and the fourth image forming unit, respectively, and positively chargeable a-Si photosensitive member 1, which was prepared as mentioned above, was arranged as a photosensitive member. The photosensitive member was rotated at the circumferential speed (process speed: PS) of 133 mm/s The surface potential of the photosensitive member was set to be 400 V in the developing area, and the developing sleeve was rotated at the speed of 1.75 times the circumferential speed of the photosensitive member. Imagewise exposure was adopted for forming an image and an image forming apparatus that can form 30 sheets of images per one minute was manufactured.

As toners, Y1 for yellow toner, M1 for magenta toner, C1 for cyanide toner, and Bk1 for black toner were used, respectively.

On the transfer power of each color, the image densities after fixing of image was conducted once when the amount of unfixed toner on a transfer material (M/S) was 0.5 $mg/cm^2$, were 1.43 for D0.5Y, 1.23 for D0.5M, 1.30 for D0.5C, and 1.30 for D0.5Bk. Further, the difference between the maximum value (D0.5 max) and minimum value (1)0.5 min) of D0.5Y, D0.5M and D0.5C was 0.20.

The gloss difference, the chroma of the color image, and the color reproducibility in environmental changes with each color are shown in Table 16D.

<Example 2D>

The evaluation of image formation was carried out in the same way as in Example 1D, except for using Y5 for yellow toner, M5 for magenta toner and C2 for cyan toner.

As a result, D0.5Y was 1.12, D0.5M was 1.15, D0.5C was 1.25, and D0.5Bk was 1.30. Further, the difference between the maximum value (D0.5 max) and minimum value (D0.5 min) of D0.5Y, D0.5M and D0.5C was 0.13.

The gloss difference, the chroma of the color image, and the color reproducibility in environmental changes with each color are shown in Table 16D.

<Example 3D>

The evaluation of image formation was carried out in the same way as in Example 1D, except for using Y5 for yellow toner, M10 for magenta toner and C2 for cyan toner.

The difference between the maximum value (D0.5 max) and minimum value (D0.5 min) for D0.5Y, D0.5M and D0.5C, and the gloss difference the chroma of the color image, and the color reproducibility in environmental changes with each color are shown in Table 16D.

<Comparative Example 1D>

The evaluation of image formation was carried out in the same way as in Example 1D, except for using Y5 for yellow toner, M13 for magenta toner and C2 for cyan toner.

The difference between the maximum value (D0.5 max) and minimum value (D0.5 min) of D0.5Y, D0.5M and D0.5C, and the gloss difference, the chroma of the color image, and the color reproducibility in environmental changes with each color are shown in Table 16D.

As a result of the evaluation of images, the gloss difference with each color were large and no clear image could be obtained. Further, of the density due to environmental difference became larger because severe control on the fluctuation of density was needed under environmental difference.

<Example 4D>

The evaluation of image formation was carried out in the same way as in Example 1D, except for using Y5 for yellow toner, M5 for magenta toner and C4 for cyan toner.

The difference between the maximum value (D0.5 max) and minimum value (D0.5 min) of D0.5Y, D0.5M and D0.5C, and the gloss difference, the chroma of the color image, and the color reproducibility in environmental changes with each color are shown in Table 16D.

<Comparative Example 2D>

The evaluation of image formation was carried out in the same way as in Example 1D), except for using Y5 for yellow toner, M5 for magenta toner and C5 for cyan toner.

The difference between the maximum value (D0.5 max) and minimum value (D0.5 min) of D0.5YS, D0.5M and D0.5C, and the gloss difference, the chroma of the color image, and the color reproducibility in environmental changes with each color are shown in Table 16D.

As a result of the evaluation of images, the gloss difference with each color were large and no clear image could be obtained. Further, unevenness of the density due to environmental difference became larger because severe control on the density change was needed under environmental difference.

<Example 5D>

The evaluation of image formation was carried out in the same way as in Example 1D, except for using Y18 for yellow toner, M13 for magenta toner and C5 for cyan toner.

D0.5Y was 1.58, D0.5M was 1.66, D0.5C was 1.69, and D0.5Bk was 1.30. Further, the difference between the maximum value (D0.5 max) and minimum value (D0.5 min) of D0.5Y, D0.5M and D0.5C was 0.11.

The gloss difference, the chroma of the color image, and the color reproducibility in environmental changes with each color are shown in Table 16D.

<Example 6D>

The evaluation of image formation was carried out in the same way as in Example ID, except for using Y18 for yellow toner, M1 for magenta toner and C5 for cyan toner.

The difference between the maximum value (D0.5 max) and minimum value (D0.5 min) for D0.5Y, D0.5M and D0.5C, and the gloss difference, the chroma of the color image, and the color reproducibility in environmental changes with each color are shown in Table 16D.

<Comparative Example 3D>

The evaluation of image formation was carried out in the same way as in Example 1D, except for using Y18 for yellow toner, M5 for magenta toner and C5 for cyan toner.

The difference between the maximum value (D0.5 max) and minimum value (D0.5 min) of D0.5Y, D0.5M and D0.5C, and the gloss difference, the chroma of the color image, and the color reproducibility in environmental changes with each color are shown in Table 16D.

As a result of the evaluation of images, the gloss difference with each color were large and no clear image could be, obtained. Further, unevenness of the density due to environmental difference became larger because severe control on the density change was needed under environmental difference.

<Example 7D>

The evaluation of image formation was carried out in the same way as in Example 1D, except for using Y8 for yellow toner, M13 for magenta toner and C5 for cyan toner.

The difference between the maximum value (D0.5 max) and minimum value (D0.5 min) of D0.5Y, D0.5M and D0.5C, and the gloss difference, the chroma of the color image, and the color reproducibility in environmental changes with each color are shown in Table 16D.

<Comparative Example 4D>

The evaluation of image formation was carried out in the same way as in Example 1D, except for using Y5 for yellow toner, M13 for magenta toner and C5 for cyan toner.

The difference between the maximum value (D0.5 max) and minimum value (D0.5 min) of D0.5Y, D0.5M and D0.5C, and the gloss difference, the chroma of the color image, and the color reproducibility in environmental changes with each color are shown in Table 16D.

As a result of the evaluation of images, the gloss difference with each color were large and no clear image could be obtained. Further, unevenness of the density due to environmental difference became larger because severe control on the density change was needed under environmental difference.

<Example 8D>

Images were evaluated using an image forming apparatus shown in FIG. 1 and FIG. 6 in which CLC1000, a copying machine made by CANON KABUSHIKI KAISHA, was remodeled into a one component developing system.

Cyan toner, magenta toner, yellow toner and black toner were arranged in the first image forming unit, the second image forming unit, the third image forming unit and the fourth image forming unit, respectively, and a positively chargeable a-Si photosensitive member 5, which was prepared as mentioned above, was arranged as a photosensitive member. The photosensitive member was rotated at the circumferential speed (process speed: PS) of 100 mm/s.

The surface potential of the photosensitive member was set to be 320 V in the developing area, and the developing sleeve was rotated at the speed of 1.5 times the circumferential speed of the photosensitive member. Imagewise exposure was adopted for image formation and an image forming apparatus that can form 21 sheets of images per one minute was manufactured.

As toners, Y2 for yellow toner, M2 for magenta toner, C2 for cyan toner, and Bk2 for black toner were used, respectively.

D0.5Y was 1.42, D0.5M was 1.40, D0.5C was 1.25, and D0.5Bk was 1.53.

The gloss difference, the chroma of the color image, and the color reproducibility in environmental changes with each color are shown in Table 16D.

<Example 9D>

Images were evaluated using an image forming apparatus in which CLC1000, a copying machine made by CANON KABUSHIKI KAISHA, was remodeled into a one-component developing system.

Cyan toner, magenta toner, yellow toner and black toner were arranged in the first image forming unit, the second image forming unit, the third image forming unit and the fourth image forming unit, respectively, and positively chargeable a-Si photosensitive member 1, which was prepared as mentioned above, was arranged as a photosensitive member. The photosensitive member was rotated at the circumferential speed (process speed: PS) of 300 mm/s.

The surface potential of the photosensitive member was set to be 380 V in the developing area, and the developing sleeve was rotated at the speed of 1.5 times the circumferential speed of the photosensitive member. Imagewise exposure was adopted for image formation and an image forming apparatus that can form 70 sheets of images per one minute was manufactured.

As toners, Y3 for yellow toner, M3 for magenta toner, C1 for cyan toner, and Bk7 for black toner were used, respectively.

D0.5Y was 1.40, D0.5M was 1.30, D0.5C was 1.30, and D0.5Bk was 1.28.

The gloss difference, the chroma of the color image, and the color reproducibility in environmental changes with each color are shown in Table 16D.

<Examples 10D to 20D>

The evaluation of image formation was carried out under the same conditions as in Example 1D, except for changing the yellow toner into toners Y2 to T12. The gloss difference, the chroma of the color image, and the color reproducibility in environmental changes with each color are shown in Table 16D.

<Examples 21D to 35D>

The evaluation of image formation was carried out under the same conditions as in Example 1D, except for changing magenta toner into M2 to M16. The gloss difference, the chroma of the color image, and the color reproducibility in environmental changes with each color are shown in Table 16D.

<Examples 36D to 39D>

The evaluation of image formation was carried out under the same conditions as in Example 1D, except for changing cyan toner into C2, and C7 to C9. The gloss difference, the chroma of the color image, and the color reproducibility in environmental changes with each color are shown in Table 16D.

<Examples 40D to 44D>

The evaluation of image formation was carried out under the same conditions as in Example 1D, except for changing black toner into Bk2, and Bk5 to Bk8. The gloss difference, the chroma of the color image, and the color reproducibility in environmental changes with each color are shown in Table 16D.

<Example 45D>

Images were evaluated using an image forming apparatus in which CLC1000, a copying machine made by CANON KABUSHIKI KAISHA, was remodeled into a one-component developing system.

Cyan toner, magenta toner, yellow toner and black toner were arranged in the first image forming unit, the second image forming unit, the third image forming unit and the fourth image forming unit, respectively, and negatively chargeable a-Si photosensitive member 2, which was prepared as mentioned above, was arranged as a photosensitive member. The photosensitive member was rotated at the circumferential speed (process speed: PS) of 200 mm/s The surface potential of the photosensitive member was set to be 380 V in the developing area, and the developing sleeve was rotated at the speed of 1.9 times the circumferential speed of the photosensitive member. Back scan exposure was adopted for image formation and an image forming apparatus that can produce 50 sheets of images per one minute was manufactured.

As toners. Y1 for yellow toner, M1 for magenta toner, C1 for cyan toner, and Bk1 for black toner were used, respectively.

D0.5Y was 1.43, D0.5M was 1.23, D0.5C was 1.30, and D0.5Bk was 1.30.

The gloss difference, the chroma of the color image, and the color reproducibility in environmental changes with each color are shown in Table 17D.

<Examples 46D to 56D>

The evaluation of image formation was carried out under the same conditions as in Example 45D, except for changing the yellow toner into Y2 to T12. The gloss difference, the chroma of the color image, and the color reproducibility in environmental changes with each color are shown in Table 17D.

<Examples 57D to 71D>

The evaluation of image formation was carried out under the same conditions as in Example 45D, except for changing magenta toner into M2 to M16. The gloss difference, the chroma of the color image, and the color reproducibility in environmental changes with each color are shown in Table 17D.

<Examples 72D to 76D>

The evaluation of image formation was carried out under the same conditions as in Example 45D, except for changing the cyan toner into C2, and C7 to C9. The gloss difference, the chroma of the color image, and the color reproducibility in environmental changes with each color are shown in Table 17D.

<Examples 77D to 80D>

The evaluation of image formation was carried out under the same conditions as in Example 45D. except for changing the black toner into Bk2, and Bk5 to Bk8. The gloss difference, the chroma of the color image, and the color reproducibility in environmental changes with each color are shown in Table 17D.

TABLE 1

| Particle diameter range ($\mu$m) |
|---|
| $0.5 \leqq d < 1.8$ |
| $1.8 \leqq d < 2.2$ |
| $2.2 \leqq d < 2.6$ |
| $2.6 \leqq d < 3.0$ |
| $3.0 \leqq d < 3.6$ |

TABLE 1-continued

| Particle diameter range (μm) |
|---|
| 3.6 ≦ d < 4.4 |
| 4.4 ≦ d < 5.2 |
| 5.2 ≦ d < 6.2 |
| 6.2 ≦ d < 7.4 |
| 7.4 ≦ d < 8.6 |
| 8.6 ≦ d < 10.0 |
| 10.0 ≦ d < 12.0 |
| 12.0 ≦ d < 15.0 |
| 15.0 ≦ d < 18.0 |
| 18.0 ≦ d < 21.0 |
| 21.0 ≦ d < 25.0 |
| 25.0 ≦ d < 30.0 |
| 30.0 ≦ d < 36.0 |
| 36.6 ≦ d < 42.0 |
| 42.0 ≦ d < 50.0 |
| 50.0 ≦ d < 60.0 |
| 60.0 ≦ d < 72.0 |
| 72.0 ≦ d < 86.0 |
| 86.0 ≦ d < 102.0 |
| 102.0 ≦ d < 122.0 |
| 122.0 ≦ d < 146.0 |
| 146.0 ≦ d < 174.0 |
| 174.0 ≦ d < 206.0 |
| 206.0 ≦ d < 246.0 |
| 246.0 ≦ d < 294.0 |
| 294.0 ≦ d < 350.0 |

d: particle diameter

TABLE 2A

| | Charge injection inhibiting layer | Photo-conductive layer 1 | Photo-conductive layer 2 | Surface layer |
|---|---|---|---|---|
| Gases and flow rate | | | | |
| $SiH_4$[$cm^3$/min(normal)] | 100 | 200 | 200 | 10 |
| $H_2$[$cm^3$/min(normal)] | 300 | 800 | 800 | |
| $B_2H_6$[ppm](based on $SiH_4$) | 2000 | 2 | 0.5 | |
| NO[$cm^3$/min(normal)] | 50 | | | |
| $CH_4$[$cm^3$/min(normal)] | | | | 480 |
| Temperature of support (° C.) | 280 | 280 | 280 | 280 |
| Internal pressure [Pa] | 67 | 67 | 67 | 53 |
| RF POWER [W] | 500 | 800 | 400 | 250 |
| Layer thickness [μm] | 3 | 20 | 7 | 0.5 |

TABLE 3A

| | Charge injection inhibiting layer | Photo conductive layer | Inter-mediate layer | Surface layer |
|---|---|---|---|---|
| Gases and flow rate | | | | |
| $SiH_4$[$cm^3$/min(normal)] | 160 | 200 | 200 | 10 |
| $H_2$[$cm^3$/min(normal)] | 500 | 800 | | |
| $PH_3$[ppm](based on $SiH_4$) | 1000 | | | |
| $B_2H_6$[ppm](based on $SiH_4$) | | 0.5 | 500 | |
| $CH_4$[$cm^3$/min(normal)] | 20 | | 300 | 480 |
| Temperature of support (° C.) | 260 | 260 | 260 | 260 |
| Internal pressure [Pa] | 40 | 40 | 27 | 13 |
| RF POWER [W] | 300 | 600 | 300 | 200 |
| Layer thickness [μm] | 2 | 30 | 0.1 | 0.5 |

TABLE 4A

| Resin | Monomer composition | Acid value (mgKOH/g) | Tg (° C.) | Mn | Mw |
|---|---|---|---|---|---|
| Resin (1) | Polyoxypropylene(2.2)-2, 2bis(4-hydroxyphenyl)propane<br>Polyoxyethylene(2.2)-2, 2bis(4-hydroxyphenyl)propane<br>Terephthalic acid<br>Fumaric acid<br>Trimellitic acid | 10.5 | 56 | 4000 | 10500 |
| Resin (2) | Polyoxypropylene(2.2)-2, 2bis(4-hydroxyphenyl)propane<br>Fumaric acid<br>Trimellitic acid | 2.3 | 59 | 4500 | 12500 |
| Resin (3) | Polyoxypropylene(2.2)-2, 2bis(4-hydroxyphenyl)propane<br>Fumaric acid | 44.3 | 49 | 3600 | 8500 |
| Resin (4) | Polyoxypropylene(2.2)-2, 2bis(4-hydroxyphenyl)propane<br>Polyoxyethylene(2.2)-2, 2bis(4-hydroxyphenyl)propane<br>Terephthalic acid<br>Fumaric acid<br>Trimellitic acid | 1.9 | 62 | 5200 | 18600 |
| Resin (5) | Polyoxypropylene(2.2)-2, 2bis(4-hydroxyphenyl)propane<br>Terephthalic acid<br>Fumaric acid<br>Trimellitic acid | 55.3 | 59 | 5800 | 22200 |
| Resin (6) | Polyoxypropylene(2.2)-2, 2bis(4-hydroxyphenyl)propane<br>Polyoxyethylene(2.2)-2, 2bis(4-hydroxyphenyl)propane | 13.2 | 69 | 8400 | 105000 |

TABLE 4A-continued

| Resin | Monomer composition | Acid value (mgKOH/g) | Tg (° C.) | Mn | Mw |
|---|---|---|---|---|---|
| | Terephthalic acid | | | | |
| | Trimellitic acid | | | | |
| Resin (7) | Styrene | 13.2 | 63 | 6000 | 18800 |
| | n-butylacrylate | | | | |
| | mono-n-butylmalate | | | | |

TABLE 5A

| | Resin | | Colorant | | Charge control agent *2) | | Pigment-dispersing condition *3) | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | | External additives | Amount (wt %) | diameter (μm) | power D0.5Y |
| Y1 | Resin(1) | 100 | PY 180 | 5.0 | DTBS A1 compound | 4.0 | Strong | Titanium oxide A | 1.0 | 8.0 | 1.43 |
| Y2 | Resin(1) | 100 | PY 74 | 3.0 | DTBS A1 compound | 4.0 | Strong | Titanium oxide A | 1.0 | 8.0 | 1.42 |
| Y3 | Resin(1) | 100 | PY 93 | 5.0 | DTBS A1 compound | 4.0 | Strong | Titanium oxide A | 1.0 | 8.1 | 1.40 |
| Y4 | Resin(1) | 100 | PY 97 | 5.0 | DTBS A1 compound | 4.0 | Strong | Titanium oxide A | 1.0 | 7.8 | 1.38 |
| Y5 | Resin(1) | 100 | PY 109 | 5.0 | DTBS A1 compound | 4.0 | Strong | Titanium oxide A | 1.0 | 8.2 | 1.12 |
| Y6 | Resin(1) | 100 | PY 128 | 6.0 | DTBS A1 compound | 4.0 | Strong | Titanium oxide A | 1.0 | 7.9 | 1.37 |
| Y7 | Resin(1) | 100 | PY 151 | 5.5 | DTBS A1 compound | 4.0 | Strong | Titanium oxide A | 1.0 | 8.0 | 1.40 |
| Y8 | Resin(1) | 100 | PY 154 | 4.0 | DTBS A1 compound | 4.0 | Strong | Titanium oxide A | 1.0 | 8.0 | 1.22 |
| Y9 | Resin(1) | 100 | PY 155 | 5.0 | DTBS A1 compound | 4.0 | Strong | Titanium oxide A | 1.0 | 8.1 | 1.13 |
| Y10 | Resin(1) | 100 | PY 166 | 4.0 | DTBS A1 compound | 4.0 | Strong | Titanium oxide A | 1.0 | 8.3 | 1.25 |
| Y11 | Resin(1) | 100 | PY 168 | 4.0 | DTBS A1 compound | 4.0 | Strong | Titanium oxide A | 1.0 | 8.4 | 1.40 |
| Y12 | Resin(1) | 100 | PY 185 | 5.0 | DTBS A1 compound | 4.0 | Strong | Titanium oxide A | 1.0 | 8.2 | 1.20 |
| Y13 | Resin(1) | 100 | PY 180 | 5.0 | DTBS A1 compound | 4.0 | Strong | Titanium oxide A | 1.5 | 4.5 | 1.56 |
| Y14 | Resin(1) | 100 | PY 180 | 5.0 | DTBS A1 compound | 4.0 | Strong | Titanium oxide A | 0.8 | 9.5 | 1.32 |
| Y15 | Resin(1) | 100 | PY 180 | 5.0 | DTBS A1 compound | 4.0 | Strong | Titanium oxide A | 1.5 | 3.8 | 1.63 |
| Y16 | Resin(1) | 100 | PY 180 | 5.0 | DTBS A1 compound | 4.0 | Strong | Titanium oxide A | 0.6 | 11.0 | 1.21 |
| Y17 | Resin(1) | 100 | PY 93 | 2.5 | DTBS A1 compound | 4.0 | Strong | Titanium oxide A | 1.0 | 8.1 | 0.96 |
| Y18 | Resin(1) | 100 | PY 93 | 6.0 | DTBS A1 compound | 4.0 | Strong | Titanium oxide A | 1.0 | 8.1 | 1.58 |
| Y19 | Resin(1) | 100 | PY 93 | 8.0 | DTBS A1 compound | 4.0 | Normal | Titanium oxide A | 1.0 | 8.1 | 1.82 |
| Y20 | Resin(1) | 100 | PY 93 | 4.0 | DTBS A1 compound | 4.0 | Normal | Titanium oxide A | 1.0 | 8.1 | 1.28 |
| Y21 | Resin(1) | 100 | PY 93 | 4.0 | DTBS A1 compound | 4.0 | Weak | Titanium oxide A | 1.0 | 8.1 | 0.98 |
| Y22 | Resin(1) | 100 | PY 93 | 6.0 | DTBS A1 compound | 4.0 | Strong 2 | Titanium oxide A | 1.0 | 8.1 | 1.84 |

*1) PY represents C.I. Pigment Yellow.
*2) DTBS represents di-tert-butyl salicylate.
*3) Weak: First kneaded product is not made and the dispersion state is weak.
Normal: Powder pigment is blended with resin and kneaded twice with a three-roll mill to make first kneaded product.
Strong: Paste pigment is heated and melt-kneaded to make first kneaded product.
Strong 2: The first kneaded product made in the pigment-dispersing condition "strong" is further kneaded 5 times with a three-roll mill.

TABLE 6A

| | Resin | | Colorant | | Charge control agent *2) | | Pigment-dispersing condition *3) | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | | External additives | Amount (wt %) | diameter (μm) | power D0.5M |
| M1 | Resin(1) | 100 | PR 122 | 6.0 | DTBS A1 compound | 4.0 | Strong | Titanium oxide A | 1.2 | 7.2 | 1.23 |
| M2 | Resin(1) | 100 | PR 57.1 | 3.5 | DTBS A1 compound | 4.0 | Strong | Titanium oxide A | 1.2 | 7.0 | 1.40 |
| M3 | Resin(1) | 100 | PR 122 | 2.0 | DTBS A1 compound | 4.0 | Strong | Titanium oxide A | 1.2 | 7.1 | 1.30 |
| | | PR 57.1 | 2.0 | | | | | | | | |
| M4 | Resin(1) | 100 | PR 48.2 | 4.0 | DTBS A1 compound | 4.0 | Strong | Titanium oxide A | 1.2 | 7.2 | 1.20 |
| M5 | Resin(1) | 100 | PR 58.2 | 5.0 | DTBS A1 compound | 4.0 | Strong | Titanium oxide A | 1.2 | 7.0 | 1.15 |
| M6 | Resin(1) | 100 | PR 5 | 5.0 | DTBS A1 compound | 4.0 | Strong | Titanium oxide A | 1.2 | 7.5 | 1.42 |
| M7 | Resin(1) | 100 | PR 31 | 4.0 | DTBS A1 compound | 4.0 | Strong | Titanium oxide A | 1.2 | 7.2 | 1.45 |
| M8 | Resin(1) | 100 | PR 146 | 4.0 | DTBS A1 compound | 4.0 | Strong | Titanium oxide A | 1.2 | 7.0 | 1.30 |
| M9 | Resin(1) | 100 | PR 147 | 4.0 | DTBS A1 compound | 4.0 | Strong | Titanium oxide A | 1.2 | 7.0 | 1.32 |
| M10 | Resin(1) | 100 | PR 150 | 5.0 | DTBS A1 compound | 4.0 | Strong | Titanium oxide A | 1.2 | 7.1 | 1.47 |
| M11 | Resin(1) | 100 | PR 184 | 4.0 | DTBS A1 compound | 4.0 | Strong | Titanium oxide A | 1.2 | 7.2 | 1.32 |
| M12 | Resin(1) | 100 | PR 187 | 4.0 | DTBS A1 compound | 4.0 | Strong | Titanium oxide A | 1.2 | 7.2 | 1.31 |
| M13 | Resin(1) | 100 | PR 238 | 6.0 | DTBS A1 compound | 4.0 | Strong | Titanium oxide A | 1.2 | 7.1 | 1.66 |
| M14 | Resin(1) | 100 | PR 245 | 4.0 | DTBS A1 compound | 4.0 | Strong | Titanium oxide A | 1.2 | 7.3 | 1.29 |

TABLE 6A-continued

| | Resin | | Colorant | | Charge control agent *2) | | Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition *3) | External additives | Amount (wt %) | diameter (μm) | power D0.5M |
| M15 | Resin(1) | 100 | PR 185 | 5.0 | DTBS A1 compound | 4.0 | Strong | Titanium oxide A | 1.2 | 7.0 | 1.43 |
| M16 | Resin(1) | 100 | PR 265 | 5.0 | DTBS A1 compound | 4.0 | Strong | Titanium oxide A | 1.2 | 7.0 | 1.29 |

*1) PR represents C.I. Pigment Red.
*2) DTBS represents di-tert-butyl salicylate.
*3) Strong: Paste pigment is heated and melt-kneaded to make first kneaded product.

TABLE 7A

| | Resin | | Colorant | | Charge control agent *2) | | Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition *3) | External additives | Amount (wt %) | diameter (μm) | power D0.5C |
| C1 | Resin(1) | 100 | PB 15:3 | 3.0 | DTBS A1 compound | 4.0 | Strong | Titanium oxide A | 1.0 | 8.0 | 1.30 |
| C2 | Resin(1) | 100 | Al phthalo-cyanine | 5.0 | DTBS A1 compound | 4.0 | Strong | Titanium oxide A | 1.4 | 6.0 | 1.25 |
| C3 | Resin(1) | 100 | PB 15:3 | 2.0 | DTBS A1 compound | 4.0 | Weak | Alumina A | 1.0 | 7.0 | 0.92 |
| C4 | Resin(1) | 100 | PB 15:3 | 4.0 | DTBS A1 compound | 4.0 | Strong | Alumina A | 1.0 | 7.0 | 1.55 |
| C5 | Resin(1) | 100 | PB 15:3 | 5.0 | DTBS A1 compound | 4.0 | Strong | Alumina A | 1.0 | 7.0 | 1.69 |
| C6 | Resin(1) | 100 | PB 15:3 | 6.0 | DTBS A1 compound | 4.0 | Strong | Alumina A | 1.0 | 7.0 | 1.83 |
| C7 | Resin(1) | 100 | PB 15:3 | 3.0 | DTBS Cr compound | 4.0 | Strong | Titanium oxide A | 1.0 | 8.0 | 1.32 |
| C8 | Resin(1) | 100 | PB 15:3 | 3.0 | DTBS Zr compound | 4.0 | Strong | Titanium oxide A | 1.0 | 8.0 | 1.39 |
| C9 | Resin(1) | 100 | PB 15:3 | 3.0 | n-OS A1 compound | 4.0 | Strong | Titanium oxide A | 1.0 | 8.0 | 1.38 |
| C10 | Resin(2) | 100 | PB 15:3 | 3.0 | DTBS A1 compound | 4.0 | Strong | Titanium oxide A | 1.0 | 8.0 | 1.35 |
| C11 | Resin(3) | 100 | PB 15:3 | 3.0 | DTBS A1 compound | 4.0 | Strong | Titanium oxide A | 1.0 | 8.0 | 1.25 |
| C12 | Resin(4) | 100 | PB 15:3 | 3.0 | DTBS A1 compound | 4.0 | Strong | Titanium oxide A | 1.0 | 8.0 | 1.36 |
| C13 | Resin(5) | 100 | PB 15:3 | 3.0 | DTBS A1 compound | 4.0 | Strong | Titanium oxide A | 1.0 | 8.0 | 1.23 |
| C14 | Resin(6) | 100 | PB 15:3 | 3.0 | DTBS A1 compound | 4.0 | Strong | Titanium oxide A | 1.0 | 8.0 | 1.10 |
| C15 | Resin(7) | 100 | PB 15:3 | 3.0 | DTBS A1 compound | 4.0 | Strong | Titanium oxide A | 1.0 | 8.0 | 1.15 |

*1) PB represents C.I. Pigment Blue.
*2) DTBS represents di-tert-butyl salicylate. n-OS represents n-octyl salicylate.
*3) Weak: First kneaded product is not made and the dispersion state is weak.
Strong: Paste pigment is heated and melt-kneaded to make first kneaded product.

TABLE 8A

| Inorganic fine powder | Base material of inorganic fine powder | Treatment materials | Average primary particle diameter (μm) | Hydro-phobicity degree (%) | BET specific surface area ($m^2/g$) |
|---|---|---|---|---|---|
| Titanium oxide A | Titanium oxide | Isobutyl-methoxy-silane | 0.03 | 66 | 130 |

TABLE 8A-continued

| Inorganic fine powder | Base material of inorganic fine powder | Treatment materials | Average primary particle diameter (μm) | Hydro-phobicity degree (%) | BET specific surface area ($m^2/g$) |
|---|---|---|---|---|---|
| Alumina A | Alumina | Isobutyl-methoxy-silane | 0.005 | 66 | 210 |
| Silica A | Silica | Hexamethyl-disilazane | 0.005 | 65 | 230 |

TABLE 9A

| | Resin | | Colorant | | Charge control agent *2) | | Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition *3) | External additives | Amount (wt %) | diameter (μm) | power D0.5Bk |
| Bk1 | Resin(1) | 100 | CB-A | 3.0 | DTBS A1 compound | 4.0 | Normal | Titanium oxide A | 1.0 | 7.0 | 1.30 |
| Bk2 | Resin(1) | 100 | CB-A | 4.0 | DTBS A1 compound | 4.0 | Normal | Titanium oxide A | 1.0 | 7.0 | 1.53 |
| Bk3 | Resin(1) | 100 | CB-A | 6.0 | DTBS A1 compound | 4.0 | Normal | Titanium oxide A | 1.0 | 7.0 | 1.82 |

TABLE 9A-continued

| | Resin | | Colorant | | Charge control agent *2) | | Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition *3) | External additives | Amount (wt %) | diameter (μm) | power D0.5Bk |
| Bk4 | Resin(1) | 100 | CB-A | 2.0 | DTBS A1 compound | 4.0 | Weak | Titanium oxide A | 1.0 | 7.0 | 0.92 |
| Bk5 | Resin(1) | 100 | CB-B | 3.5 | DTBS A1 compound | 4.0 | Normal | Titanium oxide A | 1.0 | 7.0 | 1.43 |
| Bk6 | Resin(1) | 100 | CB-C | 2.5 | DTBS A1 compound | 4.0 | Normal | Titanium oxide A | 1.0 | 7.0 | 1.24 |
| Bk7 | Resin(1) | 100 | PY 17 | 1.5 | DTBS A1 compound | 4.0 | Normal | Titanium oxide A | 1.0 | 7.0 | 1.28 |
| | | | PR 5 | 3.0 | | | | | | | |
| | | | PB 15:3 | 1.5 | | | | | | | |
| | | | CB-A | 1.0 | | | | | | | |
| Bk8 | Resin(1) | 100 | CB-A | 3.0 | DTBS A1 compound | 4.0 | Normal | Silica A | 1.0 | 7.0 | 1.30 |

*1) PY, PR and PB represent C.I. Pigment Yellow, Red and Blue, respectively.
*2) DTBS represents di-tert-butyl salicylate.
*3) Weak: First kneaded product is not made and the dispersion state is weak.
Normal: Powder pigment is blended with resin and kneaded twice with a three-roll mill to make first kneaded product.

TABLE 10A

| | List of Carbon Black | | | | |
|---|---|---|---|---|---|
| | Primary particle diameter (nm) | Oil absorption (ml/100 g) | BET specific surface area ($m^2/g$) | Volatile (%) | pH |
| CB-A | 32 | 45 | 65 | 0.5 | 9 |
| CB-B | 40 | 135 | 50 | 1.5 | 7 |
| CB-C | 18 | 123 | 145 | 1.2 | 9 |

TABLE 11A

| | Core materials | *4) Coating materials | Coating amount (%) | 50% average particle diameter (μm) |
|---|---|---|---|---|
| Carrier 1 | Mn-Mg-Fe type ferrite | Coating material A | 0.2 | 40 |
| Carrier 2 | Mn-Mg-Fe type ferrite | Coating material A | 1.0 | 9 |
| Carrier 3 | Mn-Mg-Fe type ferrite | Coating material A | 0.5 | 15 |
| Carrier 4 | Mn-Mg-Fe type ferrite | Coating material A | 0.1 | 60 |
| Carrier 5 | Mn-Mg-Fe type ferrite | Coating material A | 0.05 | 82 |
| Carrier 6 | Cu-Zn-Fe type ferrite | Coating material A | 0.2 | 40 |
| Carrier 7 | Cu-Zn-Fe type ferrite | Coating material B | 0.35 | 40 |

*4) Coating material A: Modified silicone resin produced by the reaction of nitrogen-containing silane coupling agent and silicone resin
Coating material B: Styrene-methyl methacrylate (copolymer weight ratio 65:35)

TABLE 12A

| Photosensitive member diameter (mm) | 15 | 20 | 60 | 80 | 100 |
|---|---|---|---|---|---|
| BK solid density | 1.32 | 1.52 | 1.62 | 1.63 | 1.65 |
| Yellow density (single color) | 1.29 | 1.47 | 1.58 | 1.60 | 1.61 |
| Yellow density (four colors) | 1.29 | 1.47 | 1.57 | 1.58 | 1.45 |

TABLE 12A-continued

| Notes | Potential was insufficient. Slowing down the speed, evaluation was made. | | | Image density was uneven. |
|---|---|---|---|---|

TABLE 13A

| Surface potential (V) | −250 | −300 | −400 | −450 | −500 |
|---|---|---|---|---|---|
| Image density | 1.35 | 1.43 | 1.64 | 1.68 | 1.70 |
| Density Dispersion | 0.05 | 0.07 | 0.08 | 0.10 | 0.20 |
| Drum ghost | 0.07 | 0.09 | 0.11 | 0.12 | 0.24 |

TABLE 14A

| SD gap (μm) | 300 | 350 | 500 | 800 | 900 |
|---|---|---|---|---|---|
| Image density | 1.67 | 1.64 | 1.54 | 1.43 | 1.36 |
| Drum melt-adhesion after extensive operation on 10,000 sheets | Melt-adhesion occurs. | None | None | None | None |

TABLE 15A

| | | | | | |
|---|---|---|---|---|---|
| Sleeve peripheral speed ratio | 1.05<br>1.05 | 1.1<br>1.1 | 2.0<br>2.0 | 4.0<br>4.0 | 5.0<br>5.0 |
| Image density at the initial stage | 1.3 | 1.55 | 1.62 | 1.63 | 1.65 |
| Image density after extensive operation on 50,000 sheets | 1.29 | 1.53 | 1.58 | 1.55 | 1.32 |
| Fogging on drum after extensive operation on 50,000 sheets | 0.2 | 0.2 | 0.5 | 2.0 | 5.0 |

TABLE 16A

| Toner | Y15 | Y13 | Y1 | Y14 | Y16 |
|---|---|---|---|---|---|
| Weight-average particle diameter (μm) | 3.8 | 4.5 | 8.0 | 9.5 | 11.0 |

TABLE 16A-continued

| Toner | Y15 | Y13 | Y1 | Y14 | Y16 |
|---|---|---|---|---|---|
| Image quality | C | A | A | AB | C |
| Notes | Much fogging | Image density slightly decreases in light-resistance test. | Good | | Minute dot reproduction is bad |

A: good

B: not good, but not bad

C: poor

TABLE 17A

| Carrier No. | Carrier 2 | Carrier 3 | Carrier 1 | Carrier 4 | Carrier 5 |
|---|---|---|---|---|---|
| 50% average particle diameter of carrier (μm) | 9 | 15 | 40 | 60 | 82 |
| Carrier adhesion | severe | a little | none | none | none |
| Stability of coating amount on sleeve | C | AB | A | A | A |
| Image quality | C | A | A | AB | C |

A: good

B: average

C: bad (poor)

TABLE 18A

| | Yellow toner | | | | | | |
|---|---|---|---|---|---|---|---|
| | Y17 | Y21 | Y20 | Y3 | Y18 | Y19 | Y22 |
| Coloring power D0.5Y | 0.96 | 0.98 | 1.28 | 1.40 | 1.58 | 1.82 | 1.84 |
| Image density | 1.32 | 1.34 | 1.53 | 1.56 | 1.60 | 1.62 | 1.63 |
| Image density reproduction at HT | good | good | good | good | good | poor | poor |
| Notes | Image density was insufficient. | Image density was insufficient. | | | | Fogging was liable to occur. Too much pigment causes charging inhibition. | Gradation at HT was bad. Anti-offset property was poor. |

TABLE 19A

| | Cyan toner | | | | | | |
|---|---|---|---|---|---|---|---|
| | C1 | C10 | C11 | C12 | C13 | C14 | C15 |
| Resin | Resin(1) 1.70→1.68 | Resin(2) 1.67→1.59 | Resin(3) 1.78→1.74 | Resin(4) 1.68→1.36 | Resin(5) 1.70→1.80 | Resin(6) 1.50→1.48 | Resin(7) 1.62→1.50 |
| Durability under low temperature and low humidity (23° C./5%) | AA: good No problem even after extensive operation on 50,000 sheets | A: Charge-up occurs during extensive operation but no problem. | AA: good No problem even after extensive operation on 50,000 sheets | B: Image density started decreasing from the middle of extensive operation. | AA: good | A: Gloss was a little low but durability was good. | A: In extensive operation, there was a tendency to cause charge-up. |
| Durability under high temperature and high humidity (30° C./80%) | AA: good No problem even after extensive operation on 50,000 sheets | AA: good No problem even after extensive operation on 50,000 sheets | B: Image density gradually increased with extensive operation. Slight contamination was seen on the fixing roller at 50,000-sheet | AA: good No problem even after extensive operation on 50,000 sheets | B: After left standing upon extensive operation, charge quantity decreased and image density increased. Fogging and scattering were slightly seen. | AA: good No problem even after extensive operation on 50,000 sheets | AA: good No Problem even after extensive operation on 50,000 sheets |

TABLE 19A-continued

| | Cyan toner | | | | | | |
|---|---|---|---|---|---|---|---|
| | C1 | C10 | C11 | C12 | C13 | C14 | C15 |
| OHP transparency | AA: good No problem even after extensive operation on 50,000 sheets | AA: good No problem even after extensive operation on 50,000 sheets | A: The image surface was slightly uneven. A little inferior. | AA: good No problem even after extensive operation on 50,000 sheets | AA: good No problem even after extensive operation on 50,000 sheets | B: Transparency is a little uneven | B: Transparency is a little uneven |

AA: Good
A: problem a little occurs, but practically no problem
B: problem occurs to some extent

TABLE 20A

| | Yellow toner | Magenta toner | Cyan toner | Black toner | Carrier | Photosensitive member diameter (mm) | PS (mm/s) | Photosensitive member surface potential (V) | SD gap (μm) | Sleeve peripheral speed ratio |
|---|---|---|---|---|---|---|---|---|---|---|
| Ex. 1A | Y1 | M1 | C1 | Bk1 | Carrier 1 | 60 | 133 | −400 | 450 | 1.75 |
| Ex. 2A | Y5 | M5 | C2 | Bk1 | Carrier 1 | 60 | 133 | −400 | 450 | 1.75 |
| Ex. 3A | Y5 | M10 | C2 | Bk1 | Carrier 1 | 60 | 133 | −400 | 450 | 1.75 |
| Comp. Ex. 1A | Y5 | M13 | C2 | Bk1 | Carrier 1 | 60 | 133 | −400 | 450 | 1.75 |
| Ex. 4A | Y5 | M5 | C4 | Bk1 | Carrier 1 | 60 | 133 | −400 | 450 | 1.75 |
| Comp. Ex. 2A | Y5 | M5 | C5 | Bk1 | Carrier 1 | 60 | 133 | −400 | 450 | 1.75 |
| Ex. 5A | Y18 | M13 | C5 | Bk1 | Carrier 1 | 60 | 133 | −400 | 450 | 1.75 |
| Ex. 6A | Y18 | M1 | C5 | Bk1 | Carrier 1 | 60 | 133 | −400 | 450 | 1.75 |
| Comp. Ex. 3A | Y18 | M5 | C5 | Bk1 | Carrier 1 | 60 | 133 | −400 | 450 | 1.75 |
| Ex. 7A | Y8 | M13 | C5 | Bk1 | Carrier 1 | 60 | 133 | −400 | 450 | 1.75 |
| Comp. Ex. 4A | Y5 | M13 | C5 | Bk1 | Carrier 1 | 60 | 133 | −400 | 450 | 1.75 |
| Ex. 8A | Y2 | M2 | C2 | Bk2 | Carrier 6 | 40 | 100 | −320 | 600 | 1.5 |
| Ex. 9A | Y3 | M3 | C1 | Bk7 | Carrier 7 | 60 | 300 | −380 | 450 | 3.0 |

| | Coloring power difference | Gloss difference in color | Chroma of full-color image | Color reproduction with changes in environment | Notes |
|---|---|---|---|---|---|
| Ex. 1A | 0.20 | AA | AA | A | Good images were obtained |
| Ex. 2A | 0.13 | AA | A | A | Good images were obtained |
| Ex. 3A | 0.35 | A | A | A | Good images were obtained |
| Comp. Ex. 1A | 0.54 | C | A | C | Color reproduction with changes in environment was bad. Texture different from color to color. |
| Ex. 4A | 0.43 | B | A | B | Color reproduction with changes in environment was a little poor, which fell within control. |
| Comp. Ex. 2A | 0.57 | C | A | C | Color reproduction with changes in environment was bad. Texture different from color to color. |
| Ex. 5A | 0.11 | AA | AA | A | Good images were obtained |
| Ex. 6A | 0.46 | B | AA | B | Color reproduction with changes in environment was a little poor, which fell within control. |
| Comp. Ex. 3A | 0.54 | C | A | C | Color reproduction with changes in environment was bad. Texture different from color to color. |
| Ex. 7A | 0.47 | B | A | B | Color reproduction with changes in environment was a little poor, which fell within control. |
| Comp. Ex. 4A | 0.57 | C | A | C | Color reproduction with changes in environment was bad. Texture different from color to color. |
| Ex. 8A | 0.17 | AA | A | A | Good images were obtained |
| Ex. 9A | 0.10 | AA | AA | A | " |

TABLE 21A

| | Yellow toner | Magenta toner | Cyan toner | Black toner | Carrier | Photosensitive member diameter (mm) | PS (mm/s) | Photosensitive member surface potential (V) | SD gap (μm) | Sleeve peripheral speed ratio |
|---|---|---|---|---|---|---|---|---|---|---|
| Ex. 10A | Y2 | M1 | C1 | Bk1 | Carrier 1 | 60 | 133 | −400 | 450 | 1.8 |
| Ex. 11A | Y3 | M1 | C1 | Bk1 | Carrier 1 | 60 | 133 | −400 | 450 | 1.8 |

TABLE 21A-continued

| | | | | | | | | | | |
|---|---|---|---|---|---|---|---|---|---|---|
| Ex. 12A | Y4 | M1 | C1 | Bk1 | Carrier 1 | 60 | 133 | −400 | 450 | 1.8 |
| Ex. 13A | Y5 | M1 | C1 | Bk1 | Carrier 1 | 60 | 133 | −400 | 450 | 1.8 |
| Ex. 14A | Y6 | M1 | C1 | Bk1 | Carrier 1 | 60 | 133 | −400 | 450 | 1.8 |
| Ex. 15A | Y7 | M1 | C1 | Bk1 | Carrier 1 | 60 | 133 | −400 | 450 | 1.8 |
| Ex. 16A | Y8 | M1 | C1 | Bk1 | Carrier 1 | 60 | 133 | −400 | 450 | 1.8 |
| Ex. 17A | Y9 | M1 | C1 | Bk1 | Carrier 1 | 60 | 133 | −400 | 450 | 1.8 |
| Ex. 18A | Y10 | M1 | C1 | Bk1 | Carrier 1 | 60 | 133 | −400 | 450 | 1.8 |
| Ex. 19A | Y11 | M1 | C1 | Bk1 | Carrier 1 | 60 | 133 | −400 | 450 | 1.8 |
| Ex. 20A | Y12 | M1 | C1 | Bk1 | Carrier 1 | 60 | 133 | −400 | 450 | 1.8 |

| | Coloring power difference | Gloss difference in color | Chroma of full-color image | Color reproduction with changes in environment | Notes |
|---|---|---|---|---|---|
| Ex. 10A | 0.19 | AA | A | A | Good images were obtained. |
| Ex. 11A | 0.20 | AA | AA | A | " |
| Ex. 12A | 0.15 | AA | A | A | " |
| Ex. 13A | 0.18 | AA | A | A | " |
| Ex. 14A | 0.14 | AA | A | A | " |
| Ex. 15A | 0.17 | AA | A | A | " |
| Ex. 16A | 0.08 | AA | A | A | " |
| Ex. 17A | 0.17 | AA | A | A | " |
| Ex. 18A | 0.07 | AA | A | A | " |
| Ex. 19A | 0.17 | AA | A | A | " |
| Ex. 20A | 0.10 | AA | B | A | Yellow, flesh color and green had a little defect, but there was no problem in practical use. |

TABLE 22A

| | Yellow toner | Magenta toner | Cyan toner | Black toner | Carrier | Photosensitive member diameter (mm) | PS (mm/s) | Photosensitive member surface potential (V) | SD gap (μm) | Sleeve peripheral speed ratio |
|---|---|---|---|---|---|---|---|---|---|---|
| Ex. 21A | Y1 | M2 | C1 | Bk1 | Carrier 1 | 60 | 133 | −400 | 450 | 1.8 |
| Ex. 22A | Y1 | M3 | C1 | Bk1 | Carrier 1 | 60 | 133 | −400 | 450 | 1.8 |
| Ex. 23A | Y1 | M4 | C1 | Bk1 | Carrier 1 | 60 | 133 | −400 | 450 | 1.8 |
| Ex. 24A | Y1 | M5 | C1 | Bk1 | Carrier 1 | 60 | 133 | −400 | 450 | 1.8 |
| Ex. 25A | Y1 | M6 | C1 | Bk1 | Carrier 1 | 60 | 133 | −400 | 450 | 1.8 |
| Ex. 26A | Y1 | M7 | C1 | Bk1 | Carrier 1 | 60 | 133 | −400 | 450 | 1.8 |
| Ex. 27A | Y1 | M8 | C1 | Bk1 | Carrier 1 | 60 | 133 | −400 | 450 | 1.8 |
| Ex. 28A | Y1 | M9 | C1 | Bk1 | Carrier 1 | 60 | 133 | −400 | 450 | 1.8 |
| Ex. 29A | Y1 | M10 | C1 | Bk1 | Carrier 1 | 60 | 133 | −400 | 450 | 1.8 |
| Ex. 30A | Y1 | M11 | C1 | Bk1 | Carrier 1 | 60 | 133 | −400 | 450 | 1.8 |
| Ex. 31A | Y1 | M12 | C1 | Bk1 | Carrier 1 | 60 | 133 | −400 | 450 | 1.8 |
| Ex. 32A | Y1 | M13 | C1 | Bk1 | Carrier 1 | 60 | 133 | −400 | 450 | 1.8 |
| Ex. 33A | Y1 | M14 | C1 | Bk1 | Carrier 1 | 60 | 133 | −400 | 450 | 1.8 |
| Ex. 34A | Y1 | M15 | C1 | Bk1 | Carrier 1 | 60 | 133 | −400 | 450 | 1.8 |
| Ex. 35A | Y1 | M16 | C1 | Bk1 | Carrier 1 | 60 | 133 | −400 | 450 | 1.8 |

| | Coloring power difference | Gloss difference in color | Chroma of full-color image | Color reproduction with changes in environment | Notes |
|---|---|---|---|---|---|
| Ex. 21A | 0.13 | AA | A | A | Good images were obtained. |
| Ex. 22A | 0.13 | AA | AA | A | " |
| Ex. 23A | 0.23 | AA | A | A | " |
| Ex. 24A | 0.28 | A | A | A | " |
| Ex. 25A | 0.13 | AA | A | A | " |
| Ex. 26A | 0.15 | AA | B | A | Magenta and flesh color were defective in color reproduction, but there was no problem in practical use. |
| Ex. 27A | 0.13 | AA | A | A | Good images were obtained. |
| Ex. 28A | 0.13 | AA | A | A | " |
| Ex. 29A | 0.17 | AA | AA | A | " |
| Ex. 30A | 0.13 | AA | B | A | Magenta and flesh color were defective in color reproduction, but there was no problem in practical use. |
| Ex. 31A | 0.13 | AA | B | A | Magenta and flesh color were defective in color reproduction, but there was no problem in practical use. |
| Ex. 32A | 0.36 | A | AA | A | Good images were obtained. |
| Ex. 33A | 0.14 | AA | A | A | " |

TABLE 22A-continued

| | | | | | |
|---|---|---|---|---|---|
| Ex. 34A | 0.13 | AA | B | A | Magenta and flesh color were defective in color reproduction, but there was no problem in practical use. |
| Ex. 35A | 0.14 | AA | A | A | Magenta and flesh color were defective in color reproduction, but there was no problem in practical use. |

TABLE 23A

| | Yellow toner | Magenta toner | Cyan toner | Black toner | Carrier | Photosensitive member diameter (mm) | PS (mm/s) | Photosensitive member surface potential (V) | SD gap (μm) | Sleeve peripheral speed ratio |
|---|---|---|---|---|---|---|---|---|---|---|
| Ex. 36 | Y1 | M1 | C2 | Bk1 | Carrier 1 | 60 | 133 | −400 | 450 | 1.8 |
| Ex. 37 | Y1 | M1 | C7 | Bk1 | Carrier 1 | 60 | 133 | −400 | 450 | 1.8 |
| Ex. 38 | Y1 | M1 | C8 | Bk1 | Carrier 1 | 60 | 133 | −400 | 450 | 1.8 |
| Ex. 39 | Y1 | M1 | C9 | Bk1 | Carrier 1 | 60 | 133 | −400 | 450 | 1.8 |
| Ex. 40 | Y1 | M1 | C1 | Bk2 | Carrier 1 | 60 | 133 | −400 | 450 | 1.8 |
| Ex. 41 | Y1 | M1 | C1 | Bk5 | Carrier 1 | 60 | 133 | −400 | 450 | 1.8 |
| Ex. 42 | Y1 | M1 | C1 | Bk6 | Carrier 1 | 60 | 133 | −400 | 450 | 1.8 |
| Ex. 43 | Y1 | M1 | C1 | Bk7 | Carrier 1 | 60 | 133 | −400 | 450 | 1.8 |
| Ex. 44 | Y1 | M1 | C1 | Bk8 | Carrier 1 | 60 | 133 | −400 | 450 | 1.8 |

| | Coloring power difference | Gloss difference in color | Chroma of full-color image | Color reproduction with changes in environment | Notes |
|---|---|---|---|---|---|
| Ex. 36 | 0.20 | AA | A | A | Good images were obtained. |
| Ex. 37 | 0.20 | AA | A | A | " |
| Ex. 38 | 0.20 | AA | AA | A | " |
| Ex. 39 | 0.20 | AA | AA | A | " |
| Ex. 40 | 0.20 | AA | AA | A | " |
| Ex. 41 | 0.20 | AA | AA | A | " |
| Ex. 42 | 0.20 | AA | AA | A | " |
| Ex. 43 | 0.20 | AA | AA | A | " |
| Ex. 44 | 0.20 | AA | AA | A | " |

TABLE 24A

| | Yellow toner | Magenta toner | Cyan toner | Black toner | Carrier | Photo-sensitive member diameter (mm) | PS (mm/s) | Photo-sensitive member surface potential (V) | SD gap (μm) | Sleeve periph-eral speed ratio |
|---|---|---|---|---|---|---|---|---|---|---|
| Ex. 45A | Y1 | M1 | C1 | Bk1 | Carrier 1 | 60 | 200 | 380 | 500 | 1.9 |
| Ex. 46A | Y2 | M1 | C1 | Bk1 | Carrier 1 | 60 | 200 | 380 | 500 | 1.9 |
| Ex. 47A | Y3 | M1 | C1 | Bk1 | Carrier 1 | 60 | 200 | 380 | 500 | 1.9 |
| Ex. 48A | Y4 | M1 | C1 | Bk1 | Carrier 1 | 60 | 200 | 380 | 500 | 1.9 |
| Ex. 49A | Y5 | M1 | C1 | Bk1 | Carrier 1 | 60 | 200 | 380 | 500 | 1.9 |
| Ex. 50A | Y6 | M1 | C1 | Bk1 | Carrier 1 | 60 | 200 | 380 | 500 | 1.9 |
| Ex. 51A | Y7 | M1 | C1 | Bk1 | Carrier 1 | 60 | 200 | 380 | 500 | 1.9 |
| Ex. 52A | Y8 | M1 | C1 | Bk1 | Carrier 1 | 60 | 200 | 380 | 500 | 1.9 |
| Ex. 53A | Y9 | M1 | C1 | Bk1 | Carrier 1 | 60 | 200 | 380 | 500 | 1.9 |
| Ex. 54A | Y10 | M1 | C1 | Bk1 | Carrier 1 | 60 | 200 | 380 | 500 | 1.9 |
| Ex. 55A | Y11 | M1 | C1 | Bk1 | Carrier 1 | 60 | 200 | 380 | 500 | 1.9 |
| Ex. 56A | Y12 | M1 | C1 | Bk1 | Carrier 1 | 60 | 200 | 380 | 500 | 1.9 |

| | Coloring power difference | Gloss difference in color | Chroma of full-color image | Color reproduction with changes in environment | Notes |
|---|---|---|---|---|---|
| Ex. 45A | 0.20 | AA | AA | A | Good images were obtained. |
| Ex. 46A | 0.19 | AA | A | A | " |
| Ex. 47A | 0.20 | AA | AA | A | " |
| Ex. 48A | 0.16 | AA | A | A | " |
| Ex. 49A | 0.18 | AA | A | A | " |
| Ex. 50A | 0.14 | AA | A | A | " |
| Ex. 51A | 0.17 | AA | A | A | " |
| Ex. 52A | 0.08 | AA | A | A | " |
| Ex. 53A | 0.17 | AA | A | A | " |

TABLE 24A-continued

| | | | | | |
|---|---|---|---|---|---|
| Ex. 54A | 0.07 | AA | A | A | " |
| Ex. 55A | 0.17 | AA | A | A | " |
| Ex. 56A | 0.10 | AA | B | A | Yellow, flesh color and green had a little defect, but there was no problem in practical use. |

TABLE 25A

| | Yellow toner | Magenta toner | Cyan toner | Black toner | Carrier | Photo-sensitive member diameter (mm) | PS (mm/s) | Photo-sensitive member surface potential (V) | SD gap (μm) | Sleeve periph-eral speed ratio |
|---|---|---|---|---|---|---|---|---|---|---|
| Ex. 57A | Y1 | M2 | C1 | Bk1 | Carrier 1 | 60 | 200 | 380 | 500 | 1.9 |
| Ex. 58A | Y1 | M3 | C1 | Bk1 | Carrier 1 | 60 | 200 | 380 | 500 | 1.9 |
| Ex. 59A | Y1 | M4 | C1 | Bk1 | Carrier 1 | 60 | 200 | 380 | 500 | 1.9 |
| Ex. 60A | Y1 | M5 | C1 | Bk1 | Carrier 1 | 60 | 200 | 380 | 500 | 1.9 |
| Ex. 61A | Y1 | M6 | C1 | Bk1 | Carrier 1 | 60 | 200 | 380 | 500 | 1.9 |
| Ex. 62A | Y1 | M7 | C1 | Bk1 | Carrier 1 | 60 | 200 | 380 | 500 | 1.9 |
| Ex. 63A | Y1 | M8 | C1 | Bk1 | Carrier 1 | 60 | 200 | 380 | 500 | 1.9 |
| Ex. 64A | Y1 | M9 | C1 | Bk1 | Carrier 1 | 60 | 200 | 380 | 500 | 1.9 |
| Ex. 65A | Y1 | M10 | C1 | Bk1 | Carrier 1 | 60 | 200 | 380 | 500 | 1.9 |
| Ex. 66A | Y1 | M11 | C1 | Bk1 | Carrier 1 | 60 | 200 | 380 | 500 | 1.9 |
| Ex. 67A | Y1 | M12 | C1 | Bk1 | Carrier 1 | 60 | 200 | 380 | 500 | 1.9 |
| Ex. 68A | Y1 | M13 | C1 | Bk1 | Carrier 1 | 60 | 200 | 380 | 500 | 1.9 |
| Ex. 69A | Y1 | M14 | C1 | Bk1 | Carrier 1 | 60 | 200 | 380 | 500 | 1.9 |
| Ex. 70A | Y1 | M15 | C1 | Bk1 | Carrier 1 | 60 | 200 | 380 | 500 | 1.9 |
| Ex. 71A | Y1 | M16 | C1 | Bk1 | Carrier 1 | 60 | 200 | 380 | 500 | 1.9 |

| | Coloring power difference | Gloss difference in color | Chroma of full-color image | Color reproduction with changes in environment | Notes |
|---|---|---|---|---|---|
| Ex. 57A | 0.13 | AA | A | A | Good images were obtained. |
| Ex. 58A | 0.13 | AA | AA | A | " |
| Ex. 59A | 0.23 | AA | A | A | " |
| Ex. 60A | 0.28 | A | A | A | " |
| Ex. 61A | 0.13 | AA | A | A | " |
| Ex. 62A | 0.15 | AA | B | A | Magenta and flesh color were defective in color reproduction, but there was no problem in practical use. |
| Ex. 63A | 0.13 | AA | A | A | Good images were obtained. |
| Ex. 64A | 0.13 | AA | A | A | " |
| Ex. 65A | 0.17 | AA | AA | A | " |
| Ex. 66A | 0.13 | AA | B | A | Magenta and flesh color were defective in color reproduction, but there was no problem in practical use. |
| Ex. 67A | 0.13 | AA | B | A | Magenta and flesh color were defective in color reproduction. but there was no problem in practical use. |
| Ex. 68A | 0.36 | A | AA | A | Good images were obtained. |
| Ex. 69A | 0.14 | AA | A | A | " |
| Ex. 70A | 0.13 | AA | B | A | Magenta and flesh color were defective in color reproduction, but there was no problem in practical use. |
| Ex. 71A | 0.14 | AA | A | A | Magenta and flesh color were defective in color reproduction, but there was no problem in practical use. |

TABLE 26A

| | Yellow toner | Magenta toner | Cyan toner | Black toner | Carrier | Photo-sensitive member diameter (mm) | PS (mm/s) | Photo-sensitive member surface potential (V) | SD gap (μm) | Sleeve periph-eral speed ratio |
|---|---|---|---|---|---|---|---|---|---|---|
| Ex. 72A | Y1 | M1 | C2 | Bk1 | Carrier 1 | 60 | 200 | 380 | 500 | 1.9 |
| Ex. 73A | Y1 | M1 | C7 | Bk1 | Carrier 1 | 60 | 200 | 380 | 500 | 1.9 |
| Ex. 74A | Y1 | M1 | C8 | Bk1 | Carrier 1 | 60 | 200 | 380 | 500 | 1.9 |
| Ex. 75A | Y1 | M1 | C9 | Bk1 | Carrier 1 | 60 | 200 | 380 | 500 | 1.9 |
| Ex. 76A | Y1 | M1 | C1 | Bk2 | Carrier 1 | 60 | 200 | 380 | 500 | 1.9 |

TABLE 26A-continued

| | | | | | | | | | | |
|---|---|---|---|---|---|---|---|---|---|---|
| Ex. 77A | Y1 | M1 | C1 | Bk5 | Carrier 1 | 60 | 200 | 380 | 500 | 1.9 |
| Ex. 78A | Y1 | M1 | C1 | Bk6 | Carrier 1 | 60 | 200 | 380 | 500 | 1.9 |
| Ex. 79A | Y1 | M1 | C1 | Bk7 | Carrier 1 | 60 | 200 | 380 | 500 | 1.9 |
| Ex. 80A | Y1 | M1 | C1 | Bk8 | Carrier 1 | 60 | 200 | 380 | 500 | 1.9 |

| | Coloring power difference | Gloss difference in color | Chroma of full-color image | Color reproduction with changes in environment | Notes |
|---|---|---|---|---|---|
| Ex. 72A | 0.20 | AA | A | A | Good images were obtained. |
| Ex. 73A | 0.20 | AA | A | A | " |
| Ex. 74A | 0.20 | AA | AA | A | " |
| Ex. 75A | 0.20 | AA | AA | A | " |
| Ex. 76A | 0.20 | AA | AA | A | " |
| Ex. 77A | 0.20 | AA | AA | A | " |
| Ex. 78A | 0.20 | AA | AA | A | " |
| Ex. 79A | 0.20 | AA | AA | A | " |
| Ex. 80A | 0.20 | AA | AA | A | " |

TABLE 2B

| | Charge injection inhibiting layer | Photo-conductive layer 1 | Photo-conductive layer 2 | Surface layer |
|---|---|---|---|---|
| Gases and flow rate | | | | |
| $SiH_4$[$cm^3$/min(normal)] | 100 | 200 | 200 | 10 |
| $H_2$[$cm^3$/min(normal)] | 300 | 800 | 800 | |
| $B_2H_6$[ppm](based on $SiH_4$) | 2000 | 2 | 0.5 | |
| NO[$cm^3$/min(normal)] | 50 | | | |
| $CH_4$[$cm^3$/min(normal)] | | | | 480 |
| Temperature of support (° C.) | 280 | 280 | 280 | 280 |
| Internal pressure [Pa] | 67 | 67 | 67 | 53 |
| RF POWER [W] | 500 | 800 | 400 | 250 |
| Layer thickness [$\mu$m] | 3 | 20 | 7 | 0.5 |

TABLE 3B

| | Charge injection inhibiting layer | Photo-conductive layer | Inter-mediate layer 2 | Surface layer |
|---|---|---|---|---|
| Gases and flow rate | | | | |
| $SiH_4$[$cm^3$/min(normal)] | 160 | 200 | 100 | 10 |
| $H_2$[$cm^3$/min(normal)] | 500 | 800 | | |
| $PH_3$[ppm](based on $SiH_4$) | 1000 | | | |
| $B_2H_6$[ppm](based on $SiH_4$) | | 0.5 | 500 | |
| $CH_4$[$cm^3$/min(normal)] | 20 | | 300 | 480 |
| Temperature of support (° C.) | 260 | 260 | 260 | 260 |
| Internal pressure [Pa] | 40 | 40 | 27 | 13 |
| RF POWER [W] | 300 | 600 | 300 | 200 |
| Layer thickness [$\mu$m] | 2 | 30 | 0.1 | 0.5 |

TABLE 4B

| Resin | Monomer composition | Acid value (mgKOH/g) | Tg (° C.) | Mn | Mw |
|---|---|---|---|---|---|
| Resin (1) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Fumaric acid<br>Trimellitic acid | 10.5 | 56 | 4000 | 10500 |
| Resin (2) | Polyoxypropylene(2.2)-2,2bis(4-hydroxyphenyl)propane<br>Fumaric acid<br>Trimellitic acid | 2.3 | 59 | 4500 | 12500 |
| Resin (3) | Polyoxypropylene(2.2)-2,2bis(4-hydroxyphenyl)propane<br>Fumaric acid | 44.3 | 49 | 3600 | 8500 |
| Resin (4) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Fumaric acid<br>Trimellitic acid | 1.9 | 62 | 5200 | 18600 |

TABLE 4B-continued

| Resin | Monomer composition | Acid value (mgKOH/g) | Tg (° C.) | Mn | Mw |
|---|---|---|---|---|---|
| Resin (5) | Polyoxypropylene(2.2)-2,2bis(4-hydroxyphenyl)propane<br>Terephthalic acid<br>Fumaric acid<br>Trimellitic acid | 55.3 | 59 | 5800 | 22200 |
| Resin (6) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Trimellitic acid | 13.2 | 69 | 8400 | 105000 |
| Resin (7) | Styrene<br>n-butylacrylate<br>mono-n-butylmalate | 13.2 | 63 | 6000 | 18800 |

TABLE 5B

| | Resin | | Colorant | | Charge control agent | | Pigment- | External additive | | Toner | |
|---|---|---|---|---|---|---|---|---|---|---|---|
| | Resins | Amount (wt %) | Colorants*1) | Amount (wt %) | Charge control agents | Amount (wt %) | dispersing condition*2) | External additives | Amount (wt %) | diameter (μm) | Coloring power D0.5Y |
| Y1 | Resin(1) | 100 | PY 180 | 5.0 | Quaternary ammonium salt*3) | 4.0 | Strong | Titanium oxide A | 1.0 | 8.0 | 1.42 |
| Y2 | Resin(1) | 100 | PY 74 | 3.0 | Quaternary ammonium salt | 4.0 | Strong | Titanium oxide A | 1.0 | 8.0 | 1.41 |
| Y3 | Resin(1) | 100 | PY 93 | 5.0 | Quaternary ammonium salt | 4.0 | Strong | Titanium oxide A | 1.0 | 8.0 | 1.38 |
| Y4 | Resin(1) | 100 | PY 97 | 5.0 | Quaternary ammonium salt | 4.0 | Strong | Titanium oxide A | 1.0 | 8.0 | 1.38 |
| Y5 | Resin(1) | 100 | PY 109 | 5.0 | Quaternary ammonium salt | 4.0 | Strong | Titanium oxide A | 1.0 | 8.0 | 1.11 |
| Y6 | Resin(1) | 100 | PY 128 | 6.0 | Quaternary ammonium salt | 4.0 | Strong | Titanium oxide A | 1.0 | 8.0 | 1.37 |
| Y7 | Resin(1) | 100 | PY 151 | 5.5 | Quaternary ammonium salt | 4.0 | Strong | Titanium oxide A | 1.0 | 8.0 | 1.40 |
| Y8 | Resin(1) | 100 | PY 154 | 4.0 | Quaternary ammonium salt | 4.0 | Strong | Titanium oxide A | 1.0 | 8.0 | 1.23 |
| Y9 | Resin(1) | 100 | PY 155 | 5.0 | Quaternary ammonium salt | 4.0 | Strong | Titanium oxide A | 1.0 | 8.0 | 1.13 |
| Y10 | Resin(1) | 100 | PY 166 | 4.0 | Quaternary ammonium salt | 4.0 | Strong | Titanium oxide A | 1.0 | 8.0 | 1.26 |

| | Resin | | Colorant | | Charge control agent | | Pigment- | External additive | | Toner | |
|---|---|---|---|---|---|---|---|---|---|---|---|
| | Resins | Amount (wt %) | Colorants*1) | Amount (wt %) | Charge control agents | Amount (wt %) | dispersing condition*3) | External additives | Amount (wt %) | diameter (μm) | Coloring power D0.5Y |
| Y11 | Resin(1) | 100 | PY 168 | 4.0 | Quaternary ammonium salt | 4.0 | Strong | Titanium oxide A | 1.0 | 8.0 | 1.40 |
| Y12 | Resin(1) | 100 | PY 185 | 5.0 | Quaternary ammonium salt | 4.0 | Strong | Titanium oxide A | 1.0 | 8.0 | 1.21 |
| Y13 | Resin(1) | 100 | PY 180 | 5.0 | Quaternary ammonium salt | 4.0 | Strong | Titanium oxide A | 1.5 | 4.5 | 1.57 |
| Y14 | Resin(1) | 100 | PY 180 | 5.0 | Quaternary ammonium salt | 4.0 | Strong | Titanium oxide A | 0.8 | 9.5 | 1.31 |
| Y15 | Resin(1) | 100 | PY 180 | 5.0 | Quaternary ammonium salt | 4.0 | Strong | Titanium oxide A | 1.5 | 3.8 | 1.62 |
| Y16 | Resin(1) | 100 | PY 180 | 5.0 | Quaternary ammonium salt | 4.0 | Strong | Titanium oxide A | 0.6 | 11.0 | 1.21 |
| Y17 | Resin(1) | 100 | PY 93 | 2.5 | Quaternary ammonium salt | 4.0 | Strong | Titanium oxide A | 1.0 | 8.0 | 0.97 |
| Y18 | Resin(1) | 100 | PY 93 | 6.0 | Quaternary ammonium salt | 4.0 | Strong | Titanium oxide A | 1.0 | 8.0 | 1.57 |
| Y19 | Resin(1) | 100 | PY 180 | 8.0 | Quaternary ammonium salt | 4.0 | Normal | Titanium oxide A | 1.0 | 8.0 | 1.84 |
| Y20 | Resin(1) | 100 | PY 180 | 4.0 | Quaternary ammonium salt | 4.0 | Normal | Titanium oxide A | 1.0 | 8.0 | 1.25 |

*1)PY represents C.I. Pigment Yellow.

*2)Weak: First kneaded product is not made and the dispersion state is weak.

Normal: Powder pigment is blended with resin and kneaded twice with a three-roll mill to make first kneaded product.

Strong: Paste pigment is heated and melt-kneaded to make first kneaded product.

Strong 2: The first kneaded product made in the pigment-dispersing condition "strong" is further kneaded 5 times with a three-roll mill.

*3)Quaternary ammonium salt: VP2036 (melting point: 200° C.) made by Hoechst.

TABLE 6B

| | Resin | | Colorant | | Charge control agent | | Pigment- | External additive | | Toner | |
|---|---|---|---|---|---|---|---|---|---|---|---|
| | Resins | Amount (wt %) | Colorants*1) | Amount (wt %) | Charge control agents | Amount (wt %) | dispersing condition*2) | External additives | Amount (wt %) | diameter (μm) | Coloring power D0.5M |
| M1 | Resin(1) | 100 | PR 122 | 6.0 | Quaternary ammonium salt | 4.0 | Strong | Titanium oxide A | 1.2 | 7.5 | 1.23 |
| M2 | Resin(1) | 100 | PR 57.1 | 3.5 | Quaternary ammonium salt | 4.0 | Strong | Titanium oxide A | 1.2 | 7.5 | 1.41 |
| M3 | Resin(1) | 100 | PR 122<br>PR 57.1 | 2.0<br>2.0 | Quaternary ammonium salt | 4.0 | Strong | Titanium oxide A | 1.2 | 7.5 | 1.30 |
| M4 | Resin(1) | 100 | PR 48.2 | 4.0 | Quaternary ammonium salt | 4.0 | Strong | Titanium oxide A | 1.2 | 7.5 | 1.19 |
| M5 | Resin(1) | 100 | PR 58.2 | 5.0 | Quaternary ammonium salt | 4.0 | Strong | Titanium oxide A | 1.2 | 7.5 | 1.15 |
| M6 | Resin(1) | 100 | PR 5 | 5.0 | Quaternary ammonium salt | 4.0 | Strong | Titanium oxide A | 1.2 | 7.5 | 1.44 |
| M7 | Resin(1) | 100 | PR 31 | 4.0 | Quaternary ammonium salt | 4.0 | Strong | Titanium oxide A | 1.2 | 7.5 | 1.44 |
| M8 | Resin(1) | 100 | PR 146 | 4.0 | Quaternary ammonium salt | 4.0 | Strong | Titanium oxide A | 1.2 | 7.5 | 1.30 |
| M9 | Resin(1) | 100 | PR 147 | 4.0 | Quaternary ammonium salt | 4.0 | Strong | Titanium oxide A | 1.2 | 7.5 | 1.31 |
| M10 | Resin(1) | 100 | PR 150 | 5.0 | Quaternary ammonium salt | 4.0 | Strong | Titanium oxide A | 1.2 | 7.5 | 1.45 |
| M11 | Resin(1) | 100 | PR 184 | 4.0 | Quaternary ammonium salt | 4.0 | Strong | Titanium oxide A | 1.2 | 7.5 | 1.32 |
| M12 | Resin(1) | 100 | PR 187 | 4.0 | Quaternary ammonium salt | 4.0 | Strong | Titanium oxide A | 1.2 | 7.5 | 1.30 |
| M13 | Resin(1) | 100 | PR 238 | 6.0 | Quaternary ammonium salt | 4.0 | Strong | Titanium oxide A | 1.2 | 7.5 | 1.64 |
| M14 | Resin(1) | 100 | PR 245 | 4.0 | Quaternary ammonium salt | 4.0 | Strong | Titanium oxide A | 1.2 | 7.5 | 1.29 |
| M15 | Resin(1) | 100 | PR 185 | 5.0 | Quaternary ammonium salt | 4.0 | Strong | Titanium oxide A | 1.2 | 7.5 | 1.40 |
| M16 | Resin(2) | 100 | PR 265 | 5.0 | Quaternary ammonium salt | 4.0 | Strong | Titanium oxide A | 1.2 | 7.5 | 1.28 |

*1)PR represents C.I. Pigment Red.
*2)Strong: Paste pigment is heated and melt-kneaded to make first kneaded product.

TABLE 7B

| | Resin | | Colorant | | Charge control agent | | Pigment- | External additive | | Toner | Coloring |
|---|---|---|---|---|---|---|---|---|---|---|---|
| | Resins | Amount (wt %) | Colorants*1) | Amount (wt %) | Charge control agents | Amount (wt %) | dispersing condition*2) | External additives | Amount (wt %) | diameter (μm) | power D0.5C |
| C1 | Resin(1) | 100 | PB 15:3 | 3.0 | Quaternary ammonium salt | 4.0 | Strong | Titanium oxide A | 1.0 | 8.0 | 1.30 |
| C2 | Resin(1) | 100 | Al phthalo-cyanine | 5.0 | Quaternary ammonium salt | 4.0 | Strong | Titanium oxide A | 1.4 | 6.0 | 1.23 |
| C3 | Resin(1) | 100 | PB 15:3 | 2.0 | Quaternary ammonium salt | 4.0 | Weak | Alumina A | 1.0 | 7.0 | 0.91 |
| C4 | Resin(1) | 100 | PB 15:3 | 4.0 | Quaternary ammonium salt | 4.0 | Strong | Alumina A | 1.0 | 7.0 | 1.54 |
| C5 | Resin(1) | 100 | PB 15:3 | 5.0 | Quaternary ammonium salt | 4.0 | Strong | Alumina A | 1.0 | 7.0 | 1.69 |
| C6 | Resin(1) | 100 | PB 15:3 | 6.0 | Quaternary ammonium salt | 4.0 | Strong | Alumina A | 1.0 | 7.0 | 1.83 |
| C7 | Resin(1) | 100 | PB 15:3 | 3.0 | Imidazol compound | 3.0 | Strong | Titanium oxide A | 1.0 | 8.0 | 1.33 |
| C8 | Resin(1) | 100 | PB 15:3 | 3.0 | Ammonium group-containing sytrene-acryl copolymer resin | 5.0 | Strong | Titanium oxide A | 1.0 | 8.0 | 1.39 |
| C9 | Resin(1) | 100 | PB 15:3 | 3.0 | Quaternary ammonium salt<br>Imidazol compound | 1.0<br>3.0 | Strong | Titanium oxide A | 1.0 | 8.0 | 1.38 |
| C10 | Resin(2) | 100 | PB 15:3 | 3.0 | Quaternary ammonium salt | 4.0 | Strong | Titanium oxide A | 1.0 | 8.0 | 1.36 |
| C11 | Resin(3) | 100 | PB 15:3 | 3.0 | Quaternary ammonium salt | 4.0 | Strong | Titanium oxide A | 1.0 | 8.0 | 1.25 |

TABLE 7B-continued

| | Resin | | Colorant | | Charge control agent | | Pigment- | External additive | | Toner | Coloring |
|---|---|---|---|---|---|---|---|---|---|---|---|
| | Resins | Amount (wt %) | Colorants*1) | Amount (wt %) | Charge control agents | Amount (wt %) | dispersing condition*2) | External additives | Amount (wt %) | diameter (μm) | power D0.5C |
| C12 | Resin(4) | 100 | PB 15:3 | 3.0 | Quaternary ammonium salt | 4.0 | Strong | Titanium oxide A | 1.0 | 8.0 | 1.38 |
| C13 | Resin(5) | 100 | PB 15:3 | 3.0 | Quaternary ammonium salt | 4.0 | Strong | Titanium oxide A | 1.0 | 8.0 | 1.23 |
| C14 | Resin(6) | 100 | PB 15.3 | 3.0 | Quaternary ammonium salt | 4.0 | Strong | Titanium oxide A | 1.0 | 8.0 | 1.10 |
| C15 | Resin(7) | 100 | PB 15:3 | 3.0 | Quaternary ammonium salt | 4.0 | Strong | Titanium oxide A | 1.0 | 8.0 | 1.16 |

*1)PB represents C.I. Pigment Blue.
*2)Weak: First kneaded product is not made and the dispersion state is weak.
Strong: Paste pigment is heated and melt-kneaded to make first kneaded product.

TABLE 8B

| Inorganic fine powder | Base material of inorganic fine powder | Treatment materials | Average primary particle diameter (μm) | Hydro-phobicity degree (%) | BET specific surface area ($m^2/g$) |
|---|---|---|---|---|---|
| Titanium oxide A | Titanium oxide | 3-amino-propyl-trimethoxy-silane | 0.03 | 66 | 130 |
| Alumina A | Alumina | 3-amino-propyl-trimethoxy-silane | 0.005 | 66 | 210 |
| Silica A | Silica | Hexamethyl-disilazane + Amino-modified silicone oil | 0.005 | 64 | 230 |

TABLE 10B

| | List of Carbon Black | | | | |
|---|---|---|---|---|---|
| | Primary particle diameter (nm) | Oil absorption (ml/100 g) | BET specific surface area ($m^2/g$) | Volatile (%) | pH |
| CB-A | 32 | 45 | 65 | 0.5 | 9 |
| CB-B | 40 | 135 | 50 | 1.5 | 7 |
| CB-C | 18 | 123 | 145 | 1.2 | 9 |

TABLE 11B

| | Core materials | *4) Coating materials | Coating amount (%) | 50% average particle diameter (μm) |
|---|---|---|---|---|
| Carrier 1 | Mn-Mg-Fe type ferrite | Coating material A | 0.2 | 40 |

TABLE 9B

| | Resin | | Colorant | | Charge control agent | | Pigment- | External additive | | Toner | |
|---|---|---|---|---|---|---|---|---|---|---|---|
| | Resins | Amount (wt %) | Colorants*1) | Amount (wt %) | Charge control agents | Amount (wt %) | dispersing condition*2) | External additives | Amount (wt %) | diameter (μm) | Coloring power D0.5K |
| Bk1 | Resin(1) | 100 | CB-A | 3.0 | Quaternary ammonium salt | 4.0 | Normal | Titanium oxide A | 1.0 | 8.0 | 1.28 |
| Bk2 | Resin(1) | 100 | CB-A | 4.0 | Quaternary ammonium salt | 4.0 | Normal | Titanium oxide A | 1.0 | 8.0 | 1.50 |
| Bk3 | Resin(1) | 100 | CB-A | 6.0 | Quaternary ammonium salt | 4.0 | Normal | Titanium oxide A | 1.0 | 8.0 | 1.79 |
| Bk4 | Resin(1) | 100 | CB-A | 2.0 | Quaternary ammonium salt | 4.0 | Weak | Titanium oxide A | 1.0 | 8.0 | 0.91 |
| Bk5 | Resin(1) | 100 | CB-B | 3.5 | Quaternary ammonium salt | 4.0 | Normal | Titanium oxide A | 1.0 | 8.0 | 1.41 |
| Bk6 | Resin(1) | 100 | CB-C | 2.5 | Quaternary ammonium salt | 4.0 | Normal | Titanium oxide A | 1.0 | 8.0 | 1.20 |
| Bk7 | Resin(1) | 100 | PY 17<br>PR 5<br>PB 15:3<br>CB-A | 1.5<br>3.0<br>1.5<br>1.0 | Quaternary ammonium salt | 4.0 | Normal | Titanium oxide A | 1.0 | 8.0 | 1.25 |
| Bk8 | Resin(1) | 100 | CB-A | 3.0 | Quaternary ammonium salt | 4.0 | Normal | Silica A | 1.0 | 8.0 | 1.28 |

*1)PY, PR and PB represent C.I. Pigment Yellow, Red and Blue, respectively,
*2)Weak: First kneaded product is not made and the dispersion state is weak.
Normal: Powder pigment is blended with resin and kneaded twice with a three-roll mill to make first kneaded product.

TABLE 11B-continued

| | Core materials | *4) Coating materials | Coating amount (%) | 50% average particle diameter (μm) |
|---|---|---|---|---|
| Carrier 2 | Mn-Mg-Fe type ferrite | Coating material A | 1.0 | 9 |
| Carrier 3 | Mn-Mg-Fe type ferrite | Coating material A | 0.5 | 15 |
| Carrier 4 | Mn-Mg-Fe type ferrite | Coating material A | 0.1 | 60 |
| Carrier 5 | Mn-Mg-Fe type ferrite | Coating material A | 0.05 | 82 |
| Carrier 6 | Cu-Zn-Fe type ferrite | Coating material A | 0.2 | 40 |
| Carrier 7 | Cu-Zn-Fe type ferrite | Coating material B | 0.35 | 40 |

*4)Coating material A: Fluorine-containing acrylic resin
Coating material B: Polyester resin to which 5 wt % azo-iron metal complex is added

TABLE 12B

| Photosensitive member diameter (mm) | 15 | 20 | 60 | 80 | 100 |
|---|---|---|---|---|---|
| Bk solid density | 1.30 | 1.51 | 1.58 | 1.60 | 1.62 |
| Yellow density (single color) | 1.27 | 1.45 | 1.55 | 1.58 | 1.59 |
| Yellow density (four colors) | 1.27 | 1.45 | 1.53 | 1.55 | 1.43 |
| Notes | Potential was insufficient. Slowing down the speed, evaluation was made. | | | | Image density was uneven. |

TABLE 13B

| Surface potential (V) | 250 | 300 | 400 | 450 | 500 |
|---|---|---|---|---|---|
| Image density | 1.32 | 1.41 | 1.60 | 1.66 | 1.69 |
| Density dispersion | 0.05 | 0.07 | 0.09 | 0.11 | 0.22 |
| Drum ghost | 0.06 | 0.08 | 0.10 | 0.11 | 0.20 |

TABLE 14B

| SD gap (μm) | 300 | 16 350 | 500 | 800 | 900 |
|---|---|---|---|---|---|
| Image density | 1.65 | 1.60 | 1.52 | 1.40 | 1.33 |
| Drum melt-adhesion after extensive operation on 10,000 sheets | Melt-adhesion occurs. | None | None | None | None |

TABLE 15B

| Sleeve peripheral speed ratio | 1.05 | 1.1 | 2.0 | 4.0 | 5.0 |
|---|---|---|---|---|---|
| Image density at the initial stage | 1.25 | 1.53 | 1.58 | 1.61 | 1.64 |
| Image density after extensive operation on 50,000 sheets | 1.24 | 1.51 | 1.55 | 1.52 | 1.30 |
| Fogging on drum after extensive operation on 50,000 sheets | 0.1 | 0.2 | 0.5 | 2.3 | 5.7 |

TABLE 16B

| Toner | Y15 | Y13 | Y1 | Y14 | Y16 |
|---|---|---|---|---|---|
| Weight-average particle diameter (μm) | 3.8 | 4.5 | 8.0 | 9.5 | 11.0 |
| Image quality | C | A | A | AB | C |
| Notes | Much fogging | Image density slightly decreases in light-resistance test. | Good | | Minute dot reproduction is bad |

A: good
B: average
C: poor

TABLE 17B

| Carrier No. | Carrier 2 | Carrier 3 | Carrier 1 | Carrier 4 | Carrier 5 |
|---|---|---|---|---|---|
| 50% average particle diameter of carrier (μm) | 9 | 15 | 40 | 60 | 82 |
| Carrier adhesion | severe | a little | none | none | none |
| Stability of coating amount on sleeve | C | AB | A | A | A |
| Image quality | C | A | A | AB | C |

A: good
B: average
C: bad (poor)

TABLE 18B

| Yellow toner | Y17 | Y21 | Y20 | Y3 | Y18 | Y19 | Y22 |
|---|---|---|---|---|---|---|---|
| Coloring power D0.5Y | 0.97 | 0.99 | 1.25 | 1.38 | 1.57 | 1.84 | 1.85 |
| Image density | 1.30 | 1.33 | 1.54 | 1.57 | 1.59 | 1.63 | 1.64 |

TABLE 18B-continued

| Yellow toner | Y17 | Y21 | Y20 | Y3 | Y18 | Y19 | Y22 |
|---|---|---|---|---|---|---|---|
| Image density reproduction at HT | good | good | good | good | good | poor | poor |
| Notes | Image density was insufficient. | Image density was insufficient. | | | | Fogging was liable to occur. Too much pigment causes charging inhibition. | Gradation at HT was bad. Anti-offset property was poor |

TABLE 19B

| Cyan toner Resin | C1 Resin (1) | C10 Resin (2) | C11 Resin (3) | C12 Resin (4) | C13 Resin (5) | C14 Resin (6) | C15 Resin (7) |
|---|---|---|---|---|---|---|---|
| Durability under low temperature and low humidity (23° C./5%) | 1.68→1.65 AA: good No problem even after extensive operation on 50,000 sheets | 1.66→1.42 A: Image density decreases | 1.75→1.74 B: Fogging occurs | 1.68→1.45 A: Image density decreases | 1.72→1.66 B: Fogging occurs | 1.45→1.42 A: Gloss was a little low, but durability was good. | 1.60→1.51 AA: good No problem even after extensive operation on 50,000 sheets |
| Durability under high temperature and high humidity (30° C./80%) | AA: good No problem even after extensive operation on 50,000 sheets | AA: good No problem even after extensive operation on 50,000 sheets | B: Slight contamination was seen on the fixing roller at 50,000-sheet operation. | AA: good No problem even after extensive operation on 50,000 sheets | AA: good No problem even after extensive operation on 50,000 sheets | AA: good No problem even after extensive operation on 50,000 sheets | AA: good No problem even after extensive operation on 50,000 sheets |
| OHP transparency | AA: good No problem even after extensive operation on 50,000 sheets | AA: good No problem even after extensive operation on 50,000 sheets | A: The image surface was slightly uneven. A little inferior. | AA: good No problem even after extensive operation on 50,000 sheets | AA: good No problem even after extensive operation on 50,000 sheets | B: Transparency is a little uneven | B: Transparency is a little uneven |

AA: good
A: problem a little occurs, but practically no problem
B: problem occurs to some extent

TABLE 20B

| | Yellow toner | Magenta toner | Cyan toner | Black toner | Carrier | Photo-sensitive member diameter (mm) | PS (mm/s) | Photo-sensitive member surface potential (V) | SD gap (μm) | Sleeve peripheral speed ratio |
|---|---|---|---|---|---|---|---|---|---|---|
| Ex. 1B | Y1 | M1 | C1 | Bk1 | Carrier 1 | 60 | 133 | 400 | 450 | 1.75 |
| Ex. 2B | Y5 | M5 | C2 | Bk1 | Carrier 1 | 60 | 133 | 400 | 450 | 1.75 |
| Ex. 3B | Y5 | M10 | C2 | Bk1 | Carrier 1 | 60 | 133 | 400 | 450 | 1.75 |
| Comp. Ex. 1B | Y5 | M13 | C2 | Bk1 | Carrier 1 | 60 | 133 | 400 | 450 | 1.75 |
| Ex. 4B | Y5 | M5 | C4 | Bk1 | Carrier 1 | 60 | 133 | 400 | 450 | 1.75 |
| Comp. Ex. 2B | Y5 | M5 | C5 | Bk1 | Carrier 1 | 60 | 133 | 400 | 450 | 1.75 |
| Ex. 5B | Y18 | M13 | C5 | Bk1 | Carrier 1 | 60 | 133 | 400 | 450 | 1.75 |
| Ex. 6B | Y18 | M1 | C5 | Bk1 | Carrier 1 | 60 | 133 | 400 | 450 | 1.75 |
| Comp. Ex. 3B | Y18 | M5 | C5 | Bk1 | Carrier 1 | 60 | 133 | 400 | 450 | 1.75 |
| Ex. 7B | Y8 | M13 | C5 | Bk1 | Carrier 1 | 60 | 133 | 400 | 450 | 1.75 |
| Comp. Ex. 4B | Y5 | M13 | C5 | Bk1 | Carrier 1 | 60 | 133 | 400 | 450 | 1.75 |
| Ex. 8B | Y2 | M2 | C2 | Bk2 | Carrier 6 | 40 | 100 | 320 | 600 | 1.5 |
| Ex. 9B | Y3 | M3 | C1 | Bk7 | Carrier 7 | 60 | 300 | 380 | 450 | 3.0 |
| Ex. 10B | Y2 | M1 | C1 | Bk1 | Carrier 1 | 60 | 133 | 400 | 450 | 1.8 |
| Ex. 11B | Y3 | M1 | C1 | Bk1 | Carrier 1 | 60 | 133 | 400 | 450 | 1.8 |
| Ex. 12B | Y4 | M1 | C1 | Bk1 | Carrier 1 | 60 | 133 | 400 | 450 | 1.8 |
| Ex. 13B | Y5 | M1 | C1 | Bk1 | Carrier 1 | 60 | 133 | 400 | 450 | 1.8 |
| Ex. 148 | Y6 | M1 | C1 | Bk1 | Carrier 1 | 60 | 133 | 400 | 450 | 1.8 |
| Ex. 15B | Y7 | M1 | C1 | Bk1 | Carrier 1 | 60 | 133 | 400 | 450 | 1.8 |

TABLE 20B-continued

| | | | | | | | | | | |
|---|---|---|---|---|---|---|---|---|---|---|
| Ex. 16B | Y8 | M1 | C1 | Bk1 | Carrier 1 | 60 | 133 | 400 | 450 | 1.8 |
| Ex. 17B | Y9 | M1 | C1 | Bk1 | Carrier 1 | 60 | 133 | 400 | 450 | 1.8 |
| Ex. 18B | Y10 | M1 | C1 | Bk1 | Carrier 1 | 60 | 133 | 400 | 450 | 1.8 |
| Ex. 19B | Y11 | M1 | C1 | Bk1 | Carrier 1 | 60 | 133 | 400 | 450 | 1.8 |
| Ex. 20B | Y12 | M1 | C1 | Bk1 | Carrier 1 | 60 | 133 | 400 | 450 | 1.8 |
| Ex. 21B | Y1 | M2 | C1 | Bk1 | Carrier 1 | 60 | 133 | 400 | 450 | 1.8 |
| Ex. 22B | Y1 | M3 | C1 | Bk1 | Carrier 1 | 60 | 133 | 400 | 450 | 1.8 |
| Ex. 23B | Y1 | M4 | C1 | Bk1 | Carrier 1 | 60 | 133 | 400 | 450 | 1.8 |
| Ex. 24B | Y1 | M5 | C1 | Bk1 | Carrier 1 | 60 | 133 | 400 | 450 | 1.8 |
| Ex. 25B | Y1 | M6 | C1 | Bk1 | Carrier 1 | 60 | 133 | 400 | 450 | 1.8 |
| Ex. 26B | Y1 | M7 | C1 | Bk1 | Carrier 1 | 60 | 133 | 400 | 450 | 1.8 |
| Ex. 27B | Y1 | M8 | C1 | Bk1 | Carrier 1 | 60 | 133 | 400 | 450 | 1.8 |
| Ex. 28B | Y1 | M9 | C1 | Bk1 | Carrier 1 | 60 | 133 | 400 | 450 | 1.8 |
| Ex. 29B | Y1 | M10 | C1 | Bk1 | Carrier 1 | 60 | 133 | 400 | 450 | 1.8 |
| Ex. 30B | Y1 | M11 | C1 | Bk1 | Carrier 1 | 60 | 133 | 400 | 450 | 1.8 |
| Ex. 31B | Y1 | M12 | C1 | Bk1 | Carrier 1 | 60 | 133 | 400 | 450 | 1.8 |
| Ex. 32B | Y1 | M13 | C1 | Bk1 | Carrier 1 | 60 | 133 | 400 | 450 | 1.8 |
| Ex. 33B | Y1 | M14 | C1 | Bk1 | Carrier 1 | 60 | 133 | 400 | 450 | 1.8 |
| Ex. 34B | Y1 | M15 | C1 | Bk1 | Carrier 1 | 60 | 133 | 400 | 450 | 1.8 |
| Ex. 35B | Y1 | M16 | C1 | Bk1 | Carrier 1 | 60 | 133 | 400 | 450 | 1.8 |
| Ex. 36B | Y1 | M1 | C2 | Bk1 | Carrier 1 | 60 | 133 | 400 | 450 | 1.8 |
| Ex. 37B | Y1 | M1 | C7 | Bk1 | Carrier 1 | 60 | 133 | 400 | 450 | 1.8 |
| Ex. 38B | Y1 | M1 | C8 | Bk1 | Carrier 1 | 60 | 133 | 400 | 450 | 1.8 |
| Ex. 39B | Y1 | M2 | C9 | Bk1 | Carrier 1 | 60 | 133 | 400 | 450 | 1.8 |
| Ex. 40B | Y1 | M1 | C1 | Bk2 | Carrier 1 | 60 | 133 | 400 | 450 | 1.8 |
| Ex. 41B | Y1 | M1 | C1 | Bk5 | Carrier 1 | 60 | 133 | 400 | 450 | 1.8 |
| Ex. 42B | Y1 | M1 | C1 | Bk6 | Carrier 1 | 60 | 133 | 400 | 450 | 1.8 |
| Ex. 43B | Y1 | M1 | C1 | Bk7 | Carrier 1 | 60 | 133 | 400 | 450 | 1.8 |
| Ex. 44B | Y1 | M1 | C1 | Bk8 | Carrier 1 | 60 | 133 | 400 | 450 | 1.8 |
| Ex. 45B | Y1 | M1 | C1 | Bk1 | Carrier 1 | 60 | 200 | −380 | 500 | 1.9 |

| | Coloring power difference | Gloss difference in color | Chroma of full-color image | Color reproduction with changes in environment | Notes |
|---|---|---|---|---|---|
| Ex. 1B | 0.19 | AA | AA | A | Good images were obtained. |
| Ex. 2B | 0.12 | AA | A | A | Good image were obtained. |
| Ex. 3B | 0.34 | A | A | A | Good images were obtained. |
| Comp. Ex. 1B | 0.53 | C | A | C | Color reproduction with changes in environment was bad. Texture different from color to color. |
| Ex. 4B | 0.43 | B | A | B | Color reproduction with changes in environment was a little poor, which fell within control. |
| Comp. Ex. 2B | 0.58 | C | A | C | Color reproduction with changes in environment was bad. Texture different from color to color |
| Ex. 5B | 0.12 | AA | AA | A | Good images were obtained. |
| Ex. 6B | 0.46 | B | AA | B | Color reproduction with changes in environment was a little poor, which fell within control. |
| Comp. Ex. 3B | 0.54 | C | A | C | Color reproduction with changes in environment was bad. Texture different from color to color. |
| Ex. 7B | 0.46 | B | A | B | Color reproduction with changes in environment was a little poor, which fell within control. |
| Comp. Ex. 4B | 0.58 | C | A | C | Color reproduction with changes in environment was bad. Texture different from color to color. |
| Ex. 8B | 0.18 | AA | A | A | Good images were obtained. |
| Ex. 9B | 0.08 | AA | AA | A | " |
| Ex. 10B | 0.18 | AA | A | A | Good images were obtained. |
| Ex. 11B | 0.15 | AA | AA | A | " |
| Ex. 12B | 0.15 | AA | A | A | " |
| Ex. 13B | 0.19 | AA | A | A | " |
| Ex. 14B | 0.14 | AA | A | A | " |
| Ex. 15B | 0.17 | AA | A | A | " |
| Ex. 16B | 0.07 | AA | A | A | " |
| Ex. 17B | 0.17 | AA | A | A | " |
| Ex. 18B | 0.07 | AA | A | A | " |
| Ex. 19B | 0.17 | AA | A | A | " |
| Ex. 20B | 0.09 | AA | B | A | Yellow, flesh color and green had a little defect, but there was no problem in practical use. |
| Ex. 21B | 0.12 | AA | A | A | Good images were obtained. |
| Ex. 22B | 0.12 | AA | AA | A | " |
| Ex. 23B | 0.23 | AA | A | A | " |
| Ex. 24B | 0.27 | A | A | A | " |
| Ex. 25B | 0.14 | AA | A | A | " |
| Ex. 26B | 0.14 | AA | B | A | Magenta and flesh color were a little defective in color reproduction, but there was no problem in practical use. |
| Ex. 27B | 0.12 | AA | A | A | Good images were obtained. |
| Ex. 28B | 0.12 | AA | A | A | Good images were obtained. |

TABLE 20B-continued

| | | | | | |
|---|---|---|---|---|---|
| Ex. 29B | 0.15 | AA | AA | A | " |
| Ex. 30B | 0.12 | AA | B | A | Magenta and flesh color were a little defective in color reproduction, but there was no problem in practical use. |
| Ex. 31B | 0.12 | AA | B | A | Magenta and flesh color were a little defective in color reproduction, but there was no problem in practical use. |
| Ex. 32B | 0.34 | A | AA | A | Good images were obtained. |
| Ex. 33B | 0.13 | AA | A | A | " |
| Ex. 34B | 0.12 | AA | B | A | Magenta and flesh color were a little defective in color reproductions but there was no problem in practical use. |
| Ex. 35B | 0.14 | AA | A | A | Magenta and flesh color were a little defective in color reproductions but there was no problem in practical use. |
| Ex. 36B | 0.19 | AA | A | A | Magenta and flesh color were a little defective in color reproductions but there was no problem in practical use. |
| Ex. 37B | 0.19 | AA | A | A | Magenta and flesh color were a little defective in color reproductions but there was no problem in practical use. |
| Ex. 38B | 0.19 | AA | AA | A | Magenta and flesh color were a little defective in color reproductions but there was no problem in practical use. |
| Ex. 39B | 0.19 | AA | AA | A | Magenta and flesh color were a little defective in color reproductions but there was no problem in practical use. |
| Ex. 40B | 0.19 | AA | AA | A | Magenta and flesh color were a little defective in color reproductions but there was no problem in practical use. |
| Ex. 41B | 0.19 | AA | AA | A | Magenta and flesh color were a little defective in color reproductions but there was no problem in practical use. |
| Ex. 42B | 0.19 | AA | AA | A | Magenta and flesh color were a little defective in color reproductions but there was no problem in practical use. |
| Ex. 43B | 0.19 | AA | AA | A | Magenta and flesh color were a little defective in color reproductions but there was no problem in practical use. |
| Ex. 44B | 0.19 | AA | AA | A | Magenta and flesh color were a little defective in color reproductions but there was no problem in practical use. |
| Ex. 45B | 0.19 | AA | AA | A | Good images were obtained. |

TABLE 1C

| | Charge injection inhibiting layer | conductive layer 1 | Photo-conductive layer 2 | Photo-Surface layer |
|---|---|---|---|---|
| Gases and flow rate | | | | |
| $SiH_4$[$cm^3$/min(normal)] | 100 | 200 | 200 | 10 |
| $H_2$[$cm^3$/min(normal)] | 300 | 800 | 800 | |
| $B_2H_6$[ppm](based on $SiH_4$) | 2000 | 2 | 0.5 | |
| NO[$cm^3$/min(normal)] | 50 | | | |
| $CH_4$[$cm^3$/min(normal)] | | | | 480 |
| Temperature of support (° C.) | 280 | 280 | 280 | 280 |
| Internal pressure [Pa] | 67 | 67 | 67 | 53 |
| RF POWER [W] | 500 | 800 | 400 | 250 |
| Layer thickness [$\mu$m] | 3 | 20 | 7 | 0.5 |

TABLE 2C

| | Charge injection inhibiting layer | Photo-conductive layer | Inter-mediate layer | Surface layer |
|---|---|---|---|---|
| Gases and flow rate | | | | |
| $SiH_4$[$cm^3$/min(normal)] | 160 | 200 | 100 | 10 |
| $H_2$[$cm^3$/min(normal)] | 500 | 800 | | |
| $PH_3$[ppm](based on $SiH_4$) | 1000 | | | |
| $B_2H_6$(based on $SiH_4$) | | 0.5 | 500 | |
| $CH_4$[$cm^3$/min(normal)] | 20 | | 300 | 480 |
| Temperature of support (° C.) | 260 | 260 | 260 | 260 |
| Internal pressure [Pa] | 40 | 40 | 27 | 13 |
| RF POWER [W] | 300 | 600 | 300 | 200 |
| Layer thickness [$\mu$m] | 2 | 30 | 0.1 | 0.5 |

TABLE 3C

| Resin | Monomer composition | Acid value (mgKOH/g) | Tg (° C.) | Mn | Mw |
|---|---|---|---|---|---|
| Resin (1) | Polyoxypropylene(2.2)-2,2bis(4-hydxoxyphenyl)propane<br>Polyoxyethylene(2.2)-2,2bis(4-hydroxyphenyl)propane<br>Terephthalic acid<br>Fumaric acid<br>Trimellitic acid | 10.5 | 56 | 4000 | 10500 |
| Resin (2) | Polyoxypropylene(2.2)-2,2bis(4-hydroxyphenyl)propane<br>Fumaric acid<br>Trimellitic acid | 2.3 | 59 | 4500 | 12500 |
| Resin (3) | Polyoxypropylene(2.2)-2,2bis(4-hydroxyphenyl)propane<br>Fumaric acid | 44.3 | 49 | 3600 | 8500 |
| Resin (4) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Fumaric acid<br>Trimellitic acid | 1.9 | 62 | 5200 | 18600 |
| Resin (5) | Polyoxypropylene(2.2)-2,2bis(4-hydroxypbenyl)propane<br>Terephthalic acid<br>Fumaric acid<br>Trimellitic acid | 55.3 | 59 | 5800 | 22200 |
| Resin (6) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Trimellitic acid | 13.2 | 69 | 8400 | 105000 |
| Resin (7) | Styrene<br>n-butylacrylate<br>mono-n-butylmalate | 13.2 | 63 | 6000 | 18800 |

TABLE 4C

| | Resin | | Colorant | | Charge control agent | | Pigment- | External additive | | Toner | Coloring |
|---|---|---|---|---|---|---|---|---|---|---|---|
| | Resins | Amount (wt %) | Colorants*1) | Amount (wt %) | Charge control agents*2) | Amount (wt %) | dispersing condition*3) | External additives | Amount (wt %) | diameter (μm) | power D0.5Y |
| Y1 | Resin(1) | 100 | PY 180 | 6.0 | DTBS Al compound | 4.0 | Strong | Titanium oxide A | 1.0 | 8.0 | 1.43 |
| Y2 | Resin(1) | 100 | PY 74 | 3.0 | DTBS Al compound | 4.0 | Strong | Titanium oxide A | 1.0 | 8.0 | 1.42 |
| Y3 | Resin(1) | 100 | PY 93 | 5.0 | DTBS Al compound | 4.0 | Strong | Titanium oxide A | 1.0 | 8.1 | 1.40 |
| Y4 | Resin(1) | 100 | PY 97 | 5.0 | DTBS Al compound | 4.0 | Strong | Titanium oxide A | 1.0 | 7.8 | 1.38 |
| Y5 | Resin(1) | 100 | PY 109 | 5.0 | DTBS Al compound | 4.0 | Strong | Titanium oxide A | 1.0 | 8.2 | 1.12 |
| Y6 | Resin(1) | 100 | PY 128 | 6.0 | DTBS Al compound | 4.0 | Strong | Titanium oxide A | 1.0 | 7.9 | 1.37 |
| Y7 | Resin(1) | 100 | PY 151 | 5.5 | DTBS Al compound | 4.0 | Strong | Titanium oxide A | 1.0 | 8.0 | 1.40 |
| Y8 | Resin(1) | 100 | PY 154 | 4.0 | DTBS Al compound | 4.0 | Strong | Titanium oxide A | 1.0 | 8.0 | 1.22 |
| Y9 | Resin(1) | 100 | PY 155 | 5.0 | DTBS Al compound | 4.0 | Strong | Titanium oxide A | 1.0 | 8.1 | 1.13 |
| Y10 | Resin(1) | 100 | PY 166 | 4.0 | DTBS Al compound | 4.0 | Strong | Titanium oxide A | 1.0 | 8.3 | 1.25 |
| Y11 | Resin(1) | 100 | PY 168 | 4.0 | DTBS Al compound | 4.0 | Strong | Titanium oxide A | 1.0 | 8.4 | 1.40 |
| Y12 | Resin(1) | 100 | PY 185 | 5.0 | DTBS Al compound | 4.0 | Strong | Titanium oxide A | 1.0 | 8.2 | 1.20 |
| Y13 | Resin(1) | 100 | PY 180 | 5.0 | DTBS Al compound | 4.0 | Strong | Titanium oxide A | 1.5 | 4.5 | 1.56 |
| Y14 | Resin(1) | 100 | PY 180 | 5.0 | DTBS Al compound | 4.0 | Strong | Titanium oxide A | 0.8 | 9.5 | 1.32 |
| Y15 | Resin(1) | 100 | PY 180 | 5.0 | DTBS Al compound | 4.0 | Strong | Titanium oxide A | 1.5 | 3.8 | 1.63 |
| Y16 | Resin(1) | 100 | PY 180 | 5.0 | DTBS Al compound | 4.0 | Strong | Titanium oxide A | 0.6 | 11.0 | 1.21 |
| Y17 | Resin(1) | 100 | PY 93 | 2.5 | DTBS Al compound | 4.0 | Strong | Titanium oxide A | 1.0 | 8.1 | 0.96 |
| Y18 | Resin(1) | 100 | PY 93 | 6.0 | DTBS Al compound | 4.0 | Strong | Titanium oxide A | 1.0 | 8.1 | 1.58 |
| Y19 | Resin(1) | 100 | PY 93 | 8.0 | DTBS Al compound | 4.0 | Normal | Titanium oxide A | 1.0 | 8.1 | 1.82 |
| Y20 | Resin(1) | 100 | PY 93 | 4.0 | DTBS Al compound | 4.0 | Normal | Titanium oxide A | 1.0 | 8.1 | 1.28 |
| Y21 | Resin(1) | 100 | PY 93 | 4.0 | DTBS Al compound | 4.0 | Weak | Titanium oxide A | 1.0 | 8.1 | 0.98 |
| Y22 | Resin(1) | 100 | PY 93 | 6.0 | DTBS Al compound | 4.0 | Strong 2 | Titanium oxide A | 1.0 | 8.1 | 1.84 |

*1)PY represents C.I. Pigment Yellow.
*2)DTBS represents di-tert-butyl salicylate.
*3)Weak: First kneaded product is not made and the dispersion state is weak.
Normal: Powder pigment is blended with resin and kneaded twice with a three-roll mill to make first kneaded product.
Strong: Paste pigment is heated and melt-kneaded to make first kneaded product.
Strong 2: The first kneaded product made in the pigment-dispersing condition "strong" is further kneaded 5 times with a three-roll mill.

TABLE 5C

| | Resin | | Colorant | | Charge control agent *2) | | Pigment-*3) | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5M |
| M1 | Resin(1) | 100 | PR 122 | 6.0 | DTBS Al compound | 4.0 | Strong | Titanium oxide A | 1.2 | 7.2 | 1.23 |
| M2 | Resin(1) | 100 | PR 57.1 | 3.5 | DTBS Al compound | 4.0 | Strong | Titanium oxide A | 1.2 | 7.0 | 1.40 |
| M3 | Resin(1) | 100 | PR 122<br>PR 57.1 | 2.0<br>2.0 | DTBS Al compound | 4.0 | Strong | Titanium oxide A | 1.2 | 7.1 | 1.30 |
| M4 | Resin(1) | 100 | PR 48.2 | 4.0 | DTBS Al compound | 4.0 | Strong | Titanium oxide A | 1.2 | 7.2 | 1.20 |
| M5 | Resin(1) | 100 | PR 58.2 | 5.0 | DTBS Al compound | 4.0 | Strong | Titanium oxide A | 1.2 | 7.0 | 1.15 |
| M6 | Resin(1) | 100 | PR 5 | 5.0 | DTBS Al compound | 4.0 | Strong | Titanium oxide A | 1.2 | 7.5 | 1.42 |
| M7 | Resin(1) | 100 | PR 31 | 4.0 | DTBS Al compound | 4.0 | Strong | Titanium oxide A | 1.2 | 7.2 | 1.45 |
| M8 | Resin(1) | 100 | PR 146 | 4.0 | DTBS Al compound | 4.0 | Strong | Titanium oxide A | 1.2 | 7.0 | 1.30 |
| M9 | Resin(1) | 100 | PR 147 | 4.0 | DTBS Al compound | 4.0 | Strong | Titanium oxide A | 1.2 | 7.0 | 1.32 |
| M10 | Resin(1) | 100 | PR 150 | 5.0 | DTBS Al compound | 4.0 | Strong | Titanium oxide A | 1.2 | 7.1 | 1.47 |
| M11 | Resin(1) | 100 | PR 184 | 4.0 | DTBS Al compound | 4.0 | Strong | Titanium oxide A | 1.2 | 7.2 | 1.32 |
| M12 | Resin(1) | 100 | PR 187 | 4.0 | DTBS Al compound | 4.0 | Strong | Titanium oxide A | 1.2 | 7.2 | 1.31 |
| M13 | Resin(1) | 100 | PR 238 | 6.0 | DTBS Al compound | 4.0 | Strong | Titanium oxide A | 1.2 | 7.1 | 1.66 |
| M14 | Resin(1) | 100 | PR 245 | 4.0 | DTBS Al compound | 4.0 | Strong | Titanium oxide A | 1.2 | 7.3 | 1.29 |
| M15 | Resin(1) | 100 | PR 185 | 5.0 | DTBS Al compound | 4.0 | Strong | Titanium oxide A | 1.2 | 7.0 | 1.43 |
| M16 | Resin(1) | 100 | PR 265 | 5.0 | DTBS Al compound | 4.0 | Strong | Titanium oxide A | 1.2 | 7.0 | 1.29 |

*1) PR represents C.I. Pigment Red.
*2) DUBS represents di-tert-butyl salicylate.
*3) Strong: Paste pigment is heated and melt-kneaded to make first kneaded product.

TABLE 6C

| | Resin | | Colorant | | Charge control agent *2) | | Pigment-*3) | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5C |
| C1 | Resin(1) | 100 | PB 15:3 | 3.0 | DTBS Al compound | 4.0 | Strong | Titanium oxide A | 1.0 | 8.0 | 1.30 |
| C2 | Resin(1) | 100 | Al phthalo-cyanine | 5.0 | DTBS Al compound | 4.0 | Strong | Titanium oxide A | 1.4 | 6.0 | 1.25 |
| C3 | Resin(1) | 100 | PB 15:3 | 2.0 | DTBS Al compound | 4.0 | Weak | Alumina A | 1.0 | 7.0 | 0.92 |
| C4 | Resin(1) | 100 | PB 15:3 | 4.0 | DTBS Al compound | 4.0 | Strong | Alumina A | 1.0 | 7.0 | 1.55 |
| C5 | Resin(1) | 100 | PB 15:3 | 5.0 | DTBS Al compound | 4.0 | Strong | Alumina A | 1.0 | 7.0 | 1.69 |
| C6 | Resin(1) | 100 | PB 15:3 | 6.0 | DTBS Al compound | 4.0 | Strong | Alumina A | 1.0 | 7.0 | 1.83 |
| C7 | Resin(1) | 100 | PB 15:3 | 3.0 | DTBS Cr compound | 4.0 | Strong | Titanium oxide A | 1.0 | 8.0 | 1.32 |
| C8 | Resin(1) | 100 | PB 15:3 | 3.0 | DTBS Zr compound | 4.0 | Strong | Titanium oxide A | 1.0 | 8.0 | 1.39 |
| C9 | Resin(1) | 100 | PB 15:3 | 3.0 | n-OS Al compound | 4.0 | Strong | Titanium oxide A | 1.0 | 8.0 | 1.38 |
| C10 | Resin(2) | 100 | PB 15:3 | 3.0 | DTBS Al compound | 4.0 | Strong | Titanium oxide A | 1.0 | 8.0 | 1.35 |
| C11 | Resin(3) | 100 | PB 15:3 | 3.0 | DTBS Al compound | 4.0 | Strong | Titanium oxide A | 1.0 | 8.0 | 1.25 |
| C12 | Resin(4) | 100 | PB 15:3 | 3.0 | DTBS Al compound | 4.0 | Strong | Titanium oxide A | 1.0 | 8.0 | 1.36 |
| C13 | Resin(5) | 100 | PB 15:3 | 3.0 | DTBS Al compound | 4.0 | Strong | Titanium oxide A | 1.0 | 8.0 | 1.23 |
| C14 | Resin(6) | 100 | PB 15:3 | 3.0 | DTBS Al compound | 4.0 | Strong | Titanium oxide A | 1.0 | 8.0 | 1.10 |
| C15 | Resin(7) | 100 | PB 15:3 | 3.0 | DTBS Al compound | 4.0 | Strong | Titanium oxide A | 1.0 | 8.0 | 1.15 |

*1) PB represents C.I. Pigment Blue.
*2) DTBS represents di-tert-butyl salicylate. n-OS represents n-octyl salicylate.
*3) Weak: First kneaded product is not made and the dispersion state is weak.
Strong: Paste pigment is heated and melt-kneaded to make first kneaded product.

TABLE 7C

| Inorganic fine powder | Base material of inorganic fine powder | Treatment materials | Average primary particle diameter (μm) | Hydrophobicity degree (%) | BET specific surface area ($m^2/g$) |
|---|---|---|---|---|---|
| Titanium oxide A | Titanium oxide | Isobutyl-methoxysilane | 0.03 | 66 | 130 |
| Alumina A | Alumina | Isobutyl-methoxysilane | 0.005 | 66 | 210 |
| Silica A | Silica | Hexamethyl-disilazane | 0.005 | 65 | 230 |

TABLE 8C

| | Resin | | Colorant | | Charge control agent *2) | | Pigment- *3) | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5Bk |
| Bk1 | Resin(1) | 100 | CB-A | 3.0 | DTBS Al compound | 4.0 | Normal | Titanium oxide A | 1.0 | 7.0 | 1.30 |
| Bk2 | Resin(1) | 100 | CB-A | 4.0 | DTBS Al compound | 4.0 | Normal | Titanium oxide A | 1.0 | 7.0 | 1.53 |
| Bk3 | Resin(1) | 100 | CB-A | 6.0 | DTBS Al compound | 4.0 | Normal | Titanium oxide A | 1.0 | 7.0 | 1.82 |
| Bk4 | Resin(1) | 100 | CB-A | 2.0 | DTBS Al compound | 4.0 | Weak | Titanium oxide A | 1.0 | 7.0 | 0.92 |
| Bk5 | Resin(1) | 100 | CB-B | 3.5 | DTBS Al compound | 4.0 | Normal | Titanium oxide A | 1.0 | 7.0 | 1.43 |
| Bk6 | Resin(1) | 100 | CB-C | 2.5 | DTBS Al compound | 4.0 | Normal | Titanium oxide A | 1.0 | 7.0 | 1.24 |
| Bk7 | Resin(1) | 100 | PY 17 | 1.5 | DTBS Al compound | 4.0 | Normal | Titanium oxide A | 1.0 | 7.0 | 1.28 |
| | | | PR 5 | 3.0 | | | | | | | |
| | | | PB 15:3 | 1.5 | | | | | | | |
| | | | CB-A | 1.0 | | | | | | | |
| Bk8 | Resin(1) | 100 | CB-A | 3.0 | DTBS Al compound | 4.0 | Normal | Silica A | 1.0 | 7.0 | 1.30 |

*1) PY, PR and PB represent C.I. Pigment Yellow, Red and Blue, respectively.
*2) DTBS represents di-tert-butyl salicylate.
*3) Weak: First kneaded product is not made and the dispersion state is weak.
Normal: Powder pigment is blended with resin and kneaded twice with a three-roll mill to make first kneaded product.

TABLE 9C

| | List of Carbon Black | | | | |
|---|---|---|---|---|---|
| | Primary particle diameter (nm) | Oil absorption (ml/100 g) | BET specific surface area ($m^2/g$) | Volatile (%) | pH |
| CB-A | 32 | 45 | 65 | 0.5 | 9 |
| CB-B | 40 | 135 | 50 | 1.5 | 7 |
| CB-C | 18 | 123 | 145 | 1.2 | 9 |

TABLE 10C

| Photosensitive member diameter (mm) | 15 | 20 | 60 | 80 | 100 |
|---|---|---|---|---|---|
| BK solid density | 1.32 | 1.52 | 1.62 | 1.63 | 1.65 |
| Yellow density (single color) | 1.29 | 1.47 | 1.58 | 1.60 | 1.61 |
| Yellow density (four colors) | 1.29 | 1.47 | 1.57 | 1.58 | 1.45 |
| Notes | Potential was insufficient. Slowing down the speed, evaluation was made. | | | | Image density was uneven. |

TABLE 11C

| Surface potential (V) | 250 | 300 | 400 | 450 | 500 |
|---|---|---|---|---|---|
| Image density | 1.35 | 1.43 | 1.64 | 1.68 | 1.70 |
| Density dispersion | 0.05 | 0.07 | 0.08 | 0.10 | 0.20 |
| Drum ghost | 0.07 | 0.09 | 0.11 | 0.12 | 0.24 |

TABLE 12C

| Sleeve peripheral speed ratio | 1.05 | 1.1 | 2.0 | 4.0 | 5.0 |
|---|---|---|---|---|---|
| Image density at the initial stage | 1.3 | 1.55 | 1.62 | 1.63 | 1.65 |
| Image density after extensive operation on 50,000 sheets | 1.29 | 1.53 | 1.58 | 1.55 | 1.32 |
| Fogging on drum after extensive operation on 50,000 sheets | 0.2 | 0.2 | 0.5 | 2.0 | 5.0 |

TABLE 13C

| Toner | Y15 | Y13 | Y1 | Y14 | Y16 |
|---|---|---|---|---|---|
| Weight-average particle diameter (μm) | 3.8 | 4.5 | 8.0 | 9.5 | 11.0 |
| Image quality | C | A | A | AB | C |
| Notes | Much fogging | Image density slightly decreases in light-resistance test. | Good | | Minute dot reproduction is bad |

A: good
B: average
C: poor

TABLE 14C

| Yellow toner | Y17 | Y21 | Y20 | Y3 | Y18 | Y19 | Y22 |
|---|---|---|---|---|---|---|---|
| Coloring power D0.5Y | 0.96 | 0.96 | 1.28 | 1.40 | 1.58 | 1.82 | 1.64 |
| Image density | 1.32 | 1.34 | 1.53 | 1.56 | 1.60 | 1.62 | 1.63 |
| Image density reproduction at HT | good | good | good | good | good | poor | poor |
| Notes | Image density was insufficient. | Image density was insufficient. | | | | Fogging was liable to occur. Too much pigment causes charging inhibition. | Gradation at HT was bad. Anti-offset property was poor |

TABLE 15C

| Cyan toner | C1 | C10 | C11 | C12 | C13 | C14 | C15 |
|---|---|---|---|---|---|---|---|
| Resin | Resin (1) | Resin (2) | Resin (3) | Resin (4) | Resin (5) | Resin (6) | Resin (7) |
| Durability under low temperature and low humidity (23° C./5%) | 1.70→1.68 AA: good No problem even after extensive operation on 50,000 sheets | 1.67→1.59 A: Charge-up occurs during extensive operation, but no problem. | 1.78→1.74 AA: good No problem even after extensive operation on 50,000 sheets | 1.68→1.36 B: good Image density started decreasing from the middle of extensive operation. | 1.70→1.80 AA: good | 1.50→1.48 A: Gloss was a little low, but durability was good. | 1.62→1.50 A: In extensive operation, there was a tendency to cause charge-up. |
| Durability under high temperature and high humidity (30° C./80%) | AA: good No problem even after extensive operation on 50,000 sheets | AA: good No problem even after extensive operation on 50,000 sheets | B: Image density gradually increased with extensive operation. Slight contamination was seen on the fixing roller at 50,000-sheet | AA: good No problem even after extensive operation on 50,000 sheets | B: After left standing upon extensive operation, charge quantity decreased and image density increased. Fogging and scattering were slightly seen. | AA: good No problem even after extensive operation on 50,000 sheets | AA: good No problem even after extensive operation on 50,000 sheets |
| OHP transparency | AA: good No problem even after extensive operation on 50,000 sheets | AA: good No problem even after extensive operation on 50,000 sheets | A: The image surface was slightly uneven. A little inferior. | AA: good No problem even after extensive operation on 50,000 sheets | AA: good No problem even after extensive operation on 50,000 sheets | B: Transparency is a little uneven | B: Transparency is a little uneven |

AA: good
A: problem a little occurs, but practically no problem
B: problem occurs to some extent

TABLE 16C

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 1C | Y1 | M1 | C1 | Bk1 | 60 | 133 | 400 | 1.75 | 0.20 |
| Ex. 2C | Y5 | M5 | C2 | Bk1 | 60 | 133 | 400 | 1.75 | 0.13 |
| Ex. 3C | Y5 | M10 | C2 | Bk1 | 60 | 133 | 400 | 1.75 | 0.35 |
| Comp. Ex. 1C | Y5 | M13 | C2 | Bk1 | 60 | 133 | 400 | 1.75 | 0.54 |
| Ex. 4C | Y5 | M5 | C4 | Bk1 | 60 | 133 | 400 | 1.75 | 0.43 |
| Comp. Ex. 2C | Y5 | M5 | C5 | Bk1 | 60 | 133 | 400 | 1.75 | 0.57 |
| Ex. 5C | Y18 | M13 | C5 | Bk1 | 60 | 133 | 400 | 1.75 | 0.11 |
| Ex. 6C | Y18 | M1 | C5 | Bk1 | 60 | 133 | 400 | 1.75 | 0.46 |
| Comp. Ex. 3C | Y18 | M5 | C5 | Bk1 | 60 | 133 | 400 | 1.75 | 0.54 |

TABLE 16C-continued

| | | | | | | | | | |
|---|---|---|---|---|---|---|---|---|---|
| Ex. 7C | Y8 | M13 | C5 | Bk1 | 60 | 133 | 400 | 1.75 | 0.47 |
| Comp. Ex. 4C | Y5 | M13 | C5 | Bk1 | 60 | 133 | 400 | 1.75 | 0.57 |
| Ex. 8C | Y2 | M2 | C2 | Bk2 | 40 | 100 | 320 | 1.5 | 0.17 |
| Ex. 9C | Y3 | M3 | C1 | Bk7 | 60 | 300 | 380 | 3.0 | 0.10 |
| Ex. 10C | Y2 | M1 | C1 | Bk1 | 60 | 133 | 400 | 1.8 | 0.19 |
| Ex. 11C | Y3 | M1 | C1 | Bk1 | 60 | 133 | 400 | 1.8 | 0.20 |
| Ex. 12C | Y4 | M1 | C1 | Bk1 | 60 | 133 | 400 | 1.8 | 0.15 |
| Ex. 13C | Y5 | M1 | C1 | Bk1 | 60 | 133 | 400 | 1.8 | 0.18 |
| Ex. 14C | Y6 | M1 | C1 | Bk1 | 60 | 133 | 400 | 1.8 | 0.14 |
| Ex. 15C | Y7 | M1 | C1 | Bk1 | 60 | 133 | 400 | 1.8 | 0.17 |
| Ex. 16C | Y8 | M1 | C1 | Bk1 | 60 | 133 | 400 | 1.8 | 0.08 |

| | Gloss difference In color | Chroma of full-color Image | Color reproduction with changes in environment | Notes |
|---|---|---|---|---|
| Ex. 1C | AA | AA | A | Good images were obtained. |
| Ex. 2C | AA | A | A | " |
| Ex. 3C | A | A | A | " |
| Comp. Ex. 1C | C | A | C | Color reproduction with changes in environment was bad. Texture different from color to color. |
| Ex. 4C | B | A | B | Color reproduction with changes in environment was a little poor, which fell within control. |
| Comp. Ex. 2C | C | A | C | Color reproduction with changes in environment was bad. Texture different from color to color. |
| Ex. 5C | AA | AA | A | Good images were obtained. |
| Ex. 6C | B | AA | B | Color reproduction with changes in environment was a little poor, which fell within control. |
| Comp. Ex. 3C | C | A | C | Color reproduction with changes in environment was bad. Texture different from color to color. |
| Ex. 7C | B | A | B | Color reproduction with changes in environment was a little poor, which fell within control. |
| Comp. Ex. 4C | C | A | C | Color reproduction with changes in environment was bad. Texture different from color to color. |
| Ex. 8C | AA | A | A | Good images were obtained. |
| Ex. 9C | AA | AA | A | " |
| Ex. 10C | AA | A | A | " |
| Ex. 11C | AA | AA | A | " |
| Ex. 12C | AA | A | A | " |
| Ex. 13C | AA | A | A | " |
| Ex. 14C | AA | A | A | " |
| Ex. 15C | AA | A | A | " |
| Ex. 16C | AA | A | A | " |

TABLE 17C

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 17C | Y9 | M1 | C1 | Bk1 | 60 | 133 | 400 | 1.8 | 0.17 |
| Ex. 18C | Y10 | M1 | C1 | Bk1 | 60 | 133 | 400 | 1.8 | 0.07 |
| Ex. 19C | Y11 | M1 | C1 | Bk1 | 60 | 133 | 400 | 1.8 | 0.17 |
| Ex. 20C | Y12 | M1 | C1 | Bk1 | 60 | 133 | 400 | 1.8 | 0.10 |
| Ex. 21C | Y1 | M2 | C1 | Bk1 | 60 | 133 | 400 | 1.8 | 0.13 |
| Ex. 22C | Y1 | M3 | C1 | Bk1 | 60 | 133 | 400 | 1.8 | 0.13 |
| Ex. 23C | Y1 | M4 | C1 | Bk1 | 60 | 133 | 400 | 1.8 | 0.23 |
| Ex. 24C | Y1 | M5 | C1 | Bk1 | 60 | 133 | 400 | 1.8 | 0.28 |
| Ex. 25C | Y1 | M6 | C1 | Bk1 | 60 | 133 | 400 | 1.8 | 0.13 |
| Ex. 26C | Y1 | M7 | C1 | Bk1 | 60 | 133 | 400 | 1.8 | 0.15 |
| Ex. 27C | Y1 | M8 | C1 | Bk1 | 60 | 133 | 400 | 1.8 | 0.13 |
| Ex. 28C | Y1 | M9 | C1 | Bk1 | 60 | 133 | 400 | 1.8 | 0.13 |
| Ex. 29C | Y1 | M10 | C1 | Bk1 | 60 | 133 | 400 | 1.8 | 0.17 |
| Ex. 30C | Y1 | M11 | C1 | Bk1 | 60 | 133 | 400 | 1.8 | 0.13 |
| Ex. 31C | Y1 | M12 | C1 | Bk1 | 60 | 133 | 400 | 1.8 | 0.13 |
| Ex. 32C | Y1 | M13 | C1 | Bk1 | 60 | 133 | 400 | 1.8 | 0.36 |
| Ex. 33C | Y1 | M14 | C1 | Bk1 | 60 | 133 | 400 | 1.8 | 0.14 |
| Ex. 34C | Y1 | M15 | C1 | Bk1 | 60 | 133 | 400 | 1.8 | 0.13 |
| Ex. 35C | Y1 | M16 | C1 | Bk1 | 60 | 133 | 400 | 1.8 | 0.14 |
| Ex. 36C | Y1 | M1 | C2 | Bk1 | 60 | 133 | 400 | 1.8 | 0.20 |
| Ex. 37C | Y1 | M1 | C7 | Bk1 | 60 | 133 | 400 | 1.8 | 0.20 |
| Ex. 38C | Y1 | M1 | C8 | Bk1 | 60 | 133 | 400 | 1.8 | 0.20 |
| Ex. 39C | Y1 | M1 | C9 | Bk1 | 60 | 133 | 400 | 1.8 | 0.20 |

TABLE 17C-continued

| | Gloss difference in color | Chroma of full-color Image | Color reproduction with changes in environment | Notes |
|---|---|---|---|---|
| Ex. 17C | AA | A | A | Good images were obtained. |
| Ex. 18C | AA | A | A | " |
| Ex. 19C | AA | A | A | " |
| Ex. 20C | AA | B | A | Yellow, flesh color and green had a little defect, but there was no problem in practical use. |
| Ex. 21C | AA | A | A | Good images were obtained. |
| Ex. 22C | AA | AA | A | " |
| Ex. 23C | AA | A | A | " |
| Ex. 24C | A | A | A | " |
| Ex. 25C | AA | A | A | " |
| Ex. 26C | AA | B | A | Magenta and flesh color were defective in color reproduction, but there was no problem in practical use. |
| Ex. 27C | AA | A | A | Good images were obtained. |
| Ex. 28C | AA | A | A | " |
| Ex. 29C | AA | AA | A | " |
| Ex. 30C | AA | B | A | Magenta and flesh color were defective in color reproduction, but there was no problem in practical use. |
| Ex. 31C | AA | B | A | Magenta and flesh color were defective in color reproduction, but there was no problem in practical use. |
| Ex. 32C | A | AA | A | Good images were obtained. |
| Ex. 33C | AA | A | A | " |
| Ex. 34C | AA | B | A | Magenta and flesh color were defective in color reproduction, but there was no problem in practical use. |
| Ex. 35C | AA | A | A | Magenta and flesh color were defective in color reproduction, but there was no problem in practical use. |
| Ex. 36C | AA | A | A | Magenta and flesh color were defective in color reproduction, but there was no problem in practical use. |
| Ex. 37C | AA | A | A | Magenta and flesh color were defective in color reproduction, but there was no problem in practical use. |
| Ex. 38C | AA | AA | A | Magenta and flesh color were defective in color reproduction, but there was no problem in practical use. |
| Ex. 39C | AA | AA | A | Magenta and flesh color were defective in color reproduction, but there was no problem in practical use. |

TABLE 18C

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 40C | Y1 | M1 | C1 | Bk5 | 60 | 133 | 400 | 1.8 | 0.20 |
| Ex. 41C | Y1 | M1 | C1 | Bk6 | 60 | 133 | 400 | 1.8 | 0.20 |
| Ex. 42C | Y1 | M1 | C1 | Bk7 | 60 | 133 | 400 | 1.8 | 0.20 |
| Ex. 43C | Y1 | M1 | C1 | Bk8 | 60 | 133 | 400 | 1.8 | 0.20 |
| Ex. 44C | Y1 | M1 | C1 | Bk1 | 60 | 133 | 400 | 1.8 | 0.20 |
| Ex. 45C | Y1 | M1 | C1 | Bk1 | 60 | 200 | 380 | 1.9 | 0.20 |
| Ex. 46C | Y2 | M1 | C1 | Bk1 | 60 | 200 | 380 | 1.9 | 0.19 |
| Ex. 47C | Y3 | M1 | C1 | Bk1 | 60 | 200 | 380 | 1.9 | 0.20 |
| Ex. 48C | Y4 | M1 | C1 | Bk1 | 60 | 200 | 380 | 1.9 | 0.15 |
| Ex. 49C | Y5 | M1 | C1 | Bk1 | 60 | 200 | 380 | 1.9 | 0.18 |
| Ex. 50C | Y6 | M1 | C1 | Bk1 | 60 | 200 | 380 | 1.9 | 0.14 |
| Ex. 51C | Y7 | M1 | C1 | Bk1 | 60 | 200 | 380 | 1.9 | 0.17 |
| Ex. 52C | Y8 | M1 | C1 | Bk1 | 60 | 200 | 380 | 1.9 | 0.08 |
| Ex. 53C | Y9 | M1 | C1 | Bk1 | 60 | 200 | 380 | 1.9 | 0.17 |
| Ex. 54C | Y10 | M1 | C1 | Bk1 | 60 | 200 | 380 | 1.9 | 0.07 |
| Ex. 55C | Y11 | M1 | C1 | Bk1 | 60 | 200 | 380 | 1.9 | 0.17 |
| Ex. 56C | Y12 | M1 | C1 | Bk1 | 60 | 200 | 380 | 1.9 | 0.10 |
| Ex. 57C | Y1 | M2 | C1 | Bk1 | 60 | 200 | 380 | 1.9 | 0.13 |
| Ex. 58C | Y1 | M3 | C1 | Bk1 | 60 | 200 | 380 | 1.9 | 0.13 |
| Ex. 59C | Y1 | M4 | C1 | Bk1 | 60 | 200 | 380 | 1.9 | 0.23 |
| Ex. 60C | Y1 | M5 | C1 | Bk1 | 60 | 200 | 380 | 1.9 | 0.28 |
| Ex. 61C | Y1 | M6 | C1 | Bk1 | 60 | 200 | 380 | 1.9 | 0.13 |
| Ex. 62C | Y1 | M7 | C1 | Bk1 | 60 | 200 | 380 | 1.9 | 0.15 |
| Ex. 63C | Y1 | M8 | C1 | Bk1 | 60 | 200 | 380 | 1.9 | 0.13 |

| | Gloss difference in color | Chroma of full-color Image | Color reproduction with changes in environment | Notes |
|---|---|---|---|---|
| Ex. 40C | AA | AA | A | Magenta and flesh color were defective in color reproduction, but there was no problem in practical use. |

TABLE 18C-continued

| | | | | |
|---|---|---|---|---|
| Ex. 41C | AA | AA | A | Magenta and flesh color were defective in color reproduction, but there was no problem in practical use. |
| Ex. 42C | AA | AA | A | Magenta and flesh color were defective in color reproduction, but there was no problem in practical use. |
| Ex. 43C | AA | AA | A | Magenta and flesh color were defective in color reproduction, but there was no problem in practical use. |
| Ex. 44C | AA | AA | A | Magenta and flesh color were defective in color reproduction, but there was no problem in practical use. |
| Ex. 45C | AA | AA | A | Good images were obtained. |
| Ex. 46C | AA | A | A | Good images were obtained. |
| Ex. 47C | AA | AA | A | Good images were obtained. |
| Ex. 48C | AA | A | A | Good images were obtained. |
| Ex. 49C | AA | A | A | Good images were obtained. |
| Ex. 50C | AA | A | A | Good images were obtained. |
| Ex. 51C | AA | A | A | Good images were obtained. |
| Ex. 52C | AA | A | A | Good images were obtained. |
| Ex. 53C | AA | A | A | Good images were obtained. |
| Ex. 54C | AA | A | A | Good images were obtained. |
| Ex. 55C | AA | A | A | Good images were obtained. |
| Ex. 56C | AA | B | A | Yellow, flesh color and green had a little detect, but there was no problem in practical use. |
| Ex. 57C | AA | A | A | Good images were obtained. |
| Ex. 58C | AA | AA | A | Good images were obtained. |
| Ex. 59C | AA | A | A | Good images were obtained. |
| Ex. 60C | A | A | A | Good images were obtained. |
| Ex. 61C | AA | A | A | Good images were obtained. |
| Ex. 62C | AA | B | A | Magenta and flesh color were defective in color reproduction. but there was no problem in practical use. |
| Ex. 63C | AA | A | A | Good images were obtained. |

TABLE 19C

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 64C | Y1 | M9 | C1 | Bk1 | 60 | 200 | 380 | 1.9 | 0.13 |
| Ex. 65C | Y1 | M10 | C1 | Bk1 | 60 | 200 | 380 | 1.9 | 0.17 |
| Ex. 66C | Y1 | M11 | C1 | Bk1 | 60 | 200 | 380 | 1.9 | 0.13 |
| Ex. 67C | Y1 | M12 | C1 | Bk1 | 60 | 200 | 380 | 1.9 | 0.13 |
| Ex. 68C | Y1 | M13 | C1 | Bk1 | 60 | 200 | 380 | 1.9 | 0.36 |
| Ex. 69C | Y1 | M14 | C1 | Bk1 | 60 | 200 | 380 | 1.9 | 0.14 |
| Ex. 70C | Y1 | M15 | C1 | Bk1 | 60 | 200 | 380 | 1.9 | 0.13 |
| Ex. 71C | Y1 | M16 | C1 | Bk1 | 60 | 200 | 380 | 1.9 | 0.14 |
| Ex. 72C | Y1 | M1 | C2 | Bk1 | 60 | 200 | 300 | 1.9 | 0.20 |
| Ex. 73C | Y1 | M1 | C7 | Bk1 | 60 | 200 | 380 | 1.9 | 0.20 |
| Ex. 74C | Y1 | M1 | C8 | Bk1 | 60 | 200 | 380 | 1.9 | 0.20 |
| Ex. 75C | Y1 | M1 | C9 | Bk1 | 60 | 200 | 380 | 1.9 | 0.20 |
| Ex. 76C | Y1 | M1 | C1 | Bk2 | 60 | 200 | 380 | 1.9 | 0.20 |
| Ex. 77C | Y1 | M1 | C1 | Bk5 | 60 | 200 | 380 | 1.9 | 0.20 |
| Ex. 78C | Y1 | M1 | C1 | Bk6 | 60 | 200 | 380 | 1.9 | 0.20 |
| Ex. 79C | Y1 | M1 | C1 | Bk7 | 60 | 200 | 380 | 1.9 | 0.20 |
| Ex. 80C | Y1 | M1 | C1 | Bk8 | 60 | 200 | 380 | 1.9 | 0.20 |

| | Gloss difference in color | Chroma of full-color image | Color reproduction with changes in environment | Notes |
|---|---|---|---|---|
| Ex. 64C | AA | A | A | Good images were obtained. |
| Ex .65C | AA | AA | A | " |
| Ex. 66C | AA | B | A | Magenta and flesh color were defective in color reproduction, but there was no problem in practical use. |
| Ex. 67C | AA | B | A | Magenta and flesh color were defective in color reproduction, but there was no problem in practical use. |
| Ex. 68C | A | AA | A | Good images were obtained. |
| Ex. 69C | AA | A | A | " |
| Ex. 70C | AA | B | A | Magenta and flesh color were defective in color reproduction, but there was no problem in practical use. |
| Ex. 71C | AA | A | A | Magenta and flesh color were defective in color reproduction, but there was no problem in practical use. |
| Ex. 72C | AA | A | A | Magenta and flesh color were defective in color reproduction, but there was no problem in practical use. |
| Ex. 73C | AA | A | A | Magenta and flesh color were defective in color reproduction, but there was no problem in practical use. |

TABLE 19C-continued

| | | | | |
|---|---|---|---|---|
| Ex. 74C | AA | AA | A | Magenta and flesh color were defective in color reproduction, but there was no problem in practical use. |
| Ex. 75C | AA | AA | A | Magenta and flesh color were defective in color reproduction, but there was no problem in practical use. |
| Ex. 76C | AA | AA | A | Magenta and flesh color were defective in color reproduction, but there was no problem in practical use. |
| Ex. 77C | AA | AA | A | Magenta and flesh color were defective in color reproduction, but there was no problem in practical use. |
| Ex. 78C | AA | AA | A | Magenta and flesh color were defective in color reproduction, but there was no problem in practical use. |
| Ex. 79C | AA | AA | A | Magenta and flesh color were defective in color reproduction, but there was no problem in practical use. |
| Ex. 80C | AA | AA | A | Magenta and flesh color were defective in color reproduction, but there was no problem in practical use. |

TABLE 1D

| | Charge injection inhibiting layer | Photo-conductive layer 1 | Photo-conductive layer 2 | Surface layer |
|---|---|---|---|---|
| Gases and flow rate | | | | |
| $SiH_4$[$cm^3$/min(normal)] | 100 | 200 | 200 | 10 |
| $H_2$[$cm^3$/min(normal)] | 300 | 800 | 800 | |
| $B_2H_6$[ppm](based on $SiH_4$) | 2000 | 2 | 0.5 | |
| NO[$cm^3$/min(normal] | 50 | | | |
| $CH_4$[$cm^3$/min(normal)] | | | | 480 |
| Temperature of support (° C.) | 280 | 280 | 280 | 280 |
| Internal pressure [Pa] | 67 | 67 | 67 | 53 |
| RF POWER [W] | 500 | 800 | 400 | 250 |
| Layer thickness [$\mu$m] | 3 | 20 | 7 | 0.5 |

TABLE 2D

| | Charge injection inhibiting layer | Photo-conductive layer | Inter-mediate layer | Surface layer |
|---|---|---|---|---|
| Gases and flow rate | | | | |
| $SiH_4$[$cm^3$/min(normal)] | 160 | 200 | 100 | 10 |
| $H_2$[$cm^3$/min(normal)] | 500 | 800 | | |
| $PH_3$[ppm](based on $SiH_4$) | 1000 | | | |
| $B_2H_6$[ppm](based on $SiH_4$) | | 0.5 | 500 | |
| $CH_4$[$cm^3$/min(normal)] | 20 | | 300 | 480 |
| Temperature of support (° C.) | 260 | 260 | 260 | 260 |
| Internal pressure [Pa] | 40 | 40 | 27 | 13 |
| RF POWER [W] | 300 | 600 | 300 | 200 |
| Layer thickness [$\mu$m] | 2 | 30 | 0.1 | 0.5 |

TABLE 3D

| Resin | Monomer composition | Acid value (mgKOH/g) | Tg (° C.) | Mn | Mw |
|---|---|---|---|---|---|
| Resin (1) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Fumaric acid<br>Trimellitic acid | 10.5 | 56 | 4000 | 10500 |
| Resin (2) | Polyoxypropylene(2.2)-2,2bis(4-hydroxyphenyl)propane<br>Fumaric acid<br>Trimellitic acid | 2.3 | 59 | 4500 | 12500 |
| Resin (3) | Polyoxypropylene(2.2)-2,2bis(4-hydroxyphenyl)propane<br>Fumaric acid | 44.3 | 49 | 3600 | 8500 |
| Resin (4) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Fumaric acid<br>Trimellitic acid | 1.9 | 62 | 5200 | 18600 |
| Resin (5) | Polyoxypropylene(2.2)-2,2bis(4-hydroxyphenyl)propane<br>Terephthalic acid<br>Fumaric acid<br>Trimellitic acid | 55.3 | 59 | 5800 | 22200 |

TABLE 3D-continued

| Resin | Monomer composition | Acid value (mgKOH/g) | Tg (° C.) | Mn | Mw |
|---|---|---|---|---|---|
| Resin (6) | Polyoxypropylene(2.2)-2,2bis(4-hydroxyphenyl)propane<br>Polyoxyethylene(2.2)-2,2bis(4-hydroxyphenyl)propane<br>Terephthalic acid<br>Trimellitic acid | 13.2 | 69 | 8400 | 105000 |
| Resin (7) | Styrene<br>n-butylacrylate<br>mono-n-butylmalate | 13.2 | 63 | 6000 | 18800 |

TABLE 4D

| | Resin | | Colorant | | Charge control agent | | *2) Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5Y |
| Y1 | Resin(1) | 100 | PY 180 | 6.0 | Quaternary ammonium salt *3) | 4.0 | Strong | Titanium oxide A | 1.0 | 8.0 | 1.43 |
| Y2 | Resin(1) | 100 | PY 74 | 3.0 | Quaternary ammonium salt | 4.0 | Strong | Titanium oxide A | 1.0 | 8.0 | 1.42 |
| Y3 | Resin(1) | 100 | PY 93 | 5.0 | Quaternary ammonium salt | 4.0 | Strong | Titanium oxide A | 1.0 | 8.1 | 1.40 |
| Y4 | Resin(1) | 100 | PY 97 | 5.0 | Quaternary ammonium salt | 4.0 | Strong | Titanium oxide A | 1.0 | 7.8 | 1.38 |
| Y5 | Resin(1) | 100 | PY 109 | 5.0 | Quaternary ammonium salt | 4.0 | Strong | Titanium oxide A | 1.0 | 8.2 | 1.12 |
| Y6 | Resin(1) | 100 | PY 128 | 6.0 | Quaternary ammonium salt | 4.0 | Strong | Titanium oxide A | 1.0 | 7.9 | 1.37 |
| Y7 | Resin(1) | 100 | PY 151 | 5.5 | Quaternary ammonium salt | 4.0 | Strong | Titanium oxide A | 1.0 | 8.0 | 1.40 |
| Y8 | Resin(1) | 100 | PY 154 | 4.0 | Quaternary ammonium salt | 4.0 | Strong | Titanium oxide A | 1.0 | 8.0 | 1.22 |
| Y9 | Resin(1) | 100 | PY 155 | 5.0 | Quaternary ammonium salt | 4.0 | Strong | Titanium oxide A | 1.0 | 8.1 | 1.13 |
| Y10 | Resin(1) | 100 | PY 166 | 4.0 | Quaternary ammonium salt | 4.0 | Strong | Titanium oxide A | 1.0 | 8.3 | 1.25 |
| Y11 | Resin(1) | 100 | PY 168 | 4.0 | Quaternary ammonium salt | 4.0 | Strong | Titanium oxide A | 1.0 | 8.4 | 1.40 |
| Y12 | Resin(1) | 100 | PY 185 | 5.0 | Quaternary ammonium salt | 4.0 | Strong | Titanium oxide A | 1.0 | 8.2 | 1.20 |
| Y13 | Resin(1) | 100 | PY 180 | 5.0 | Quaternary ammonium salt | 4.0 | Strong | Titanium oxide A | 1.5 | 4.5 | 1.56 |
| Y14 | Resin(1) | 100 | PY 180 | 5.0 | Quaternary ammonium salt | 4.0 | Strong | Titanium oxide A | 0.8 | 9.5 | 1.32 |
| Y15 | Resin(1) | 100 | PY 180 | 5.0 | Quaternary ammonium salt | 4.0 | Strong | Titanium oxide A | 1.5 | 3.8 | 1.63 |
| Y16 | Resin(1) | 100 | PY 180 | 5.0 | Quaternary ammonium salt | 4.0 | Strong | Titanium oxide A | 0.6 | 11.0 | 1.21 |
| Y17 | Resin(1) | 100 | PY 93 | 2.5 | Quaternary ammonium salt | 4.0 | Strong | Titanium oxide A | 1.0 | 8.1 | 0.96 |
| Y18 | Resin(1) | 100 | PY 93 | 6.0 | Quaternary ammonium salt | 4.0 | Strong | Titanium oxide A | 1.0 | 8.1 | 1.58 |
| Y19 | Resin(1) | 100 | PY 180 | 8.0 | Quaternary ammonium salt | 4.0 | Normal | Titanium oxide A | 1.0 | 8.1 | 1.82 |
| Y20 | Resin(1) | 100 | PY 180 | 4.0 | Quaternary ammonium salt | 4.0 | Normal | Titanium oxide A | 1.0 | 8.1 | 1.28 |
| Y21 | Resin(1) | 100 | PY 180 | 4.0 | Quaternary ammonium salt | 4.0 | Weak | Titanium oxide A | 1.0 | 8.1 | 0.98 |
| Y22 | Resin(1) | 100 | PY 180 | 6.0 | Quaternary ammonium salt | 4.0 | Strong 2 | Titanium oxide A | 1.0 | 8.1 | 1.84 |

*1) PY represents C.I. Pigment Yellow.
*2) Weak: First kneaded product is not made and the dispersion state is weak.
Normal: Powder pigment is blended with resin and kneaded twice with a three-roll mill to make first kneaded product.
Strong: Paste pigment is heated and melt-kneaded to make first kneaded product.
Strong 2: The first kneaded product made in the pigment-dispersing condition "strong" is further kneaded 5 times with a three-roll mill.
*3) Quaternary ammonium salt: VP2036 (melting point: 200° C.) made by Hoechst.

TABLE 5D

| | Resin | | Colorant | | Charge control agent | | *2) Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5M |
| M1 | Resin (1) | 100 | PR 122 | 6.0 | Quaternary ammonium salt | 4.0 | Strong | Titanium oxide A | 1.2 | 7.2 | 1.23 |
| M2 | Resin (1) | 100 | PR 57.1 | 3.5 | Quaternary ammonium salt | 4.0 | Strong | Titanium oxide A | 1.2 | 7.0 | 1.40 |
| M3 | Resin (1) | 100 | PR 122<br>PR 57.1 | 2.0<br>2.0 | Quaternary ammonium salt | 4.0 | Strong | Titanium oxide A | 1.2 | 7.1 | 1.30 |
| M4 | Resin (1) | 100 | PR 48.2 | 4.0 | Quaternary ammonium salt | 4.0 | Strong | Titanium oxide A | 1.2 | 7.2 | 1.20 |
| M5 | Resin (1) | 100 | PR 58.2 | 5.0 | Quaternary ammonium salt | 4.0 | Strong | Titanium oxide A | 1.2 | 7.0 | 1.15 |
| M6 | Resin (1) | 100 | PR 5 | 5.0 | Quaternary ammonium salt | 4.0 | Strong | Titanium oxide A | 1.2 | 7.5 | 1.42 |
| M7 | Resin (1) | 100 | PR 31 | 4.0 | Quaternary ammonium salt | 4.0 | Strong | Titanium oxide A | 1.2 | 7.2 | 1.45 |
| M8 | Resin (1) | 100 | PR 146 | 4.0 | Quaternary ammonium salt | 4.0 | Strong | Titanium oxide A | 1.2 | 7.0 | 1.30 |
| M9 | Resin (1) | 100 | PR 147 | 4.0 | Quaternary ammonium salt | 4.0 | Strong | Titanium oxide A | 1.2 | 7.0 | 1.32 |
| M10 | Resin (1) | 100 | PR 150 | 5.0 | Quaternary ammonium salt | 4.0 | Strong | Titanium oxide A | 1.2 | 7.1 | 1.47 |
| M11 | Resin (1) | 100 | PR 184 | 4.0 | Quaternary ammonium salt | 4.0 | Strong | Titanium oxide A | 1.2 | 7.2 | 1.32 |
| M12 | Resin (1) | 100 | PR 187 | 4.0 | Quaternary ammonium salt | 4.0 | Strong | Titanium oxide A | 1.2 | 7.2 | 1.31 |
| M13 | Resin (1) | 100 | PR 238 | 6.0 | Quaternary ammonium salt | 4.0 | Strong | Titanium oxide A | 1.2 | 7.1 | 1.66 |
| M14 | Resin (1) | 100 | PR 245 | 4.0 | Quaternary ammonium salt | 4.0 | Strong | Titanium oxide A | 1.2 | 7.3 | 1.29 |
| M15 | Resin (1) | 100 | PR 185 | 5.0 | Quaternary ammonium salt | 4.0 | Strong | Titanium oxide A | 1.2 | 7.0 | 1.43 |
| M16 | Resin (1) | 100 | PR 265 | 5.0 | Quaternary ammonium salt | 4.0 | Strong | Titanium oxide A | 1.2 | 7.0 | 1.29 |

*1) PR represents C.I. Pigment Red.
*2) Strong: Paste pigment is heated and melt-kneaded to make first kneaded product.

TABLE 6D

| | Resin | | Colorant | | Charge control agent | | *2) Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5C |
| C1 | Resin (1) | 100 | PB 15:3 | 3.0 | Quaternary ammonium salt | 4.0 | Strong | Titanium oxide A | 1.0 | 8.0 | 1.30 |
| C2 | Resin (1) | 100 | Al phthalo-cyanine | 5.0 | Quaternary ammonium salt | 4.0 | Strong | Titanium oxide A | 1.4 | 6.0 | 1.25 |
| C3 | Resin (1) | 100 | PB 15:3 | 2.0 | Quaternary ammonium salt | 4.0 | Weak | Alumina A | 1.0 | 7.0 | 0.92 |
| C4 | Resin (1) | 100 | PB 15:3 | 4.0 | Quaternary ammonium salt | 4.0 | Strong | Alumina A | 1.0 | 7.0 | 1.55 |
| C5 | Resin (1) | 100 | PB 15:3 | 5.0 | Quaternary ammonium salt | 4.0 | Strong | Alumina A | 1.0 | 7.0 | 1.69 |
| C6 | Resin (1) | 100 | PB 15:3 | 6.0 | Quaternary ammonium salt | 4.0 | Strong | Alumina A | 1.0 | 7.0 | 1.83 |
| C7 | Resin (1) | 100 | PB 15:3 | 3.0 | Imidazole compound | 3.0 | Strong | Titanium oxide A | 1.0 | 8.0 | 1.32 |
| C8 | Resin (1) | 100 | PB 15:3 | 3.0 | Ammonio group-containing styrene-acryl copolymer resin | 5.0 | Strong | Titanium oxide A | 1.0 | 8.0 | 1.39 |
| C9 | Resin (1) | 100 | PB 15:3 | 3.0 | Quaternary ammonium salt<br>Imidazole compound | 1.0<br>3.0 | Strong | Titanium oxide A | 1.0 | 8.0 | 1.38 |
| C10 | Resin (2) | 100 | PB 15:3 | 3.0 | Quaternary ammonium salt | 4.0 | Strong | Titanium oxide A | 1.0 | 8.0 | 1.35 |
| C11 | Resin (3) | 100 | PB 15:3 | 3.0 | Quaternary ammonium salt | 4.0 | Strong | Titanium oxide A | 1.0 | 8.0 | 1.25 |
| C12 | Resin (4) | 100 | PB 15:3 | 3.0 | Quaternary ammonium salt | 4.0 | Strong | Titanium oxide A | 1.0 | 8.0 | 1.36 |

TABLE 6D-continued

| | Resin | | Colorant | | Charge control agent | | *2) Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5C |
| C13 | Resin (5) | 100 | PB 15:3 | 3.0 | Quaternary ammonium salt | 4.0 | Strong | Titanium oxide A | 1.0 | 8.0 | 1.23 |
| C14 | Resin (6) | 100 | PB 15:3 | 3.0 | Quaternary ammonium salt | 4.0 | Strong | Titanium oxide A | 1.0 | 8.0 | 1.10 |
| C15 | Resin (7) | 100 | PB 15:3 | 3.0 | Quaternary ammonium salt | 4.0 | Strong | Titanium oxide A | 1.0 | 8.0 | 1.15 |

*1) PB represents C.I. Pigment Blue.
*2) Weak: First kneaded product is not made and the dispersion state is weak.
Strong: Paste pigment is heated and melt-kneaded to make first kneaded product.

TABLE 7D

| Inorganic fine powder | Base material of inorganic fine powder | Treatment materials | Average primary particle diameter (μm) | Hydrophobicity degree (%) | BET specific surface area ($m^2/g$) |
|---|---|---|---|---|---|
| Titanium oxide A | Titanium oxide | Isobutyl-methoxysilane | 0.03 | 66 | 130 |
| Alumina A | Alumina | Isobutyl-methoxysilane | 0.005 | 66 | 210 |
| Silica A | Silica | Hexamethyl-disilazane | 0.005 | 65 | 230 |

TABLE 8D

| | Resin | | Colorant | | Charge control agent | | *2) Pigment- | External additive | | Toner | Coloring |
|---|---|---|---|---|---|---|---|---|---|---|---|
| | Resins | Amount (wt %) | *1) Colorants | Amount (wt %) | Charge control agents | Amount (wt %) | dispersing condition | External additives | Amount (wt %) | diameter (μm) | power D0.5Bk |
| Bk1 | Resin (1) | 100 | CB-A | 3.0 | Quaternary ammonium salt | 4.0 | Normal | Titanium oxide A | 1.0 | 7.0 | 1.30 |
| Bk2 | Resin (1) | 100 | CB-A | 4.0 | Quaternary ammonium salt | 4.0 | Normal | Titanium oxide A | 1.0 | 7.0 | 1.53 |
| Bk3 | Resin (1) | 100 | CB-A | 6.0 | Quaternary ammonium salt | 4.0 | Normal | Titanium oxide A | 1.0 | 7.0 | 1.82 |
| Bk4 | Resin (1) | 100 | CB-A | 2.0 | Quaternary ammonium salt | 4.0 | Weak | Titanium oxide A | 1.0 | 7.0 | 0.92 |
| Bk5 | Resin (1) | 100 | CB-B | 3.5 | Quaternary ammonium salt | 4.0 | Normal | Titanium oxide A | 1.0 | 7.0 | 1.43 |
| Bk6 | Resin (1) | 100 | CB-C | 2.5 | Quaternary ammonium salt | 4.0 | Normal | Titanium oxide A | 1.0 | 7.0 | 1.24 |
| Bk7 | Resin (1) | 100 | PY 17<br>PR 5<br>PB 15:3<br>CB-A | 1.5<br>3.0<br>1.5<br>1.0 | Quaternary ammonium salt | 4.0 | Normal | Titanium oxide A | 1.0 | 7.0 | 1.28 |
| Bk8 | Resin (1) | 100 | CB-A | 3.0 | Quaternary ammonium salt | 4.0 | Normal | Silica A | 1.0 | 7.0 | 1.30 |

*1) PY, PR and PB represent C.I. Pigment Yellow, Red and Blue, respectively.
*2) Weak: First kneaded product is not made and the dispersion state is weak.
Normal: Powder pigment is blended with resin and kneaded twice with a three-roll mill to make first kneaded product.

TABLE 9D

| | Primary particle diameter (nm) | Oil absorption (ml/100 g) | BET specific surface area ($m^2/g$) | Volatile (%) | pH |
|---|---|---|---|---|---|
| CB-A | 32 | 45 | 65 | 0.5 | 9 |
| CB-B | 40 | 135 | 50 | 1.5 | 7 |
| CB-C | 18 | 123 | 145 | 1.2 | 9 |

TABLE 10D

| Photosensitive member diameter (mm) | 15 | 20 | 60 | 80 | 100 |
|---|---|---|---|---|---|
| BK solid density | 1.31 | 1.51 | 1.61 | 1.63 | 1.64 |
| Yellow density (single color) | 1.28 | 1.47 | 1.58 | 1.59 | 1.61 |
| Yellow density (four colors) | 1.28 | 1.47 | 1.57 | 1.58 | 1.48 |
| Notes | Potential was insufficient, Slowing down the speed, evaluation was made. | | | | Image density was uneven. |

TABLE 11D

| Surface potential (V) | 250 | 300 | 400 | 450 | 500 |
|---|---|---|---|---|---|
| Image density | 1.34 | 1.41 | 1.62 | 1.66 | 1.70 |
| Density dispersion | 0.05 | 0.07 | 0.08 | 0.10 | 0.20 |
| Drum ghost | 0.06 | 0.09 | 0.11 | 0.12 | 0.23 |

TABLE 12D

| Sleeve peripheral speed ratio | 1.05 | 1.1 | 2.0 | 4.0 | 5.0 5.0 |
|---|---|---|---|---|---|
| Image density at the initial stage | 1.27 | 1.55 | 1.62 | 1.63 | 1.65 |
| Image density after extensive operation on 50,000 sheets | 1.25 | 1.53 | 1.58 | 1.53 | 1.32 |
| Fogging on drum after extensive operation on 50,000 sheets | 0.2 | 0.2 | 0.5 | 2.0 | 5.1 |

TABLE 13D

| Toner | Y15 | Y13 | Y1 | Y14 | Y16 |
|---|---|---|---|---|---|
| Weight-average particle diameter (μm) | 3.8 | 4.5 | 8.0 | 9.5 | 11.0 |
| Image quality | C | A | A | AB | C |
| Notes | Much fogging | Image density slightly decreases in light-resistance test. | Good | | Minute dot reproduction is bad |

A: good
B: average
C: poor

TABLE 14D

| Yellow toner | Y17 | Y21 | Y20 | Y3 | Y18 | Y19 | Y22 |
|---|---|---|---|---|---|---|---|
| Coloring power D0.5Y | 0.96 | 0.98 | 1.28 | 1.38 | 1.58 | 1.84 | 1.84 |
| Image density | 1.32 | 1.34 | 1.55 | 1.58 | 1.60 | 1.62 | 1.63 |
| Image density reproduction at HT | good | good | good | good | good | poor | poor |
| Notes | Image density was insufficient. | Image density was insufficient. | | | | Fogging was liable to occur. Too much pigment causes charging inhibition. | Gradation at HT was bad. Anti-offset property was poor |

TABLE 15D

| | Cyan toner | | | | | | |
|---|---|---|---|---|---|---|---|
| | C1 | C10 | C11 | C12 | C13 | C14 | C15 |
| Resin | Resin (1) 1.70→1.68 | Resin (2) 1.67→1.45 | Resin (3) 1.78→1.74 | Resin (4) 1.68→1.45 | Resin (5) 1.70→1.80 | Resin (6) 1.50→1.48 | Resin (7) 1.62→1.50 |
| Durability under low temperature and low humidity (23° C./5%) | AA: good No problem even after extensive operation on 50,000 sheets | A: Image density decreases | B: Fogging occurs | B: B: Image density started decreasing from the middle of extensive operation. | B: Fogging occurs | A: Gloss was a little low, but durability was good. | AA: good No problem even after extensive operation on 50,000 sheets |
| Durability under high | AA: good No problem | AA: good No problem | B: Slight contamination | AA: good No problem | AA: good No problem | AA: good No problem | AA: good No problem |

TABLE 15D-continued

| | Cyan toner | | | | | | |
|---|---|---|---|---|---|---|---|
| | C1 | C10 | C11 | C12 | C13 | C14 | C15 |
| temperature and high humidity (30° C./80%) | even after extensive operation on 50,000 sheets | even after extensive operation on 50,000 sheets | was seen on the fixing roller at 50,000-sheet operation. | even after extensive operation on 50,000 sheets | even after extensive operation on 50,000 sheets | even after extensive operation on 50,000 sheets | even after extensive operation on 50,000 sheets |
| OHP transparency | AA: good No problem even after extensive operation on 50,000 sheets | AA: good No problem even after extensive operation on 50,000 sheets | A: The image surface was slightly uneven. A little inferior. | AA: good No problem even after extensive operation on 50,000 sheets | AA: good No problem even after extensive operation on 50,000 sheets | B: Transparency is a little uneven | B: Transparency is a little uneven |

AA: good
A: problem a little occurs, but pratically no problem
B: problem occurs to some extent

TABLE 16D

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 1D | Y1 | M1 | C1 | Bk1 | 60 | 133 | 400 | 1.75 | 0.20 |
| Ex. 2D | Y5 | M5 | C2 | Bk1 | 60 | 133 | 400 | 1.75 | 0.13 |
| Ex. 3D | Y5 | M10 | C2 | Bk1 | 60 | 133 | 400 | 1.75 | 0.35 |
| Comp. Ex. 1D | Y5 | M13 | C2 | Bk1 | 60 | 133 | 400 | 1.75 | 0.54 |
| Ex. 4D | Y5 | M5 | C4 | Bk1 | 60 | 133 | 400 | 1.75 | 0.43 |
| Comp. Ex. 2D | Y5 | M5 | C5 | Bk1 | 60 | 133 | 400 | 1.75 | 0.57 |
| Ex. 5D | Y18 | M13 | C5 | Bk1 | 60 | 133 | 400 | 1.75 | 0.11 |
| Ex. 6D | Y18 | M1 | C5 | Bk1 | 60 | 133 | 400 | 1.75 | 0.46 |
| Comp. Ex. 3D | Y18 | M5 | C5 | Bk1 | 60 | 133 | 400 | 1.75 | 0.54 |
| Ex. 7D | Y8 | M13 | C5 | Bk1 | 60 | 133 | 400 | 1.75 | 0.47 |
| Comp. Ex. 4D | Y5 | M13 | C5 | Bk1 | 60 | 133 | 400 | 1.75 | 0.57 |
| Ex. 8D | Y2 | M2 | C2 | Bk2 | 40 | 100 | 320 | 1.5 | 0.17 |
| Ex. 9D | Y3 | M3 | C1 | Bk7 | 60 | 300 | 380 | 3.0 | 0.10 |
| Ex. 10D | Y2 | M1 | C1 | Bk1 | 60 | 133 | 400 | 1.8 | 0.19 |
| Ex. 11D | Y3 | M1 | C1 | Bk1 | 60 | 133 | 400 | 1.8 | 0.20 |
| Ex. 12D | Y4 | M1 | C1 | Bk1 | 60 | 133 | 400 | 1.8 | 0.15 |
| Ex. 13D | Y5 | M1 | C1 | Bk1 | 60 | 133 | 400 | 1.8 | 0.18 |
| Ex. 14D | Y6 | M1 | C1 | Bk1 | 60 | 133 | 400 | 1.8 | 0.14 |
| Ex. 15D | Y7 | M1 | C1 | Bk1 | 60 | 133 | 400 | 1.8 | 0.17 |
| Ex. 16D | Y8 | M1 | C1 | Bk1 | 60 | 133 | 400 | 1.8 | 0.08 |
| Ex. 17D | Y9 | M1 | C1 | Bk1 | 60 | 133 | 400 | 1.8 | 0.17 |
| Ex. 18D | Y10 | M1 | C1 | Bk1 | 60 | 133 | 400 | 1.8 | 0.07 |
| Ex. 19D | Y11 | M1 | C1 | Bk1 | 60 | 133 | 400 | 1.8 | 0.17 |
| Ex. 20D | Y12 | M1 | C1 | Bk1 | 60 | 133 | 400 | 1.8 | 0.10 |
| Ex. 21D | Y1 | M2 | C1 | Bk1 | 60 | 133 | 400 | 1.8 | 0.13 |
| Ex. 22D | Y1 | M3 | C1 | Bk1 | 60 | 133 | 400 | 1.8 | 0.13 |
| Ex. 23D | Y1 | M4 | C1 | Bk1 | 60 | 133 | 400 | 1.8 | 0.23 |
| Ex. 24D | Y1 | M5 | C1 | Bk1 | 60 | 133 | 400 | 1.8 | 0.28 |
| Ex. 25D | Y1 | M6 | C1 | Bk1 | 60 | 133 | 400 | 1.8 | 0.13 |
| Ex. 26D | Y1 | M7 | C1 | Bk1 | 60 | 133 | 400 | 1.8 | 0.15 |
| Ex. 27D | Y1 | M8 | C1 | Bk1 | 60 | 133 | 400 | 1.8 | 0.13 |
| Ex. 28D | Y1 | M9 | C1 | Bk1 | 60 | 133 | 400 | 1.8 | 0.13 |
| Ex. 29D | Y1 | M10 | C1 | Bk1 | 60 | 133 | 400 | 1.8 | 0.17 |
| Ex. 30D | Y1 | M11 | C1 | Bk1 | 60 | 133 | 400 | 1.8 | 0.13 |
| Ex. 31D | Y1 | M12 | C1 | Bk1 | 60 | 133 | 400 | 1.8 | 0.13 |
| Ex. 32D | Y1 | M13 | C1 | Bk1 | 60 | 133 | 400 | 1.8 | 0.36 |
| Ex. 33D | Y1 | M14 | C1 | Bk2 | 60 | 133 | 400 | 1.8 | 0.14 |
| Ex. 34D | Y1 | M15 | C1 | Bk1 | 60 | 133 | 400 | 1.8 | 0.13 |
| Ex. 35D | Y1 | M16 | C1 | Bk1 | 60 | 133 | 400 | 1.8 | 0.14 |
| Ex. 36D | Y1 | M1 | C2 | Bk1 | 60 | 133 | 400 | 1.8 | 0.20 |
| Ex. 37D | Y1 | M1 | C7 | Bk1 | 60 | 133 | 400 | 1.8 | 0.20 |
| Ex. 38D | Y1 | M1 | C8 | Bk1 | 60 | 133 | 400 | 1.8 | 0.20 |
| Ex. 39D | Y1 | M1 | C9 | Bk1 | 60 | 133 | 400 | 1.8 | 0.20 |
| Ex. 40D | Y1 | M1 | C1 | Bk2 | 60 | 133 | 400 | 1.8 | 0.20 |
| Ex. 41D | Y1 | M1 | C1 | Bk5 | 60 | 133 | 400 | 1.8 | 0.20 |
| Ex. 42D | Y1 | M1 | C1 | Bk6 | 60 | 133 | 400 | 1.8 | 0.20 |

TABLE 16D-continued

| | | | | | | | | | |
|---|---|---|---|---|---|---|---|---|---|
| Ex. 43D | Y1 | M1 | C1 | Bk7 | 60 | 133 | 400 | 1.8 | 0.20 |
| Ex. 44D | Y1 | M1 | C1 | Bk8 | 60 | 133 | 400 | 1.8 | 0.20 |

| | Gloss difference in color | Chroma of full-color image | Color reproduction with changes in environment | Notes |
|---|---|---|---|---|
| Ex. 1D | AA | AA | A | Good images were obtained. |
| Ex. 2D | AA | A | A | Good images were obtained. |
| Ex. 3D | A | A | A | Good images were obtained. |
| Comp. Ex. 1D | C | A | C | Color reproduction with changes in environment was bad. Texture different from color to color. |
| Ex. 4D | B | A | B | Color reproduction with changes in environment was a little poor, which fell within control. |
| Comp. Ex. 2D | C | A | C | Color reproduction with changes in environment was bad. Texture different from color to color. |
| Ex. 5D | AA | AA | A | Good images were obtained. |
| Ex. 6D | B | AA | B | Color reproduction with changes in environment was a little poor, which fell within control. |
| Comp. Ex. 3D | C | A | C | Color reproduction with changes in environment was bad. Texture different from color to color. |
| Ex. 7D | B | A | B | Color reproduction with changes in environment was a little poor, which fell within control. |
| Comp. Ex. 4D | C | A | C | Color reproduction with changes in environment was bad. Texture different from color to color. |
| Ex. 8D | AA | A | A | Good images were obtained. |
| Ex. 9D | AA | AA | A | " |
| Ex. 10D | AA | A | A | Good images were obtained. |
| Ex. 11D | AA | AA | A | " |
| Ex. 12D | AA | A | A | " |
| Ex. 13D | AA | A | A | " |
| Ex. 14D | AA | A | A | " |
| Ex. 15D | AA | A | A | " |
| Ex. 16D | AA | A | A | " |
| Ex. 17D | AA | A | A | " |
| Ex. 18D | AA | A | A | " |
| Ex. 19D | AA | A | A | " |
| Ex. 20D | AA | B | A | Yellow, flesh color and green had a little defect, but there was no problem in practical use. |
| Ex. 21D | AA | A | A | Good images were obtained. |
| Ex. 22D | AA | AA | A | " |
| Ex. 23D | AA | A | A | " |
| Ex. 24D | A | A | A | " |
| Ex. 25D | AA | A | A | " |
| Ex. 26D | AA | B | A | Magenta and flesh color were a little defective in color reproduction, but there was no problem in practical use. |
| Ex. 27D | AA | A | A | Good images were obtained. |
| Ex. 28D | AA | A | A | Good images were obtained. |
| Ex. 29D | AA | AA | A | " |
| Ex. 30D | AA | B | A | Magenta and flesh color were a little defective in color reproduction, but there was no problem in practical use. |
| Ex. 31D | AA | B | A | Magenta and flesh color were a little defective in color reproduction, but there was no problem in practical use. |
| Ex. 32D | A | AA | A | Good images were obtained. |
| Ex. 33D | AA | A | A | " |
| Ex. 34D | AA | B | A | Magenta and flesh color were a little defective in color reproduction, but there was no problem in practical use. |
| Ex. 35D | AA | A | A | " |
| Ex. 36D | AA | A | A | " |
| Ex. 37D | AA | A | A | " |
| Ex. 38D | AA | AA | A | " |
| Ex. 39D | AA | AA | A | " |
| Ex. 40D | AA | AA | A | " |
| Ex. 41D | AA | AA | A | " |
| Ex. 42D | AA | AA | A | " |
| Ex. 43D | AA | AA | A | " |
| Ex. 44D | AA | AA | A | " |

TABLE 17D

| | Yellow toner | Magenta toner | Cyan toner | Black toner | Photosensitive member diameter (mm) | PS (mm/s) | Photosensitive member surface potential (V) | Sleeve peripheral speed ratio | Coloring power difference |
|---|---|---|---|---|---|---|---|---|---|
| Ex. 45D | Y1 | M1 | C1 | Bk1 | 60 | 200 | 380 | 1.9 | 0.20 |
| Ex. 46D | Y2 | M1 | C1 | Bk1 | 60 | 200 | 380 | 1.9 | 0.19 |
| Ex. 47D | Y3 | M1 | C1 | Bk1 | 60 | 200 | 380 | 1.9 | 0.20 |
| Ex. 48D | Y4 | M1 | C1 | Bk1 | 60 | 200 | 380 | 1.9 | 0.15 |
| Ex. 49D | Y5 | M1 | C1 | Bk1 | 60 | 200 | 380 | 1.9 | 0.18 |
| Ex. 50D | Y6 | M1 | C1 | Bk1 | 60 | 200 | 380 | 1.9 | 0.14 |
| Ex. 51D | Y7 | M1 | C1 | Bk1 | 60 | 200 | 380 | 1.9 | 0.17 |
| Ex. 52D | Y8 | M1 | C1 | Bk1 | 60 | 200 | 380 | 1.9 | 0.08 |
| Ex. 53D | Y9 | M1 | C1 | Bk1 | 60 | 200 | 380 | 1.9 | 0.17 |
| Ex. 54D | Y10 | M1 | C1 | Bk1 | 60 | 200 | 380 | 1.9 | 0.07 |
| Ex. 55D | Y11 | M1 | C1 | BK1 | 60 | 200 | 380 | 1.9 | 0.17 |
| Ex. 56D | Y12 | M1 | C1 | Bk1 | 60 | 200 | 380 | 1.9 | 0.10 |
| Ex. 57D | Y1 | M2 | C1 | Bk1 | 60 | 200 | 380 | 1.9 | 0.13 |
| Ex. 58D | Y1 | M3 | C1 | Bk1 | 60 | 200 | 380 | 1.9 | 0.13 |
| Ex. 59D | Y1 | M4 | C1 | Bk1 | 60 | 200 | 380 | 1.9 | 0.23 |
| Ex. 60D | Y1 | M5 | C1 | Bk1 | 60 | 200 | 380 | 1.9 | 0.28 |
| Ex. 61D | Y1 | M6 | C1 | Bk1 | 60 | 200 | 380 | 1.9 | 0.13 |
| Ex. 62D | Y1 | M7 | C1 | Bk1 | 60 | 200 | 380 | 1.9 | 0.15 |
| Ex. 63D | Y1 | M8 | C1 | Bk1 | 60 | 200 | 380 | 1.9 | 0.13 |
| Ex. 64D | Y1 | M9 | C1 | Bk1 | 60 | 200 | 380 | 1.9 | 0.13 |
| Ex. 65D | Y1 | M10 | C1 | Bk1 | 60 | 200 | 380 | 1.9 | 0.17 |
| Ex. 66D | Y1 | M11 | C1 | Bk1 | 60 | 200 | 380 | 1.9 | 0.13 |
| Ex. 67D | Y1 | M12 | C1 | Bk1 | 60 | 200 | 380 | 1.9 | 0.13 |
| Ex. 68D | Y1 | M13 | C1 | Bk1 | 60 | 200 | 380 | 1.9 | 0.36 |
| Ex. 69D | Y1 | M14 | C1 | Bk1 | 60 | 200 | 380 | 1.9 | 0.14 |
| Ex. 70D | Y1 | M15 | C1 | Bk1 | 60 | 200 | 380 | 1.9 | 0.13 |
| Ex. 71D | Y1 | M16 | C1 | Bk1 | 60 | 200 | 380 | 1.9 | 0.14 |
| Ex. 72D | Y1 | M1 | C2 | Bk1 | 60 | 200 | 380 | 1.9 | 0.20 |
| Ex. 73D | Y1 | M1 | C7 | Bk1 | 60 | 200 | 380 | 1.9 | 0.20 |
| Ex. 74D | Y1 | M1 | C8 | Bk1 | 60 | 200 | 380 | 1.9 | 0.20 |
| Ex. 75D | Y1 | M1 | C9 | Bk1 | 60 | 200 | 380 | 1.9 | 0.20 |
| Ex. 76D | Y1 | M1 | C1 | Bk2 | 60 | 200 | 380 | 1.9 | 0.20 |
| Ex. 77D | Y1 | M1 | C1 | Bk5 | 60 | 200 | 380 | 1.9 | 0.20 |
| Ex. 76D | Y1 | M1 | C1 | Bk6 | 60 | 200 | 380 | 1.9 | 0.20 |
| Ex. 79D | Y1 | M1 | C1 | Bk7 | 60 | 200 | 380 | 1.9 | 0.20 |
| Ex. 80D | Y1 | M1 | C1 | Bk8 | 60 | 200 | 380 | 1.9 | 0.20 |

| | Gloss difference in color | Chroma of full-color image | Color reproduction with changes in environment | Notes |
|---|---|---|---|---|
| Ex. 45D | AA | AA | A | Good images were obtained. |
| Ex. 46D | AA | A | A | " |
| Ex. 47D | AA | AA | A | " |
| Ex. 48D | AA | A | A | " |
| Ex. 49D | AA | A | A | " |
| Ex. 50D | AA | A | A | " |
| Ex. 51D | AA | A | A | " |
| Ex. 52D | AA | A | A | " |
| Ex. 53D | AA | A | A | " |
| Ex. 54D | AA | A | A | " |
| Ex. 55D | AA | A | A | " |
| Ex. 56D | AA | B | A | Yellow, flesh color and green had a little defect, but there was no problem in practical use. |
| Ex. 57D | AA | A | A | Good images were obtained. |
| Ex. 58D | AA | AA | A | " |
| Ex. 59D | AA | A | A | " |
| Ex. 60D | A | A | A | " |
| Ex. 61D | AA | A | A | Good images were obtained. |
| Ex. 62D | AA | B | A | Magenta and flesh color were a little defective in color reproduction, but there was no problem in practical use. |
| Ex. 63D | AA | A | A | Good images were obtained |
| Ex. 64D | AA | A | A | " |
| Ex. 65D | AA | AA | A | " |
| Ex. 66D | AA | B | A | Magenta and flesh color were a little defective in color reproduction, but there was no problem in practical use. |
| Ex. 67D | AA | B | A | Magenta and flesh color were a little defective in color reproduction, but there was no problem in practical use. |
| Ex. 68D | A | AA | A | Good images were obtained. |
| Ex. 69D | AA | A | A | " |

TABLE 17D-continued

| | | | | |
|---|---|---|---|---|
| Ex. 70D | AA | B | A | Magenta and flesh color were a little defective in color reproduction, but there was no problem in practical use. |
| Ex. 71D | AA | A | A | Magenta and flesh color were a little defective in color reproduction, but there was no problem in practical use. |
| Ex. 72D | AA | A | A | Magenta and flesh color were a little defective in color reproduction, but there was no problem in practical use. |
| Ex. 73D | AA | A | A | Magenta and flesh color were a little defective in color reproduction, but there was no problem in practical use. |
| Ex. 74D | AA | AA | A | Magenta and flesh color were a little defective in color reproduction, but there was no problem in practical use. |
| Ex. 75D | AA | AA | A | Magenta and flesh color were a little defective in color reproduction, but there was no problem in practical use. |
| Ex. 76D | AA | AA | A | Magenta and flesh color were a little defective in color reproduction, but there was no problem in practical use. |
| Ex. 77D | AA | AA | A | Magenta and flesh color were a little defective in color reproduction, but there was no problem in practical use. |
| Ex. 78D | AA | AA | A | Magenta and flesh color were a little defective in color reproduction, but there was no problem in practical use. |
| Ex. 79D | AA | AA | A | Magenta and flesh color were a little defective in color reproduction, but there was no problem in practical use. |
| Ex. 80D | AA | AA | A | Magenta and flesh color were a little defective in color reproduction, but there was no problem in practical use. |

What is claimed is:

1. An image-forming method used in an image-forming apparatus comprising:

four image-forming units making use of a first toner, a second toner, a third toner and a fourth toner which have colors different from one another, for forming toner images on a transfer medium; and a heat-and-pressure fixing means for performing heat-and-pressure treatment on the transfer medium having the toner images thereon;

said four image-forming units each having;

a photosensitive member having an amorphous silicon or non-single-crystal silicon layer;

a charging means for charging the photosensitive member electrostatically;

an exposure means for exposing the photosensitive member to form an electrostatic latent image thereon: and a developing means having a developing sleeve for developing the electrostatic latent image formed on the photosensitive member;

said photosensitive member having a diameter of from 20 mm to 80 mm;

after charging said photosensitive member with the charging means, the electrostatic latent image being formed by exposure with the exposure means, and, at a development position in unexposed areas, said photosensitive member being made to have a surface potential of from 300 V to 450 V as an absolute value;

said developing means having a two-component developer containing the toner and a carrier;

said photosensitive member and said developing sleeve being so disposed as to have a minimum gap between them of from 350 $\mu$m to 800 $\mu$m;

while the developing sleeve rotates at a peripheral speed from 1.1 times to 4.0 times the peripheral speed of the photosensitive member, the electrostatic latent image being developed with a magnetic brush of the two-component developer to form a toner image on the photosensitive member;

said first toner, second toner, third toner and fourth toner being selected from the group consisting of a non-magnetic yellow toner, a non-magnetic magenta toner, a non-magnetic cyan toner and a non-magnetic black toner;

said non-magnetic yellow toner, non-magnetic magenta toner, non-magnetic cyan toner and non-magnetic black toner having negative chargeability and each having a weight-average particle diameter of from 4.0 $\mu$m to 10.0 $\mu$m;

the carrier of said two-component developer having a 50% average particle diameter of from 10 $\mu$m to 80 $\mu$m; and where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the nonmagnetic black toner by DO.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being 0.5 or less.

2. The image-forming method according to claim 1, wherein said non-magnetic yellow toner contains a yellow pigment selected from the group consisting of C.I. Pigment Yellow 74, 93, 97, 109. 128, 151. 154, 155, 166. 168, 180 and 185.

3. The image-forming method according to claim 1, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

4. The image-forming method according to claim 1, wherein said non-magnetic cyan toner contains a copper phthalocyanine pigment or an aluminum phthalocyanine pigment.

5. The image-forming method according to claim 1, wherein said non-magnetic black toner contains a non-magnetic black pigment.

6. The image-forming method according to claim 1, wherein said toners each have a coloring power of from 1.1 to 1.7 as the image density D0.5 measured after the toner is fixed once when the quantity of unfixed toner on a transfer medium, M/S, is 0.5 mg/cm$^2$.

7. The image-forming method according to claim 1, wherein said photosensitive member comprises an amorphous silicon or amorphous silicon compound having positive or negative chargeability.

8. The image-forming method according to claim 7, wherein the electrostatic latent image is formed by back-scan exposure, using the amorphous silicon photosensitive member having positive chargeability.

9. The image-forming method according to claim 7, wherein the electrostatic latent image is formed by image-wise exposure, using the amorphous silicon photosensitive member having negative chargeability.

10. The image-forming method according to claim 1, wherein said toners each contain an organometallic compound, and the organometallic compound is a negative charge control agent.

11. The image-forming method according to claim 1, wherein the carrier of said two-component developer has a 50% average particle diameter of from 20 $\mu$m to 70 $\mu$m.

12. The image-forming method according to claim 1, wherein said toners each have a binder resin composed chiefly of a polyester.

13. The image-forming method according to claim 1, wherein said toners each have an acid value of from 2 mg·KOH/g to 50 mg·KOH/g.

14. The image-forming method according to claim 1, wherein said toners each have a glass transition temperature Tg of from 50° C. to 70° C.

15. An image-forming apparatus comprising:

four image-forming units making use of a first toner, a second toner, a third toner and a fourth toner which have colors different from one another, for forming toner images on a transfer medium; and a heat-and-pressure fixing means for performing heat-and-pressure treatment on the transfer medium having the toner images thereon;

said four image-forming units each having: a photosensitive member having an amorphous silicon or non-single-crystal silicon layer;

a charging means for charging the photosensitive member electrostatically;

an exposure means for exposing the photosensitive member to form an electrostatic latent image thereon; and a developing means having a developing sleeve for developing the electrostatic latent image formed on the photosensitive member;

said photosensitive member having a diameter of from 20 mm to 80 mm; said photosensitive member being charged by the charging means, thereafter the electrostatic latent image being formed by exposure made by the exposure means, and, at a development position in unexposed areas, said photosensitive member having a surface potential of from 300 V to 450 V as an absolute value;

said developing means having a two-component developer containing the toner and a carrier;

said photosensitive member and said developing sleeve being so disposed as to have a minimum gap between them of from 350 $\mu$m to 800 $\mu$m;

the electrostatic latent image being developed with a magnetic brush of the two-component developer while rotating the developing sleeve at a peripheral speed from 1.1 times to 4.0 times the peripheral speed of the photosensitive member, to form a toner image on the photosensitive member;

said first toner, second toner, third toner and fourth toner being selected from the group consisting of a non-magnetic yellow toner, a non-magnetic magenta toner, a non-magnetic cyan toner and a non-magnetic black toner;

said non-magnetic yellow toner, non-magnetic magenta toner, non-magnetic cyan toner and non-magnetic black toner having negative chargeability and each having a weight-average particle diameter of from 4.0 $\mu$m to 10.0 $\mu$m;

the carrier of said two-component developer having a 50% average particle diameter of from 10 $\mu$m to 80 $\mu$m; and where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being each from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being 0.5 or less.

16. The image-forming apparatus according to claim 15, wherein said non-magnetic yellow toner contains a yellow pigment selected from the group consisting of C.I. Pigment Yellow 74, 93, 97, 109, 128, 151, 154, 155, 166, 168, 180 and 185.

17. The image-forming apparatus according to claim 15, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

18. The image-forming apparatus according to claim 15, wherein said non-magnetic cyan toner contains a copper phthalocyanine pigment or an aluminum phthalocyanine pigment.

19. The image-forming apparatus according to claim 15, wherein said non-magnetic black toner contains a non-magnetic black pigment.

20. The image-forming apparatus according to claim 15, wherein said toners each have a coloring power of from 1.1 to 1.7 as the image density D0.5 measured after the toner is fixed once when the quantity of unfixed toner on a transfer medium, M/S, is M/S=0.5 mg/cm$^2$.

21. The image-forming apparatus, according to claim 15, wherein said photosensitive member comprises an amorphous silicon or amorphous silicon compound having positive or negative chargeability.

22. The image-forming apparatus according to claim 21, wherein the electrostatic latent image is formed by back-scan exposure, using the amorphous silicon photosensitive member having positive chargeability.

23. The image-forming apparatus according to claim 21, wherein the electrostatic latent image is formed by image-wise exposure, using the amorphous silicon photosensitive member having negative chargeability.

24. The image-forming apparatus according to claim 15, wherein said toners each contain an organometallic compound, and the organometallic compound is a negative charge control agent.

25. The image-forming apparatus according to claim 15, wherein the carrier of said two-component developer has a 50% average particle diameter of from 20 $\mu$m to 70 $\mu$m.

26. The image-forming apparatus according to claim 15, wherein said toners each have a binder resin composed chiefly of a polyester.

27. The image-forming apparatus according to claim 15, wherein said toners each have an acid value of from 2 mg·KOH/g to 50 mg·KOH/g.

28. The image-forming apparatus according to claim 15, wherein said toners each have a glass transition temperature Tg of from 50° C. to 70° C.

29. An image-forming method for forming a full-color image or a multi-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit;

transferring to the transfer medium having the first, second and third toner images a fourth toner image formed in a fourth image-forming unit; and transporting to a heat-and-pressure fixing means the transfer medium having the first, second, third and fourth toner images to effect heat-and-pressure fixing;

(A) the formation of the first toner image in said first image-forming unit:

(i) comprising at least a first charging step of electrostatically charging a first photosensitive member having an amorphous silicon or non-single-crystal silicon layer, a first exposure step, and a first developing step having a first developing sleeve;

(ii) the first photosensitive member having a diameter of from 20 mm to 80 mm; the first photosensitive member being charged in the first charging step from 300 V to 450 V as an absolute value at its developing zone opposite to the first developing sleeve; and thereafter a first electrostatic latent image being formed on the first photosensitive member by exposure in the first exposure step;

(iii) in the first developing step, a magnetic brush of a two-component developer containing a first toner and a first magnetic carrier being formed on the first developing sleeve;

(iv) the first photosensitive member and the first developing sleeve being so disposed as to have a minimum gap between them of from 350 $\mu$m to 800 $\mu$m;

(v) the first electrostatic latent image being developed with the magnetic brush of the two-component developer while the first developing sleeve is rotated at a peripheral speed from 1.1 times to 4.0 times the peripheral speed of the first photosensitive member, to form the first toner image on the first photosensitive member;

(B) the formation of the second toner image in said second image-forming unit:

(i) comprising at least a second charging step of electrostatically charging a second photosensitive member having an amorphous silicon or non-single-crystal silicon layer, a second exposure step, and a second developing step having a second developing sleeve;

(ii) the second photosensitive member having a diameter of from 20 mm to 80 mm; the second photosensitive member being charged in the second charging step from 300 V to 450 V as an absolute value at its developing zone opposite to the second developing sleeve; and thereafter a second electrostatic latent image being formed on the second photosensitive member by exposure in the second exposure step;

(iii) in the second developing step, a magnetic brush of a two-component developer containing a second toner and a second magnetic carrier being formed on the second developing sleeve, (iv) the second photosensitive member and the second developing sleeve being so disposed as to have a minimum gap between them of from 350 $\mu$m to 800 $\mu$m;

(v) the second electrostatic latent image being developed with the magnetic brush of the two-component developer while the second developing sleeve is rotated at a peripheral speed from 1.1 times to 4.0 times the peripheral speed of the second photosensitive member, to form the second toner image on the second photosensitive member;

(C) the formation of the third toner image in said third image-forming unit:

(i) comprising at least a third charging step of electrostatically charging a third photosensitive member having an amorphous silicon or non-single-crystal silicon layer, a third exposure step, and a third developing step having a third developing sleeve;

(ii) the third photosensitive member having a diameter of from 20 mm to 80 mm; the third photosensitive member being charged in the third charging step from 300 V to 450 V as an absolute value at its developing zone opposite to the third developing sleeve; and thereafter a third electrostatic latent image being formed on the third photosensitive member by exposure in the third exposure step;

(iii) in the third developing step, a magnetic brush of a two-component developer containing a third toner and a third magnetic carrier being formed on the third developing sleeve;

(iv) the third photosensitive member and the third developing sleeve being so disposed as to have a minimum gap between them of from 350 $\mu$m to 800 $\mu$m;

(v) the third electrostatic latent image being developed with the magnetic brush of the two-component developer while the third developing sleeve is rotated at a peripheral speed from 1.1 times to 4.0 times the peripheral speed of the third photosensitive member, to form the third toner image on the third photosensitive member;

(D) the formation of the fourth toner image in said fourth image-forming unit;

(i) comprising at least a fourth charging step of electrostatically charging a fourth photosensitive member having an amorphous silicon or non-single-crystal silicon layer, a fourth exposure step, and a fourth developing step having a fourth developing sleeve;

(ii) the fourth photosensitive member having a diameter of from 20 mm to 80 mm; the fourth photosensitive member being charged in the fourth charging step from 300 V to 450 V as an absolute value at its developing zone opposite to the fourth developing sleeve: and thereafter a fourth electrostatic latent image being formed on the fourth photosensitive member by exposure in the fourth exposure step;

(iii) in the fourth developing step, a magnetic brush of a two-component developer containing a fourth toner and a fourth magnetic carrier being formed on the fourth developing sleeve;

(iv) the fourth photosensitive member and the fourth developing sleeve being so disposed as to have a minimum gap between them of from 350 $\mu$m to 800 $\mu$m;

(v) the fourth electrostatic latent image being developed with the magnetic brush of the two-component developer while the fourth developing sleeve is rotated at a peripheral speed from 1.1 times to 4.0 times the peripheral speed of the fourth photosensitive member, to form the fourth toner image on the fourth photosensitive member; and (E) said first toner, second toner, third toner and fourth toner having color tones different from one another, and each being selected from the group consisting of a nonmagnetic yellow toner, a non-magnetic magenta toner, a non-magnetic cyan toner and a non-magnetic black toner;

(a) said non-magnetic yellow toner, non-magnetic magenta toner, non-magnetic cyan toner and nonmagnetic black toner having positive chargeability and each having a weight-average particle diameter of from 4.0 $\mu$m to 10.0 $\mu$m;

(b) the magnetic carrier of said two-component developer having a 50% volume-average particle diameter of from 10 $\mu$m to 80 $\mu$m; and (c) where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being from 0 to 0.5.

30. The image-forming method according to claim 29, wherein said non-magnetic yellow toner contains a yellow pigment selected from the group consisting of C.I. Pigment Yellow 74, 93, 97. 109, 128, 151, 154, 155, 166, 168, 180 and 185.

31. The image-forming method according to claim 29, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

32. The image-forming method according to claim 29, wherein said non-magnetic cyan toner contains a copper phthalocyanine pigment or an aluminum phthalocyanine pigment.

33. The image-forming method according to claim 29, wherein said non-magnetic black toner contains a non-magnetic black pigment.

34. The image-forming method according to claim 29, wherein said D0.5Y, D0.5M, D0.5C and D0.5Bk are each from 1.1 to 1.7.

35. The image-forming method according to claim 29, wherein said first to fourth photosensitive members are each a photosensitive member with an amorphous silicon or non-single-crystal silicon layer having positive or negative chargeability.

36. The image-forming method according to claim 29, wherein said first to fourth photosensitive members are each a photosensitive member with an amorphous silicon or non-single-crystal silicon layer having positive chargeability, and the electrostatic latent image is formed by imagewise exposure.

37. The image-forming method according to claim 29. wherein said first to fourth photosensitive members are each a photosensitive member with an amorphous silicon or non-single-crystal silicon layer having negative chargeability, and the electrostatic latent image is formed by back-scan exposure.

38. The image-forming method according to claim 29, wherein said first to fourth toners each contain at least one positive charge control agent selected from the group consisting of a quaternary ammonium salt, an imidazole compound, an ammonio-group-containing styrene-acrylic copolymer resin and a phosphonium compound.

39. The image-forming method according to claim 29, wherein the magnetic carriers of said two-component developers each have a 50% volume-average particle diameter of from 20 $\mu$m to 70 $\mu$m.

40. The image-forming method according to claim 29, wherein said first to fourth toners each have a binder resin composed chiefly of one selected from the group consisting of a polyester, a styrene-acrylic copolymer and a modified product of any of these.

41. The image-forming method according to claim 40, wherein said polyester has an acid value of from 35 mg·KOH/g or below.

42. The image-forming method according to claim 29, wherein said toners each have a glass transition temperature Tg of from 50° C. to 70° C.

43. An image-forming apparatus for forming a full-color image or a multi-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit:

transferring to the transfer medium having the first, second and third toner images a fourth toner image formed in a fourth image-forming unit; and transporting to a heat-and-pressure fixing means the transfer medium having the first, second, third and fourth toner images to effect heat-and-pressure fixing:

(A) said first image-forming unit:

(i) comprising at least a first photosensitive member having an amorphous silicon or non-single-crystal silicon layer. a first charging means, a first exposure means and a first developing means having a first developing sleeve;

(ii) the first photosensitive member having a diameter of from 20 mm to 80 mm; the first photosensitive member being charged by the first charging means from 300 V to 450 V as an absolute value at its developing zone opposite to the first developing sleeve; and thereafter a first electrostatic latent image being formed on the first photosensitive member by exposure with the first exposure means;

(iii) the first developing means having a two-component developer containing a first toner and a first magnetic carrier; the two-component developer forming a magnetic brush on the first developing sleeve;

(iv) the first photosensitive member and the first developing sleeve being so disposed as to have a minimum gap between them of from 350 $\mu$m to 800 $\mu$m;

(v) the first electrostatic latent image being developed with the magnetic brush of the two-component developer while the first developing sleeve is rotated at a peripheral speed from 1.1 times to 4.0 times the peripheral speed of the first photosensitive member, to form the first toner image on the first photosensitive member;

(B) said second image-forming unit;

(i) comprising at least a second photosensitive member having an amorphous silicon or non-single-crystal silicon layer, a second charging means, a second exposure means and a second developing means having a second developing sleeve;

(ii) the second photosensitive member having a diameter of from 20 mm to 80 mm; the second photosensitive member being charged by the second charging means from 300 V to 450 V as an absolute value at its developing zone opposite to the second developing sleeve; and thereafter a second electrostatic latent image being formed on the second photosensitive member by exposure with the second exposure means;

(iii) the second developing means having a two-component developer containing a second toner and a second magnetic carrier; the two-component developer forming a magnetic brush on the second developing sleeve;

(iv) the second photosensitive member and the second developing sleeve being so disposed as to have a minimum gap between them of from 350 $\mu$m to 800 $\mu$m;

(v) the second electrostatic latent image being developed with the magnetic brush of the two-component developer while the second developing sleeve is rotated at a peripheral speed from 1.1 times to 4.0 times the peripheral speed of the second photosensitive member, to form the second toner image on the second photosensitive member;

(C) said third image-forming unit:

(i) comprising at least a third photosensitive member having an amorphous silicon or non-single-crystal silicon layer, a third charging means, a third exposure means and a third developing means having a third developing sleeve;

(ii) the third photosensitive member having a diameter of from 20 mm to 80 mm: the third photosensitive member being charged by the third charging means from 300 V to 450 V as an absolute value at its developing zone opposite to the third developing sleeve; and thereafter a third electrostatic latent image being formed on the third photosensitive member by exposure with the third exposure means;

(iii) the third developing means having a two-component developer containing a third toner and a third magnetic carrier; the two-component developer forming a magnetic brush on the third developing sleeve;

(iv) the third photosensitive member and the third developing sleeve being so disposed as to have a minimum gap between them of from 350 $\mu$m to 800 $\mu$m;

(v) the third electrostatic latent image being developed with the magnetic brush of the two-component developer while the third developing sleeve is rotated at a peripheral speed from 1.1 times to 4.0 times the peripheral speed of the third photosensitive member, to form the third toner image on the third photosensitive member;

(D) said fourth image-forming unit:

(i) comprising at least a fourth photosensitive member having an amorphous silicon or non-single-crystal silicon layer, a fourth charging means, a fourth exposure means and a fourth developing means having a fourth developing sleeve;

(ii) the fourth photosensitive member having a diameter of from 20 mm to 80 mm; the fourth photosensitive member being charged by the fourth charging means from 300 V to 450 V as an absolute value at its developing zone opposite to the fourth developing sleeve; and thereafter a fourth electrostatic latent image being formed on the fourth photosensitive member by exposure with the fourth exposure means;

(iii) the fourth developing means having a two-component developer containing a fourth toner and a fourth magnetic carrier; the two-component developer forming a magnetic a brush on the fourth developing sleeve;

(iv) the fourth photosensitive member and the fourth developing sleeve being so disposed as to have a minimum gap between them of from 350 $\mu$m to 800 $\mu$m;

(v) the fourth electrostatic latent image being developed with the magnetic brush of the two-component developer while the fourth developing sleeve is rotated at a peripheral speed from 1.1 times to 4.0 times the peripheral speed of the fourth photosensitive member, to form the fourth toner image on the fourth photosensitive member;

(E) said first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) said non-magnetic yellow toner, non-magnetic magenta toner, non-magnetic cyan toner and non-magnetic black toner having positive chargeability and each having a weight-average particle diameter of from 4.0 $\mu$m to 10.0 $\mu$m;

(b) the magnetic carrier of said two-component developer having a 50% volume-average particle diameter of from 10 μm to 80 μm; and (c) where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being each from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, the difference between D0.5max and D0.5min being from 0 to 0.5.

44. The image-forming apparatus according to claim 43, wherein said non-magnetic yellow toner contains a yellow pigment selected from the group consisting of C.I. Pigment Yellow 74, 93, 97, 109, 128, 151, 154, 155, 166, 168, 180 and 185.

45. The image-forming apparatus according to claim 43, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

46. The image-forming apparatus according to claim 43, wherein said non-magnetic cyan toner contains a copper phthalocyanine pigment or an aluminum phthalocyanine pigment.

47. The image-forming apparatus according to claim 43, wherein said non-magnetic black toner contains a non-magnetic black pigment.

48. The image-forming apparatus according to claim 43, wherein said D0.5Y, D0.5M, D0.5C and D0.5Bk are each from 1.1 to 1.7.

49. The image-forming apparatus according to claim 43, wherein said first to fourth photosensitive members are each a photosensitive member with an amorphous silicon or non-single-crystal silicon layer having positive or negative chargeability.

50. The image-forming apparatus according to claim 43, wherein said first to fourth photosensitive members are each a photosensitive member with an amorphous silicon or non-single-crystal silicon layer having positive chargeability, and the electrostatic latent image is formed by imagewise exposure.

51. The image-forming apparatus according to claim 43, wherein said first to fourth photosensitive members are each a photosensitive member with an amorphous silicon or non-single-crystal silicon layer having negative chargeability, and the electrostatic latent image is formed by back-scan exposure.

52. The image-forming apparatus according to claim 43, wherein said first to fourth toners each contain at least one positive charge control agent selected from the group consisting of a quaternary ammonium salt, an imidazole compound, an ammonio-group-containing styrene-acrylic copolymer resin and a phosphonium compound.

53. The image-forming apparatus according to claim 43, wherein the magnetic carriers of said two-component developers each have a 50% volume-average particle diameter of from 20 μm to 70 μm.

54. The image-forming apparatus according to claim 43, wherein said first to fourth toners each have a binder resin composed chiefly of one selected from the group consisting of a polyester, a styrene-acrylic copolymer and a modified product of any of these.

55. The image-forming apparatus according to claim 54, wherein said polyester has an acid value of from 35 mg·KOH/g or below.

56. The image-forming apparatus according to claim 43, wherein said toners each have a glass transition temperature Tg of from 50° C. to 70° C.

57. An image-forming method for forming a full-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit;

transferring to the transfer medium having the first, second and third toner images a fourth toner image formed in a fourth image-forming unit; and fixing the first, second, third and fourth toner images to the transfer medium by heat-and-pressure fixing;

(A) said first image-forming unit:

(i) comprising at least a first photosensitive drum, a first charging means for charging the first photosensitive drum-electrostatically, a first exposure means for forming on the photosensitive drum thus charged a first electrostatic latent image by exposure, and a first developing means for developing the electrostatic latent image at a developing zone;

(ii) the first photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the first developing means having a one-component developer containing a first toner and a first developing sleeve for transporting the developer to the developing zone;

the first photosensitive drum and the first developing sleeve being so disposed as to either contact each other or maintain a minimum gap between them;

the first electrostatic latent image being developed with the one-component developer while in a case of contact development the first developing sleeve is rotated at a peripheral speed from 1.05 times to 2.0 times the peripheral speed of the first photosensitive drum and in a case of non-contact development the first developing sleeve is rotated at a peripheral speed from 1.1 times to 4.0 times the peripheral speed of the first photosensitive drum, to form the first toner image on the first photosensitive drum;

(B) said second image-forming unit:

(i) comprising at least a second photosensitive drum, a second charging means for charging the second photosensitive drum electrostatically, a second exposure means for forming on the photosensitive drum thus charged a second electrostatic latent image by exposure, and a second developing means for developing the electrostatic latent image at a developing zone;

(ii) the second photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the second developing means having a one-component developer containing a second toner and a second developing sleeve for transporting the developer to the developing zone;

the second photosensitive drum and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) said third image-forming unit:

(i) comprising at least a third photosensitive drum, a third charging means for charging the third photosensitive drum electrostatically, a third exposure means for forming on the photosensitive drum thus charged a third electrostatic latent image by exposure, and a third developing means for developing the electrostatic latent image at a developing zone;

(ii) the third photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the third developing means having a one-component developer containing a third toner and a third developing sleeve for transporting the developer to the developing zone;

the third photosensitive drum and the third developing sleeve being so disposed as to either contact each other or maintain a minimum gap between them;

the third electrostatic latent image being developed with the one-component developer while in a case of contact development the third developing sleeve is rotated at a peripheral speed from 1.05 times to 2.0 times the peripheral speed of the third photosensitive drum and in a case of non-contact development the third developing sleeve is rotated at a peripheral speed from 1.1 times to 4.0 times the peripheral speed of the third photosensitive drum, to form the third toner image on the third photosensitive drum;

(D) said fourth image-forming unit:

(i) comprising at least a fourth photosensitive drum, a fourth charging means for charging the fourth photosensitive drum electrostatically, a fourth exposure means for forming on the photosensitive drum thus charged a fourth electrostatic latent image by exposure, and a fourth developing means for developing the electrostatic latent image at a developing zone;

(ii) the fourth photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the fourth developing means having a one-component developer containing a fourth toner and a fourth developing sleeve for transporting the developer to the developing zone;

the fourth photosensitive drum and the fourth developing sleeve being so disposed as to either contact each other or maintain a minimum gap between them;

the fourth electrostatic latent image being developed with the one-component developer while in a case of contact development the fourth developing sleeve is rotated at a peripheral speed from 1.05 times to 2.0 times the peripheral speed of the fourth photosensitive drum and in a case of non-contact development the fourth developing sleeve is rotated at a peripheral speed from 1.1 times to 4.0 times the peripheral speed of the fourth photosensitive drum, to form the fourth toner image on the fourth photosensitive drum; and (E) said first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) the non-magnetic yellow toner, non-magnetic magenta toner, non-magnetic cyan toner and non-magnetic black toner being each a negatively chargeable toner containing a binder resin and a colorant; each having a weight-average particle diameter of from 4.0 $\mu$m to 10.0 $\mu$m; and (b) each toner having a coloring power of from 1.0 to 1.8, and a difference between the coloring power of the toner showing the maximum coloring power among the three colors of yellow, magenta and cyan and the coloring power of the toner showing the minimum coloring power among them being from 0 to 0.5.

58. The image-forming method according to claim 57, wherein said non-magnetic yellow toner contains a yellow pigment selected from the group consisting of C.I. Pigment Yellow 74, 93, 97, 109, 128, 151, 154, 155, 166, 168, 180 and 185.

59. The image-forming method according to claim 57, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

60. The image-forming method according to claim 57, wherein said non-magnetic cyan toner contains a copper phthalocyanine pigment or an aluminum phthalocyanine pigment.

61. The image-forming method according to claim 57, wherein said non-magnetic black toner contains a non-magnetic black pigment.

62. The image-forming method according to claim 57, wherein said non-magnetic toners each have a coloring power of from 1.1 to 1.7.

63. The image-forming method according to claim 57, wherein the electrostatic latent image is formed by back-scan exposure, using the photosensitive drum having positive chargeability.

64. The image-forming method according to claim 57, wherein the electrostatic latent image is formed by image-wise exposure, using the photosensitive drum having negative chargeability.

65. The image-forming method according to claim 57, wherein said toners each contain an organometallic compound, and the organometallic compound is a negative charge control agent.

66. The image-forming method according to claim 57, wherein said non-magnetic toners each have a binder resin composed chiefly of a polyester resin.

67. The image-forming method according to claim 66, wherein said binder resin has an acid value of from 2 mg·KOH/g to 50 mg·KOH/g.

68. The image-forming method according to claim 66, wherein said binder resin has a glass transition temperature Tg of from 50° C. to 70° C.

69. An image-forming apparatus for forming a full-color image on a transfer medium, comprising:

a first image-forming unit for forming an electrostatic latent image on a photosensitive member, developing the electrostatic latent image to form a first toner image, and transferring the first toner image to a transfer medium;

a second image-forming unit for forming an electrostatic latent image on a photosensitive member, developing the electrostatic latent image to form a second toner image, and transferring the second toner image to the transfer medium having the first toner image;

a third image-forming unit for forming an electrostatic latent image on a photosensitive member, developing the electrostatic latent image to form a third toner image, and transferring the third toner image to the transfer medium having the first and second toner images;

a fourth image-forming unit for forming an electrostatic latent image on a photosensitive member, developing the electrostatic latent image to form a fourth toner image, and transferring the fourth toner image to the transfer medium having the first, second and third toner images; and a heat-and-pressure fixing means for fixing the first, second, third and fourth toner images to the transfer medium by heat-and-pressure fixing;

(A) said first image-forming unit:

(i) comprising at least a first photosensitive drum, a first charging means for charging the first photosensitive drum electrostatically, a first exposure means for forming on the photosensitive drum thus charged a first electrostatic latent image by exposure, and a first developing means for developing the electrostatic latent image at a developing zone;

(ii) the first photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the first developing means having a one-component developer containing a first toner and a first developing sleeve for transporting the developer to the developing zone;

the first photosensitive drum and the first developing sleeve being so disposed as to either contact each other or maintain a minimum gap between them;

the first electrostatic latent image being developed with the one-component developer while in the case of contact development the first developing sleeve is rotated at a peripheral speed from 1.05 times to 2.0 times the peripheral speed of the first photosensitive drum and in the case of non-contact development the first developing sleeve is rotated at a peripheral speed from 1.1 times to 4.0 times the peripheral speed of the first photosensitive drum, to form the first toner image on the first photosensitive drum;

(B) said second image-forming unit:

(i) comprising at least a second photosensitive drum, a second charging means for charging the second photosensitive drum electrostatically, a second exposure means for forming on the photosensitive drum thus charged a second electrostatic latent image by exposure, and a second developing means for developing the electrostatic latent image at a developing zone;

(ii) the second photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the second developing means having a one-component developer containing a second toner and a second developing sleeve for transporting the developer to the developing zone;

the second photosensitive drum and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) said third image-forming unit:

(i) comprising at least a third photosensitive drum, a third charging means for charging the third photosensitive drum electrostatically, a third exposure means for forming on the photosensitive drum thus charged a third electrostatic latent image by exposure, and a third developing means for developing the electrostatic latent image at a developing zone;

(ii) the third photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the third developing means having a one-component developer containing a third toner and a third developing sleeve for transporting the developer to the developing zone;

the third photosensitive drum and the third developing sleeve being so disposed as to either contact each other or maintain a minimum gap between them;

the third electrostatic latent image being developed with the one-component developer while in the case of contact development the third developing sleeve is rotated at a peripheral speed from 1.05 times to 2.0 times the peripheral speed of the third photosensitive drum and in the case of non-contact development the third developing sleeve is rotated at a peripheral speed from 1.1 times to 4.0 times the peripheral speed of the third photosensitive drum, to form the third toner image on the third photosensitive drum;

(D) said fourth image-forming unit:

(i) comprising at least a fourth photosensitive drum, a fourth charging means for charging the fourth photosensitive drum electrostatically, a fourth exposure means for forming on the photosensitive drum thus charged a fourth electrostatic latent image by exposure, and a fourth developing means for developing the electrostatic latent image at a developing zone;

(ii) the fourth photosensitive drum having an amorphous silicon layer as a photosensitive layer, having a diameter of from 20 mm to 80 mm, and having at unexposed areas in the developing zone a surface potential of from 300 V to 450 V as an absolute value; and (iii) the fourth developing means having a one-component developer containing a fourth toner and a fourth developing sleeve for transporting the developer to the developing zone;

the fourth photosensitive drum and the fourth developing sleeve being so disposed as to have either contact each other or maintain a minimum gap between them;

the fourth electrostatic latent image being developed with the one-component developer while in the case of contact development the fourth developing sleeve is rotated at a peripheral speed from 1.05 times to 2.0 times the peripheral speed of the fourth photosensitive drum and in the case of non-contact development the fourth developing sleeve is rotated at a peripheral speed from 1.1 times to 4.0 times the peripheral speed of the fourth photosensitive drum, to form the fourth toner image on the fourth photosensitive drum; and (E) said first toner, second toner, third toner and fourth toner having color tones different from one another, and each being selected from the group consisting of a non-magnetic yellow toner, a non-magnetic magenta toner, a non-magnetic cyan toner and a non-magnetic black toner;

(a) the non-magnetic yellow toner, non-magnetic magenta toner, non-magnetic cyan toner and non-magnetic black toner being each a negatively chargeable toner containing a binder resin and a colorant; each having a weight-average particle diameter of from 4.0 $\mu$m to 10.0 $\mu$m, and (b) each toner having a coloring power of from 1.0 to 1.8, and a difference between the coloring power of the toner showing the maximum coloring power among the three colors of yellow, magenta and cyan and the coloring power of the toner showing the minimum coloring power among them being from 0 to 0.5.

70. The image-forming apparatus according to claim 69, wherein said non-magnetic yellow toner contains a yellow pigment selected from the group consisting of C.I. Pigment Yellow 74, 93, 97, 109, 128, 151, 154, 155, 166, 168, 180 and 185.

71. The image-forming apparatus according to claim 69, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

72. The image-forming apparatus according to claim 69, wherein said non-magnetic cyan toner contains a copper phthalocyanine pigment or an aluminum phthalocyanine pigment.

73. The image-forming apparatus according to claim 69, wherein said non-magnetic black toner contains a non-magnetic black pigment.

74. The image-forming apparatus according to claim 69, wherein said non-magnetic toners each have a coloring power of from 1.1 to 1.7.

75. The image-forming apparatus according to claim 69, wherein the electrostatic latent image is formed by back-scan exposure, using the photosensitive drum having positive chargeability.

76. The image-forming apparatus according to claim 69, wherein the electrostatic latent image is formed by image-wise exposure, using the photosensitive drum having negative chargeability.

77. The image-forming apparatus according to claim 69, wherein said toners each contain an organometallic compound, and the organometallic compound is a negative charge control agent.

78. The image-forming apparatus according to claim 69, wherein said non-magnetic toners each have a binder resin composed chiefly of a polyester resin.

79. The image-forming apparatus according to claim 78, wherein said binder resin has an acid value of from 2 mg·KOH/g to 50 mg·KOH/g.

80. The image-forming apparatus according to claim 78, wherein said binder resin has a glass transition temperature Tg of from 50° C. to 70° C.

81. An image-forming method for forming a full-color image or a multi-color image on a transfer medium by:

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit:

transferring to the transfer median having the first, second and third toner images a fourth toner image formed in a fourth image-forming unit; and transporting to a heat-and-pressure fixing means the transfer medium having the first, second, third and fourth toner images to effect heat-and-pressure fixing;

(A) the formation of the first toner image in said first image-forming unit:

(i) comprising at least a first charging step of electrostatically charging a first photosensitive member having an amorphous silicon or non-single-crystal silicon layer, a first exposure step, and a first developing step having a first developing sleeve;

(ii) the first photosensitive member having a diameter of from 20 mm to 80 mm; the first photosensitive member being charged in the first charging step from 300 V to 450 V as an absolute value at its developing zone opposite to the first developing sleeve; and thereafter a first electrostatic latent image being formed on the first photosensitive member by exposure in the first exposure step; and (iii) in the first developing step, a one-component developer being used which contains a first toner;

the first photosensitive member and the first developing sleeve being so disposed as to either contact each other or maintain a minimum gap between them;

the first electrostatic latent image being developed with the one-component developer while in the case of contact development the first developing sleeve is rotated at a peripheral speed from 1.05 times to 2.0 times the peripheral speed of the first photosensitive drum and in the case of non-contact development the first developing sleeve is rotated at a peripheral speed from 1.1 times to 4.0 times the peripheral speed of the first photosensitive drum, to form the first toner image on the first photosensitive drum;

(B) the formation of the second toner image in said second image-forming unit:

(i) comprising the method having at least a second charging step of electrostatically charging a second photosensitive member having an amorphous silicon or non-single-crystal silicon layer, a second exposure step, and a second developing step having a second developing sleeve;

(ii) the second photosensitive member having a diameter of from 20 mm to 80 mm; the second photosensitive member being charged in the second charging step from 300 V to 450 V as an absolute value at its developing zone opposite to the second developing sleeve; and thereafter a second electrostatic latent image being formed on the second photosensitive member by exposure in the second exposure step; and (iii) in the second developing step, a one-component developer being used which contains a second toner;

the second photosensitive member and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) the formation of the third toner image in said third image-forming unit:

(i) comprising at least a third charging step of electrostatically charging a third photosensitive member having an amorphous silicon or non-single-crystal silicon layer, a third exposure step, and a third developing step having a third developing sleeve;

(ii) the third photosensitive member having a diameter of from 20 mm to 80 mm; the third photosensitive member being charged in the third charging step from 300 V to 450 V as an absolute value at its developing zone opposite to the third developing sleeve; and thereafter a third electrostatic latent image being formed on the third photosensitive member by exposure in the third exposure step; and (iii) in the third developing step, a one-component developer being used which contains a third toner;

the third photosensitive member and the third developing sleeve being so disposed as to either contact each other or maintain a minimum gap between them;

the third electrostatic latent image being developed with the one-component developer while in the case of contact development the third developing sleeve is rotated at a peripheral speed from 1.05 times to 2.0 times the peripheral speed of the third photosensitive drum and in the case of non-contact development the third developing sleeve is rotated at a peripheral speed from 1.1 times to 4.0 times the peripheral speed of the third photosensitive drum, to form the third toner image on the third photosensitive drum;

(D) the formation of the fourth toner image in said fourth image-forming unit:

(i) comprising at least a fourth charging step of electrostatically charging a fourth photosensitive member having an amorphous silicon or non-single-crystal silicon layer, a fourth exposure step, and a fourth developing step having a fourth developing sleeve;

(ii) the fourth photosensitive member having a diameter of from 20 mm to 80 mm; the fourth photosensitive member being charged in the fourth charging step from 300 V to 450 V as an absolute value at its developing zone opposite to the fourth developing sleeve; and thereafter a fourth electrostatic latent image being formed on the fourth photosensitive member by exposure in the fourth exposure step; and (iii) in the fourth developing step, a one-component developer being used which contains a fourth toner;

the fourth photosensitive member and the fourth developing sleeve being so disposed as to either contact each other or maintain a minimum gap between them;

the fourth electrostatic latent image being developed with the one-component developer while in the case of contact development the fourth developing sleeve is rotated at a peripheral speed from 1.05 times to 2.0 times the peripheral speed of the fourth photosensitive drum and in the case of non-contact development the fourth developing sleeve is rotated at a peripheral speed from 1.1 times to 4.0 times the peripheral speed of the fourth photosensitive drum, to form the fourth toner image on the fourth photosensitive drum; and (E) said first toner, second toner, third toner and fourth toner having color tones different from one another, and each being selected from the group consisting of a non-magnetic yellow toner, a nonmagnetic magenta toner, a non-magnetic cyan toner and a non-magnetic black toner;

(a) the non-magnetic yellow toner, non-magnetic magenta toner, non-magnetic cyan toner and non-magnetic black toner being positively chargeable and each having a weight-average particle diameter of from 4.0 $\mu$m to 10.0 $\mu$m; and (b) where the coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the nonmagnetic cyan toner by D0.5C and the coloring power of the non-magnetic black toner by D0.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being from 0 to 0.5.

82. The image-forming method according to claim 79, wherein said non-magnetic yellow toner contains a yellow pigment selected from the group consisting of C.I. Pigment Yellow 74, 93, 97, 109, 128, 151, 154, 155, 166, 168, 180 and 185.

83. The image-forming method according to claim 79, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

84. The image-forming method according to claim 79, wherein said non-magnetic cyan toner contains a copper phthalocyanine pigment or an aluminum phthalocyanine pigment.

85. The image-forming method according to claim 79, wherein said non-magnetic black toner contains a non-magnetic black pigment.

86. The image-forming method according to claim 79, wherein said D0.5Y, D0.5M, D0.5C and D0.5Bk are each from 1.1 to 1.7.

87. The image-forming method according to claim 79, wherein said first to fourth photosensitive members are each a photosensitive member having an amorphous silicon or non-single-crystal silicon layer having positive or negative chargeability.

88. The image-forming method according to claim 79, wherein said first to fourth photosensitive members are each a photosensitive member with an amorphous silicon or non-single-crystal silicon layer having positive chargeability, and the electrostatic latent image is formed by imagewise exposure.

89. The image-forming method according to claim 79, wherein said first to fourth photosensitive members are each a photosensitive member with an amorphous silicon or non-single-crystal silicon layer having negative chargeability, and the electrostatic latent image is formed by back-scan exposure.

90. The image-forming method according to claim 79, wherein said first to fourth toners each contain at least one positive charge control agent selected from the group consisting of a quaternary ammonium salt, an imidazole compound, an ammonio-group-containing styrene-acrylic copolymer resin and a phosphonium compound.

91. The image-forming method according to claim 79, wherein said first to fourth toners each have a binder resin composed chiefly of one selected from the group consisting of a polyester, a styrene-acrylic copolymer and a modified product of any of these.

92. The image-forming method according to claim 91, wherein said polyester has an acid value of from 35 mg·KOH/g or below.

93. The image-forming method according to claim 79, wherein said toners each have a glass transition temperature Tg of from 50° C. to 70° C.

94. An image-forming apparatus for forming a full-color image or a multi-color image on a transfer medium by;

transferring to the transfer medium a first toner image formed in a first image-forming unit;

transferring to the transfer medium having the first toner image a second toner image formed in a second image-forming unit;

transferring to the transfer medium having the first and second toner images a third toner image formed in a third image-forming unit;

transferring to the transfer medium having the first, second and third toner images a fourth toner image formed in a fourth image-forming unit; and transporting to a heat-and-pressure fixing means the transfer medium having the first, second, third and fourth toner images to effect heat-and-pressure fixing;

(A) said first image-forming unit:

(i) comprising at least a first photosensitive member having an amorphous silicon or non-single-crystal silicon layer, a first charging means, a first exposure means and a first developing means having a first developing sleeve;

(ii) the first photosensitive member having a diameter of from 20 mm to 80 mm; the first photosensitive member being charged by the first charging means from 300 V to 450 V as an absolute value at its developing zone opposite to the first developing sleeve; and thereafter a first electrostatic latent image being formed on the first photosensitive member by exposure with the first exposure means; and (iii) the first developing means having a one-component developer containing a first toner;

the first photosensitive member and the first developing sleeve being so disposed as to either contact each other or maintain a minimum gap between them;

the first electrostatic latent image being developed with the one-component developer while in the case of contact development the first developing sleeve is rotated at a peripheral speed from 1.05 times to 2.0 times the peripheral speed of the first photosensitive drum and in the case of non-contact development the first developing sleeve is rotated at a peripheral speed from 1.1 times to 4.0 times the peripheral speed of the first photosensitive drum, to form the first toner image on the first photosensitive drum;

(B) said second image-forming unit:

(i) comprising at least a second photosensitive member having an amorphous silicon or non-single-crystal silicon layer, a second charging means, a second exposure means and a second developing means having a second developing sleeve;

(ii) the second photosensitive member having a diameter of from 20 mm to 80 mm; the second photosensitive member being charged by the second charging means from 300 V to 450 V as an absolute value at its developing zone opposing the second developing sleeve; and thereafter a second electrostatic latent image being formed on the second photosensitive member by exposure with the second exposure means; and (iii) the second developing means having a one-component developer containing a second toner;

the second photosensitive member and the second developing sleeve being so disposed as to either contact each other or maintain a minimum gap between them;

the second electrostatic latent image being developed with the one-component developer while in the case of contact development the second developing sleeve is rotated at a peripheral speed from 1.05 times to 2.0 times the peripheral speed of the second photosensitive drum and in the case of non-contact development the second developing sleeve is rotated at a peripheral speed from 1.1 times to 4.0 times the peripheral speed of the second photosensitive drum, to form the second toner image on the second photosensitive drum;

(C) said third image-forming unit:

(i) comprising at least a third photosensitive member having an amorphous silicon or non-single-crystal silicon layer, a third charging means, a third exposure means and a third developing means having a third developing sleeve;

(ii) the third photosensitive member having a diameter of from 20 mm to 80 mm; the third photosensitive member being charged by the third charging means from 300 V to 450 V as an absolute value at its developing zone opposite to the third developing sleeve; and thereafter a third electrostatic latent image being formed on the third photosensitive member by exposure with the third exposure means, and (iii) the third developing means having a one-component developer containing a third toner;

the third photosensitive member and the third developing sleeve being so disposed as to either contact each other or maintain a minimum gap between them;

the third electrostatic latent image being developed with the one-component developer while in the case of contact development the third developing sleeve is rotated at a peripheral speed from 1.05 times to 2.0 times the peripheral speed of the third photosensitive drum and in the case of non-contact development the third developing sleeve is rotated at a peripheral speed from 1.1 times to 4.0 times the peripheral speed of the third photosensitive drum, to form the third toner image on the third photosensitive drum;

(D) said fourth image-forming unit:

(i) comprising at least a fourth photosensitive member having an amorphous silicon or non-single-crystal silicon layer, a fourth charging means, a fourth exposure means and a fourth developing means having a fourth developing sleeve;

(ii) the fourth photosensitive member having a diameter of from 20 mm to 80 mm; the fourth photosensitive member being charged by the fourth charging means from 300 V to 450 V as an absolute value at its developing zone opposite to the fourth developing sleeve; and thereafter a fourth electrostatic latent image being formed on the fourth photosensitive member by exposure with the fourth exposure means; and (iii) the fourth developing means having a one-component developer containing a fourth toner;

the fourth photosensitive drum and the fourth developing sleeve being so disposed as to either contact each other or maintain a minimum gap between them;

the fourth electrostatic latent image being developed with the one-component developer while in the case of contact development the fourth developing sleeve is rotated at a peripheral speed from 1.05 times to 2.0 times the peripheral speed of the fourth photosensitive drum and in the case of non-contact development the fourth developing sleeve is rotated at a peripheral speed from 1.1 times to 4.0 times the peripheral speed of the fourth photosensitive drum, to form the fourth toner image on the fourth photosensitive drum;

(E) said first toner, second toner, third toner and fourth toner having color tones different from one another, and each being selected from the group consisting of a non-magnetic yellow toner, a non-magnetic magenta toner, a non-magnetic cyan toner and a non-magnetic black toner:

(a) the non-magnetic yellow toner, non-magnetic magenta toner, non-magnetic cyan toner and non-magnetic black toner being positively chargeable and each having a weight-average particle diameter of from 4.0 $\mu$m to 10.0 $\mu$m; and (b) where a coloring power of the toner of each color is defined as image density D0.5 measured after being fixed once when a quantity of unfixed toner on a transfer medium, M/S, is 0.5 mg/cm$^2$ and the coloring power of the non-magnetic yellow toner is represented by D0.5Y, the coloring power of the non-magnetic magenta toner by D0.5M, the coloring power of the non-magnetic cyan toner by D0.5C and the coloring power of the non-magnetic black toner by D0.5Bk, each of D0.5Y, D0.5M, D0.5C and D0.5Bk being from 1.0 to 1.8 as image density, and, where the coloring power of the toner showing the maximum coloring power among the three colors of yellow, magenta and cyan is represented by D0.5max, and the coloring power of the toner showing the minimum coloring power by D0.5min, a difference between D0.5max and D0.5min being from 0 to 0.5.

95. The image-forming apparatus according to claim 94, wherein said non-magnetic yellow toner contains a yellow pigment selected from the group consisting of C.I. Pigment Yellow 74, 93, 97, 109, 128, 151, 154, 155, 166, 168, 180 and 185.

96. The image-forming apparatus according to claim 94, wherein said non-magnetic magenta toner contains a magenta pigment selected from the group consisting of a quinacridone pigment, C.I. Pigment Red 48:2, 57:1 and 58:2, C.I. Pigment Red 5, 31, 146, 147, 150, 184, 187, 238 and 245, or C.I. Pigment Red 185 and 265.

97. The image-forming apparatus according to claim 94, wherein said non-magnetic cyan toner contains a copper phthalocyanine pigment or an aluminum phthalocyanine pigment.

98. The image-forming apparatus according to claim 94, wherein said non-magnetic black toner contains a non-magnetic black pigment.

99. The image-forming apparatus according to claim 94, wherein said D0.5Y, D0.5M, D0.5C and D0.5Bk are each from 1.1 to 1.7.

100. The image-forming apparatus according to claim 94, wherein said first to fourth photosensitive members are each a photosensitive member having an amorphous silicon or non-single-crystal silicon layer having positive or negative chargeability.

101. The image-forming apparatus according to claim 94, wherein said first to fourth photosensitive members are each a photosensitive member with an amorphous silicon or non-single-crystal silicon layer having positive chargeability, and the electrostatic latent image is formed by imagewise exposure.

102. The image-forming apparatus according to claim 94, wherein said first to fourth photosensitive members are each a photosensitive member having an amorphous silicon or non-single-crystal silicon layer having negative chargeability, and the electrostatic latent image is formed by back-scan exposure.

103. The image-forming apparatus according to claim 94, wherein said first to fourth toners each contain at least one positive charge control agent selected from the group consisting of a quaternary ammonium salt, an imidazole compound, an ammonio-group-containing styrene-acrylic copolymer resin and a phosphonium compound.

104. The image-forming apparatus according to claim 94, wherein said first to fourth toners each have a binder resin composed chiefly of one selected from the group consisting of a polyester, a styrene-acrylic copolymer and a modified product of any of these.

105. The image-forming apparatus according to claim 104, wherein said polyester has an acid value of from 35 mg·KOH/g or below.

106. The image-forming apparatus according to claim 94, wherein said toners each have a glass transition temperature Tg of from 50° C. to 70° C.

* * * * *

UNITED STATES PATENT AND TRADEMARK OFFICE

CERTIFICATE OF CORRECTION

PATENT NO. : 6,537,714 B2
DATED : March 25, 2003
INVENTOR(S) : Takaaki Kaya et al.

It is certified that error appears in the above-identified patent and that said Letters Patent is hereby corrected as shown below:

Title page,
Item [57], ABSTRACT,
Line 16, “form” should read -- from --.

Column 1,
Line 13, “As photosensitive” should read -- Photosensitive --.

Column 14,
Line 34, “member” should read -- member; --.

Column 16
Line 8, “DO.5” should read -- D0·5--.

Column 31,
Line 8, “important factors” should read -- an important factor --.

Column 34,
Line 44, “lifetime” should read -- lifetime. --.

Column 35,
Line 61, “represent” should read -- represents --.

Column 36,
Line 47, “an” (second occurrence) should read -- a --.

Column 55,
Line 22, “as” should read -- so as --; and
Line 31, “resin” should read -- Resin --.

Column 59,
Line 10, “Henshel” should read -- Henschel --.

Column 60,
Line 50, “Henshel” should read -- Henschel --.

Column 61,
Lines 23 and 42, “Henshel” should read -- Henschel --.

Column 66,
Line 11, “a” should read -- an --; and
Line 52, “C2,” should be deleted.

UNITED STATES PATENT AND TRADEMARK OFFICE

CERTIFICATE OF CORRECTION

PATENT NO. : 6,537,714 B2
DATED : March 25, 2003
INVENTOR(S) : Takaaki Kaya et al.

It is certified that error appears in the above-identified patent and that said Letters Patent is hereby corrected as shown below:

Column 67,
Line 62, “one” should be deleted.

Column 69,
Line 41, “of” should be deleted.

Column 72,
Line 54, “once” should read -- once. --; and
Line 55, “Kneader” should read -- kneader --.

Column 73,
Line 1, “Kneader” should read -- kneader --;
Lines 43 and 58, “preliminary” should read -- preliminarily --.

Column 74,
Line 15, “were” should read -- was --;
Line 50, “in stead” should read -- instead --; and
Line 63, “above describe” should read -- above-described --.

Column 75,
Lines 10 and 63, “Kneader” should read -- kneader --.
Line 10, “above describe” should read -- above-described --; and Column 85,
Line 29, “a” (first occurrence) should read -- an --.

Column 89,
Line 29, “cyanide” should read -- cyan --.

Column 90,
Lines 21 and 66, “were” should read -- was --.

Column 91,
Line 28, “were” should read -- was --.

Column 170,
Line 57, “DO.5Bk,” should read -- D0·5Bk, --.

UNITED STATES PATENT AND TRADEMARK OFFICE

CERTIFICATE OF CORRECTION

PATENT NO. : 6,537,714 B2
DATED : March 25, 2003
INVENTOR(S) : Takaaki Kaya et al.

It is certified that error appears in the above-identified patent and that said Letters Patent is hereby corrected as shown below:

Column 178,
Line 44, "a" should be deleted.

Signed and Sealed this

Fourth Day of November, 2003

JAMES E. ROGAN
*Director of the United States Patent and Trademark Office*